US008602672B2

(12) United States Patent
Kanaka et al.

(10) Patent No.: US 8,602,672 B2
(45) Date of Patent: Dec. 10, 2013

(54) BINDING DEVICE

(75) Inventors: Kanji Kanaka, Ashiya (JP); Hiroshi Arai, Kawachinagano (JP); Hiroshi Nakano, Ibaraki (JP)

(73) Assignee: Lihit Lab., Inc., Osaka (JP)

( * ) Notice: Subject to any disclaimer, the term of this patent is extended or adjusted under 35 U.S.C. 154(b) by 674 days.

(21) Appl. No.: 12/524,721

(22) PCT Filed: Mar. 28, 2007

(86) PCT No.: PCT/JP2007/056731
§ 371 (c)(1),
(2), (4) Date: Jul. 27, 2009

(87) PCT Pub. No.: WO2008/093434
PCT Pub. Date: Aug. 7, 2008

(65) Prior Publication Data

US 2010/0034576 A1 Feb. 11, 2010

(30) Foreign Application Priority Data

Jan. 29, 2007 (JP) ..... 2007-017804

(51) Int. Cl.
*B42F 13/20* (2006.01)

(52) U.S. Cl.
USPC ..... 402/29

(58) Field of Classification Search
USPC ..... 402/25–27, 29, 45
See application file for complete search history.

(56) References Cited

U.S. PATENT DOCUMENTS

2003/0123923 A1* 7/2003 Koike et al. ..... 402/19
2004/0086323 A1* 5/2004 Tanaka et al. ..... 402/73
2008/0080925 A1* 4/2008 Cheng ..... 402/19

FOREIGN PATENT DOCUMENTS

JP 2005-246940 A 9/2005
WO WO-2004/028828 A1 4/2004

* cited by examiner

*Primary Examiner* — Dana Ross
*Assistant Examiner* — Matthew G Katcoff
(74) *Attorney, Agent, or Firm* — Rabin & Berdo, P.C.

(57) ABSTRACT

A binding device is provided which allows reduction in profile.

A binding device 10 includes: a holding member 16 having a length which allows a plurality of openable-closable binding rings 12 and 14 to be disposed with a spacing therebetween; an operating member 18 secured inside the holding member 16; and an opening/closing member 40. The operating member 18 includes a pair of operating pieces 30 and 32 on which the binding rings 12 and 14 are secured. For housing the opening/closing member 40, an opening/closing member housing portion 36 is provided in a manner such as to be recessed from a reverse side, opposite to a surface on which the binding rings 12 and 14 are secured, towards the surface side. The opening/closing member 40 is secured to the opening/closing member housing portion 36 of the operating member 18 on the reverse side opposite to the surface on which the binding rings 12 and 14 are secured, and is formed to, when the binding rings 12 and 14 are opened, cause the binding rings 12 and 14 to be changed in an opening direction so that the operating pieces are moved in a longitudinal direction of the holding member 16 and are held in a direction approaching an inner surface of the holding member 16, within the holding member 16.

19 Claims, 88 Drawing Sheets

(A)

(B)

(C)

(A)

(B)

(C)

Viewed along arrow A direction (A)

(B)

(A)

(B)

(C)

Viewed along arrow A direction (A)

(B)

BINDING DEVICE

TECHNICAL FIELD

The present invention relates to a binding device, and in particular, for example, to a binding device used as a ring binder or file.

BACKGROUND ART

As a conventional binding device serving as the background of this invention, there is a binding device disclosed in, for example, International Publication Number WO 2004/028828.

This binding device includes: a binding ring; a holding member having a length which allows binding rings to be disposed with a spacing therebetween; an operating member having a surface to which base portions of the respective binding rings are secured such that the binding rings are disposed with a spacing therebetween; and the operating member being movably secured inside the holding member such that the binding rings are secured to the holding member. The binding device includes the operating member, wherein the operating member comprises a pair of operating pieces which move inside the holding member in a longitudinal direction of the holding member, one of the base portions of each of the binding rings being secured to one of the operating pieces, the other base portion of each of the binding rings being secured to the other operating piece, and the binding device includes an opening/closing member which, when the binding rings are opened, moves the operating pieces in the longitudinal direction of the holding member and causes the binding rings to be changed in the opening direction such that the operating pieces are held in the direction approaching the inner surface of the holding member.

Patent Document International Publication Number WO 2004/028828

DISCLOSURE OF THE INVENTION

Problems to be Solved by the Invention

The present binding device, however, requires certain height in a holding member since the conventional binding device needs to smoothly operate an operating member when a binding ring is opened or closed, which has limitations in a reduction in the binding device.

On the other hand, it is desirable to have the binding device which is attached to a cover with the same size of a general file or binder when the binding device is attached to a cover of a file or binder.

Therefore, it is a main object of the present invention to provide a binding device which achieves reduction in profile.

Means for Solving the Problems

A binding device according to claim 1 of the present invention refers to a binding device including: a plurality of openable-closeable binding rings; a holding member having a length which allows the binding rings to be disposed with a spacing therebetween; an operating member having a surface on which the binding rings are secured with a spacing therebetween and being secured inside the holding member such that the binding rings are secured to the holding member; and an opening/closing member biasing the binding rings in an opening direction, wherein the operating member includes a pair of operating pieces, to one of which one base portion of each of the binding rings is secured and to the other of which the other base portion of each of the binding rings is secured, wherein, when the binding rings are closed, at a position away from an inner surface of the holding member, the operating pieces are held in a state in which abutting edges thereof abut against each other, wherein, when the binding rings are opened, the operating pieces are secured to the holding member so as to be held in a manner such as to be directed in a direction approaching the inner surface of the holding member, wherein the operating member has an opening/closing member housing portion for housing the opening/closing member which opening/closing member housing portion is provided in a manner such as to be recessed from a reverse side, opposite to the surface on which the binding rings are secured, towards the surface side, and wherein the opening/closing member is secured to the opening/closing member housing portion of the operating member on the reverse side opposite to the surface on which the binding rings are secured, and is formed to, when the binding rings are opened, cause the binding rings to be changed in the opening direction so that the operating pieces are moved in a longitudinal direction of the holding member and are held in the direction approaching the inner surface of the holding member, within the holding member.

A binding device according to claim 2 of the present invention refers to the binding device according to claim 1, wherein the opening/closing member is made of an elastic member, and wherein the opening/closing member is extended, between the pair of operating pieces constituting the operating member, in a direction obliquely intersecting a direction connecting the base portions of the binding rings secured to the operating pieces with a spacing therebetween, such that the pair of operating pieces are moved in opposite directions and opening/closing condition of the binding rings are maintained.

A binding device according to claim 3 of the present invention refers to the binding device according to claim 2, wherein one end of the opening/closing member is secured to one of the operating pieces constituting the operating member, wherein the other end of the opening/closing member is secured to the other of the operating pieces constituting the operating member, and wherein the opening/closing member is extended between one and the other of the operating pieces.

A binding device according to claim 4 of the present invention refers to the binding device according to claim 3, wherein the opening/closing member is made of an elastic member, wherein one end of the opening/closing member is secured in the opening/closing member housing portion on a surface opposite to the surface on which the base portions of the binding rings in one of the operating pieces constituting the operating member are secured, wherein the other end of the opening/closing member is secured in the opening/closing member housing portion on a surface opposite to the surface on which the base portions of the binding rings in the other of the operating pieces constituting the operating member are secured, and wherein the opening/closing member is extended between one and the other of the operating pieces.

A binding device according to claim 5 of the present invention refers to the binding device according to any of claims 2 to 4, wherein the opening/closing member is made of a coil spring which receives twisting moment around a central axis of a coil, and wherein, in a state in which the spring is loaded and bending stress is generated on a strand while a pair of the binding rings are closed, one end of the opening/closing member is secured to one of the operating pieces constituting the operating member and the other end of the opening/ closing member is secured to the other of the operating pieces constituting the operating member.

A binding device according to claim 6 of the present invention refers to the binding device according to claim 5, wherein in the opening/closing member, a load direction in which the spring is loaded is a direction in which the coil is wound.

A binding device according to claim 7 of the present invention refers to the binding device according to any of claims 1 to 6, wherein the operating member has the pair of operating pieces movably secured to the holding member so as to oscillate about the abutting edges of the pair of operating pieces and move in the direction connecting the base portions of the binding rings disposed with a spacing therebetween, within the holding member.

A binding device according to claim 8 of the present invention refers to the binding device according to any of claims 1 to 7, wherein the holding member is formed with a holding portion for holding the operating member inside the holding member which holding portion is recessed and/or bent towards the inside so as to hold the operating member fitted inside the holding member.

A binding device according to claim 9 of the invention refers to the binding device according to any of claims 1 to 8, wherein the holding member includes a holding wall and a bound object-mounting portion extending in a direction close to the direction connecting the base portions of the binding rings disposed on the operating member with a spacing therebetween, wherein the holding wall and the bound object-mounting portion of the holding member forms a holding space for holding the operating member inside the holding member, and wherein the operating member and the opening/closing member are configured to move within the holding space when the binding rings are opened or closed.

A binding device according to claim 10 of the present invention refers to the binding device according to any of claims 1 to 9, wherein the operating member has the opening/closing member housing portion formed by recessing vicinity of the abutting edges of the pair of operating pieces in a direction in which the binding rings protrude.

A binding device according to any of claims 11 of the present invention refers to the binding device according to any of claims 1 to 10, wherein the opening/closing member housing portion has a recess formed in one of the operating pieces and a recess formed in the other of the operating pieces in a manner such as to be line-symmetric to each other, defining the abutting edges as an axis.

A binding device according to claim 12 of the present invention refers to the binding device according to any of claims 1 to 11, wherein said one and the other of the operating pieces are plates of a rectangular shape in a plan view, including a length direction extending in a moving direction at time of opening and closing the binding rings, and wherein said one and the other of the operating pieces are point-symmetric, defining a center of the abutting edges in a length direction as a center of symmetry.

A binding device according to claim 13 of the present invention refers to the binding device according to any of claims 1 to 12, wherein the holding member has the holding space for holding the operating member inside the holding member which holding space is formed by the holding wall and the bound object-mounting portion, and wherein, in the operating member, one and the other of the operating pieces abut against each other at the abutting edges and are movably secured at outer edges to an inner side of the holding wall and the binding rings are secured in a manner such as to protrude towards the bound object-mounting portion.

A binding device according to claim 14 of the present invention refers to the binding device according to any of claims 5 to 13, wherein said one of the operating pieces has a first engaging portion which: is formed by bending and recessing the abutting edge from the surrounding reference surface towards the surface side on which the opening/closing member is secured and also bending the abutting edge towards a side opposite to the surface on which the opening/closing member is secured and which first engaging portion has an engaging surface located lower than the reference surface, wherein the other of the operating pieces has a second engaging portion which is formed by bending and recessing the abutting edge from the surrounding reference surface towards the surface side on which the opening/closing member is secured and which second engaging portion has an engaging surface located lower than the reference surface, and wherein the engaging surface of the first engaging portion of said one of the operating pieces and the engaging surface of the second engaging portion of the other of the operating pieces are engaged with each other at a height substantially the same as or lower than the height of the reference surfaces.

A binding device according to claim 15 of the present invention refers to the binding device according to any of claims 5 to 14, wherein said one operating piece has first engaging portions which are formed by bending and recessing vicinity of both ends of the abutting edge along the abutting edge from the surrounding reference surface towards the surface side on which the opening/closing member is secured to thereby form recessed portions and then bending the recessed portions towards the side opposite to the surface on which the opening/closing member is secured and each of which first engaging portions has an engaging surface located higher than surrounding thereof but lower than the reference surface, wherein the other of the operating pieces has second engaging portions which are formed by bending and recessing vicinity of both ends of the abutting edge along the abutting edge from the surrounding reference surface towards the surface side on which the opening/closing member is secured to thereby form recessed portions and each of which second engaging portions has an engaging surface formed by the recessed portion and located lower than the reference surface, and wherein the engaging surface of each of the first engaging portions of said one of the operating pieces and the engaging surface of each of the second engaging portions of the other of the operating pieces are engaged with each other at the height substantially the same as or lower than the height of the reference surfaces.

A binding device according to claim 16 of the present invention refers to the binding device according to any of claims 1 to 15, wherein said one of the operating pieces has the first engaging portions which are formed by bending and recessing the vicinity of the both ends of the abutting edge, i.e., portions extending from regions where the base portions of the binding rings are secured towards the abutting edge, along the abutting edge from the surrounding reference surface towards the surface side on which the opening/closing member is secured to thereby form the recessed portions and then bending the recessed portions towards the side opposite to the surface on which the opening/closing member is secured and each of which first engaging portions has the engaging surface located higher than the surrounding thereof but lower than the reference surface, wherein the other of the operating pieces has the second engaging portion which are formed by bending and recessing the vicinity of the both ends of the abutting edge, i.e., portions extending from regions where the base portions of the binding rings are secured towards the abutting edge, along the abutting edge from the surrounding reference surface towards the surface side on which the opening/closing member is secured to thereby form the recessed portions and each of which second engaging portions has the engaging surface formed by the recessed portions and located lower than the reference surface, and wherein the engaging surface of each of the first engaging portions of said one of the operating pieces and the engaging surface of each of the second engaging portions of the other of the operating pieces are engaged with each other at the height substantially the same as or lower than the height of the reference surfaces.

A binding device according to claim 17 of the present invention refers to the binding device according to either of claims 15 and 16, wherein said one of the operating pieces is formed with the first engaging portions and, in addition, has second engaging portions formed in the same manner as the other of the operating pieces has, and the other of the operating pieces is formed with the second engaging portions and, in addition, has first engaging portions formed in the same manner as said one of the operating pieces has.

A binding device according to claim 18 of the present invention refers to the binding device according to any of claims 1 to 17, wherein said one and the other of the operating pieces are plates of a rectangular shape in a plan view, including a length direction extending in a moving direction at time of opening and closing the binding rings, and wherein said one and the other of the operating pieces are point-symmetric, defining a center of the abutting edge in a length direction as a center of symmetry.

Effect of the Invention

According to claim 1 of the present invention, a binding device includes: a plurality of openable-closable binding rings; a holding member having a length which allows the binding rings to be disposed with a spacing therebetween; an operating member having a surface on which the binding rings are secured with a spacing therebetween and being secured inside the holding member such that the binding rings are secured to the holding member; and an opening/closing member biasing the binding rings in an opening direction. The operating member includes a pair of operating pieces, to one of which one base portion of each of the binding rings is secured and to the other of which the other base portion of each of the binding rings is secured. When the binding rings are closed, at a position away from an inner surface of the holding member, the operating pieces are held in a state in which abutting edges thereof abut against each other. When the binding rings are opened, the operating pieces are secured to the holding member so as to be held in a manner such as to be directed in a direction approaching the inner surface of the holding member. The operating member has an opening/closing member housing portion for housing the opening/closing member which opening/closing member housing portion is provided in a manner such as to be recessed from a reverse side, opposite to the surface on which the binding rings are secured, towards the surface side. The opening/closing member is secured to the opening/closing member housing portion of the operating member on the reverse side opposite to the surface on which the binding rings are secured, and is formed to, when the binding rings are opened, cause the binding rings to be changed in the opening direction so that the operating pieces are moved in a longitudinal direction of the holding member and are held in the direction approaching the inner surface of the holding member, within the holding member. Therefore, the binding device can be provided which allows reduction in profile.

According to the invention of claim 2, the opening/closing member is made of an elastic member; one end of the opening/closing member is secured in the opening/closing member housing portion on a surface opposite to the surface on which the base portions of the binding rings in one of the operating pieces constituting the operating member are secured; the other end of the opening/closing member is secured in the opening/closing member housing portion on a surface opposite to the surface on which the base portions of the binding rings in the other of the operating pieces constituting the operating member are secured; and the opening/closing member is extended between one and the other of the operating pieces. Therefore, the operating member can be relatively easily mounted in the holding member to produce the binding device.

According to the invention of claim 3, the operating member has the opening/closing member housing portion formed by recessing vicinity of the abutting edges of the pair of operating pieces in a direction in which the binding rings protrude. Therefore, a protrusion can be relatively easily formed by press working after forming a protruding portion.

According to the invention of claim 4, the opening/closing member housing portion has a recess formed in one of the operating pieces and a recess formed in the other of the operating pieces in a manner such as to be line-symmetric to each other, defining the abutting edges as an axis. Therefore, the opening/closing member housing portion can be relatively easily formed by press working or the like, which permits promoting reinforcement of the operating pieces.

According to the invention of claim 5, a binding device includes: a plurality of openable/closable binding rings; a holding member having a length which allows the binding rings to be disposed with a spacing therebetween; an operating member having a pair of operating pieces of a plate-like shape on which the binding rings are secured in a manner such as to extend from a surface side and which pair of operating pieces is held inside the holding member such that the binding rings are secured to the holding member; and an opening/closing member secured to the operating member on a reverse side opposite to the surface side on which the binding rings are secured and biasing the binding rings in an opening direction, The operating member has the operating pieces to one of which one base portion of each of the binding rings is secured and to the other of which the other base portion of each of the binding rings is secured. When the binding rings are closed, at a position away from an inner surface of the holding member, the operating pieces are held in a planar state in a state in which abutting edges thereof abut against each other. When the binding rings are opened, the operating pieces are secured to the holding member so as to be held in an upward folded state with the abutting edges of the operating pieces directed in a direction approaching the inner surface of the holding member. In order to hold and move the operating member and the opening/closing member in a holding space of the holding member, an engaging portion for maintaining the abutting state even during the movement is formed at the abutting edges of the pair of operating pieces in a manner such as to protrude towards a surface side on which the opening/closing member is secured. The engaging portion is formed at a height the same as or lower than a height of a reference surface of the operating pieces on the surface side. The opening/closing member and the operating member are formed such that, when the binding rings are opened, within the holding member, the operating pieces are moved in a longitudinal direction of the holding member and are held in the direction approaching the inner surface of the holding member. Therefore, the binding device can be provided which allows reduction in profile.

According to the invention of claim 6, the opening/closing member is made of an elastic member; and the opening/closing member is extended, between the pair of operating pieces constituting the operating member, in a direction obliquely intersecting a direction connecting the base portions of the binding rings secured to the operating pieces with a spacing therebetween, such that the pair of operating pieces are moved in opposite directions and opening/closing condition of the binding rings are maintained. Therefore, opening/closing of the binding rings can be easily done.

According to the invention of claim 7, one end of the opening/closing member is secured to one of the operating pieces constituting the operating member; the other end of the opening/closing member is secured to the other of the operating pieces constituting the operating member; and the opening/closing member is extended between one and the other of the operating pieces. Therefore, the opening/closing of the binding rings can be easily done.

According to the invention of claim 8, the opening/closing member is made of a coil spring which receives twisting moment around a central axis of a coil; and in a state in which the spring is loaded and bending stress is generated on a strand while a pair of the binding rings are closed, one end of the opening/closing member is secured to one of the operating pieces constituting the operating member and the other end of the opening/closing member is secured to the other of the operating pieces constituting the operating member. Therefore, the closed binding rings can be smoothly opened.

According to the invention of claim 9, in the opening/closing member, a load direction in which the spring is loaded is a direction in which the coil is wound. Therefore, the operating pieces are mounted at an optimal position in the holding member, which permits smooth movement of the operating pieces.

According to the invention of claim 10, the operating member has the pair of operating pieces movably secured to the holding member so as to oscillate about the abutting edges of the pair of operating pieces and move in the direction connecting the base portions of the binding rings disposed with a spacing therebetween, within the holding member. Therefore, the opening/closing of the binding rings can be easily done.

According to the invention of claim 11, the holding member is formed with a holding portion for holding the operating member inside the holding member which holding portion is recessed and/or bent towards the inside so as to hold the operating member fitted inside the holding member. Therefore, the holding portion can be relatively easily formed by press working.

According to the invention of claim 12, the holding member includes a holding wall and a bound object-mounting portion extending in a direction close to the direction connecting the base portions of the binding rings disposed on the operating member with a spacing therebetween; the holding wall and the bound object-mounting portion of the holding member forms the holding space for holding the operating member inside the holding member; and the operating member and the opening/closing member are configured to move within the holding space when the binding rings are opened or closed. Therefore, the operating pieces can be mounted at the optimal position in the holding member, which permits the smooth movement of the operating pieces.

According to the invention of claim 13, the holding member has the holding space for holding the operating member inside the holding member which holding space is formed by the holding wall and the bound object-mounting portion and including an inner surface of a bulging portion for forming a recessed portion which houses the abutting edges of the pair of operating pieces in an upward folded state when the binding rings are opened; and in the operating member, one and the other of the operating pieces abut against each other at the abutting edges and are movably secured at outer edges to an inner side of the holding wall and the binding rings are secured in a manner such as to protrude towards the bound object-mounting portion. Therefore, the binding device can be provided which can support the reduction in profile of the holding member and which allows reduction in profile overall.

According to the invention of claim 14, said one of the operating pieces has a first engaging portion which is formed by bending and recessing the abutting edge from the surrounding reference surface towards the surface side on which the opening/closing member is secured and also bending the abutting edge towards a side opposite to the surface on which the opening/closing member is secured and which, first engaging portion has an engaging surface located lower than the reference surface; the other of the operating pieces has a second engaging portion which is formed by bending and recessing the abutting edge from the surrounding reference surface towards the surface side on which the opening/closing member is secured and which second engaging portion has an engaging surface located lower than the reference surface; and the engaging surface of the first engaging portion of said one of the operating pieces and the engaging surface of the second engaging portion of the other of the operating pieces are engaged with each other at a height substantially the same as or lower than the height of the reference surfaces. Therefore, the binding device can be provided which can support the reduction in profile of the holding member and which allows reduction in profile overall.

According to the invention of claim 15, said one operating piece has first engaging portions which are formed by bending and recessing vicinity of both ends of the abutting edge along the abutting edge from the surrounding reference surface towards the surface side on which the opening/closing member is secured to thereby form recessed portions and then bending the recessed portions towards the side opposite to the surface on which the opening/closing member is secured and each of which first engaging portions has an engaging surface located higher than surrounding thereof but lower than the reference surface; the other of the operating pieces has second engaging portions which are formed by bending and recessing vicinity of both ends of the abutting edge along the abutting edge from the surrounding reference surface towards the surface side on which the opening/closing member is secured to thereby form recessed portions and each of which second engaging portions has an engaging surface formed by the recessed portion and located lower than the reference surface; and the engaging surface of each of the first engaging portions of said one of the operating pieces and the engaging surface of each of the second engaging portions of the other of the operating pieces are engaged with each other at the height substantially the same as or lower than the height of the reference surfaces. Therefore, the binding device can be provided which can support the reduction in profile of the holding member and which allows reduction in profile overall.

According to the invention of claim 16, said one of the operating pieces has the first engaging portions which are formed by bending and recessing the vicinity of the both ends of the abutting edge, i.e., portions extending from regions where the base portions of the binding rings are secured towards the abutting edge, along the abutting edge from the surrounding reference surface towards the surface side on which the opening/closing member is secured to thereby form the recessed portions and then bending the recessed portions towards the side opposite to the surface on which the opening/closing member is secured and each of which first engaging portions has the engaging surface located higher than the surrounding thereof but lower than the reference surface; the other of the operating pieces has the second engaging portion which are formed by bending and recessing the vicinity of the both ends of the abutting edge, i.e., portions extending from regions where the base portions of the binding rings are secured towards the abutting edge, along the abutting edge from the surrounding reference surface towards the surface side on which the opening/closing member is secured to thereby form the recessed portions and each of which second engaging portions having has the engaging surface formed by the recessed portions and located lower than the reference surface; and the engaging surface of each of the first engaging portions of said one of the operating pieces and the engaging surface of each of the second engaging portions of the other of the operating pieces are engaged with each other at the height substantially the same as or lower than the height of the reference surfaces. Therefore, the binding device can be provided which can smoothly move the operating member at the time of opening/closing the binding rings and which allows reduction in profile overall.

According to the invention of claim 17, said one of the operating pieces is formed with the first engaging portions and, in addition, has second engaging portions formed in the same manner as the other of the operating pieces has, and the other of the operating pieces is formed with the second engaging portions and, in addition, has first engaging portions formed in the same manner as said one of the operating pieces has. Therefore, the binding device can be provided which can smoothly move the operating member at the time of opening/closing the binding rings and which allows reduction in profile overall.

According to the invention of claim 18, said one and the other of the operating pieces are plates of a rectangular shape in a plan view, including a length direction extending in a moving direction at time of opening and closing the binding rings; and said one and the other of the operating pieces are point-symmetric, defining a center of the abutting edges in a length direction as a center of symmetry. Therefore, the operating pieces can be relatively easily formed by press working or the like, which permits promoting reinforcement of the operating pieces.

BRIEF DESCRIPTION OF THE DRAWINGS

FIG. 6(A) is a schematic side view of the opening/closing member in an original state, FIG. 6(B) is a schematic side view (viewed along arrow A direction in FIG. 5(A)) in which a coil portion is secured to the operating pieces by applying forces to the circumferential direction of the coil portion, and FIG. 6(C) is a schematic side view (viewed along arrow B direction in FIG. 5(A)) in which a coil portion is secured to the operating pieces by applying forces to the circumferential direction of the coil portion;

FIG. 7(A) is a schematic plan view showing the binding rings and the operating members in a closed state, and FIG. 7(B) is a schematic left lateral view of a second operating piece;

FIG. 10(A) is a cross-sectional view taken along the line A-A in FIG. 9, and FIG. 10(B) is a cross-sectional view taken along the line B-B in FIG. 9;

FIG. 14(A) is a schematic bottom view showing the binding device in a nearly opened state, and FIG. 14(B) is a schematic bottom view showing the binding device in a completely opened state;

FIG. 15(A) is a cross-sectional view taken along the line A-A in FIG. 14, and FIG. 15(B) is a cross-sectional view taken along the line B-B in FIG. 14;

FIG. 16(A) is a schematic plan view, FIG. 16(B) is a schematic cross-sectional view taken along the line A-A in FIG. 16(A), and FIG. 16(C) is a schematic elevation view;

FIG. 17(A) is a schematic side view, and FIG. 17(B) is a schematic cross-sectional view taken along the line B-B in FIG. 17(A);

FIG. 18(A) is a schematic plan view, and FIG. 18(B) is a schematic elevation view;

FIG. 19(A) is a schematic plan view, and FIG. 19(B) is a schematic elevation view;

FIG. 20(A) is a schematic plan view, and FIG. 20(B) is a schematic elevation view;

FIG. 21(A) is a schematic plan view, and FIG. 21(B) is a schematic elevation view;

FIG. 22(B) is a schematic bottom view;

FIG. 31(A) is a schematic plan view, and FIG. 31(B) is a schematic elevation view;

FIG. 50(A) is a schematic side view in an original state, and FIGS. 50B and 50(C) are schematic side views in which the coil portions are secured to the operating pieces by applying forces to the circumferential direction of the coil portions;

FIG. 54(A) is a cross-sectional view taken along the line A-A in FIG. 53, and FIG. 54(B) is a cross-sectional view taken along the line B-B in the schematic view, FIG. 53;

FIG. 58(A) is a schematic bottom view showing the binding device in a nearly opened state, and FIG. 58(B) is a schematic bottom view showing the binding device in a completely opened state;

FIG. 59(A) is a cross-sectional view taken along the line A-A in FIG. 58, and FIG. 59(B) is a cross-sectional view taken along the line B-B in the schematic view, FIG. 58;

FIG. 60(A) is a schematic plan view, FIG. 60(B) is a schematic cross-sectional view taken along the line A-A in FIG. 60(A), and FIG. 60(C) is a schematic elevation view;

FIG. 61(A) is a schematic side view, and FIG. 61(B) is a schematic cross-sectional view taken along the line B-B in FIG. 61(A);

FIG. 62(A) is a schematic plan view, and FIG. 62(B) is a schematic elevation view;

FIG. 63(A) is a schematic plan view, and FIG. 63(B) is a schematic elevation view;

FIG. 64(A) is a schematic plan view, and FIG. 64(B) is a schematic elevation view;

FIG. 65(A) is a schematic plan view, and FIG. 65(B) is a schematic elevation view;

FIG. 66(B) is a schematic bottom view;

FIG. 75(A) is a schematic plan view, and FIG. 75(B) is a schematic elevation view;

EXPLANATION OF LETTERS OR NUMERALS

Figure 1:
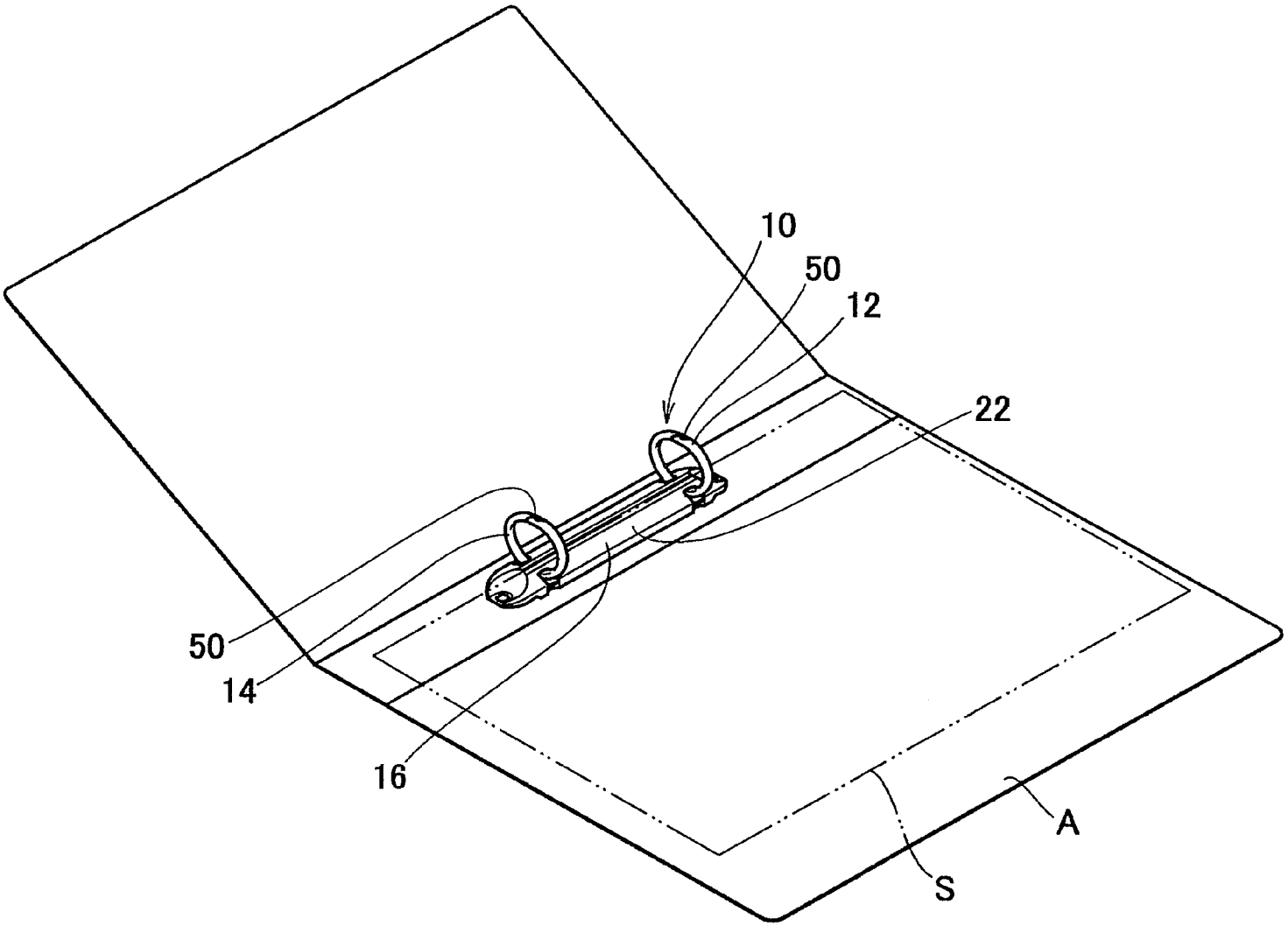
FIG. 1 is a perspective view showing a file with a binding device according to an embodiment of the present invention.

A Cover
S Object
10, 510, 610 Binding device
12, 412, 512, 612 First binding ring
14, 414, 513, 613 Second binding ring
514, 614 Third binding ring
515 Fourth binding ring
12*a*, 412*a*, 512*a*, 612*a* First half ring
12*b*, 412*b*, 512*b*, 612*b* Second half ring
14*a*, 414*a*, 513*a*, 613*a* Third half ring
14*b*, 414*b*, 513*b*, 613*b* Fourth half ring
514*a*, 614*a* Fifth half ring
514*b*, 614*b* Sixth half ring
515*a* Seventh half ring
515*b* Eighth half ring
16, 516, 616 Holding member
18, 518, 618 Operating member
20, 520, 620 Attachment hole
22, 522, 622 Bound object-mounting portion
22*a* Bulging portion
24, 524, 624 Holding wall
24*a*, 524*a*, 624*a* First holding wall
24*b*, 524*b*, 624*b* Second holding wall
26, 526, 626 First through hole
28, 527, 627 Second through hole
528, 628 Third through hole
529 Fourth through hole
30, 530, 630 First operating piece
30*a*, 530*a*, 630*a*, 730*a* Abutting edge
30*b*, 530*b*, 630*b* Outer edge
30*c*1, 30*c*2, 530*c*1, 530*c*2, 530*c*3, 630*c*3, 630*c*1, 630*c*2 Protruding portion
30*d*, 30*e* Engaging portion
30*f*, 130*f* Restricting recess
30*g*, 130*g* Restricting projection
130*d*, 730*d*, 830*d* Recess portion on opposite side of first operating piece
130*e*, 730*e*, 830*e* Recess portion on front side of first operating piece
230*h*, 530*h*, 630*h* Protrusion
32, 532, 632 Second operating piece
32*a*, 532*a*, 632*a*, 732*a* Abutting edge
32*b*, 532*b*, 632*b* Outer edge
32*c*1, 32*c*2, 532*c*1, 532*c*2, 532*c*3, 632*c*1, 632*c*2, 632*c*3 Protruding portion
32*d*, 32*e* Engaging portion
32*f*, 132*f* Restricting recess
32*g*, 132*g* Restricting projection
132*d*, 732*d*, 832*d* Recess portion on opposite side of second operating piece
132*e*, 732*e*, 832*e* Recess portion on front side of second operating piece
232*h*, 532*h*, 632*h* Protrusion
234*a*, 234*b*, 234*c*, 234*d*, 534*a*, 534*b*, 534*c*, 534*d*, 534*e*, 534*f*, 634*a*, 634*b*, 634*c*, 634*d*, 634*e*, 634*f* Bead
234*a*1, 234*b*1, 234*c*1, 234*d*1, 534*a*1, 534*b*1, 534*c*1, 534*d*1, 634*a*1, 634*b*1, 634*c*1, 634*d*1, 634*e*1, 634*f*1 First linear portion
234*a*2, 234*b*2, 234*c*2, 234*d*2, 534*a*2, 534*b*2, 534*c*2, 534*d*2, 634*a*2, 634*b*2, 634*c*2, 634*d*2, 634*e*2, 634*f*2 Second linear portion
234*a*3, 234*b*3, 234*c*3, 234*d*3, 534*a*3, 534*b*3, 534*c*3, 534*d*3, 634*a*3, 634*b*3, 634*c*3, 634*d*3, 634*e*3, 634*f*3 Hatched portion
36*a*, 36*b* Recess
136*a* First engaging portion
136*a*1, 536*a*1, 636*a*1 First engaging portion on opposite side of first operating piece
136*a*2, 536*a*2, 636*a*2 First engaging portion on front side of first operating piece
136*a*3, 536*a*3, 636*a*3 First engaging portion on front side of second operating piece
136*a*4, 536*a*4, 636*a*4 First engaging portion on opposite side of second operating piece
136*b* Second engaging portion
136*b*1, 536*b*1, 636*b*1 Second engaging portion on opposite side of second operating piece
136*b*2, 536*b*2, 636*b*2 Second engaging portion on front side of second operating piece
136*b*3, 536*b*3, 636*b*3 Second engaging portion on front side of first operating piece
136*b*1, 536*b*1, 636*b*1 Second engaging portion on opposite side of second operating piece
38*a*, 38*b*, 538*a*1, 538*a*2, 538*b*1, 538*b*2, 638*a*1, 638*a*2, 638*b*1, 638*b*2, 738*a*, 738*b* Opening/closing member fixing portion
38*a*1, 38*b*1 Latching base portion
38*a*2, 38*b*2 Latching and locking portion
36, 536A, 536B, 636A, 636B Opening/closing member housing portion
40, 540, 542, 640, 642 Opening/closing member
42*a*, 540*a*, 542*a*, 640*a*, 642*a*, 742*a* One fixing tip portion of opening/closing member
42*b*, 540*b*, 542*b*, 640*b*, 642*b*, 742*b* The other fixing tip portion of opening/closing member
44, 744 Coil portion
46*a*, 46*b*, 746*a*, 746*b* Restricting arm portion

50, 550, 650 Binding ring latching portion
52*a*, 54*a*, 56*a*, 58*a* Projection
52*b*, 54*b*, 56*b*, 58*b* Recess
52*c*, 54*c*, 56*c*, 58*c* Inclined opposing face in projection
52*d*, 54*d*, 56*d*, 58*d* Inclined opposing face in recess
60, 62, 160, 162, 560, 562, 660, 662 First holding portion
64, 66, 164, 166, 564, 566, 664, 666 Second holding portion
561, 565, 661, 665 Third holding portion
68*a*, 70*a*, 72*a*, 74*a* Cut
300 File/binder
310 Cover
312 Front cover
314 Back cover
316 Spine
318A, 318B Thin hinge portion
320 Consecutive installing portion
322, 324 Binding ring fixing means The above-described and other objects, characteristics, features, and advantages of the present invention will be more apparent from the following description of best mode for carrying out the invention with reference to the accompanying drawings.

BEST MODE FOR CARRYING OUT THE INVENTION

A two-ring perfect-circle type binding device according to an embodiment of the present invention will be described.

FIG. 1 is a perspective view showing a file with a binding device according to an embodiment of the present invention.

Figure 2:
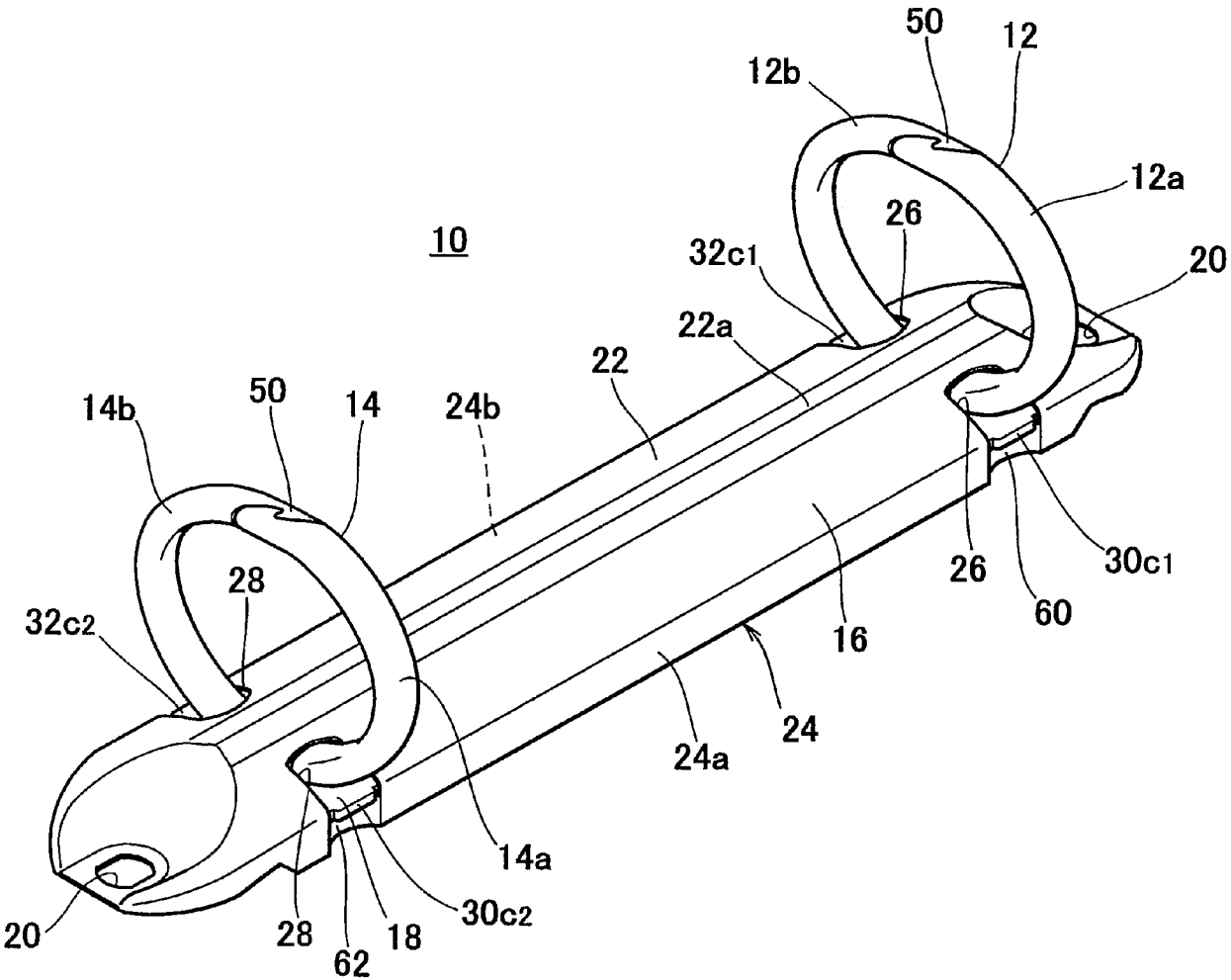
FIG. 2 is a perspective view showing an example of the binding device according to an embodiment of the present invention.

FIG. 2 is a perspective view showing an example of the binding device according to the embodiment of the present invention.

Figure 3:
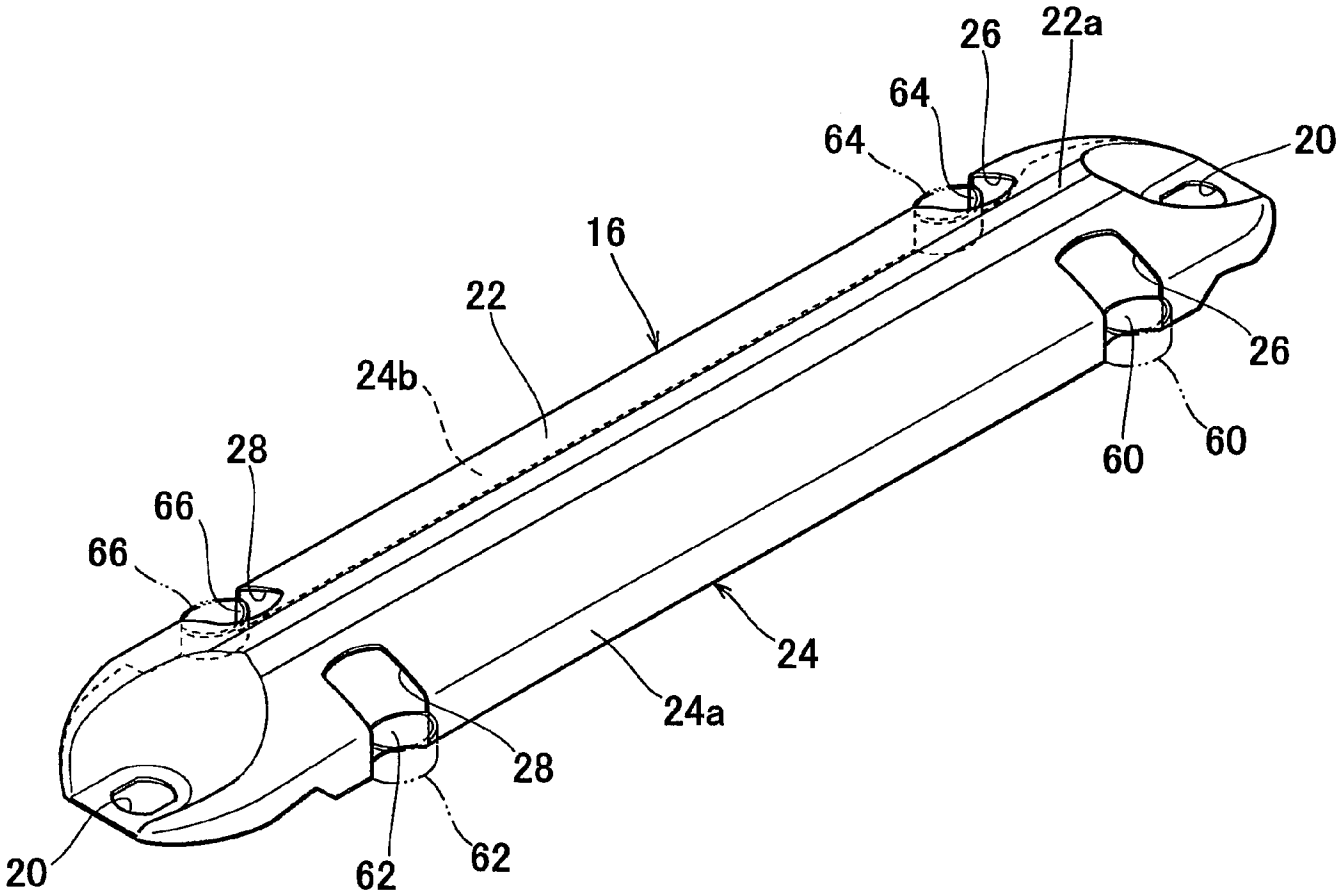
FIG. 3 is a perspective view of a holding member.

FIG. 3 is a perspective view of a holding member.

Figure 4:
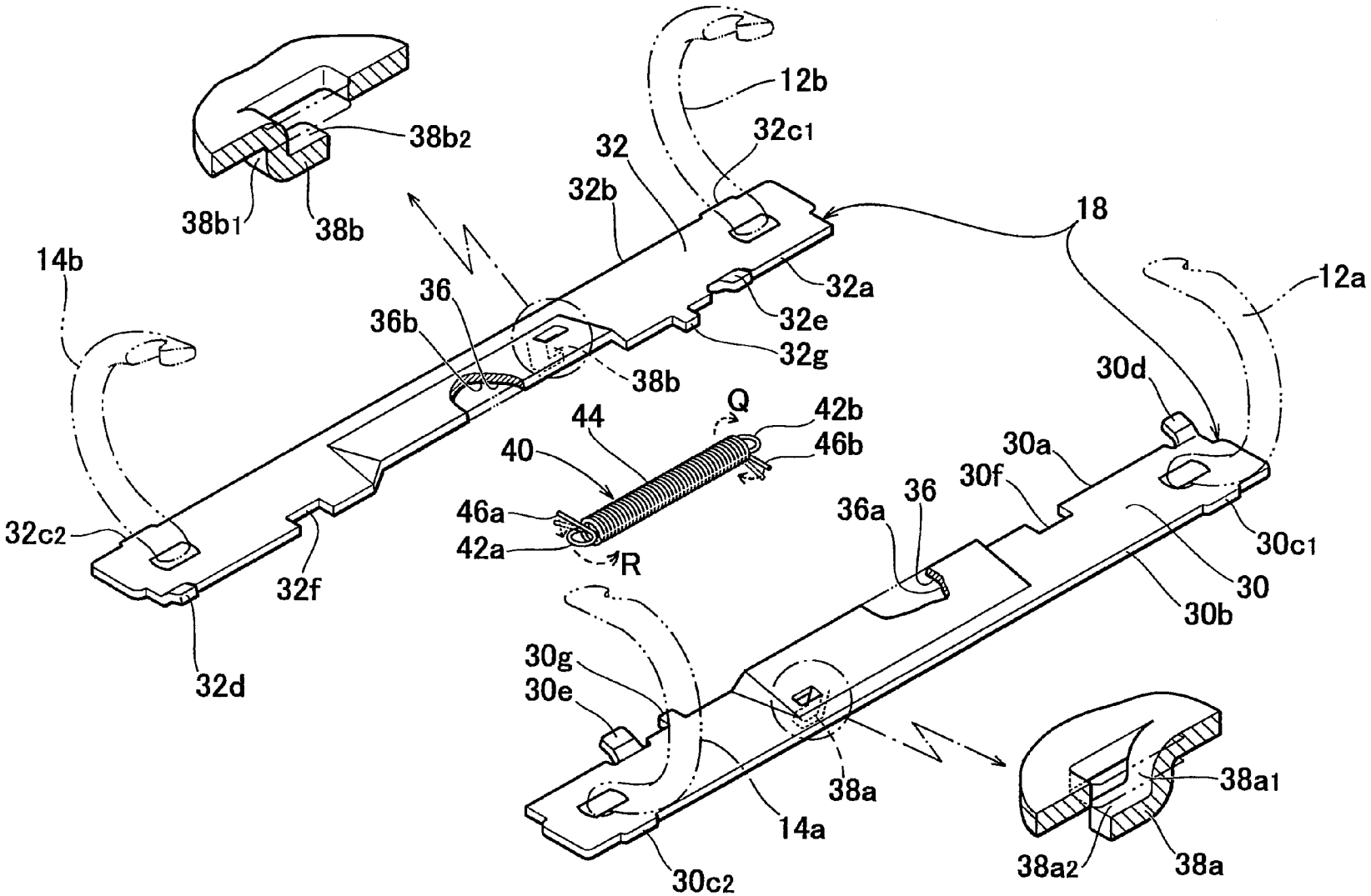
FIG. 4 is a schematic perspective view of operating members and an opening/closing member.

FIG. 4 is a schematic perspective view of operating members and an opening/closing member.

Figure 5:
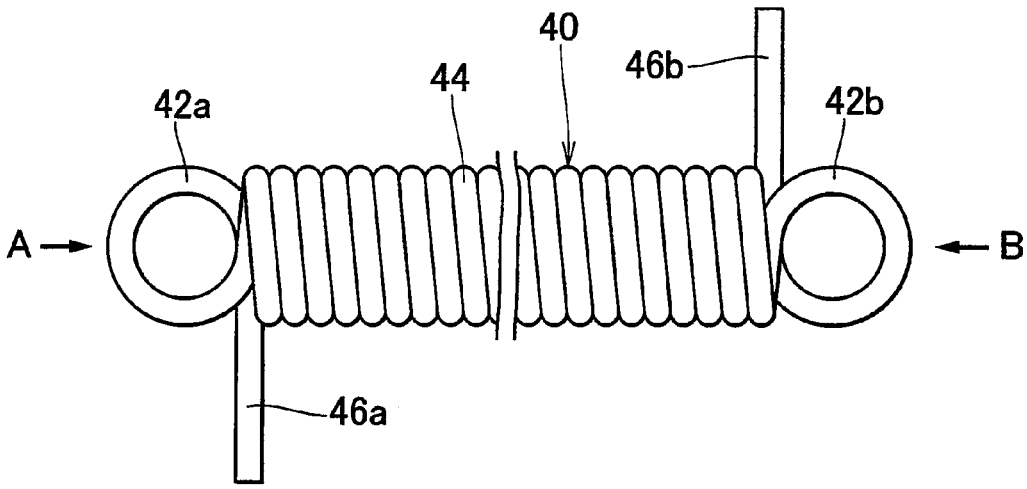
FIG. 5 is a plan view of the opening/closing member.

FIG. 5 is a plan view of the opening/closing member.

FIGS. 6(A), 6(B), and 6(C) are schematic side views of the opening/closing member, where FIG. 6(A) is a schematic side view in an original state and FIGS. 6(B) and 6(C) are schematic side views in a state in which a force is applied to a circumferential direction of a coil portion.

FIGS. 7(A) and 7(B) are schematic views of binding rings and the operating members, where FIG. 7(A) is a schematic plan view showing the binding rings and the operating members in a closed state, and FIG. 7(B) is a schematic left lateral view of a second operating piece.

Figure 8:
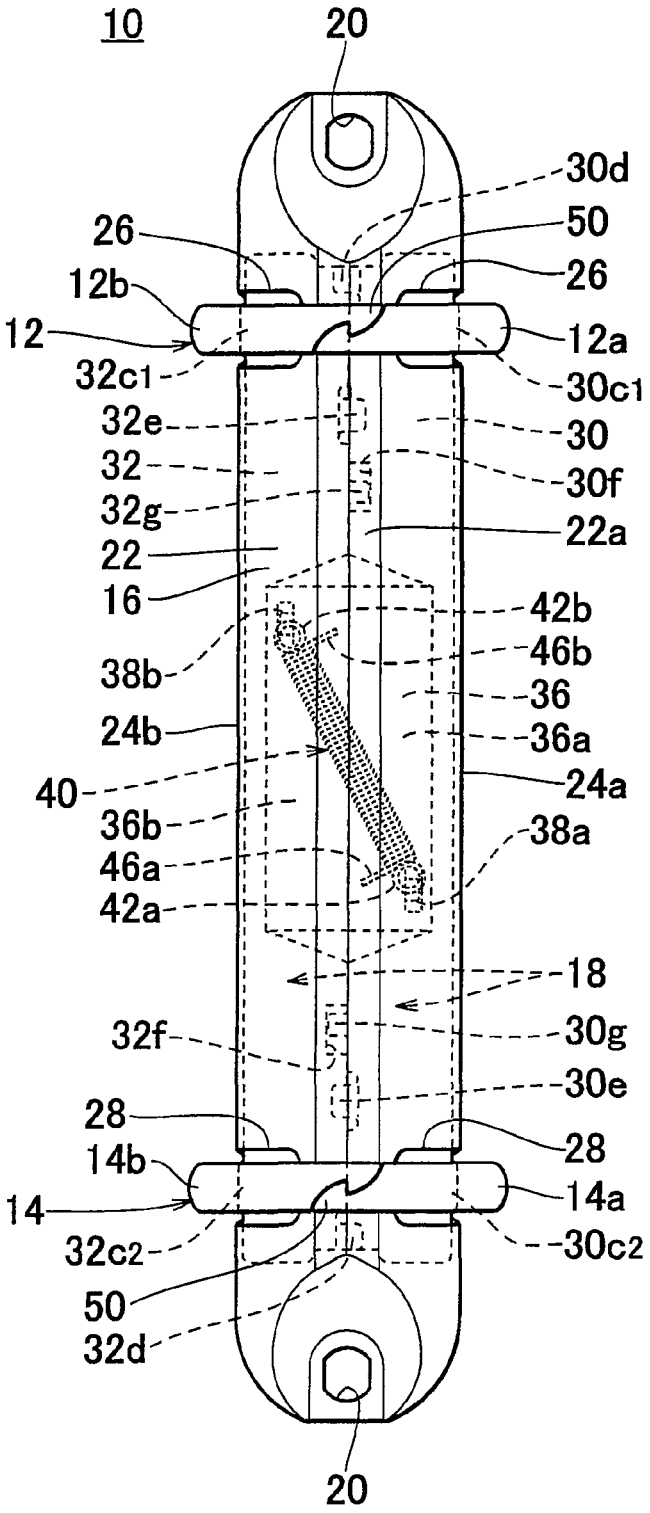
FIG. 8 is a schematic plan view showing the binding device in a closed state.

FIG. 8 is a plan view showing the binding device in a closed state.

Figure 9:
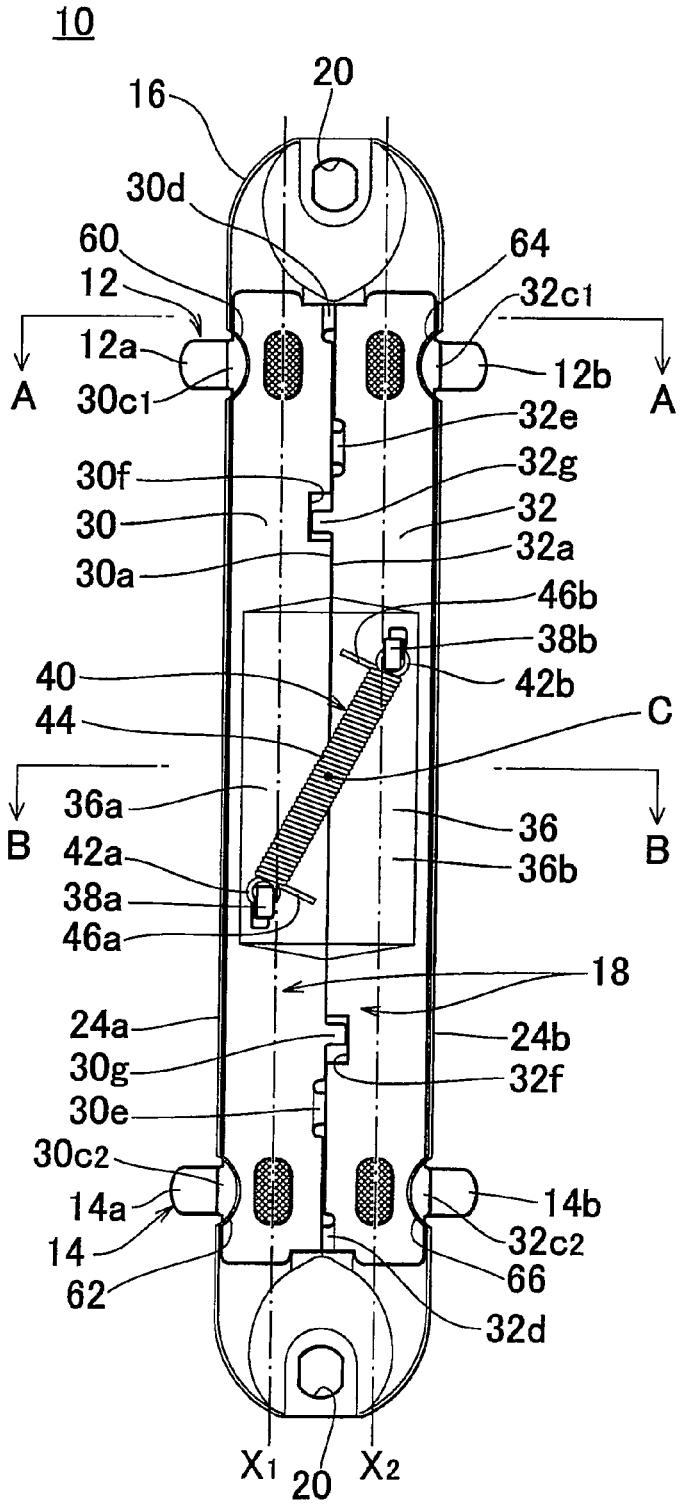
FIG. 9 is a bottom view showing the binding device in a closed state.

FIG. 9 is a bottom view showing the binding device in the closed state.

FIGS. 10(A) and 10(B) are cross-sectional views showing the binding device in the closed state, where FIG. 10(A) is a cross-sectional view taken along line A-A in FIG. 9, and FIG. 10(B) is a cross-sectional view taken along line B-B in FIG. 9.

Figure 11:
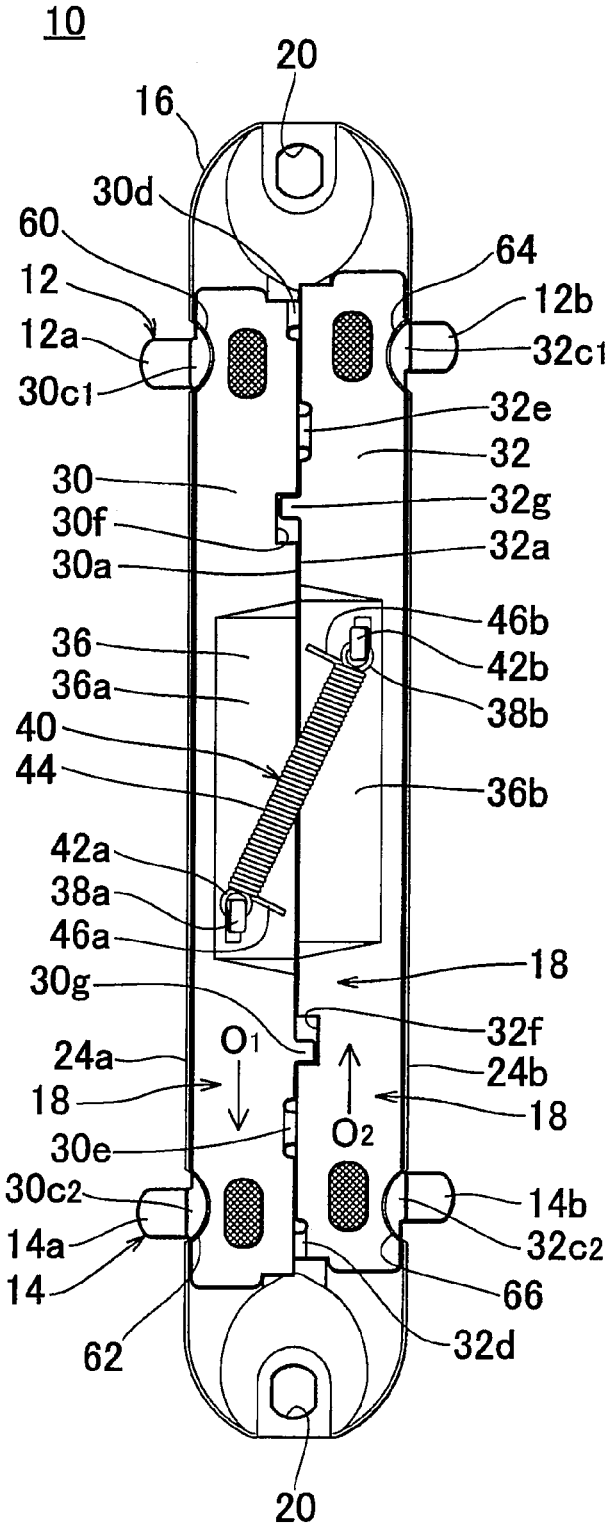
FIG. 11 is a bottom view of the binding device showing a state in which the binding rings are opened.

FIG. 11 is a bottom view of the binding device showing a state in which the binding rings are opened.

Figure 12:
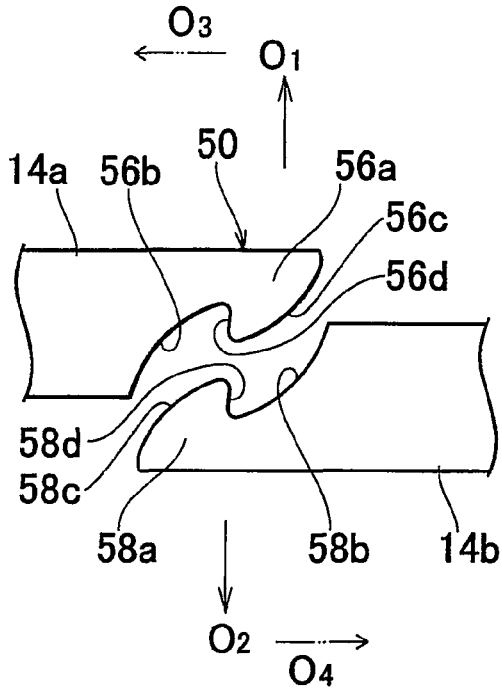
FIG. 12 is a schematic view of the binding rings of the binding device showing a state in which the binding rings are opened.
Figure 12:
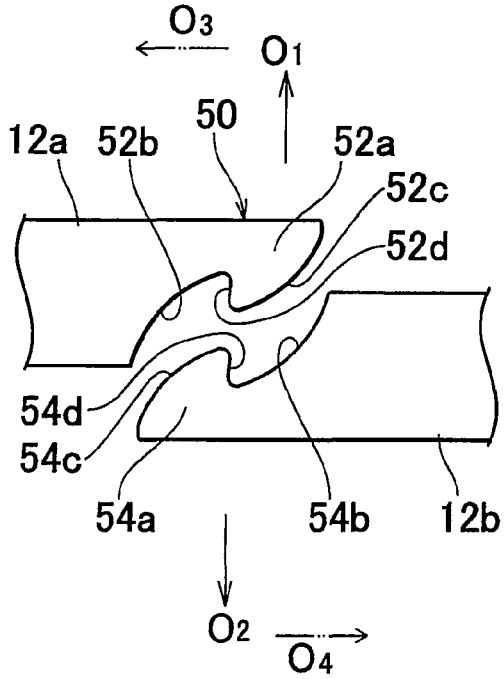
Figure 13:
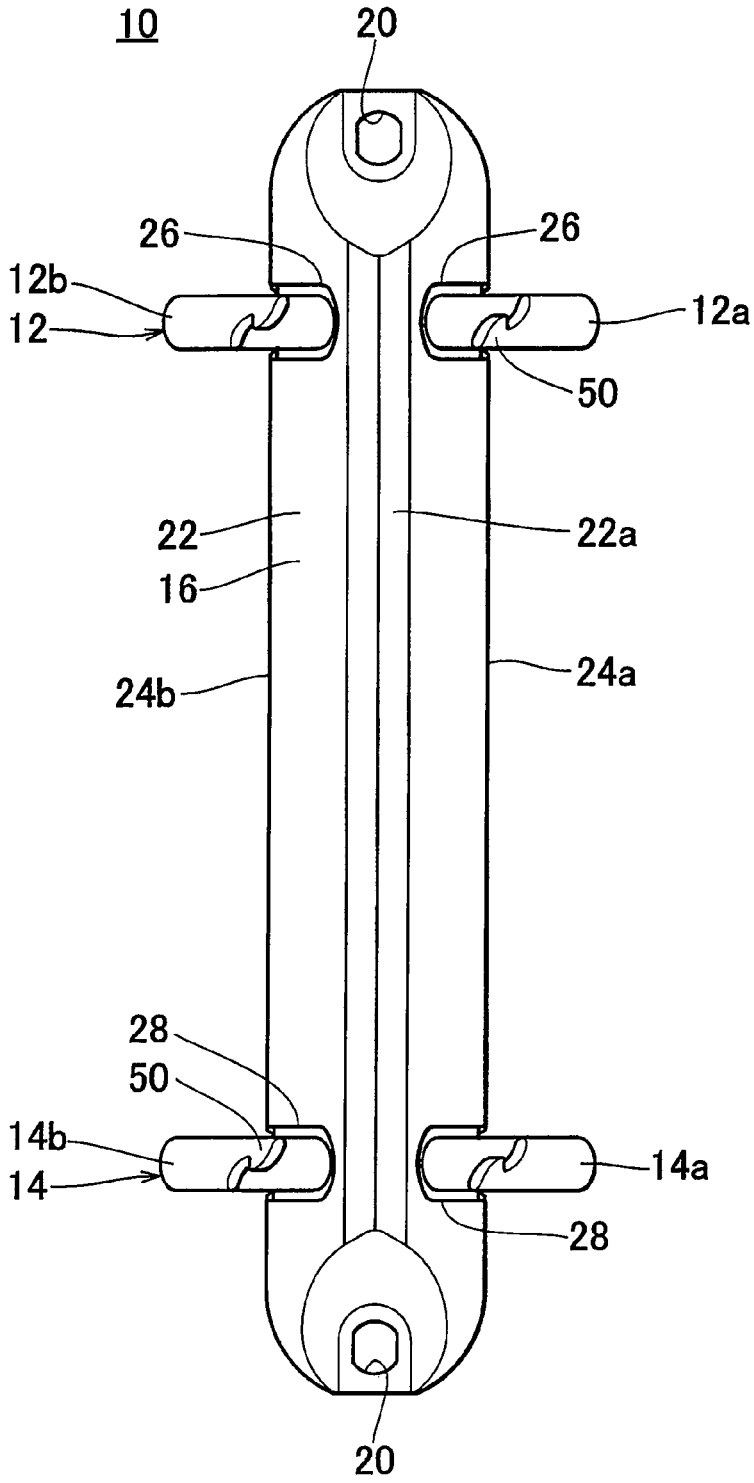
FIG. 13 is a schematic plan view showing the binding device in an opened state.

FIG. 12 is a schematic view of the binding rings of the binding device showing the state in which the binding rings are opened.

The binding device 10 shown in FIG. 1 or FIG. 2 is secured onto an inner surface of a spine between a pair of right and left folding lines, provided in an approximate center of a cover A made of a relatively hard sheet material such as cardboard. As a securing method, there is a method of securing the binding device 10 integrally with the spine with fastening tools such as a bolt and a nut or an eyelet inserted into attachment holes 20 (described below in detail) provided at both longitudinal ends of the binding device 10.

In this embodiment, the description is made using a bolt and a nut as the fastening tools. However, the fastening tools are not limited thereto. For example, a screw, an eyelet, a rivet, or other suitable fastening tools can also be used.

The binding device 10 includes a pair of binding rings which form annular binding rings, i.e., a first binding ring 12 and a second binding ring 14, a holding member 16, and an operating member 18. Each of the first binding ring 12 and the second binding ring 14 is made of metal in an approximately annular shape. The holding member 16 has a length that enables the first binding ring 12 and the second binding ring 14 to be disposed with a spacing therebetween. A base of each of the first binding ring 12 and the second binding ring 14 is secured to a surface of the operating member 18 such that the first binding ring 12 and the second binding ring 14 are disposed with a spacing therebetween. The operating member 18 is movably secured inside the holding member 16 such that the first binding ring 12 and the second binding ring 14 are secured to the holding member 16.

This binding device 10 is of an openable-closable two-hole type, i.e., the binding rings thereof include the first binding ring 12 serving as a main binding ring and the second binding ring 14 serving as a subsidiary binding ring.

The first binding ring 12 and the second binding ring 14 are configured such that their binding ring latching portions 50 can be disengaged with fingers in the same direction.

Then, when the binding rings are closed, the first binding ring 12 serving as the main binding ring is configured to be closed by directly sandwiching the first binding ring 12 between, for example, the thumb and first finger.

Then, when the first binding ring 12 is operated in a closing direction by sandwiching it between two fingers, the second binding ring 14 serving as the subsidiary binding ring is operated following this operation.

The holding member 16 is of an approximately rectangular shape in a plan view, having a length that enables the first binding ring 12 and the second binding ring 14 to be provided with a spacing therebetween. Both ends of the holding member 16, i.e., in the vicinity of the attachment holes 20 for attachment to the cover A, are formed into an approximately semicircular arc shape in a plan view.

The holding member 16 has a bound object-mounting portion 22 having an approximately semicircular arc cross-sectional shape. The bound object-mounting portion 22 protrudes inwardly from the outer vicinities of the positions where the first binding ring 12 and the second binding ring 14 are secured in a longitudinal direction toward the center.

In addition, inside of the bound object-mounting portion 22 of the holding member 16 is configured to have holding space so that the operating member 18 or other member is housed in the holding space.

On both ends of the bound object-mounting portion 22 of the holding member 16, holding walls 24 for slidably holding the operating member 18 are provided substantially from one end to the other end of the bound object-mounting portion 22 in its longitudinal direction.

For holding wall 24, in this embodiment, a first holding wall 24*a* and a second holding wall 24*b* are continuously provided so as to downwardly extend from the outer vicinities of the first binding ring 12 and the second binding ring 14 over approximately the entire length.

The first holding wall 24*a* and the second holding wall 24*b* are in parallel with each other and have substantially the same plate-like shape.

Then, the operating member 18, the opening/closing member 40, etc. described below in detail are housed within the holding space surrounded by the first holding wall 24*a*, the second holding wall 24*b*, and bound object-mounting portion 22.

First through holes 26 and second through holes 28 are provided through the bound object-mounting portion 22 of the holding member 16 so as to allow the first binding ring 12 and the second binding ring 14 to loosely pass therethrough at a predetermined distance (a predetermined length determined by Japanese Industrial Standards or the like).

The first through holes 26 and the second through holes 28 are provided so as to correspond to a first half ring 12*a* and a second half ring 12*b* constituting the first binding ring 12 and a third half ring 14*a* and a fourth half ring 14*b* constituting the second binding ring 14, respectively. The first through holes 26 and the second through holes 28 are provided in a width direction of the holding member 16 at a predetermined distance, parting right and left.

The operating member 18 includes a pair of the first operating piece 30 and the second operating piece 32, each being made of a metal plate having an approximately rectangular shape in a plan view.

The first operating piece 30 and the second operating piece 32 are, in the longitudinal direction, parallel to the first holding wall 24*a* and the second holding wall 24*b*, having outer edge 30*b* and outer edge 32*b* so formed as to oscillate on the inner surfaces thereof.

Parallel to the outer edge 30*b* and the outer edge 32*b*, an abutting edge 30*a* and an abutting edge 32*a* abutting the pair of the first operating piece 30 and the second operating piece 32 are formed at the inner edges.

The first operating piece 30 and the second operating piece 32 are point-symmetric, defining center C (shown in FIGS. 7 and 9) in the longitudinal direction of the abutting edge 30*a* and the abutting edge 32*a* as a center of symmetry. When each member is aligned in the longitudinal direction in the holding space of the holding member 16, each member is flexibly engaged at the inner edge thereof.

When no external force is applied, the first operating piece 30 and the second operating piece 32 are provided within the inner space of the holding member 16 so as to be folded downward, i.e., to be oriented in a direction separating from the inner surface of the bound object-mounting portion 22 of the holding member 16 (the abutting edges 30*a* and 32*a* are situated below a plane Pxy shown in FIG. 7) or to be folded upward state, i.e., to be oriented in a direction approaching the inner surface of the bound object-mounting portion 22 of the holding member 16 (the abutting edges 30*a* and 32*a* are situated above the plane Pxy shown in FIG. 7).

Then, the first operating piece 30 and the second operating piece 32 are installed in the holding space portion in the inside of the holding member 16 so as to maintain the downward or upward folded state.

The plane Pxy includes horizontal axes Y1 and Y2 and longitudinal axes X1 and X2 (shown in FIG. 7) passing through the locations (four locations) where the respective bases of the first binding ring 12 and the second binding ring 14 are secured to the first operating piece 30 and the second operating piece 32.

For the operating member 18, the base of the first half ring 12*a* constituting the first binding ring 12 is secured onto a surface (i.e., an upper surface) of one of the operating pieces, i.e., the first operating piece 30, which faces the inner surface of the bound object-mounting portion 22 of the holding member 16. On the same surface, the base of the third half ring 14*a* constituting the second binding ring 14 is secured at a predetermined distance from the first half ring 12*a*.

The base of the second half ring 12*b* constituting the first binding ring 12 is secured onto a surface (i.e., an upper surface) of the other operating piece, i.e., the second operating piece 32, which faces the inner surface of the bound object-mounting portion 22 of the holding member 16. On the same surface, the base of the fourth half ring 14*b* constituting the second binding ring 14 is secured at a predetermined distance from the second half ring 12*b*.

One operating piece, i.e., the first operating piece 30 are formed with a protruding portion 30*c*1 (formed in the vicinity of the first half ring 12*a*) which is inserted in first through holes 26 formed in the holding member 16 and with a protruding portion 30*c*2 (formed in the vicinity of the third half ring 14*a*) which is inserted in the second through holes 28 formed in the holding member 16.

The second operating piece 32 are formed with a protruding portion 32*c*1 (formed in the vicinity of the second half ring 12*b*) which is inserted in the first through holes 26 formed in the holding member 16 and with a protruding portion 32*c*2 (formed in the vicinity of the fourth half ring 14*b*) which is inserted in the second through holes 28 formed in the holding member 16.

Then, a pair of the first operating piece 30 and the second operating piece 32 abut against each other in a situation where the protruding portion 30*c*1 and the protruding portion 30*c*2 are passed through the first through holes 26 and the second through holes 28 and the protruding portion 32*c*1 and the protruding portion 32*c*2 are passed through the first through holes 26 and the second through holes 28.

The first operating piece 30 and the second operating piece 32 are held in the holding member 16 in a manner such as to oscillate in the direction in which the first binding ring 12 and the second binding ring 14 are opened or closed.

The abutting edges 30*a* and 32*a* are held in the holding member 16 so that the abutting edges 30*a* and 32*a* come close to the inner surface of the holding member 16 when the binding rings, i.e., the first binding ring 12 and the second binding ring 14, are opened and so that the abutting edges 30*a* and 32*a* separate away from the inner surface of the holding member 16 when the first binding ring 12 and the second binding ring 14 are closed.

The first operating piece 30 has: the substantially linear abutting edge 30*a* formed on the inner side thereof so as to allow the pair of the operating pieces to abut against each other; and the substantially linear outer edges 30*b* formed on the outer side thereof parallelly to the abutting edge 30*a*.

The second operating piece 32 has: the substantially linear abutting edge 32*a* formed on the inner side thereof so as to allow the pair of the operating pieces to abut against each other; and the substantially linear outer edges 32*b* formed on the outer side thereof parallelly to the abutting edge 32*a*.

The outer edge 30*b* of the first operating piece 30 is formed with the protruding portion 30*c*1 and the protruding portion 30*c*2.

The outer edge 32*b* of the second operating piece 32 is formed with the protruding portion 32*c*1 and the protruding portion 32*c*2.

In other words, the abutting edge 30*a* and the abutting edge 32*a* abut against each other, and the outer edge 30*b* and the outer edge 32*b* approach the inner side surfaces within the both walls of the first holding wall 24*a* and the second holding wall 24*b* of the holding member 16.

The protruding portion 30*c*1 and the protruding portion 30*c*2 are formed in a pair on the outer side (in the width direction of the first operating piece 30) close to the attachment positions of the base portions of the first half ring 12*a* and the third half ring 14*a* with a spacing at front and rear positions.

In addition, the protruding portion 32*c*1 and the protruding portion 32*c*2 are formed in a pair on the outer side (in the width direction of the second operating piece 32) close to the attachment positions of the base portions of the second half ring 12*b* and the fourth half ring 14*b* with a spacing at front and rear positions.

Then, the protruding portion 30*c*1 and the protruding portion 30*c*2, and the protruding portion 32*c*1 and the protruding portion 32*c*2 protrude outwardly from the first holding wall 24*a* and the second holding wall 24*b* of the holding wall 16, respectively, so as to allow the first binding ring 12 and the second binding ring 14 to be opened and closed.

The protruding portion 30*c*1 and the protruding portion 30*c*2 have such a length that allows them to protrude outwardly from the first through holes 26 of the first holding wall 24*a* of the holding member 16. Furthermore, the protruding portion 32*c*1 and the protruding portion 32*c*2 have such a length that allows them to protrude outwardly from the second through holes 28 of the second holding wall 24*b* of the holding member 16. In addition, the protruding portions 30*c*1, 30*c*2, 32*c*1, and 32*c*2 are of a tongue-like shape having a width that allows the operating member 18 to move in the longitudinal direction of the holding member 16 when the binding rings 12 and 14 are opened or closed.

The operating piece 30 and the operating piece 32 are made of a thin plate of metal or plastic, and the operating piece 30 and the operating piece 32 are formed integrally with the protruding portion 30*c*1, the protruding portion 30*c*2, the protruding portion 32*c*1, and the protruding portion 32*c*2.

The operating member 18 is formed with the opening/closing member housing portion 36 for housing the opening/closing member 40.

The recessed opening/closing member housing portion 36 is so provided as to protrude from the reverse side, opposite to the front surface on which the first binding ring 12 and the second binding ring 14 are secured, toward the front surface side.

The operating member 18 is recessed at the vicinity of the abutting edge 30*a* of the first operating member 30 toward the protruding direction of the first binding ring 12, and is recessed at the vicinity of the abutting edge 32*a* of the second operating member 32 toward the protruding direction of the second binding ring 14, thereby forming the recess 36*a* formed in the first operating member 30 and the recess 36*b* formed in the second operating member 32.

Then, the opening/closing member housing portion 36 is formed with the recess 36*a* and the recess 36*b*.

The recess 36*a* is formed to be deeply recessed on the abutting edge 30*a* side. The upper edge on the first binding ring 12 side and the lower edge on the second binding ring side 14 are substantially parallel to each other. The recess 36*a* has a substantially rectangular shape in a plan view, substantially orthogonal to the abutting edge 30*a*.

The recess 36*b* is formed to be deeply recessed on the abutting edge 32*a* side. The upper edge on the first binding ring 12 side and the lower edge on the second binding ring 14 side are substantially parallel to each other. The recess 36*b* has a substantially rectangular shape in a plan view, substantially orthogonal to the abutting edge 32*a*.

The opening/closing member housing portion 36 is configured such that the recess 36*a* formed in the first operating piece 30 and the recess 36*b* formed in the second operating piece 32 are formed line-symmetric to the abutting edge 30*a* and the abutting edge 32*a* as an axis.

The opening/closing member 40 is secured to the opening/closing member housing portion 36 of the operating member 18 on the reverse side opposite to the front surface on which the first binding ring 12 and the second binding ring 14 are secured. The opening/closing member 40 is formed to cause, when the first binding ring 12 and the second binding ring 14 are to be opened, the first binding ring 12 and the second binding ring 14 to be changed in the opening direction so that the operating pieces 30 and 32 are moved in a longitudinal direction of the holding member 16 and are held in a direction approaching the inner surface of the holding member 16, within the holding member 16.

Since the opening/closing member 40 is formed in such a manner, the opening/closing member 40 is housed in the opening/closing member housing portion 36, and the first operating piece 30 and the second operating piece 32 receiving action of the opening/closing member 40 are so formed as to achieve reduction in profile.

The first operating piece 30 has engaging portions 30*d* and 30*e*, for engaging the pair of the operating pieces 30 and 32 with each other, so provided as to protrude from the abutting edge 30*a* of the first operating piece 30 toward the abutting edge 32*a* of the second operating piece 32. In addition, the second operating piece 32 has engaging portions 32*d* and 32*e*, for engaging the pair of the operating pieces 30 and 32 with each other, so provided as to protrude from the abutting edge 32*a* of the second operating piece 32 toward the abutting edge 30*a* of the first operating piece 30.

The engaging portions 30*d* and 30*e* and the engaging portions 32*d* and 32*e* extend toward the upper side of the first operating piece 30 and the second operating piece 32, respectively, opposed to each other and thus are formed to allow the first operating piece 30 and the second operating piece 32 to oscillate about the abutting edges 30*a* and 32*a*.

Each of the engaging portions 30*d* and 30*e* and the engaging portions 32*d* and 32*e* is formed into a substantially U shape in a plan view having a base portion and a retaining portion, the base portion protruding an amount corresponding to the thickness of the operating member 18 toward the inner surface side of the bound object-mounting portion 22 of the holding member 16, the retaining portion protruding from the end of the base portion.

The retaining portion has a function of preventing disengagement of the first operating piece 30 or the second operating piece 32, which is one of the pair of the operating pieces, i.e., the first operating piece 30 and the second operating piece 32. Each of the engaging portions 30*d* and 30*e* and the engaging portions 32*d* and 32*e* protrudes toward the inner surface side of the bound object-mounting portion 22 of the holding member 16. The retaining portion approaches the surface of the first operating piece 30 or the second operating piece 32, which is one of the operating pieces of the pair of the operating pieces, i.e., the first operating piece 30 and the second operating piece 32, the surface being on the inner surface side of the bound object-mounting portion 22 of the holding member 16.

Each of the outermost engaging portions 30*d* and 32*d* has a width which allows the outermost engaging portions 30*d* and 32*d* to be positioned within the length of the operating member 18 even when the first operating piece 30 and the second operating piece 32 are moved in opposite directions.

The outermost engaging portions 30*d* and 32*d* are formed to be separated from the inward engaging portions 30*e* and 32*e*, respectively, by an appropriate distance so that the portion attached to the base portion of the first binding ring 12 or the second binding ring 14 is located therebetween.

Figure 10:
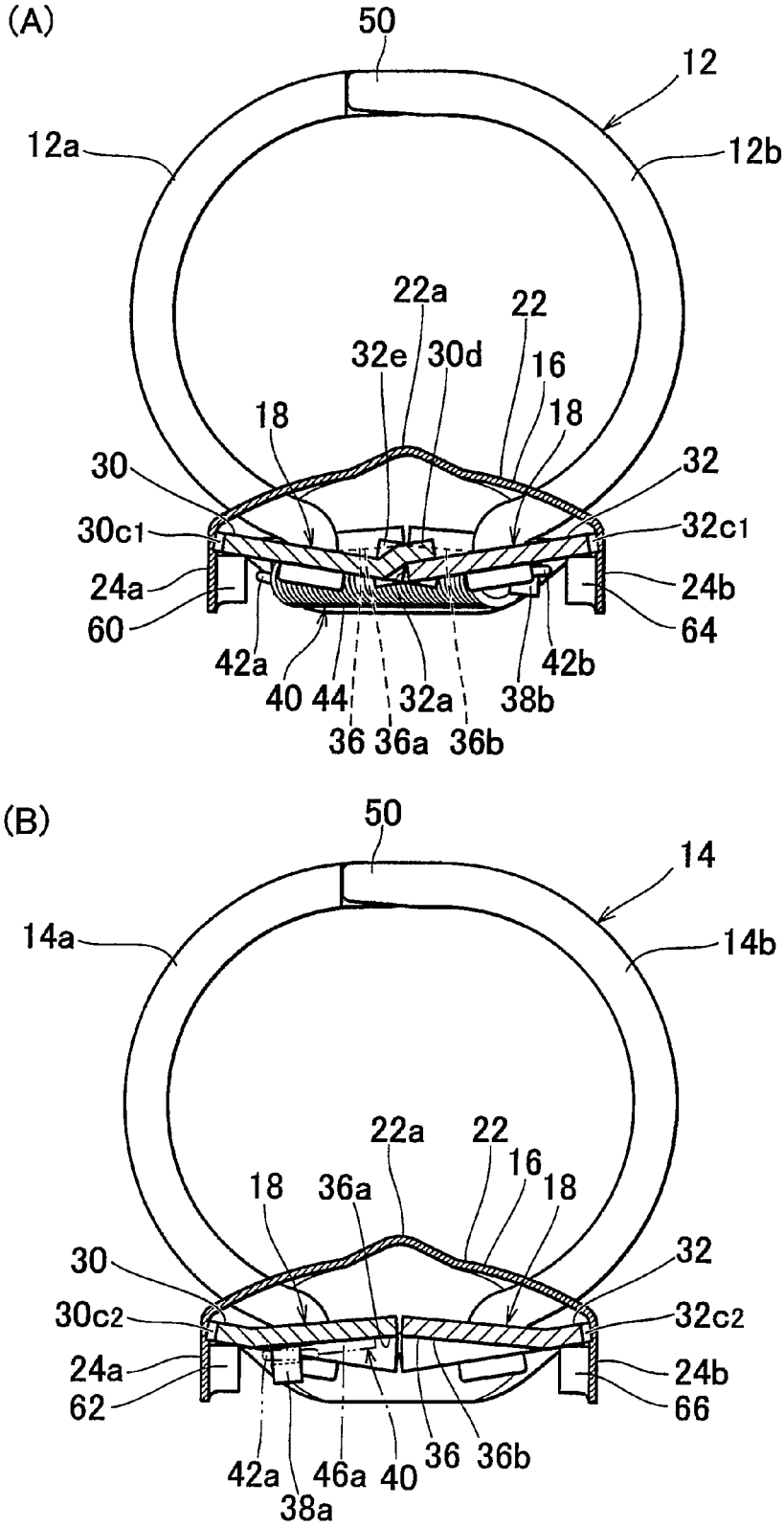
FIGS. 10(A) and 10(B) are cross-sectional views showing the binding devices in a closed state, where
Figure 15:
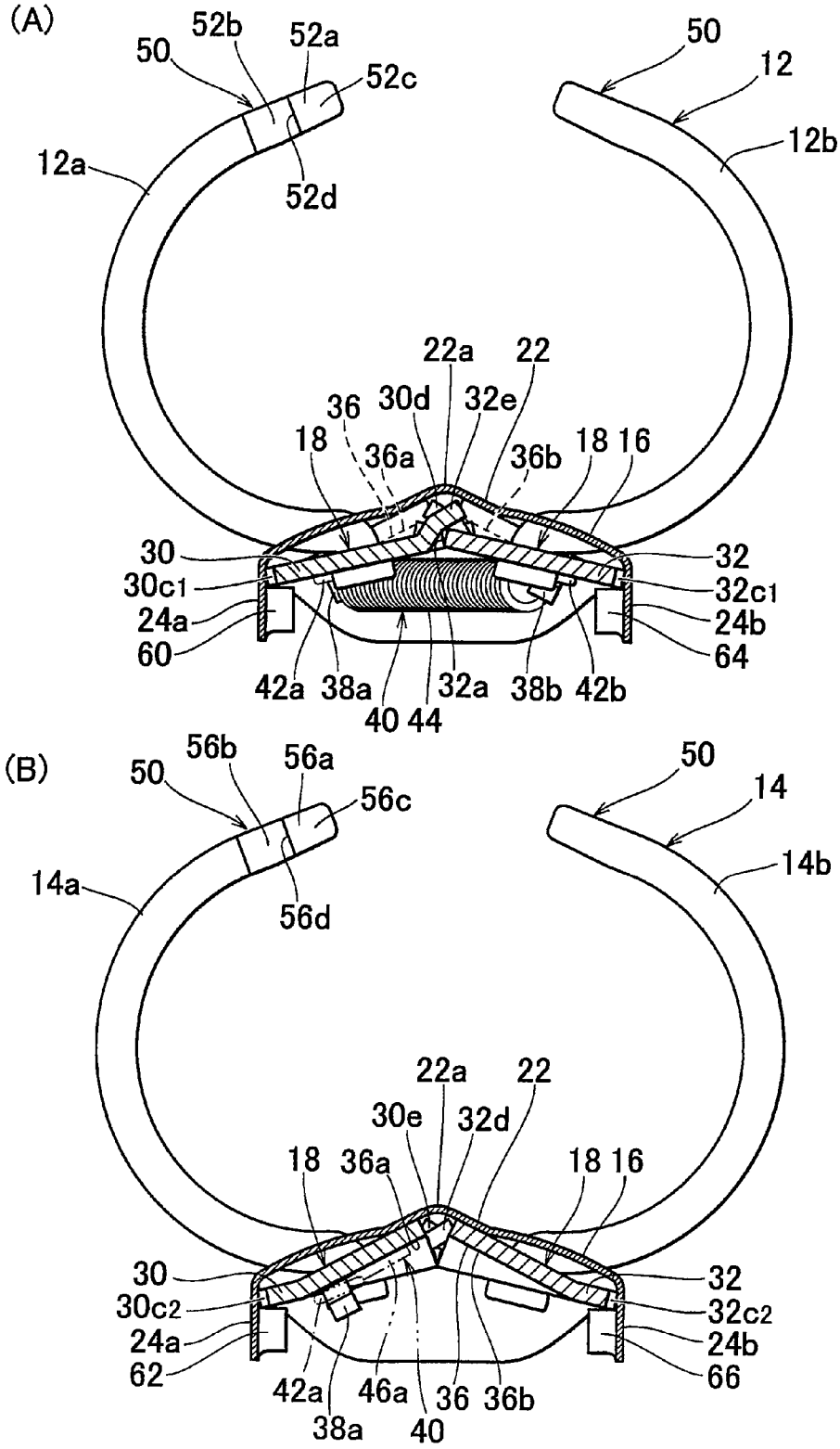
FIGS. 15(A) and 15(B) are cross-sectional views showing the binding devices in an opened state, where
Figure 16:
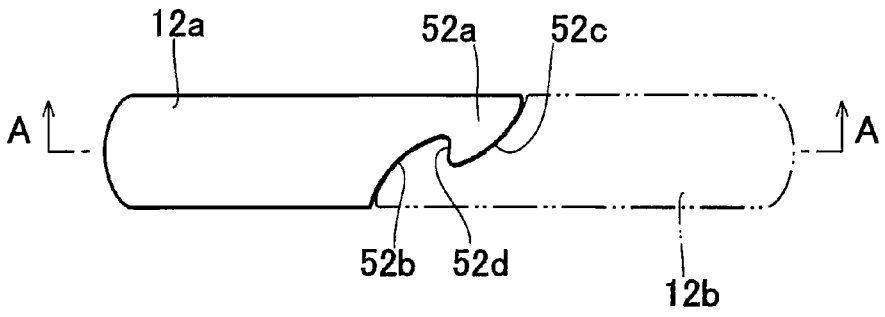
FIGS. 16(A), 16(B), and 16(C) are schematic views showing latching portions of the binding rings, where
Figure 16:
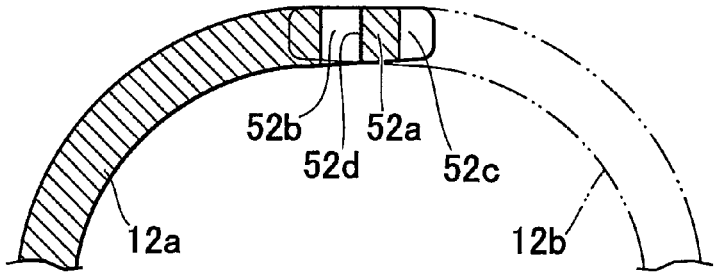
Figure 16:
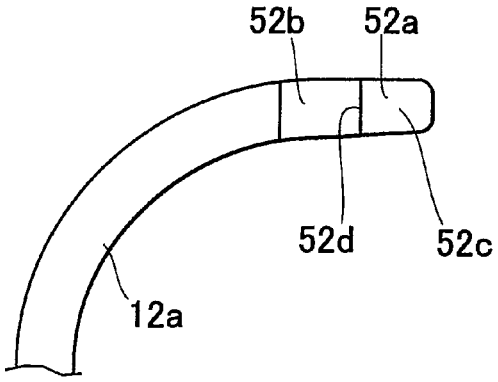
Figure 17:
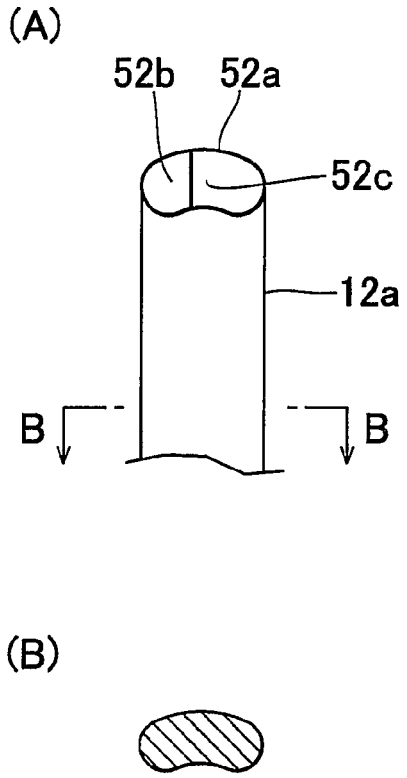
FIGS. 17(A) and 17(B) are schematic views of the latching portion of the binding ring, where
Figure 18:
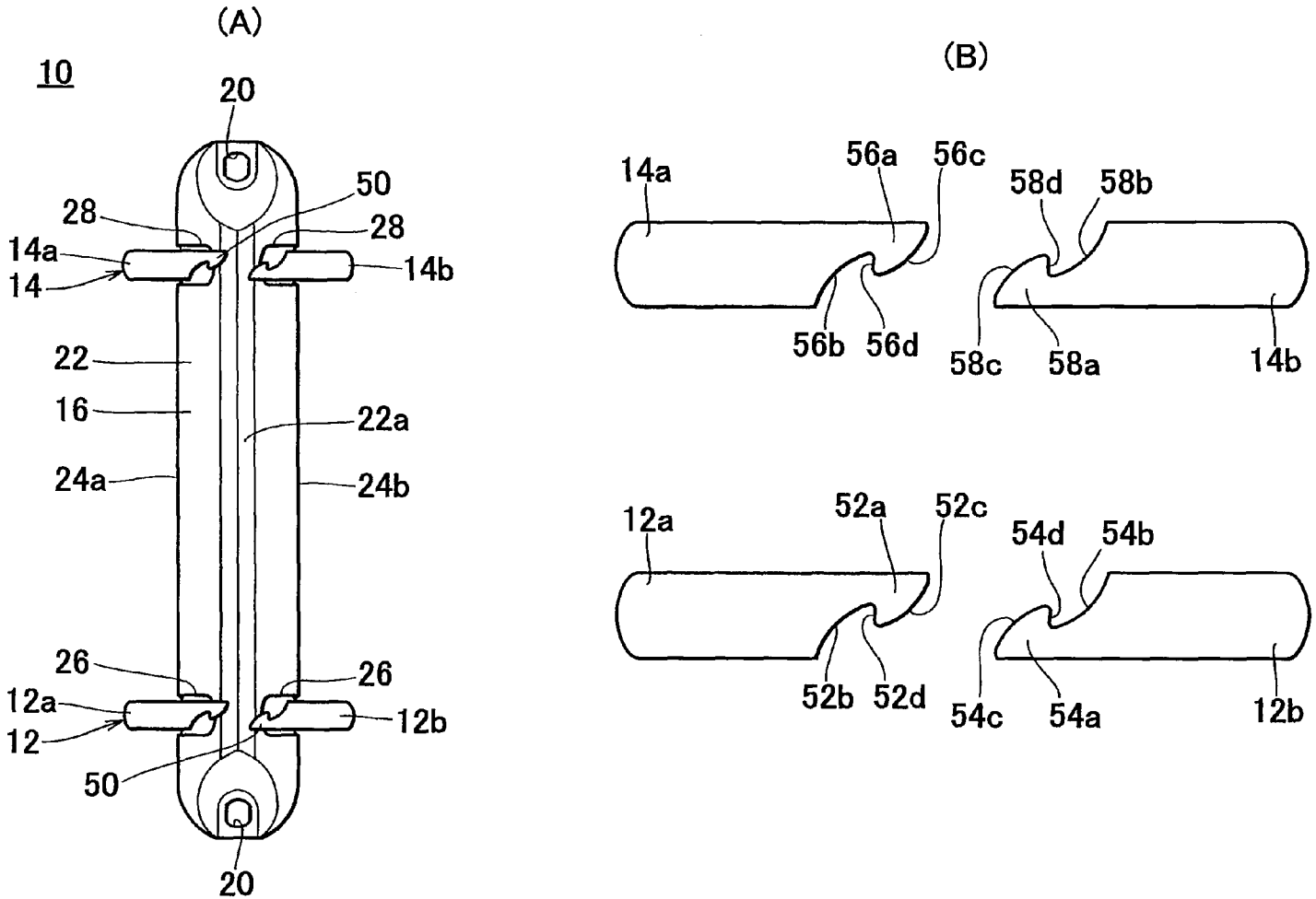
FIGS. 18(A) and 18(B) are schematic views showing a state in which the binding rings are closed, where

As shown in FIG. 10, when the first binding ring 12 and the second binding ring 14 are closed, the first operating piece 30 and the second operating piece 32 constituting the operating member 18 are held in a state (i.e., a downward folded state) in which the abutting edges 30*a* and 32*a* of the first operating piece 30 and the second operating piece 32 abut against each other with the abutting edges 30*a* and 32*a* directed in a direction away from the inner surface of the holding member 16 (the inner surface of the bound object-mounting portion 22). In addition, as shown in FIG. 15, when the first binding ring 12 and the second binding ring 14 are opened, the first operating piece 30 and the second operating piece 32 constituting the operating member 18 are secured in the space inside the holding member 16 so as to be held in a state (i.e., in an upward folded state) in which the abutting edge 32*a* of the second operating piece 32 abuts on the inner surface of the holding member 16 (the inner surface of the bound object-mounting portion 22) with the abutting edges 30*a* and 32*a* directed in a direction approaching the inner surface.

The first operating piece 30 and the second operating piece 32 constituting the operating member 18 are secured in the space inside the holding member 16 so as to operate as described above.

Furthermore, the first operating piece 30 and the second operating piece 32 constituting the operating member 18 are slidably disposed such that, when the operating pieces 30 and 32 are directed in a direction approaching the inner surface of the bound object-mounting portion 22 of the holding member 16, i.e., are in an upward folded state, the first operating piece 30 and the second operating piece 32 can be movable in the longitudinal direction of the first operating piece 30 and the second operating piece 32, i.e., a direction parallel to the line (X1 in FIG. 7) connecting the first half ring 12*a* and the third half ring 14*a* secured to the first operating piece 30 and parallel to the line (X2 in FIG. 7) connecting the second half ring 12*b* and the fourth half ring 14*b* secured to the second operating piece 32.

Each of the first operating piece 30 and the second operating piece 32 is formed with a movement restricting portion, which is provided in the vicinities outside gap portion of opening/closing member housing portion 36. The movement restricting portion is provided for restricting the movement of the first operating piece 30 and the second operating piece 32 in the longitudinal direction.

The movement restricting portion is formed of a restricting recess 30*f*, a restricting projection 30*g*, a restricting recess 32*f*, and a restricting projection 32*g*, the restricting recess 30*f* and the restricting projection 30*g* being formed in the abutting edge 30*a* of the first operating piece 30, the restricting recess 32*f* and the restricting projection 32*g* being formed in the abutting edge 32*a* of the second operating piece 32.

The restricting recess 30*f* is a notch which is provided in the vicinity outside the recess 36*a* and has a square U shape in a plan view recessed from the abutting edge 30*a* in the width direction. The restricting projection 32*g* is a projection which has a square U shape in a plan view and is formed so as to loosely fit into the restricting recess 30*f*.

The restricting projection 32*g* and the restricting recess 30*f* are formed such that the restricting projection 32*g* fits loosely into the restricting recess 30*f* to allow the first operating piece 30 and the second operating piece 32 to move in opposite longitudinal directions inside the restricting recess 30*f*.

The restricting recess 32*f* is a notch which is provided in the vicinity outside the recess 36*b* and has a square U shape in a plan view recessed from the abutting edge 32*a* in the width direction. The restricting projection 30*g* is a projection which has a square U shape in a plan view and is formed so as to loosely fit into the restricting recess 32*f*.

The restricting projection 30*g* and the restricting recess 32*f* are formed such that the restricting projection 30*g* fits loosely into the restricting recess 32*f* to allow the first operating piece 30 and the second operating piece 32 to move in opposite longitudinal directions inside the restricting recess 32*f*.

An opening/closing member 40 for shifting the first binding ring 12 and the second binding ring 14 in the opening/closing direction is provided on the side of the abutting edge 30*a* in the recess 36*a* of the first operating piece 30 and on the side of the abutting edge 32*a* in the recess 36*b* of the second operating piece 32.

The opening/closing member 40 is extended in a direction obliquely intersecting the direction connecting the base portions of the binding rings secured to the first operating piece 30 to be disposed with a spacing, i.e., the first half ring 12*a* and the third half ring 14*a*, and in a direction obliquely intersecting the direction connecting the base portions of the binding rings secured to the operating piece 32 to be disposed with a spacing, i.e., the second half ring 12*b* and the fourth half ring 14*b* such that a pair of the operating piece 30 and the operating piece 32 are moved in opposite directions and the opening/closing conditions of the binding rings, i.e., the first binding ring 12 and the second binding ring 14 are maintained, between the pair of the operating piece 30 and the operating piece 32 constituting the operating member 18.

The opening/closing member 40 is made of an extension coil spring and includes a coil portion 44 and the securing end portion 42*a* and the securing end portion 42*b* which was made as a hook by winding the coil portion 44 from the both ends of the coil portion 44.

A restricting arm portion 46*a* and a restricting arm portion 46*b* protrude in the circumferential direction of the coil portion 44 so as to be parallel to each other, as shown in FIG. 6(A).

In the opening/closing member 40, the securing end portion 42*a* which receives load is secured to the first operating piece 30 and the securing end portion 42*b* is secured to the second operating piece 32, in a state in which the first binding ring 12 and the second binding ring 14 are closed, and in a state in which the coil portion 44 which was adhering at no load is so strained as to extend, i.e., in a state in which the coil portion 44 receives tensile load.

In addition, in a state in which the first binding ring 12 and the second binding ring 14 are closed, to a direction in which the first operating piece 30 and the second operating piece 32 are rotationally moved with the abutting edges 30*a* and 32*a* as a center toward the direction from an opened state to a closed state, the twisting moment is received around a central axis of the coil portion 44 (coil), a spring is loaded, and bending stress is generated on a strand. Then, the securing end portion 42*a* is secured to the first operating piece 30, and the securing end portion 42*b* is secured to the second operating piece 32.

Figure 6:
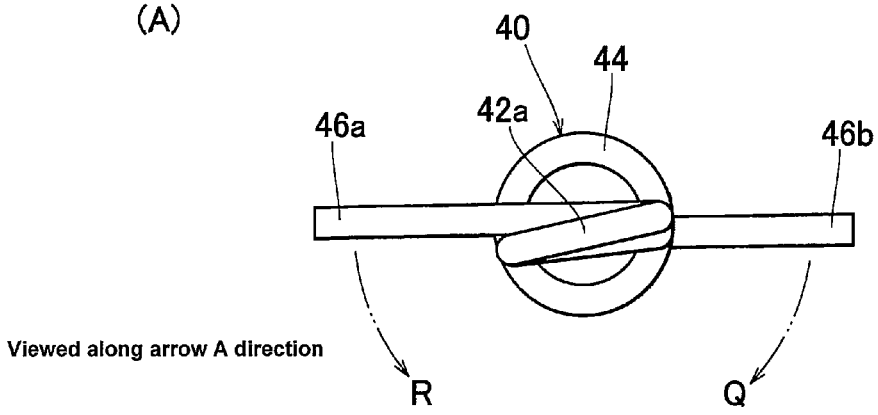
FIGS. 6(A), 6(B), and 6(C) are schematic side views of the opening/closing members, where
Figure 6:
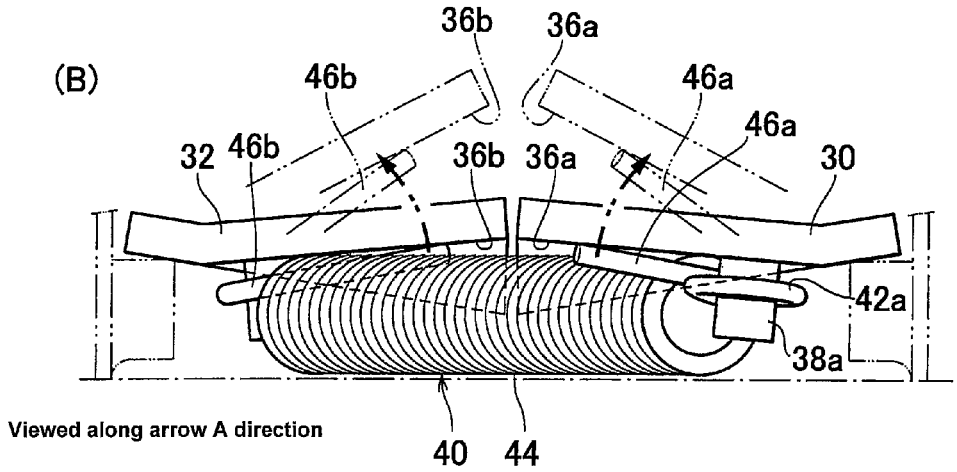
Figure 6:
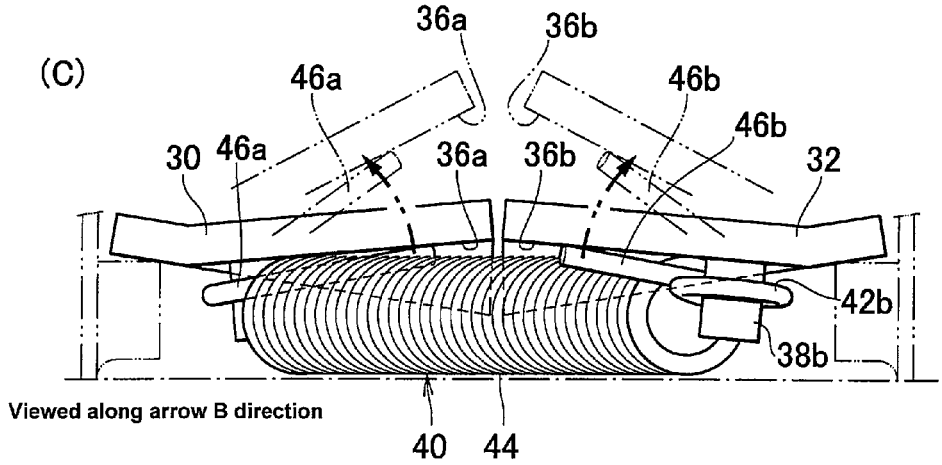

In this case, in the opening/closing member 40, in view of a state in which no load such as the twisting moment is placed on the coil portion 44 (shown in FIG. 6 (A)), the securing end portions 42*a* and 42*b* are secured to the opening/closing member fixing portions 38*a* and 38*b*, respectively, in a state in which the coil portion 44 is twisted for one turn or more so as to increase the number of turns of coils of the coil portion 44 for one turn or more (the R direction for the securing end portion 42*a* and the restricting arm portion 46*a*, and the Q direction for the securing end portion 42*b* and the restricting arm portion 46*b* (shown in FIG. 5 and FIG. 6 (A))

It is configured that the load direction for loading a spring is the direction in which the coil portion 44 (coil) is coiled.

The restricting arm portions 46*a* and 46*b* extend from a side on which the securing end portions 42*a* and 42*b* are fixed to the first operating piece 30 and the second operating piece 32 to a direction orthogonal to the central axis of the coil portion 44. One restricting arm portion 46*a* and the other restricting arm portion 46*b* protrude in the circumferential direction of the coil portion 44 so as to be parallel to each other, and extend in the opposite direction to each other, in an original state in which no twisting moment is generated, as shown in FIGS. 5 and 6(A).

One restricting arm portion 46*a* abuts at its tip end the reverse side of the first operating piece 30 when the securing end portion 42*a* is secured to the opening/closing member fixing portion 38*a* of the first operating piece 30. The other restricting arm portion 46*b* abuts at its tip end the reverse side (the underside) of the second operating piece 32 when the securing end portion 42*b* is secured to the opening/closing member fixing portion 38*b* of the second operating piece 32. The securing end portions 42*a* and 42*b* of round hook are configured to be secured to the opening/closing member fixing portions 38*a* and 38*b* in a normal state on all occasions, without heavily tilting.

In an original state in which no twisting moment is generated, one restricting arm portion 46*a* and the other restricting arm portion 46*b* are formed so as to be parallel to each other.

One end of the securing end portion 42*a* of the opening/closing member 40 is latched and secured to the opening/closing member fixing portion 38*a* formed on the reverse side (underside) of the one operating piece, i.e., the first operating piece 30. One end of the securing end portion 42*b* of the opening/closing member 40 is latched and secured to the opening/closing member fixing portion 38*b* formed on the reverse side (underside) of the other operating piece, i.e., the second operating piece 32. The opening/closing member fixing portion 38*a* is located on the reverse side (under side) of the recess 36*a* of the opening/closing member housing portion 36, and is formed at the location deviated from the center C in a longitudinal direction of the first operating piece 30 (shown in FIGS. 7 and 9) toward a direction in which the first operating piece 30 moves when the first binding ring 12 and the second binding ring 14 are opened. The opening/closing member fixing portion 38*b* is located on the reverse side (under side) of the recess 36*b* of the opening/closing member housing portion 36, and is formed at the location deviated from the center C in a longitudinal direction of the second operating piece 32 (shown in FIGS. 7 and 9) toward a direction in which the second operating piece 32 moves when the first binding ring 12 and the second binding ring 14 are opened.

The opening/closing member fixing portion 38*a* is of an L shape in a side view, having the latching base portion 38*a*1 continuing to the reverse side of the first operating piece 30 and the latching and locking portion 38*a*2 provided at the tip end (lower end) of the latching base portion 38*a*1 in such a manner as to extend to the opposite side of the opening/closing member 40.

The opening/closing member fixing portion 38*b* is of an L shape in a side view, having the latching base portion 38*b*1 continuing to the reverse side of the second operating piece 32 and the latching and locking portion 38*b*2 provided at the tip end (lower end) of the latching base portion 38*b*1 in such a manner as to extend to the opposite side of the opening/closing member 40.

The opening/closing member fixing portions 38*a* and 38*b* are formed so as to be point-symmetric, defining the center C in the longitudinal direction of the first operating piece 30 and the second operating piece 32 as a center.

The opening/closing member 40 is diagonally provided to bridge between the first operating piece 30 and the second operating piece 32 so as to be extended when the abutting edge 30*a* of the first operating piece 30 and the abutting edge 32*a* of the second operating piece 32 are in a downward folded state (shown in FIG. 10), i.e., so as to separate away from the inner surface of the bound object-mounting portion 22 of the holding member 16. The opening/closing member 40 is configured such that a force to restore the opening/closing member 40 to the original state acts in such an extended state.

The opening/closing member 40 is extended in a direction obliquely intersecting the longitudinal direction of the first operating piece 30 and the second operating piece 32, respectively. In other words, the securing end portions 42*a* and 42*b* are extended in a direction obliquely intersecting the line (longitudinal axe X1 shown in FIG. 7) connecting the portion for securing the half ring 12*a* and the portion for securing the half ring 14*a* on the first operating piece 30 and in a direction obliquely intersecting the line (longitudinal axe $X_2$ shown in FIG. 7) connecting the portion for securing the half ring 12*b* and the portion for securing the half ring 14*b* on the second operating piece 32, respectively.

The opening/closing member fixing portion 38*a* of the first operating piece 30 and the opening/closing member fixing portion 38*b* of the second operating piece 32 are formed so as to be point-symmetric, defining the center C (shown in FIGS. 7 and 9) in the longitudinal direction of the abutting edges 30*a* and 32*a* as a rotation axis. In the opening/closing member 40, the securing end portion 42*a* is latched at the opening/closing member fixing portion 38*a*, and the securing end portion 42*b* is latched at the opening/closing member fixing portion 38*b* by the uniform length from the center C (shown in FIGS. 7 and 9) in the longitudinal direction of the abutting edges 30*a* and 32*a*. It is configured that the uniform force is applied to the first operating piece 30 and the second operating piece 32.

The opening/closing member 40 keeps the distance between the first operating piece 30 and the second operating piece 32 constant, the first operating piece 30 and the second operating piece 32 abutting against each other along the abutting edge 30*a* of the first operating piece 30 and the abutting edge 32*a* of the second operating piece 32. In addition, the opening/closing member 40 brings the first operating piece 30 and the second operating piece 32 close to each other to maintain an optimal state of the positional relationship between the first operating piece 30 and the second operating piece 32.

Therefore, when the first binding ring 12 and the second binding ring 14 constituting the binding rings are opened or closed, the first operating piece 30 and the second operating piece 32 oscillate about the abutting edges 30*a* and 32*a* each serving as a pivot.

In this case, even when the sum of the width of the first operating piece 30 and the width of the second operating piece 32 reaches maximum, i.e., even when the first operating piece 30 and the second operating piece 32 are in a plane state (a neutral state), an appropriate gap is generated between the outermost edge (outer edge 30*b*) of the first operating piece 30 and the first holding wall 24*a* of the holding member 16 and between the outermost edge (outer edge 32*b*) of the second operating piece 32 and the second holding wall 24*b* of the holding member 16. In addition, the first operating piece 30 and the second operating piece 32 of the operating member 18 can be smoothly moved in the holding space of the holding member 16.

Furthermore, by moving the pair of the first operating piece 30 and the second operating piece 32 oppositely in the longitudinal direction of the holding member 16, each of the first binding ring 12 and the second binding ring 14 composed by combining the corresponding half rings is separated.

When each of the first binding ring 12 and the second binding ring 14 is separated, the opening/closing member 40 biases the first operating piece 30 and the second operating piece 32 to thereby release the first half ring 12*a* and the second half ring 12*b* from each other and the third half ring 14*a* and the fourth half ring 14*b* from each other.

When the first binding ring 12 and the second binding ring 14 start to be opened with a hand, i.e., when the binding ring latching portions 50 of each of the first binding ring 12 and the second binding ring 14 are disengaged, the elasticity of the opening/closing member 40 acts in the direction in which the extended coil portion 44 of the opening/closing member 40 further extends, and the elasticity of the opening/closing member 40 causes the first operating piece 30 and the second operating piece 32 constituting the operating member 18 to move in directions which cause the first half ring 12*a* and the second half ring 12*b* of the first binding ring 12 to be separated from each other (the first half ring 12*a* to move in the O1 direction and the second half ring 12*b* to move in the O2 direction (shown in FIG. 7)) and which cause the third half ring 14*a* and the fourth half ring 14*b* of the second binding ring 14 to be separated from each other (the third half ring 14*a* to move in the O1 direction and the fourth half ring 14*b* to move in the O2 direction (shown in FIG. 7)). The elasticity of the opening/closing member 40 acts in such a manner as to cause the first operating piece 30 and the second operating piece 32 constituting the operating member 18 to move the first operating piece 30 and the second operating piece 32 in mutually opposite directions (see FIG. 7) (the O1 direction for the first operating piece 30 and the O2 direction for the second operating piece 32) (see FIG. 11).

Figure 7:
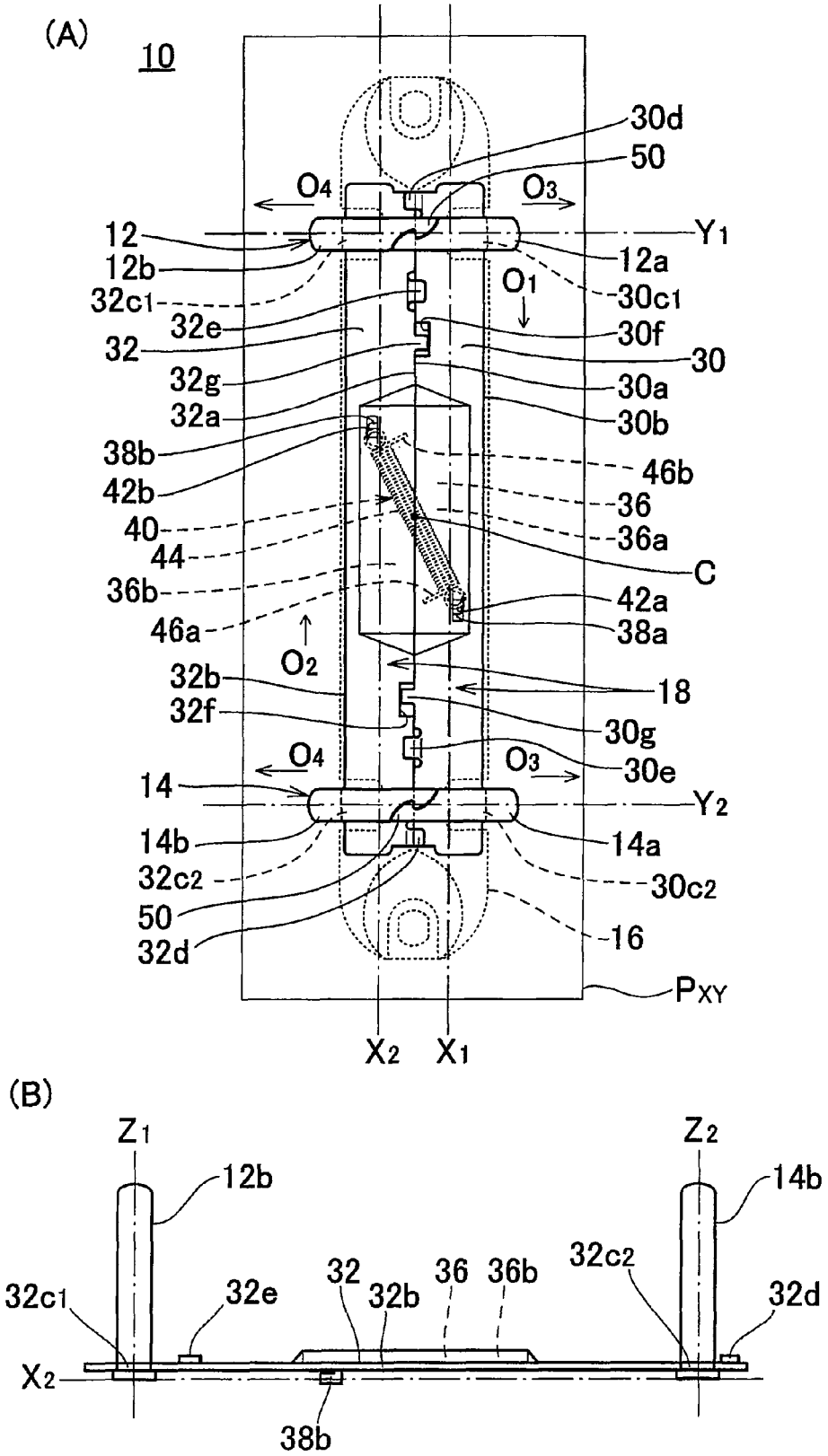
FIGS. 7(A) and 7(B) are schematic views of binding rings and the operating members, where

Furthermore, the opening/closing member 40 acts so as to separate the first half rings 12*a* and the second half rings 12*b* away from each other and the third half rings 14*a* and the fourth half rings 14*b* away from each other in a circumferential direction (in the directions of the horizontal axes Y1 and Y2 in FIG. 7).

Figure 14:
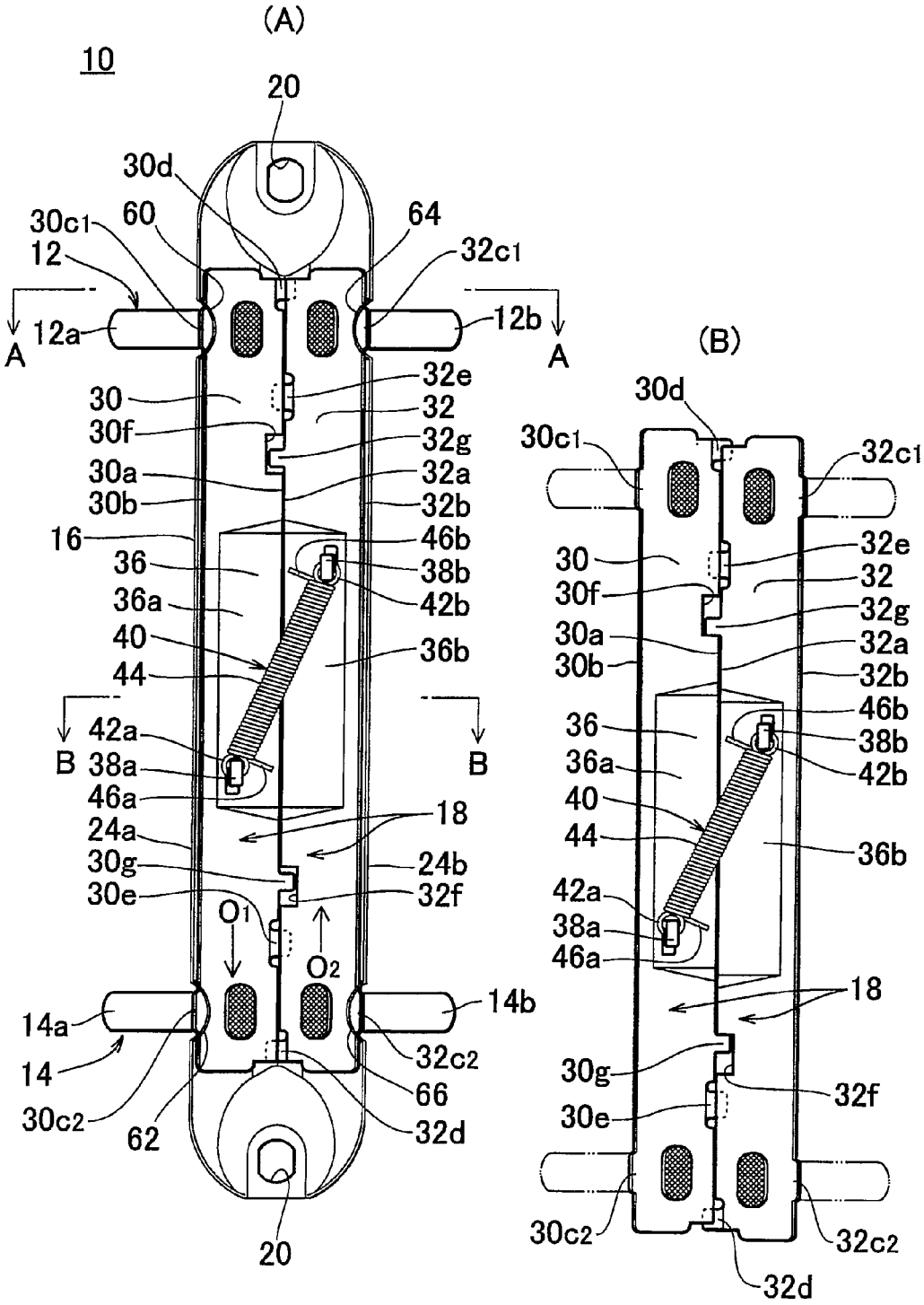
FIGS. 14(A) and 14(B) are schematic bottom views showing the binding devices in an opening state, where

The twisted opening/closing member 40 attempts to return to the original state as shown in arrow directions of FIGS. 6 (B) and (C) and thus acts to separate the first half ring 12*a* and the second half ring 12*b* and the third half ring 14*a* and the fourth half ring 14*b* in the circumferential direction of the first binding ring 12 and the second binding ring 14 (an O3 direction for first half ring 12*a* and the third half ring 14*a* and an O4 direction (shown in FIG. 7) for the second half ring 12*b* and the fourth half ring 14*b* (see FIG. 14 (A)).

Then, the opening/closing member 40 operates to the direction in which the coil portion 44 extending due to the elasticity of the opening/closing member 40 is shrinking, the first operating piece 30 constituting the operating member 18 moves in a direction toward a position for closing the binding ring latching portions 50 (the direction opposite to O1, shown in FIG. 7) and the second operating piece 32 moves in a direction toward a position for closing the binding ring latching portions 50 (the direction opposite to O2, shown in FIG. 7) (see FIGS. 14(B) and 15).

In other words, the first operating piece 30 and the second operating piece 32 gradually change from the downward folded state to a planar state (neutral state) and from the planar state (neutral state) to the upward folded state.

The first binding ring 12 and the second binding ring 14 are opened by rotating to the opening direction (the O3 direction for the first half ring 12*a* and the third half ring 14*a*, and the O4 direction for the second half ring 12*b* and the fourth half ring 14*b*).

When the first binding ring 12 and the second binding ring 14 are opened, the opening/closing member 40 acts so as to keep the abutting edge 30*a* of the first operating piece 30 and the abutting edge 32*a* of the second operating piece 32 in an upward folded state, i.e., in a state where they are close to the inner surface of the bound object-mounting portion 22 of the holding member 16.

The bound object-mounting portion 22 of the holding member 16 is formed with a bulging portion 22*a* which extends in the longitudinal direction of the bound object-mounting portion 22.

The bulging portion 22*a* is formed to extend in the longitudinal direction of the bound object-mounting portion 22 so as to prevent the engaging portions 30*d*, 30*e*, 32*d*, and 32*e* and the opening/closing member 40 from abutting against the inner surface of the bound object-mounting portion 22 when the engaging portions 30*d* and 32*e* and the engaging portions 30*e* and 32*d* of the operating member 18 rotate upwardly and the opening/closing member 40 moves upwardly.

Then, the holding member 16 includes the holding wall 24 and the bound object-mounting portion 22 which extend in the direction close to the direction connecting the base portions of the first binding ring 12 and the second binding ring 14 disposed in the operating member 18 with a spacing.

The holding portion for holding the operating member 18 within the holding member 16 is formed with the holding wall 24 and the bound object-mounting portion 22 of the holding member 16. The operating member 16 and the opening/closing member 40, when the first binding ring 12 and the second binding ring 14 are opened or closed, are configured to move within the holding portion (space).

As described above, the holding member 16 includes the holding wall 24 composed of the first holding wall 24*a* and the second holding wall 24*b* which extend to the direction close to the direction connecting the base portions (shown in the X1 direction and the X2 direction of FIG. 7) of the first binding ring 12 and the second binding ring 14 to be disposed with a spacing in the operating member 18.

The holding wall 24 extends to the direction intersecting the direction connecting the base portions (shown in the X1 direction and the X2 direction of FIG. 7) of the first binding ring 12 and the second binding ring 14 to be disposed with a spacing in the operating member 18. The holding wall 24 includes the holding wall which holds the protruding portions 30*c*1 and 30*c*2 of the first operating piece 30 and the protruding portions 32*c*1 and 32*c*2 of the second operating piece 32 protruding facing the outside of the holding wall 24, i.e., the first holding portions 60 and 62 formed in the first holding wall 24*a* and the second holding portions 64 and 66 formed in the second holding wall 24*b*.

The first holding portions 60 and 62 are recessed toward the inside of the holding wall 24 (the first holding wall 24*a*) so that the first holding portions 60 and 62 in which the part of the holding wall 24 is projected outwardly form the protruding portions 30*c*1 and 30*c*2 of the operating member 18 maintain the protruding portions 30*c*1 and 30*c*2 of the operating member 18 which is fitted into the inside of the holding member 16.

Furthermore, the second holding portions 64 and 66 are recessed toward the inside of the holding wall 24 (the second holding wall 24*b*) so that the second holding portions 64 and 66 in which the part of the holding wall 24 is projected outwardly form the protruding portions 32*c*1 and 32*c*2 of the operating member 18 maintain the protruding portions 32*c*1 and 32*c*2 of the operating member 18 which is fitted into the inside of the holding member 16.

The first holding portions 60 and 62 and the second holding portions 64 and 66 are formed with a thin cut 68*a*, cut 70*a*, cut 72*a*, and cut 74*a* to be disposed with a spacing between the lower edges of the holding wall 24 along the undersides of the first operating piece 30 and the second operating piece 32 of the operating member 18. In addition, the first holding portions 60 and 62 and the second holding portions 64 and 66 are formed by the area projected outwardly from the holding wall 24 between the cuts 68*a*, 70*a*, 72*a*, and 74*a* and the lower edges of the holding wall 24 (see FIGS. 22 (A) and (B)).

Then, the areas constituting the first holding portions 60 and 62 and the second holding portions 64 and 66 are projected toward the inside to maintain the lower edges of the protruding portions 30*c*1, 30*c*2, 32*c*1, and 32*c*2 of the operating member 18 which is fitted into the inside of the holding member 16, and are recessed toward the inside of areas other than areas between the cuts 68*a*, 70*a*, 72*a*, and 74*a* of the holding wall 24 and the lower edges of the holding wall 24. Accordingly, the first holding portions 60 and 62 and the second holding portions 64 and 66 are formed (see FIGS. 23(A)(B)).

The first binding ring 12 is composed of the semicircular arc-shaped first half ring 12*a* and the second half ring 12*b* so as to form an approximately annular shaped binding ring, whereas the second binding ring 14 is composed of the semicircular arc-shaped third half ring 14*a* and the fourth half ring 14*b* so as to form an approximately annular shaped binding ring.

The binding ring latching portions 50 are provided at the tips of the first and second half rings 12*a* and 12*b* and the tips of the third and fourth half rings 14*a* and 14*b*, i.e., at the top of the first binding ring 12 and the top of the second binding ring 14 such that the first, second, third, and fourth half rings 12*a*, 12*b*, 14*a* and 14*b* pass through binder holes perforated through an object S such as a paper in advance to bind the object S such as the paper.

The first binding ring 12 and the second binding ring 14 constituting the binding rings are formed by widening a metal-made wire rod having a circular cross-section in a direction for disengaging the binding ring latching portions 50 (the O1 and O2 directions of FIG. 7) and pressing the central portion of the wire rod to bend in a direction for closing the binding rings.

Then, the first binding ring 12 and the second binding ring 14 are formed into a shape having a substantially bean-shaped cross-section. In the substantially bean-shaped cross-section, the central portion thereof protrudes in a direction for opening the binding ring (the O3 direction in FIG. 7 for the first half ring 12*a* and the third half ring 14*a* and the O4 direction in FIG. 7 for the second half ring 12*b* and the fourth half ring 14*b*), and the both edges thereof are bent in a direction for closing the binding ring.

In other words, when the annular first binding ring 12 and second binding ring 14 are viewed from the opening/closing direction, a wavy surface is formed on the inner side of the first binding ring 12 and the second binding ring 14, and the outer side of the first binding ring 12 and the second binding ring 14 is formed into a semicircular arc shape.

Furthermore, as viewed from a direction for disengaging the binding rings, each of the first binding ring 12 and the second binding ring 14 has opposite outer edges formed into a semicircular arc shape.

Conventional binding rings having a circular cross-section do not resist deformation when the diameter is small. When the diameter is increased, the cross-sectional area increases to increase cost for the material therefor. Furthermore, since binding holes formed in the object such as the paper are usually circular holes, conventional binding rings having a substantially rectangular cross-section are not well suitable for the binding holes of the object such as the paper and are likely to damage the binding holes of the papers.

Meanwhile, when the first binding ring 12 and the second binding ring 14 constituting the binding rings are thin, the binding ring latching portions 50 may not be securely fitted with each other.

Hence, it is desirable to increase the width of the first binding ring 12 and the second binding ring 14. However, even in a case in which a wire rod having a small cross-sectional area is employed as a raw wire rod, it is desirable to ensure a required width for a binding ring by machining the raw metal-made wire rod.

Therefore, in the binding rings according to the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring latching portions 50, whereby the binding ring latching portions 50 can be completely engaged with each other.

In this embodiment, the first half ring 12*a* and the second half ring 12*b* constituting the first binding ring 12 and the third half ring 14*a* and the fourth half ring 14*b* constituting the second binding ring 14 have the same shape, i.e., the same curvature (radius of curvature).

The first half ring 12*a* and the second half ring 12*b* constituting the first binding ring 12 are annularly connected by engaging the binding ring latching portion 50 on a free end of the first half ring 12*a* with the binding ring latching portion 50 on a free end of the second half ring 12*b*.

Furthermore, the third half ring 14*a* and fourth half ring 14*b* constituting the second binding ring 14 are annularly connected by engaging the binding ring latching portion 50 on a free end of the third half ring 14*a* with the binding ring latching portion 50 on a free end of the fourth half ring 14*b*.

The first binding ring 12 and the second binding ring 14 are provided so as to extend upward from the first operating piece 30 and the second operating piece 32, respectively, thereby forming a plane perpendicular to the plane Pxy including the horizontal axes Y1 and Y2 and the longitudinal axes X1 and X2 (shown in FIG. 7) passing through the positions (four positions) where the bases of the first binding ring 12 and the second binding ring 14 are secured to the first operating piece 30 and the second operating piece 32.

Then, a circular plane defined by an axis Z1 (shown in FIG. 7) of the first binding ring 12 and a circular plane defined by an axis Z2 (shown in FIG. 7) of the second binding ring 14 are parallel to each other such that the first binding ring 12 and the second binding ring 14 are perpendicular to the plane Pxy passing through the locations where the first binding ring 12 and the second binding ring 14 are secured to the first operating piece 30 and the second operating piece 32.

As shown in FIGS. 16 to 21, the binding rings are composed of the first binding ring 12 serving as the main binding ring which is closed directly with fingers and the second binding ring 14 serving as the subsidiary binding ring which follows the motion of the first binding ring 12 in a closing direction.

Furthermore, the first binding ring 12 and the second binding ring 14 are configured such that the binding ring latching portions 50 thereof can be disengaged with fingers in the same direction (the O1 and O2 directions in FIG. 11).

The binding ring latching portion 50 is formed at the end of the first half ring 12*a* and at the end of the second half ring 12*b* constituting the first binding ring 12. The binding ring latching portion 50 is composed of a projection 52*a* at the end portion of the binding ring latching portion 50 and a recess 52*b* following the projection 52*a*. Furthermore, the binding ring latching portion 50 of the second half ring 12*b* is composed of a projection 54*a* at the end of the binding ring latching portion 50 and a recess 54*b* following the projection 54*a*. The projections 52*a* and 54*a* and the recesses 52*b* and 54*b* are formed so as to be protruded or recessed in mutually opposite directions, so that they are engaged with each other when the first binding ring 12 is closed.

The projections 52*a* and 54*a* are formed with inclined opposing faces 52*c* and 54*c*, respectively, each having a convex curved surface extending from the end portion toward the inside and with the inclined opposing faces 52*d* and 54*d*, respectively, which are formed continuously with the inclined opposing faces 52*c* and 54*c*, respectively, and gradually extend from the rear end portion (the base side) of the projections 52*a* and 54*a*, respectively, to the tip end side (a closing direction). The vicinity of the rear end of each of the projections 52*a* and 54*a* has a hook-like shape, and each of the projections 52*a* and 54*a* as a whole is formed into a hooked nose-like shape.

The recess 52*b* includes an inclined opposing face having a concave curved surface extending from the base portion side toward the tip end portion. Similarly, the recess 54*b* includes an inclined opposing face having a concave curved surface extending from the base portion side toward the tip end portion.

Moreover, the binding ring latching portion 50 is formed at the end of the third half ring 14*a* and at the end of the fourth half ring 14*b* constituting the second binding ring 14. The binding ring latching portion 50 is composed of a projection 56*a* constituting the binding ring latching portion 50 and a recess 56*b* following the projection 56*a*. Furthermore, the binding ring latching portion 50 of the fourth half ring 14*b* is composed of a projection 58*a* at the end of the binding ring latching portion 50 and a recess 58*b* following the projection 58*a* at the end of the binding ring latching portion 50. The projections 56*a* and 58*a* and the recesses 56*b* and 58*b* are formed so as to be protruded or recessed in mutually opposite directions, so that they are engaged with each other when the second binding ring 14 is closed.

The projections 56*a* and 58*a* are formed with inclined opposing faces 56*c* and 58*c*, respectively, each having a convex curved surface extending from the end portion toward the inside and with inclined opposing faces 56*d* and 58*d*, respectively, which are formed continuously with the inclined opposing faces 56*c* and 58*c*, respectively, and gradually extend from the rear end portion (the base side) of the projections 56*a* and 58*a*, respectively, to the tip end portion (a closing direction). The vicinity of the rear end of each of the projections 56*a* and 58*a* has a hook-like shape, and each of the projections 56*a* and 58*a* as a whole is formed into a hooked nose-like shape.

The recess 56*b* includes an inclined opposing face having a concave curved surface extending from the base portion side toward the tip end portion. Similarly, the recess 58*b* includes an inclined opposing face having a concave curved surface extending from the base portion side toward the tip end portion.

The projection 52*a* constituting the binding ring latching portion 50 of the first half ring 12*a* and the projection 56*a* constituting the binding ring latching portion 50 of the third half ring 14*a* are formed so as to protrude in the same direction. Furthermore, these projections 52*a* and 56*a* include a convex curved surface formed to extend from the tip end to the base side and are formed into the same shape.

The recess 52*b* constituting the binding ring latching portion 50 of the first half ring 12*a* and the recess 56*b* constituting the binding ring latching portion 50 of the third half ring 14*a* are formed so as to be recessed in the same direction. Furthermore, these recesses 52*b* and 56*b* include a concave curved surface formed to extend from the rear end of the projections 54*a* and 56*a* to the base side and formed into the same shape.

The projection 54*a* constituting the binding ring latching portion 50 of the second half ring 12*b* and the projection 58*a* constituting the binding ring latching portion 50 of the fourth half ring 14*b* are formed so as to protrude in the same direction. Furthermore, these projections 54*a* and 58*a* include a convex curved surface formed to extend from the tip end to the base side and are formed into the same shape.

Furthermore, the recess 54*b* constituting the binding ring latching portion 50 of the second half ring 12*b* and the recess 58*b* constituting the binding ring latching portion 50 of the fourth half ring 14*b* are formed so as to be recessed in the same direction. Furthermore, these recesses 54*b* and 58*b* include a concave curved surface formed to extend from the rear end of the projections 54*a* and 58*a* to the base side and formed into the same shape.

The projection 52*a* and the recess 52*b* of the first half ring 12*a* and the projection 54*a* and the recess 54*b* of the second half ring 12*b* are formed so as to be point-symmetric, and the projection 56*a* and the recess 56*b* of the third half ring 14*a* and the projection 58*a* and the recess 58*b* of the fourth half ring 14*b* are formed so as to be point-symmetric.

The inclined opposing face 52*c* of the projection 52*a* of the first binding ring 12 and the inclined opposing face of the recess 54*b* are formed so as to obliquely intersect the direction of the axis of the first binding ring 12. When the first binding ring 12 is opened or closed, the inclined opposing face 52*c* and the inclined opposing face of the recess 54*b* come into contact with each other in an inscribed relation with one point shared thereby.

The inclined opposing face 52*c* of the projection 52*a* of the first binding ring 12 and the inclined opposing face 54*c* of the projection 54*a* are formed so as to obliquely intersect the direction of the axis of the first binding ring 12. When the first binding ring 12 is opened or closed, the inclined opposing faces 52*c* and 54*c* come into contact with each other in a circumscribed relation with one point shared thereby.

The inclined opposing face 56*c* of the projection 56*a* of the second binding ring 14 and the inclined opposing face of the recess 58*b* are formed so as to obliquely intersect the direction of the axis of the second binding ring 14. When the second binding ring 14 is opened or closed, the inclined opposing face 56*c* and the inclined opposing face of the recess 58*b* come into contact with each other in an inscribed relation with one point shared thereby.

The inclined opposing face 56*c* of the projection 56*a* of the second binding ring 14 and the inclined opposing face 58*c* of the projection 58*a* are formed so as to obliquely intersect the direction of the axis of the second binding ring 14. When the second binding ring 14 is opened or closed, the inclined opposing faces 56*c* and 58*c* come into contact with each other in a circumscribed relation with one point shared thereby.

Figure 19:
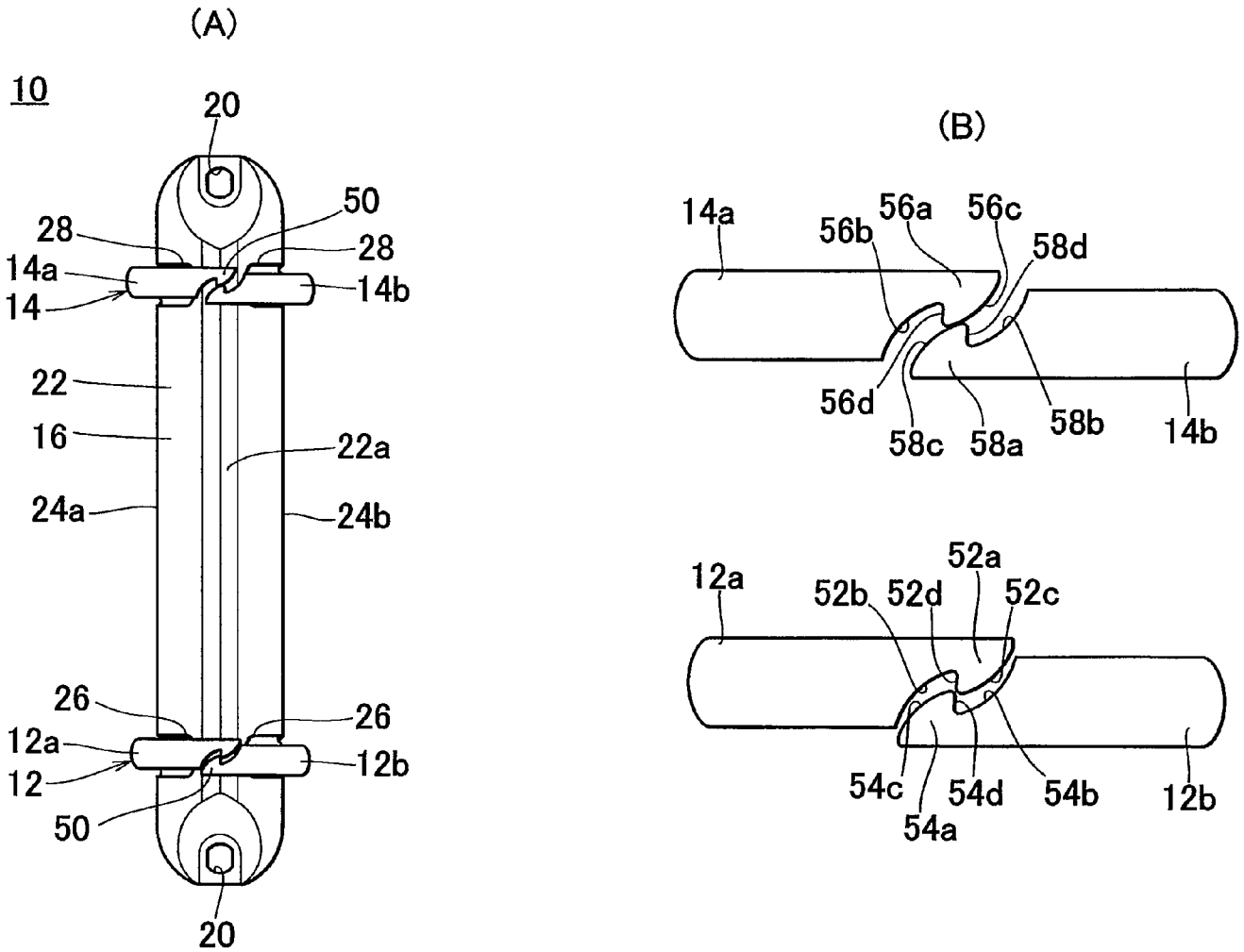
FIGS. 19(A) and 19(B) are schematic views showing a state in which the binding rings are closed, where
Figure 20:
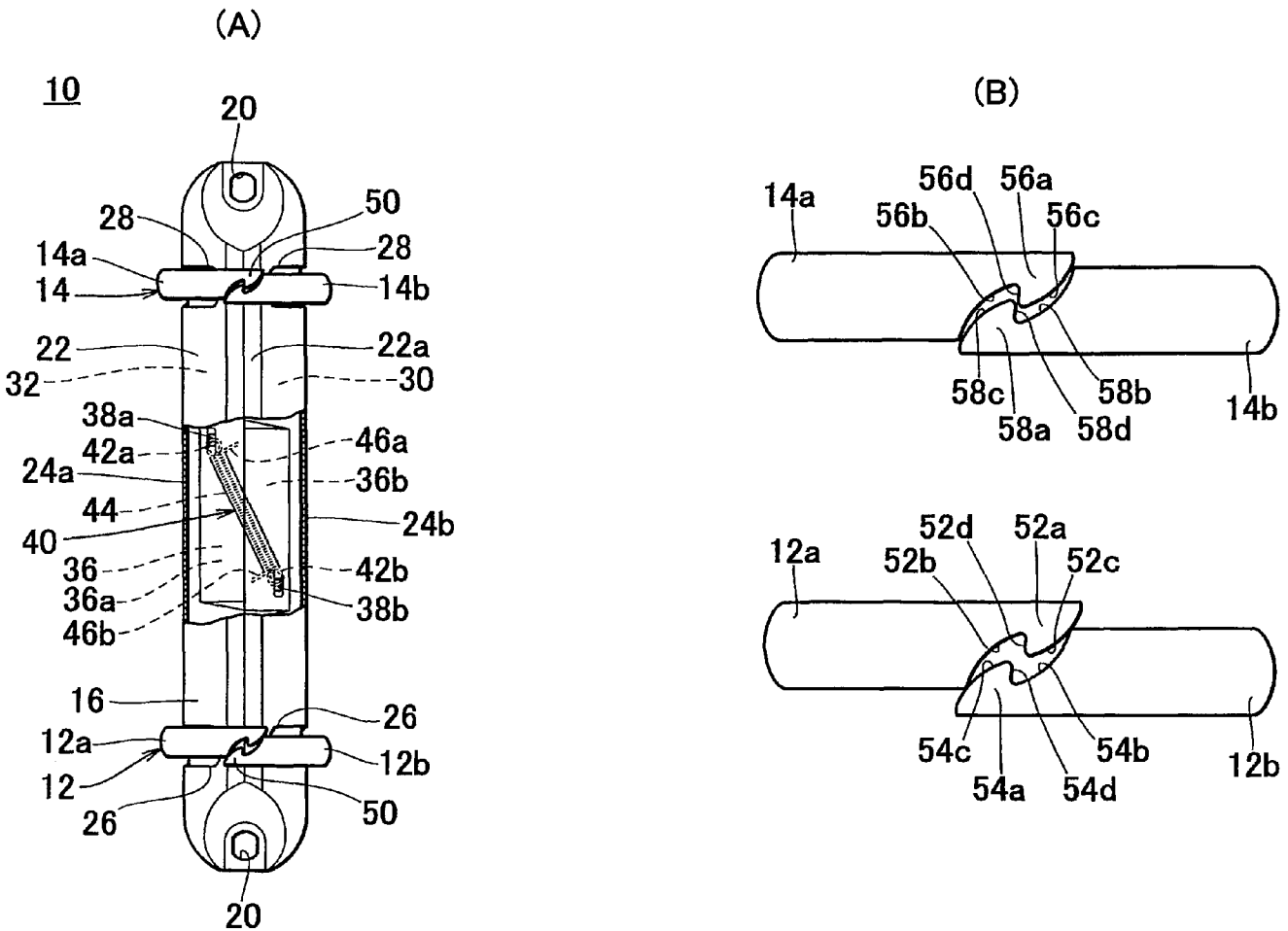
FIGS. 20(A) and 20(B) are schematic views showing a state in which the binding rings are closed, where
Figure 21:
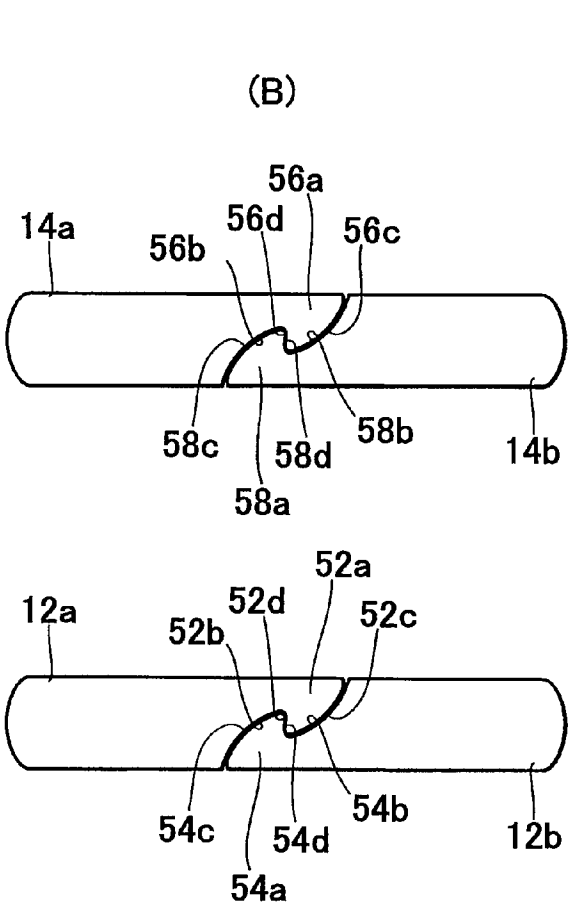
FIGS. 21(A) and 21(B) are schematic views showing a state in which the binding rings are closed, where
Figure 21:
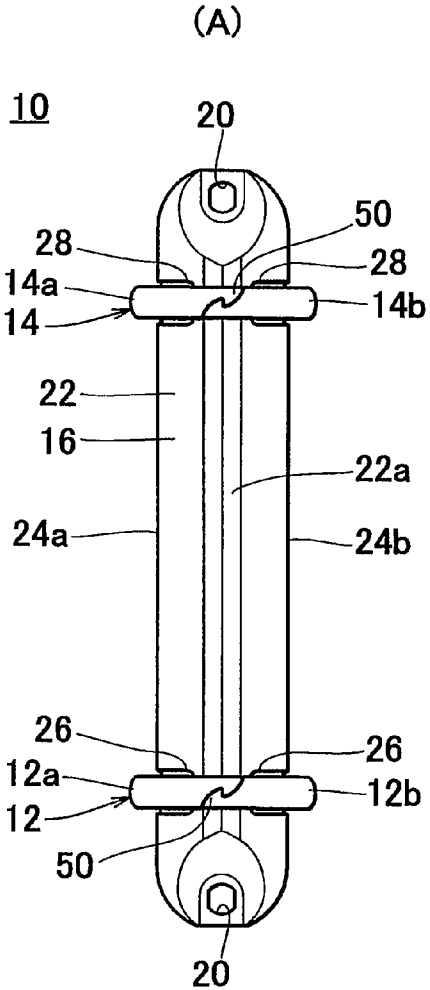

When the first binding ring 12 serving as the main binding ring is held with two fingers to start closing the binding rings 12 and 14, the projection 52*a* of the first half ring 12*a* of the first binding ring 12 and the projection 54*a* of the second half ring 12*b* of the first binding ring 12 abut against each other before the projection 56*a* of the third half ring 14*a* of the second binding ring 14 and the recess 58*b* of the fourth half ring 14*b* of the second binding ring 14 abut against each other (see FIG. 19). Furthermore, by operating the first binding ring 12 so as to be closed, the recess 52*b* of the first half ring 12*a* of the first binding ring 12 oscillates on the projection 54*a* of the second half ring 12*b*. Then, the projection 52*a* of the first half ring 12*a* of the first binding ring 12 moves past a normal engagement position where the projection 52*a* fits into the recess 54*b* of the second half ring 12*b*, and the projection 52*a* of the first half ring 12*a* slides upward on the inclined opposing face of the recess 54*b* of the second half ring 12*b* (see FIG. 20).

Hence, by operating the first binding ring 12 in the closing direction, the projection 56*a* of the third half ring 14*a* of the second binding ring 14 abuts against the projection 58*a* of the fourth half ring 14*b* of the second binding ring 14. Furthermore, by operating the first binding ring 12 so as to be closed, the projection 56*a* of the third half ring 14*a* of the second binding ring 14 oscillates on the inclined opposing face 58*c* of the projection 58*a* of the fourth half ring 14*b* (see FIG. 19). Furthermore, the projection 52*a* of the first half ring 12*a* of the first binding ring 12 slides upward on the inclined opposing face of the recess 54*b* of the second half ring 12*b*. Then, the projection 56*a* of the third half ring 14*a* of the second binding ring 14 (the projection 58*a* of the fourth half ring 14*b*) fits into the recess 58*b* of the fourth half ring 14*b* (the recess 56*b* of the third half ring 14*a*) (see FIG. 20).

Thereafter, the fingers are removed from the first binding ring 12 to release the closing force. Then, the action of the opening/closing member 40 causes the first binding ring 12 to return slightly in the opening direction. Thus, in the first binding ring 12 as in the second binding ring 14, the projection 52*a* of the first half ring 12*a* (the projection 54*a* of the second half ring 12*b*) fits into the recess 54*b* of the second half ring 12*b* (the recess 52*b* of the first half ring 12*a*) (see FIG. 21).

When the binding rings are closed, the upward folded state (see FIG. 15) of the first operating piece 30 and the second operating piece 32 is gradually changed to a planar state (neutral state) and from the planar state (neutral state) to the downward folded state (see FIG. 10). At this time, the first operating piece 30 and the second operating piece 32 in a regularly arranged state are temporarily moved in the respective directions for disengaging the binding ring latching portions 50 (the O1 direction for the first operating piece 30 and the O2 direction for the second operating piece 32) and thus are arranged in a staggered state (see FIG. 20). Subsequently, the first operating piece 30 and the second operating piece 32 are moved back and arranged regularly.

Hence, the restricting projection 30*g* of the first operating piece 30 constituting the movement restricting portion is moved inside the restricting recess 32*f* of the second operating piece 32 and abuts on an edge of the restricting recess 32*f*, the edge being on the side opposite to the direction for disengaging the binding ring latching portions 50. In addition, the restricting projection 32*g* of the second operating piece 32 constituting the movement restricting portion is moved inside the restricting recess 30*f* of the first operating piece 30 and abuts on an edge of the restricting recess 30*f*, the edge being on the side opposite to the direction for disengaging the binding ring latching portions 50 (see FIG. 11).

Therefore, when the binding rings are closed, the projection 52*a* of the first half ring 12*a* of the first binding ring 12 moves past the normal stop position where the projection 52*a* fits into the recess 54*b* of the second half ring 12*b*, and the projection 52*a* of the first half ring 12*a* slides upward on the inclined opposing face of the recess 54*b* of the second half ring 12*b*, thereby causing overrun. At this time, the overrun is stopped at an appropriate position by restricting the distance of movement of the first binding ring 12.

Thus, when the fingers are removed from the binding ring latching portions 50 of the first binding ring 12, the restoring force of the opening/closing member 40 causes the first operating piece 30 and the second operating piece 32 to move temporarily in the respective directions for disengaging the binding ring latching portions 50 (the O1 direction for the first operating piece 30 and the O2 direction for the second operating piece 32) and thus are arranged in a staggered state. Subsequently, the first operating piece 30 and the second operating piece 32 arranged in the staggered state are moved back and arranged regularly, and the binding ring latching portions 50 fit into each other (see FIGS. 9, 10, 19, 20, and 21).

Hence, when the first binding ring 12 serving as the main binding ring starts closing, the second binding ring 14, which serves as the subsidiary binding ring and is not closed directly with fingers, starts moving in the closing direction. Furthermore, when the first binding ring 12 is closed and moves past the normal engagement position, the engagement of the second binding ring 14 progresses, and the engagement of the second binding ring 14 is completed before the engagement of the first binding ring 12 is completed. Therefore, after the second binding ring 14, which serves as the subsidiary binding ring and is not closed directly with fingers, is securely engaged, the first binding ring 12 serving as the main binding ring is securely engaged.

Therefore, when the first binding ring 12 is held with fingers to move ahead in the closing direction, and when the first binding ring 12 is held so as to cause overrun, the second binding ring 14 can be securely engaged at the normal position and can be closed by operating only the first binding ring 12.

As described above, by operating the first binding ring 12 with fingers, the second binding ring 14 can also be closed, thereby improving the usability as one-touch binding devices.

When the binding ring latching portions 50 of the first binding ring 12 are disengaged by twisting the top portion of the first binding ring 12 with fingers, the restoring force of the twisted opening/closing member 40 is exerted on the first operating piece 30 and the second operating piece 32, and thus the first binding ring 12 is opened. Here, the restoring force of the opening/closing member 40 is a force for restoring the one securing end portion 42*a* and the other securing end portion 42*b* to the original state by rotating to the circumferential direction of the coil portion 44 as shown in the arrow directions of FIGS. 6 (B) and (C).

Then, the binding ring latching portions 50 of the first binding ring 12 and the second binding ring 14 are disengaged (see FIG. 11), and the downward folded state of the first operating piece 30 and the second operating piece 32 is gradually changed to a planar state (neutral state) and from the planar state (neutral state) to the upward folded state. At this time, the first operating piece 30 and the second operating piece 32 are moved in the respective directions for disengaging the binding ring latching portions 50 (the O1 direction for the first operating piece 30 and the O2 direction for the second operating piece 32) (see FIG. 14(A)).

Hence, the restricting projection 30*g* of the first operating piece 30 constituting the movement restricting portion is moved inside the restricting recess 32*f* of the second operating piece 32 and abuts on an edge of the restricting recess 32*f*, the edge being on the side opposite to the direction for disengaging the binding ring latching portions 50. In addition, the restricting projection 32*g* of the second operating piece 32 constituting the movement restricting portion is moved inside the restricting recess 30*f* of the first operating piece 30 and abuts on an edge of the restricting recess 30*f*, the edge being on the side opposite to the direction of the binding ring latching portion 2 (see FIG. 14 (B)).

When the hand is removed from the first binding ring 12, a force is exerted on the first operating piece 30 and the second operating piece 32, for restoring the one securing end portion 42*a* and the other securing end portion 42*b* of the opening/closing member 40 to the original state by rotating to the circumferential direction of the coil portion 44 as shown in the arrow directions of FIGS. 6 (B) and (C). Therefore, the first binding ring 12 and the second binding ring 14 are opened further (the first half ring 12*a* and the third half ring 14*a* are opened in the O3 direction, and the second half ring 12*b* and the fourth half ring 14*b* are opened in the O4 direction).

In addition, by shrinking the coil portion 44 of the opening/closing member 40, a force for arranging movement of the one securing end portion 42*a* and the other securing end portion 42*b* of the opening/closing member 40 opposite to each other in a plan view is exerted to cause the first operating piece 30 and the second operating piece 32 to move in directions opposite to each other (see FIG. 14 (A) (B)).

In other words, the operating member 18 and the opening/closing member 40 exert an action in the direction for opening the projection 56*a* of the third half ring 14*a* and the projection 58*a* of the fourth half ring 14*b* constituting the second binding ring 14, and an action in the direction for separating the projection 52*a* of the first half ring 12*a* of the first binding ring 12 from the projection 54*a* of the second half ring 12*b*. In addition, the operating member 18 and the opening/closing member 40 works such that the projection 56*a* of the third half ring 14*a* and the projection 58*a* of the fourth half ring 14*b* constituting the second binding ring 14 are separated from each other.

As described above, in this embodiment, by twisting the top portion of the first binding ring 12 or the second binding ring 14 with fingers, the binding ring latching portions 50 of the first half ring 12*a* and the second half ring 12*b* of the first binding ring 12 can be disengaged, and the binding ring latching portions 50 of the third half ring 14*a* and the fourth half ring 14*b* of the second binding ring 14 can also be disengaged.

When the engagement between the binding ring latching portions 50 of the first and second half rings 12*a* and 12*b* of the first binding ring 12 and the engagement between the binding ring latching portions 50 of the third and fourth half rings 14*a* and 14*b* of the second binding ring 14 are released, a force is exerted on the operating member 18 to urge the one securing end portion 42*a* and the other securing end portion 42*b* of the opening/closing member 40 to come close to each other in the circumferential direction of the coil portion 44. Therefore, the abutting edge 30*a* of the first operating piece 30 and the abutting edge 32*a* of the second operating piece 32 are brought into an upward folded state.

Figure 22:
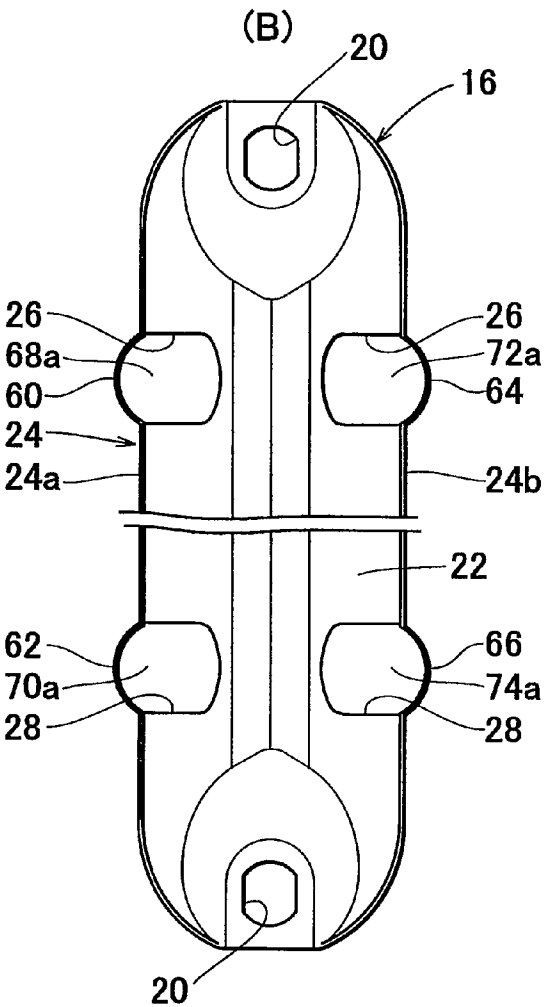
FIGS. 22(A) and 22(B) are schematic views showing method for forming the holding members, where 22(A) is a schematic side view of the holding member.
Figure 22:
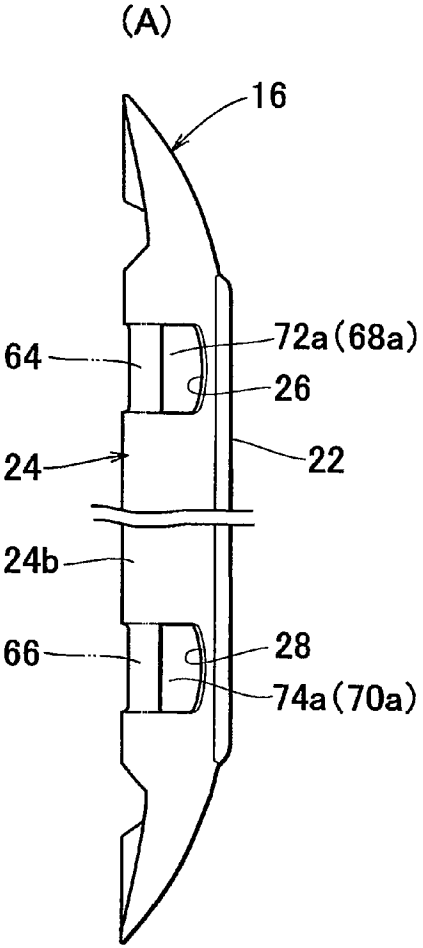
Figure 23:
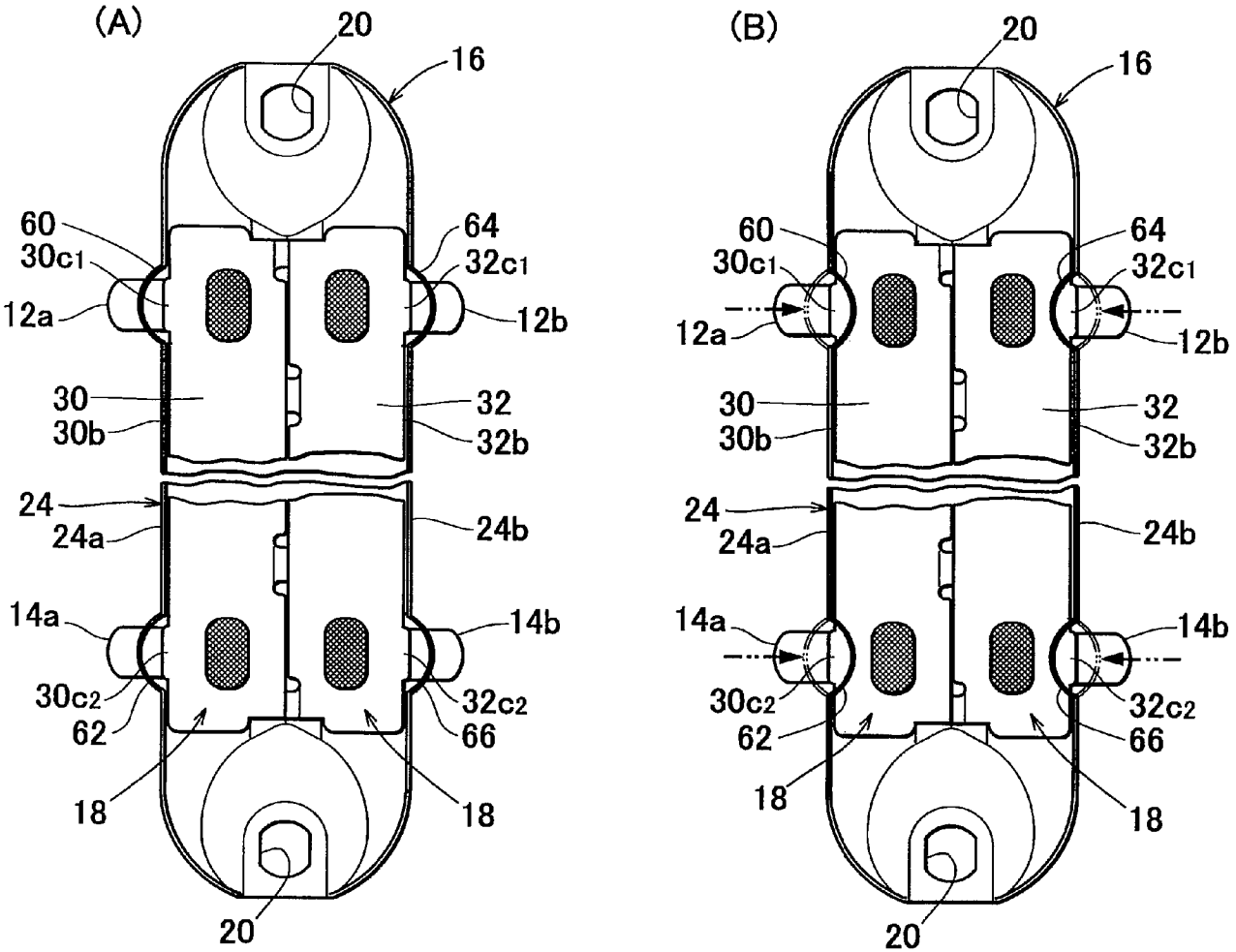
FIG. 23 is a schematic bottom view showing a method for forming the holding members.

Next, a method for mounting the operating member 18 in the holding space of the holding member 16 is described mainly with reference to FIGS. 22 and 23.

Before the holding member 16 mounts the first operating piece 30 and the second operating piece 32, the first holding portions 60 and 62 of the first holding wall 24*a* and the second holding portions 64 and 66 of the second holding wall 24*b* bulge toward the outside of the other area of the first holding wall 24*a* and the second holding wall 24*b* (see FIG. 22 (B)).

In other words, the first holding wall 24*a* is formed with the thin cuts 68*a* and 70*a* to be disposed with a spacing between the lower edges of the first holding wall 24*a* for forming the first holding portions 60 and 62 in the vicinity of the first through hole 26. The area between the cuts 68*a* and 70*a* and the lower edges of the first holding wall 24*a* is projected toward the outside of the first holding wall 24*a*. Therefore, the first holding portions 60 and 62 are formed (see FIG. 22 (B)).

Furthermore, the second holding wall 24*b* is formed with the thin cuts 72*a* and 74*a* to be disposed with a spacing between the lower edges of the second holding wall 24*b* for forming the second holding portions 64 and 66 in the vicinity of the second through hole 28. The area between the cuts 72*a* and 74*a* and the lower edges of the second holding wall 24*b* is projected toward the outside of the second holding wall 24*b*. Therefore, the second holding portions 64 and 66 are formed (see FIG. 22 (A)).

When the operating member 18 is mounted in the holding space of the holding member 16, first, the first operating piece 30 is mounted in the holding member 16, then, the second operating piece 32 is mounted in the holding member 16 (see FIG. 23 (A)).

At this time, the protruding portion 30*c*1 of the first operating piece 30 is located within the first holding portion 60, and the protruding portion 30*c*2 of the first operating piece 30 is located within the first holding portion 62. The protruding portion 32*c*1 of the second operating piece 32 is located within the second holding portion 64, the protruding portion 32*c*2 of the second operating piece 32 is located within the second holding portion 66.

Next, the first holding portions 60 and 62 and the second holding portions 64 and 66 are driven into the inside of the first holding wall 24*a* and the second holding wall 24*b*, thereby forming the first holding portions 60 and 62 and the second holding portions 64 and 66 of circular arc shape in a plan view (see FIG. 23 (B)).

Then, the first holding portion 60 is formed so as to hold the underside of the protruding portion 30*c*1, and the first holding portion 62 is formed so as to hold the underside of the protruding portion 30*c*2. The second holding portion 64 is formed so as to hold the underside of the protruding portion 32*c*1, and the second holding portion 66 is formed so as to hold the underside of the protruding portion 32*c*2.

Then, the protruding portion 30*c*1 protrudes outwardly from the first through hole 26, and the protruding portion 30*c*2 protrudes outwardly from the second through hole 28. The protruding portion 32*c*1 protrudes outwardly from the first through hole 26, and the protruding portion 32*c*2 protrudes outwardly from the second through hole 28.

Next, a method for mounting the opening/closing member 40 on the operating member 18 is described with reference to FIGS. 4 to 6.

In a state in which the first binding ring 12 and the second binding ring 14 are closed, the securing end portion 42*a* secures the opening/closing member 40 to the first operating piece 30, and the securing end portion 42*b* secures the opening/closing member 40 to the second operating piece 32 so that a spring is loaded in a direction for rotationally moving the first operating piece 30 and the second operating piece 32, defining the abutting edges 30*a* and 32*a* as a center, to the direction from an opened state to a closed state, the twisting moment is received around a central axis of the coil portion 44 (coil), and bending stress is generated on a strand.

In this case, for the opening/closing member 40, in view of a state in which no load such as the twisting moment is placed on the coil portion 44 (shown in FIG. 6 (A)), the securing end portions 42*a* and 42*b* are secured to the opening/closing member fixing portions 38*a* and 38*b*, respectively, in a state in which the coil portion 44 is twisted for one revolution or more so as to increase the number of coil of the coil portion 44 for one revolution or more (the R direction for the securing end portions 42*a* and the restricting arm portion 46*a*, and the Q direction for the securing end portion 42*b* and the restricting arm portion 46*b* (shown in FIG. 5 and FIG. 6 (A))

It is configured that the load direction for loading a spring is the direction for winding the coil portion 44 (coil).

In the embodiments described above, a pair of operating pieces (the first operating piece 30 and the second operating piece 32) is formed with the protruding portions (the protruding portions 30*c*1, 30*c*2, 32*c*1, and 32*c*2) to be inserted into the through holes (the first through hole 26 and the second through hole 28) formed in the holding member 16. Therefore, even when the base portions of the binding rings (the first binding ring 12 and the second binding ring 14) are secured to the operating pieces (the first operating piece 30 and the second operating piece 32) by, for example, swaging, the area can be increased in order to reduce stress applied to the operating pieces (the first operating piece 30 and the second operating piece 32).

Therefore, the strength of the operating pieces (the first operating piece 30 and the second operating piece 32) as a whole can be increased.

Figure 24:
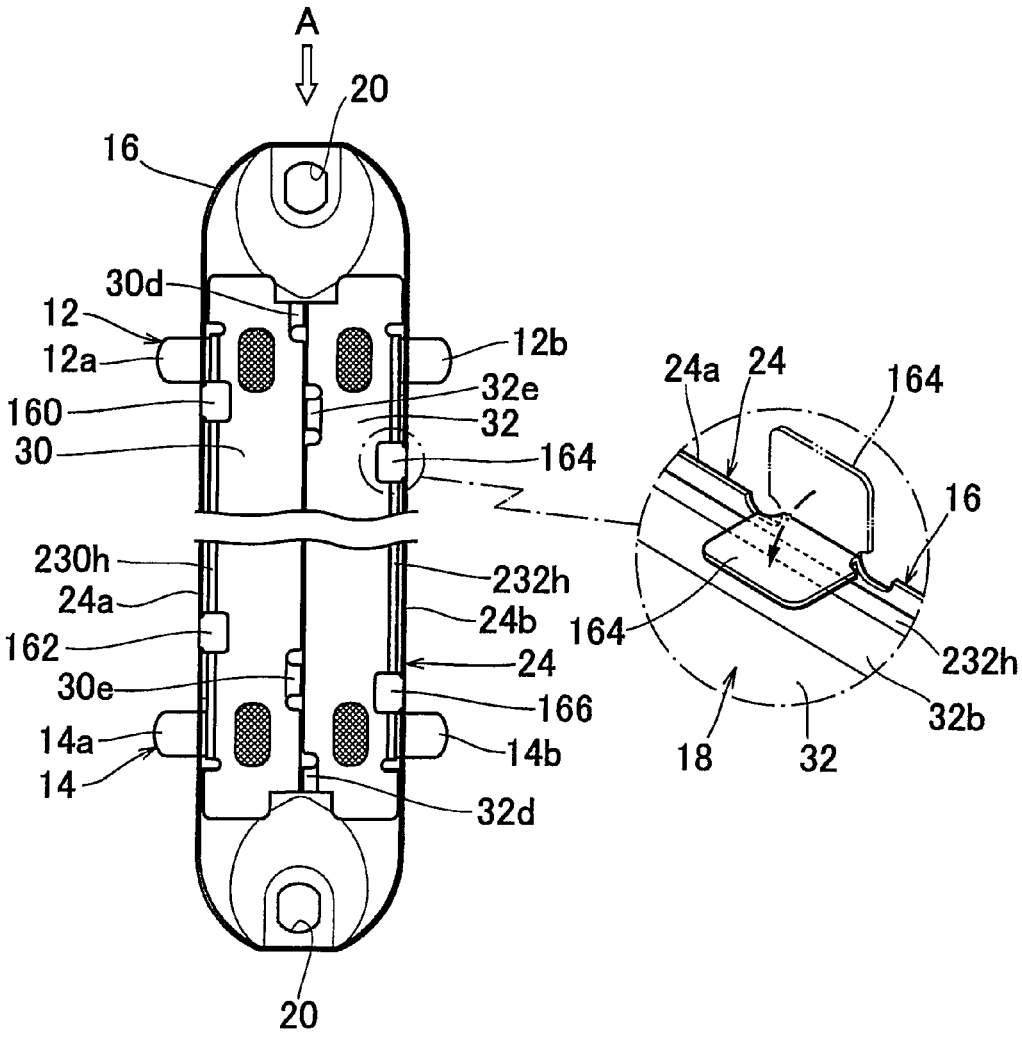
FIG. 24 is a schematic bottom view showing a method for forming an alternative example of the holding member.
Figure 25:
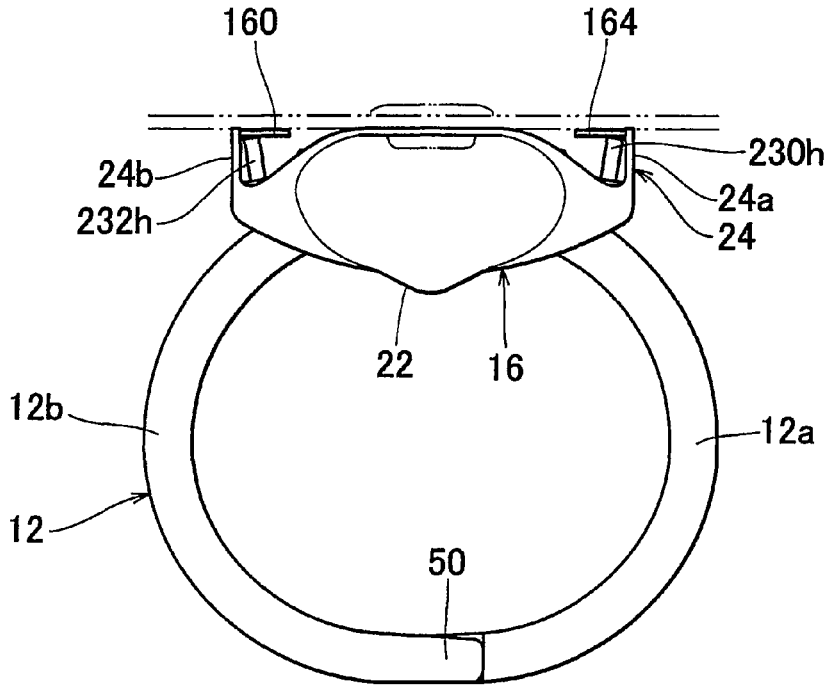
FIG. 25 is a view taken along arrow A direction in FIG. 24.

In contrast to the holding portion in the above embodiment, as shown in FIGS. 24 and 25, the square projections provided to protrude from the lower edges of the holding walls are bent toward the inside, the first holding portions 160 and 162 are formed in the first holding wall 24*a*, and the second holding portions 164 and 166 are formed in the second holding wall 24*b*. Thereby this invention may be configured so that the lower edges of the protrusions 230*h* and 232*h* (protruded on the side opposite to the protruding directions of the first binding ring 12 and the second binding ring 14) formed in the first operating piece 30 and the second operating piece 32 of the operating member 18 are maintained by the first holding portions 160 and 162 of the first holding wall 24*a* and the second holding portions 164 and 166 of the second holding wall 24*b*.

The first operating piece 30 and the second operating piece 32, along the length direction, can be moved by sliding the upper faces of the first holding portions 160 and 162 of the first holding wall 24*a* and the second holding portions 164 and 166 of the second holding wall 24*b*.

Figure 26:
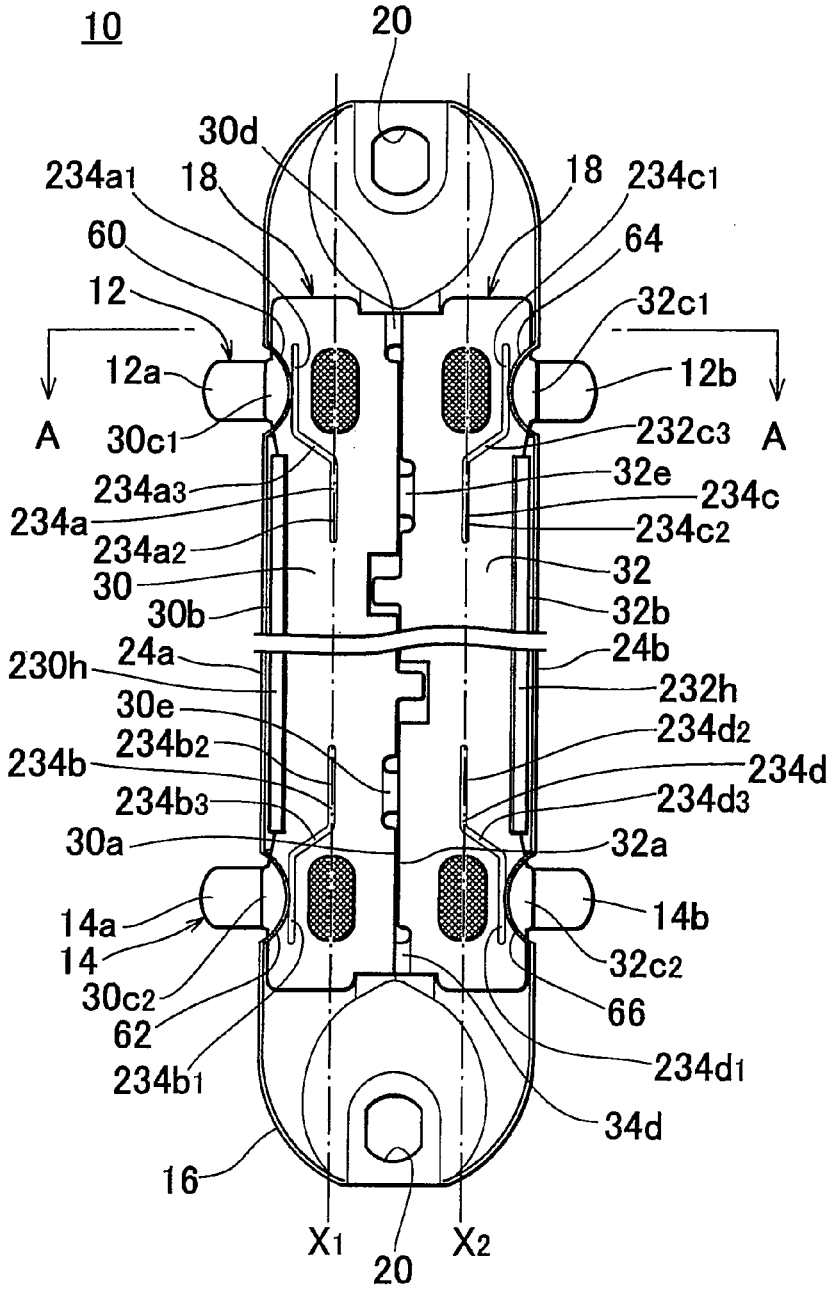
FIG. 26 is a schematic bottom view showing an alternative example of the operating members.
Figure 27:
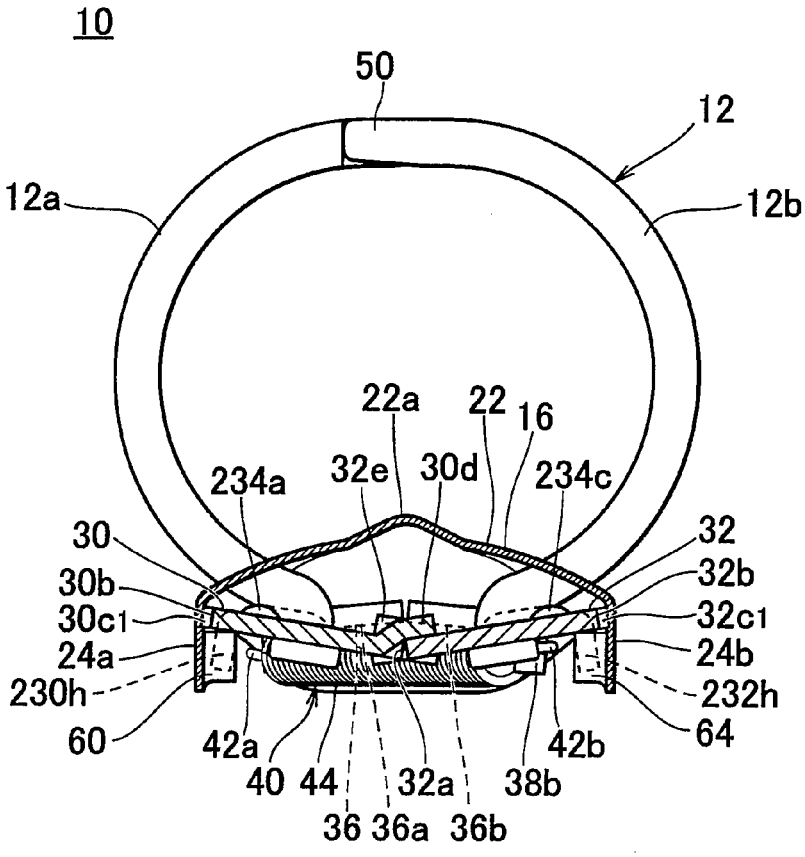
FIG. 27 is a schematic cross-sectional view showing an alternative example of the operating member.

In contrast to the above embodiment, the operating members may be changed as described in FIGS. 26 and 27.

The first operating pieces 30 shown in FIGS. 26 and 27 are formed with the protrusion 230*h* which extends to the direction close to the direction connecting the base portion of the first binding ring 12 and the base portion of the second binding ring 14 (shown in the X1 and X2 directions of FIG. 26) to be disposed with a spacing, at a position away from the abutting edge 30*a*.

In this embodiment, the protrusion 230*h* extends to the length direction of the first operating piece 30, parallel to the direction connecting the base portion of the first binding ring 12 and the base portion of the second binding ring 14.

The protrusion 230*h* continuously protrudes to the side opposite to the direction in which the first binding ring 12 and the second binding ring 14 protrude between the base portion of the first binding ring 12 and the base portion of the second binding ring 14 to be disposed with a spacing, between the protruding portions 30*c*1 and 30*c*2 of the outer edge 30*b*.

The protrusion 230*h* is formed by bending the tabular metal plate having an L shape in a cross section, constituting the first operating piece 30.

Furthermore, the second operating pieces 32 shown in FIGS. 26 and 27 are formed with the protrusion 232*h* which extends to the direction close to the direction connecting the base portion of the first binding ring 12 and the base portion of the second binding ring 14 (shown in the X1 and X2 directions of FIG. 26) to be disposed with a spacing, at a position away from the abutting edge 32*a*.

In this embodiment, the protrusion 232*h* extends to the length direction of the second operating piece 32, parallel to the direction connecting the base portion of the first binding ring 12 and the base portion of the second binding ring 14.

The protrusion 232*h* continuously protrudes to the side opposite to the direction in which the first binding ring 12 and the second binding ring 14 protrude between the base portion of the first binding ring 12 and the base portion of the second binding ring 14 to be disposed with a spacing, between the protruding portions 32*c*1 and 32*c*2 of the outer edge 32*b*.

The protrusion 232*h* is formed by bending the tabular metal plate having an L shape in a cross section, constituting the second operating piece 32.

Therefore, in the first operating piece 30 and the second operating piece 32, the bend between the base portion of the first binding ring 12 and the base portion of the second binding ring 14 is prevented by the protrusions 230*h* and 232*h*.

In the first operating pieces 30 shown in FIGS. 26 and 27, beads 234*a* and 234*b* protrude toward the upper face in the vicinity of the bases of the first half ring 12*a* and the third half ring 14*a* secured in the base portions so that the first operating piece 30 is reinforced so as to reduce the bend.

In the second operating pieces 32 shown in FIGS. 26 and 27, beads 234*c* and 234*d* protrude toward the upper face in the vicinity of the bases of the second half ring 12*b* and the fourth half ring 14*b* secured in the base portions so that the second operating piece 32 is reinforced so as to reduce the bend.

The bead 234*a* includes a first linear portion 234*a*1 extending in the longitudinal direction of the first operating piece 30 between the base portion of the first half ring 12*a* and the protruding portion 30*c*1, a second linear portion 234*a*2 extending in the longitudinal direction of the first operating piece 30 from the vicinity of the base portion of the first half ring 12*a* inside the protrusion 230*h* (substantially at the center in the width direction of the first operating piece 30), a hatched portion 234*a*3 connecting between the inner edge of the first linear portion 234*a*1 and the outer edge of the second linear portion 234*a*2. The bead 234*a* extrudes the linear projection having the predetermined width from the under side toward the upper face of the first operating piece 30.

The bead 234*b* includes a first linear portion 234*b*1 extending in the longitudinal direction of the first operating piece 30 between the base portion of the third half ring 14*a* and the protruding portion 30*c*2, a second linear portion 234*b*2 extending in the longitudinal direction of the first operating piece 30 from the vicinity of the base portion of the third half ring 14*a* inside the protrusion 230*h* (substantially at the center in the width direction of the first operating piece 30), a hatched portion 234*b*3 connecting between the inner edge of the first linear portion 234*b*1 and the outer edge of the second linear portion 234*b*2. The bead 234*b* extrudes the linear projection having the predetermined width from the under side toward the upper face of the first operating piece 30.

The bead 234*c* includes a first linear portion 234*c*1 extending in the longitudinal direction of the second operating piece 32 between the base portion of the second half ring 12*b* and the protruding portion 32*c*1, a second linear portion 234*c*2 extending in the longitudinal direction of the second operating piece 32 from the vicinity of the base portion of the second half ring 12*b* inside the protrusion 232*h* (substantially at the center in the width direction of the second operating piece 32), a hatched portion 234*c*3 connecting between the inner edge of the first linear portion 234*c*1 and the outer edge of the second linear portion 234*c*2. The bead 234*c* extrudes the linear projection having the predetermined width from the under side toward the upper face of the second operating piece 32.

The bead 234*d* includes a first linear portion 234*d*1 extending in the longitudinal direction of the second operating piece 32 between the base portion of the fourth half ring 14*b* and the protruding portion 32*c*2, a second linear portion 234*d*2 extending in the longitudinal direction of the second operating piece 32 from the vicinity of the base portion of the third half ring 14*b* inside the protrusion 232*h* (substantially at the center in the width direction of the second operating piece 32), a hatched portion 234*d*3 connecting between the inner edge of the first linear portion 234*d*1 and the outer edge of the second linear portion 234*d*2. The bead 234*d* extrudes the linear projection having the predetermined width from the under side toward the upper face of the second operating piece 32.

A cover may be the following cover 310 so as to prevent the first binding ring 12 and the second binding ring 14 from bending when there are a large amount of objects S such as papers bound in the first binding ring 12 and the second binding ring 14.

Figure 28:
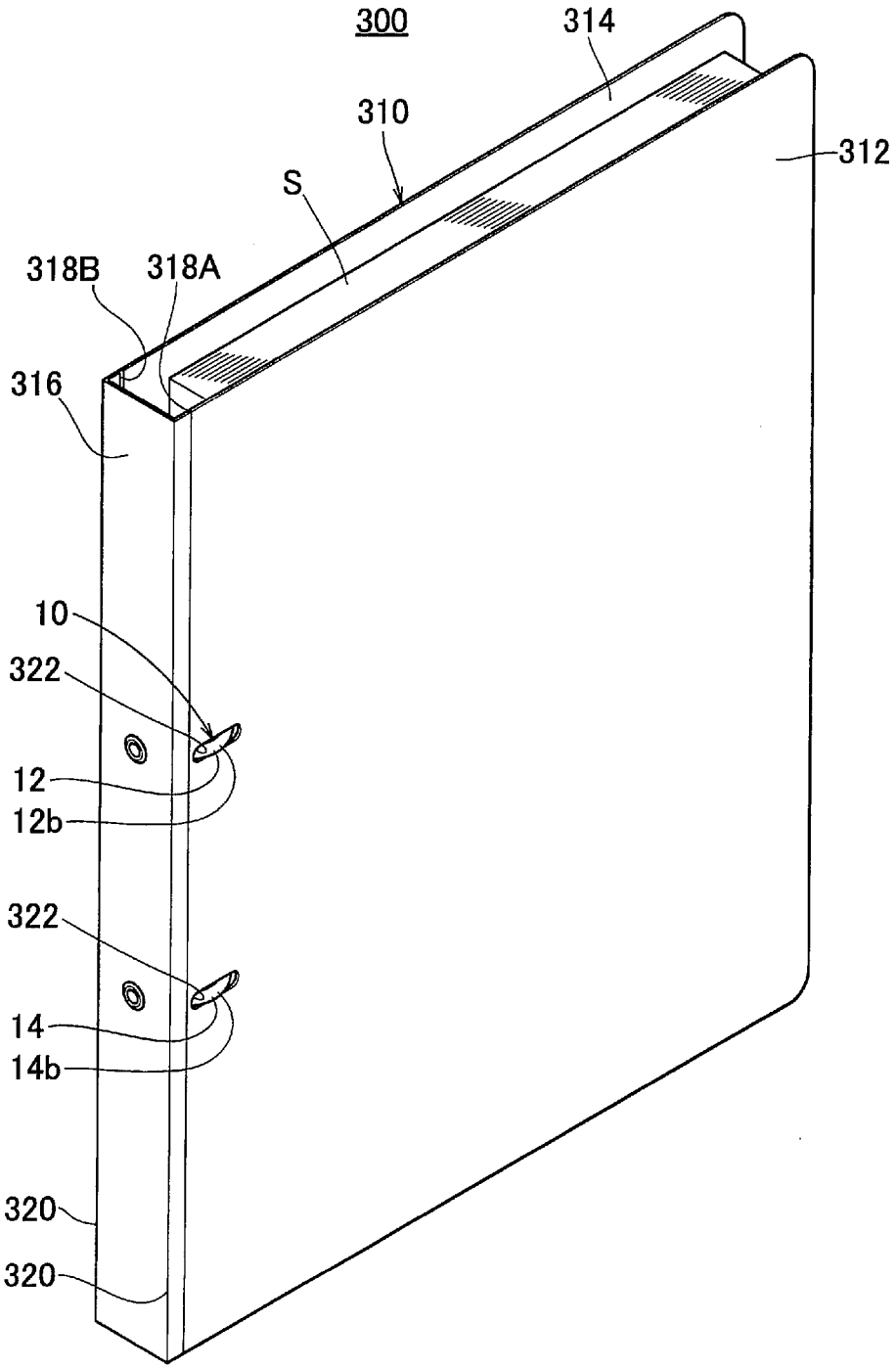
FIG. 28 is a schematic perspective view in which a cover is closed.
Figure 29:
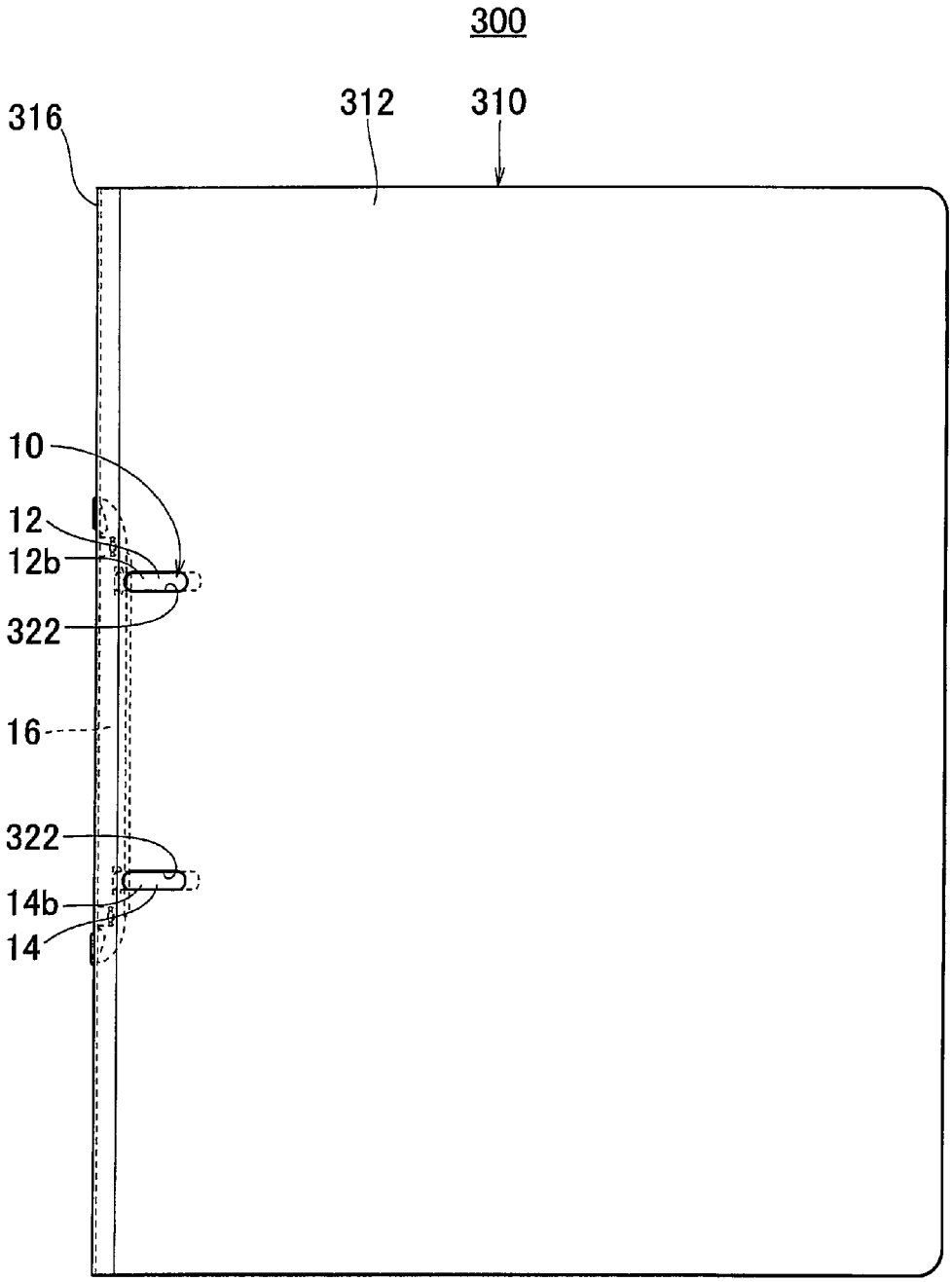
FIG. 29 is a schematic side view in which a cover is closed.
Figure 30:
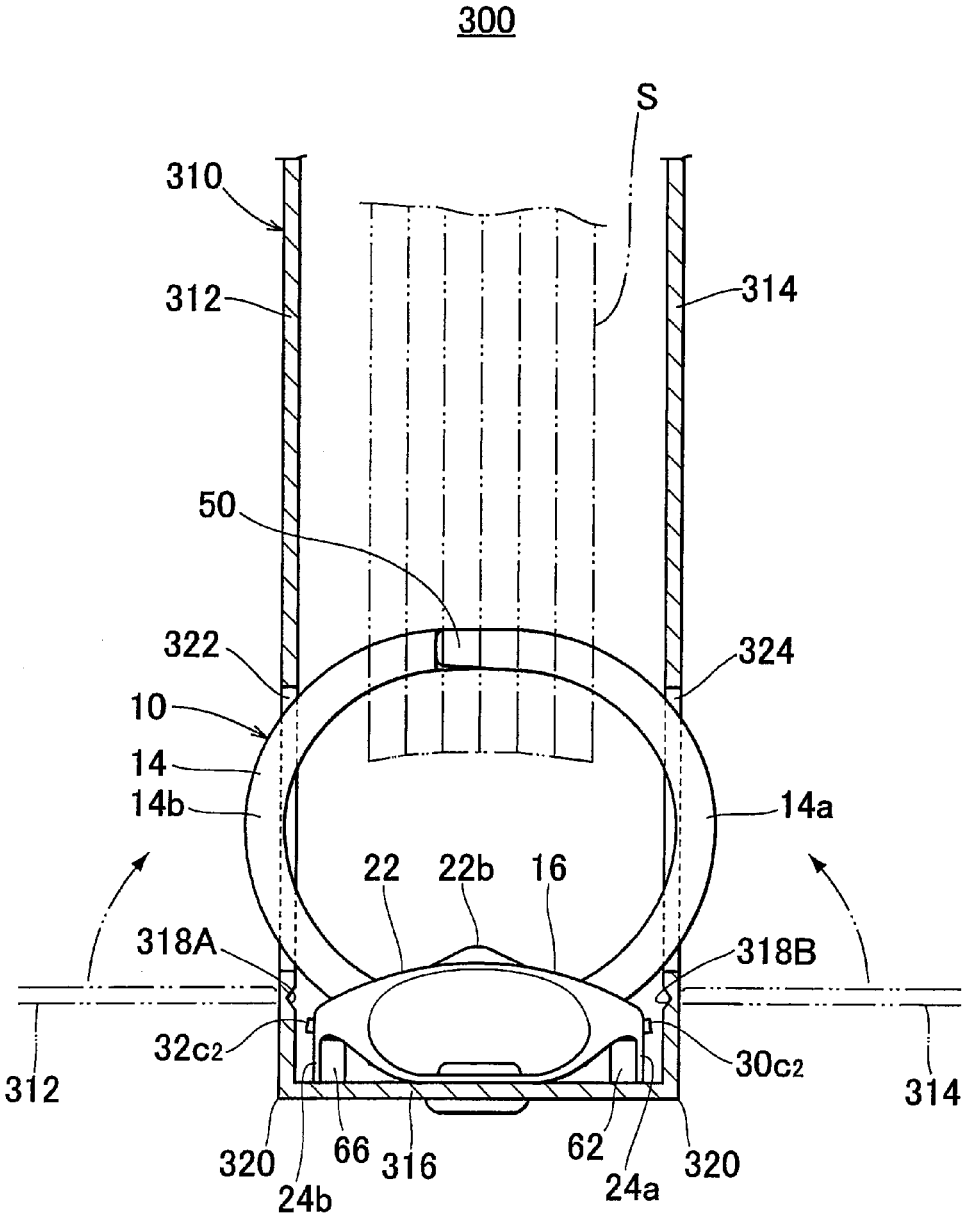
FIG. 30 is a schematic cross-sectional view in which a cover is closed.

The cover 310 includes a spine 316 fixing the holding member of the binding ring, and an extended front cover 312 and back cover 314 installed at the both edges of the spine 316 in an openable and closable manner. As shown in FIGS. 28 to 30, the front cover 312 and the back cover 314 are consecutively installed to the spine 316 so as to be in an upright-installing state.

Then, the front cover 312 and the back cover 314 include thin hinge portions 318A and 318B for opening/closing, near the spine 316.

As a configuration of a consecutive installing portion of the front cover 312/the back cover 314 and the spine 316, adopted is the configuration to form the consecutive installing portion 320 made of a substantially V-shaped groove for the plastic-type cover, and to bend the covers at the bottom of the groove.

In other words, as shown in FIG. 30, the front cover 312 and the back cover 314 are provided with the substantially V-shaped groove of the consecutive installing portion 320 between the front cover 312/the back cover 314 and the spine 316. The front cover 312 and the back cover 314 are consecutively installed to the spine 316 so as to be upright-installing state by bending the covers at the bottom of the groove of this consecutive installing portion 320.

When using the consecutive installing portion 320, the spine 316 may change the configuration by changing the angle of this consecutive installing portion 320.

Thin hinge portions 318A and 318B which permits the opening/closing of the front cover 312 and the back cover 314 are the substantially V-shaped groove in a cross section, and are provided at the front cover 312 and the back cover 314 in a position slightly near an edge from the consecutive installing portion 320.

In manufacturing as an example to form the cover 310 by using the cover made of a thermoplastic-resin sheet material, for example, the consecutive installing portion 320 made of two substantially V-shaped grooves are formed, each parallel to the cover made of the thermoplastic-resin sheet material. The consecutive installing portion 320 made of the substantially V-shaped grooves are heat-pressed, parallel to each other at the position a little near to the inside of this consecutive installing portion 320. And at the same time, by applying pressure to the covers to the direction to block the consecutive installing portion 320 made of substantially V-shaped grooves, each bottom of the grooves are bent.

Other than the single body of the thermoplastic-resin sheet material, a two-layer structure made of the thermoplastic-resin sheet material and a coated material may be used.

Furthermore, in this two-layer structure, if a two-layer structure made of a hard sheet material and a cloth is provided, a configuration may be adopted to glue both of the groove faces of the consecutive installing portion 320 made of substantially V-shaped grooves.

The front cover 312 and the back cover 314 are provided with binding ring fixing means 322 and 324 for restricting the movement of the first binding ring 12 and the second binding ring 14 by inserting a part of the binding device 10, in a region opposite to the closed first binding ring 12 and second binding ring 14.

The binding ring fixing means 322 and 324 are composed of through holes or steps in which the first binding ring 12 and the second binding ring 14 are fitted into or inserted loosely so as to oppose to the side face of the moving side of the first binding ring 12 and the second binding ring 14.

These binding ring fixing means 322 and 324 are long holes extending to the direction of the first binding ring 12 and the second binding ring 14. The long holes are formed by a pair of the above and lower linear hole edges having the length and width corresponding to the length and width of the portions in which the first binding ring 12 and the second binding ring 14 are fitted into or inserted loosely and circular-arc shaped hole edges consecutively installed between both left edges and between both right edges of the linear hole edges.

The width of the closed first binding ring 12 and second binding ring 14 are formed wider than the width of the spine 316 of the cover 310 or the width between the front cover 312 and the back cover 314 opposing parallel.

The first binding ring 12 and the second binding ring 14 are fitted into the long holes constituting the binding ring fixing means 322 and 324 formed in the front cover 312 and the back cover 314 closed substantially parallel to each other, from the position slightly higher than the base portion in which the first operating piece 30 and the second operating piece 32 are attached to the position slightly exterior of the binding ring latching portion 50.

A pair of the above and lower linear hole edges of the long holes abut against the upper and lower side faces of the first binding ring 12 and the second binding ring 14, and circular-arc shaped hole edges of the long holes abut against the right and left circumferential surfaces of the first binding ring 12 and the second binding ring 14.

Then, when file/binder 300 is made upright, defining the first binding ring 12 as an upper side and the second binding ring 14 as a lower side in a state in which the front cover 312 and the back cover 314 of the file/binder 300 are closed parallel, the movement of the first binding ring 12 and the second binding ring 14 are restricted by the binding ring fixing means 324, even if the first half ring 12*a* of the first binding ring 12 and the third half ring 14*a* of the second binding ring 14 are moved to the lower direction disengaging from the second half ring 12*b* of the first binding ring 12 and the fourth half ring 14*b* of the second binding ring 14, in such a way that impact is given when the object P such as the paper bound at the side of the first half ring 12*a* of the first binding ring 12 and the side of the third half ring 14*a* of the second binding ring 14.

Since the first binding ring 12 and the second binding ring 14 are latched at the hole edge on the lower side of the binding ring fixing means 324, the first half ring 12*a* of the first binding ring 12 and the second half ring 12*b* of the first binding ring 12, and the third half ring 14*a* of the second binding ring 14 and the fourth half ring 14*b* of the second binding ring 14 can not be disengaged at the binding ring latching portions 50, respectively.

For attachment of the binding device 10 to the cover A, after the lower edges of the first holding wall 24*a* and the second holding wall 24*b* are brought into contact with the cover A, bolts and nuts or rivets may be inserted into the attachment holes 20 so as to attach the binding device 10 to the cover A.

In the above-described embodiment, a two-ring type binder with the first binding ring 12 and the second binding ring 14 has been described. However, multi-ring type binders with an increased number of rings, for example, a three-ring type, a four-ring type, a twenty-ring type, a twenty-six ring type or a thirty-ring type binder can be provided.

Corresponding to the number of the binding ring, the length of the holding member and the operating member are extended. In addition, a through hole like one or more first through holes and second through holes are formed between the first through hole and the second through hole of the holding member. It is only necessary that the binding ring secured to the operating member can be penetrated and inserted.

Figure 31:
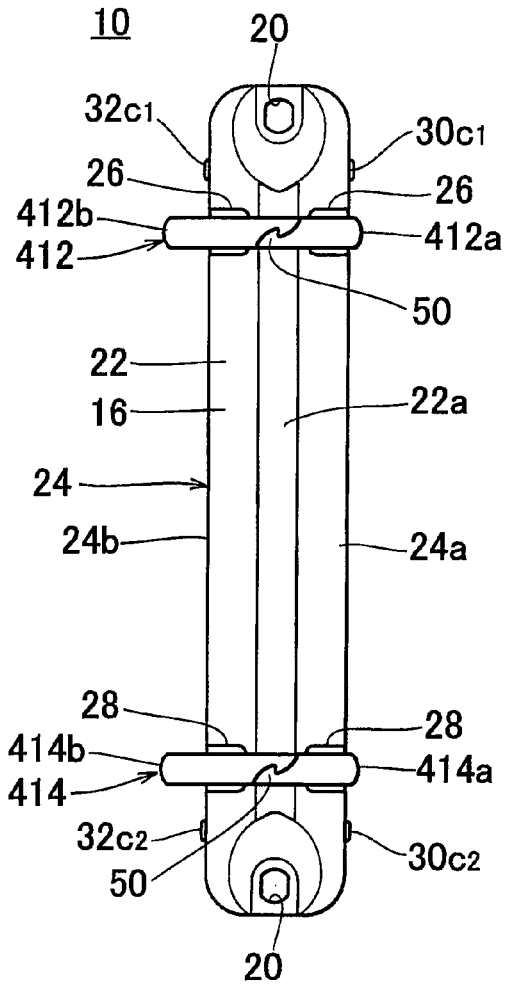
FIGS. 31(A) and 31(B) are schematic views showing alternative examples of the binding rings, where
Figure 31:
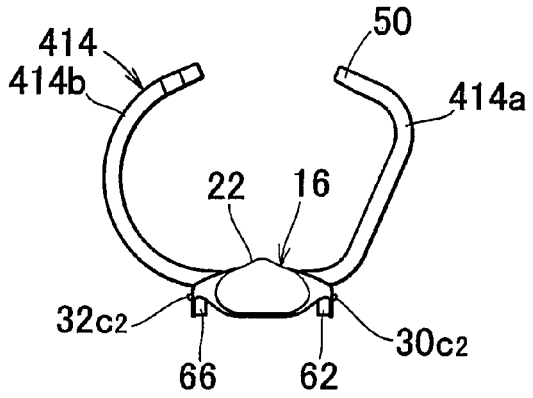

Furthermore, as shown in FIG. 31, the shape of the binding ring may be substantially a D shape, not substantially an O shape.

In order to form the first binding ring 412 and the second binding ring 414 of substantially the D shape, the second half ring 412*b* and the fourth half ring 414*b* are formed in substantially a C shape which is relatively the same as in the above embodiment, and the first half ring 412*a* and the third half ring 414*a* are formed in substantially a reverse L shape. When the first half ring 412*a* and the second half ring 412*b*, and the third half ring 414*a* and the fourth half ring 414*b* are closed, the first binding ring 412 and the second binding ring 414 are formed in substantially a D shape.

In the binding device of the above embodiment, one opening/closing member was mounted in response to a pair of operating pieces. A total number of two opening/closing members may be mounted.

Furthermore, the first operating piece and the second operating piece constituting the operating piece were formed integrally. As the number of the binding ring (such as four-hole, twenty-hole, twenty-six-hole, or thirty-hole) increases, the first operating piece and the second operating piece may be divided respectively.

Figure 32:
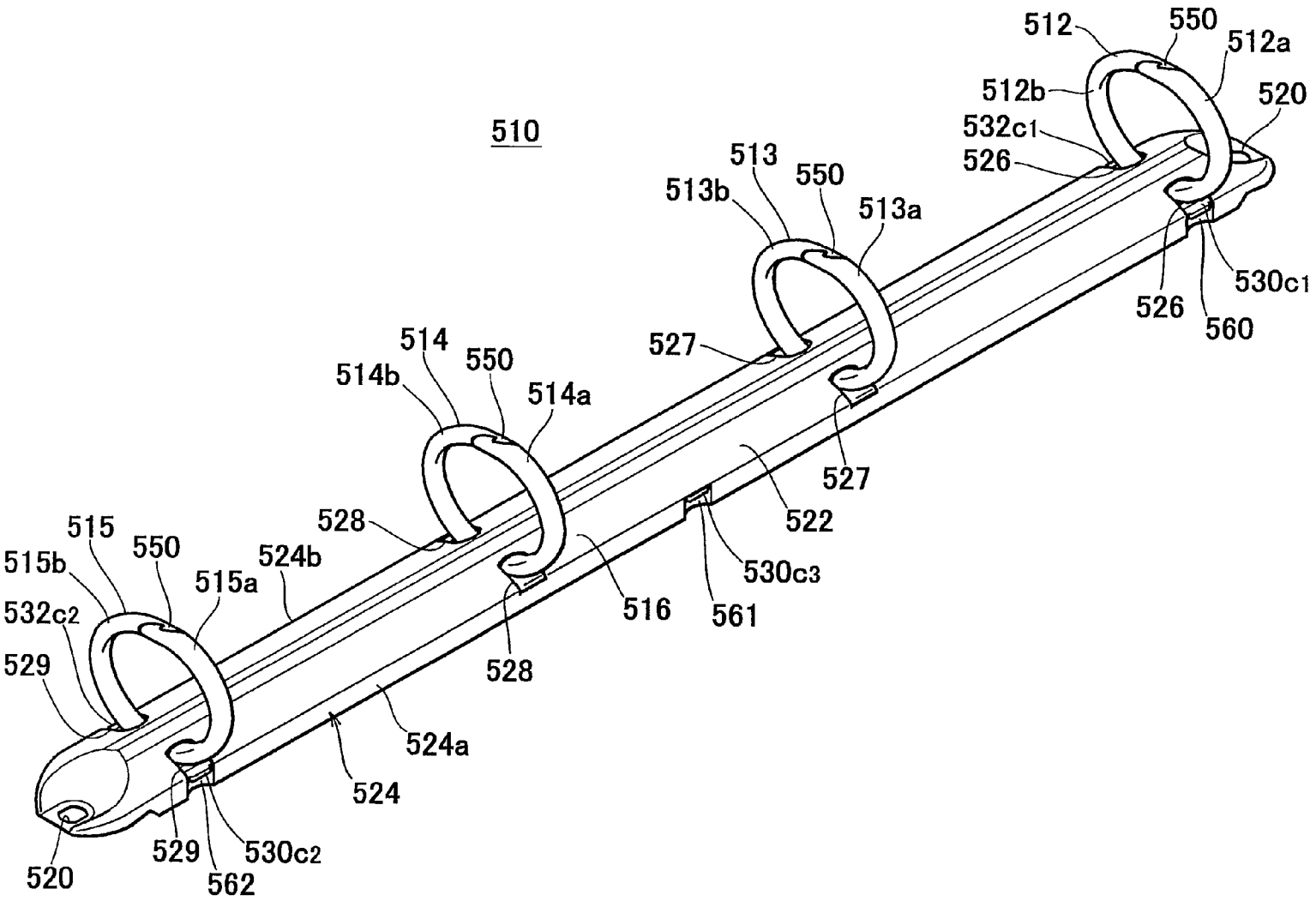
FIG. 32 is a perspective view showing an example of the binding device according to another embodiment.
Figure 33:
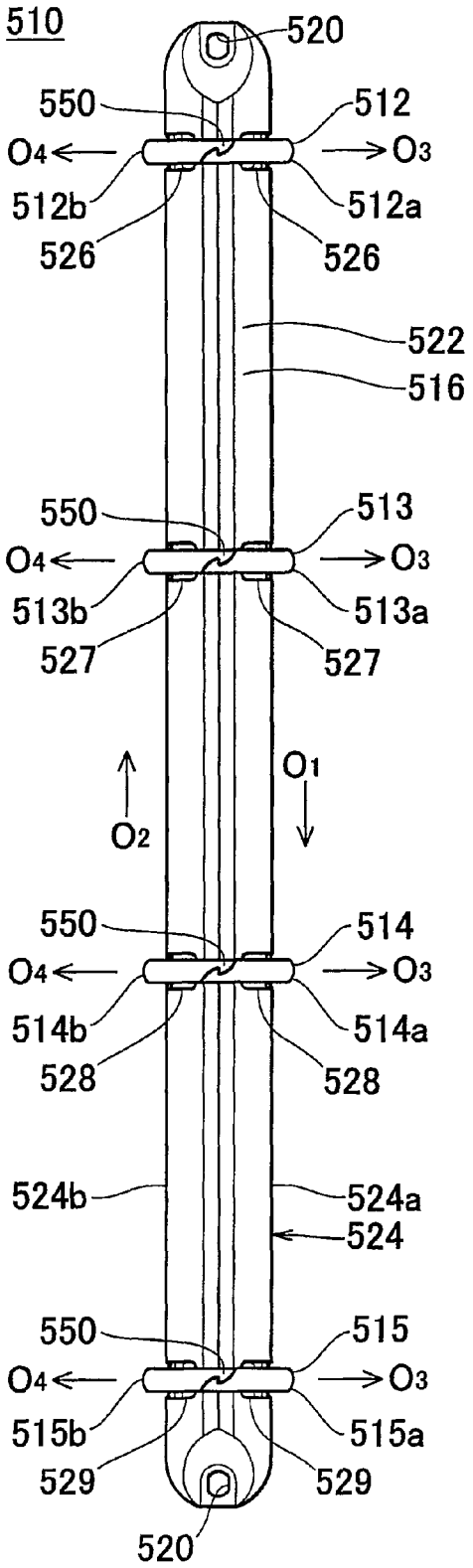
FIG. 33 is a plan view showing an example of the binding device according to another embodiment.

Next, a four-ring perfect-circle type binding device of another embodiment according to the present invention is described with reference to FIGS. 32 and 33.

A binding device 510 of this embodiment has a configuration substantially the same as the configuration of the binding device 10 of the embodiment described above. However, the configuration of the holding member, the configuration of the operating member, and the configuration of the opening/closing member are different since the number of binding rings is increased. Therefore, a description is mainly given of these differences.

The binding device 510 includes: a pair of substantially annular first binding ring 512 and second binding ring 513 and a pair of substantially annular third binding ring 514 and fourth binding ring 515, each of which is made of metal; a holding member 516 having a length which allows the first binding ring 512 and the fourth binding ring 515 to be disposed with a spacing therebetween; and an operating member 518 having a surface to which the base portions of each of the first binding ring 512 and the fourth binding ring 515 are secured with a spacing therebetween, the operating member 518 being movably secured inside the holding member 516 such that the first binding ring 512, the second binding ring 513, the third binding ring 514, and the fourth binding ring 515 are secured to the holding member 516.

The binding rings are of a four-hole type and include four binding rings, i.e., the first binding ring 512, the second binding ring 513, the third binding ring 514, and the fourth binding ring 515.

The first binding ring 512 includes a first half ring 512*a* and a second half ring 512*b*, and the second binding ring 513 includes a third half ring 513*a* and a fourth half ring 513*b*. The third binding ring 514 includes a fifth half ring 514*a* and a sixth half ring 514*b*, and the fourth binding ring 515 includes a seventh half ring 515*a* and an eighth half ring 515*b*.

Then, a binding ring latching portion 550 is formed at the end of the first half ring 512*a* and the second half ring 512*b*, at the end of the third half ring 513*a* and the fourth half ring 513*b*, at the end of the fifth half ring 514*a* and the sixth half ring 514*b*, and at the end of seventh half ring 515*a* and the eighth half ring 515*b*, i.e., at the top portion of each of the first binding ring 512, the second binding ring 513, the third binding ring 514, and the fourth binding ring 515 in order to allow an object S such as a paper to be bound by inserting the half rings into binding holes provided in the object S such as the paper in advance.

The first half ring 512*a* and the second half ring 512*b* constituting the first binding ring 512 are annularly engaged with each other by engaging the binding ring latching portion 550 of the first half ring 512*a* with the binding ring latching portion 550 of the second half ring 512*b*.

The fifth half ring 514*a* and the sixth half ring 514*b* constituting the third binding ring 514 are annularly engaged with each other by engaging the binding ring latching portion 550 of the fifth half ring 514*a* with the binding ring latching portion 550 of the sixth half ring 514*b*.

The holding member 516 is of a substantially rectangular shape in a plan view, having such a length that allows the first binding ring 512, the second binding ring 513, the third binding ring 514, and the fourth binding ring 515 to be provided at predetermined intervals. Both ends of the holding member 516, i.e., in the vicinity of attachment holes 520 for attachment to the cover A, are each formed to have an approximately semicircular arc shape in a plan view.

The holding member 516 has a holding space inside the bound object-mounting portion 522, and the holding member 516 is configured to house the operating member 518 or the like.

On both ends of the bound object-mounting portion 522 of the holding member 516, holding walls 524 for slidably holding the operating member 518 are provided in a longitudinal direction substantially from one end to the other end of the bound object-mounting portion 522.

In this embodiment, first holding walls 524*a* and second holding walls 524*b* are continuously provided in a longitudinal direction of the holding member 516 in such a manner as to extend downward and inward from the outer vicinities of the first binding ring 512, the second binding ring 513, the third binding ring 514, and the fourth binding ring 515 over the approximately entire length.

The first holding walls 524*a* and the second holding walls 524*b* are in parallel with each other and have substantially the same plate-like shape.

The operating member 518 or the like to be described below in detail is housed within the holding space surrounded by the first holding walls 524*a*, the second holding walls 524*b*, and the bound object-mounting portion 522.

First through holes 526, second through holes 527, third through holes 528, and fourth through holes 529 are provided through the bound object-mounting portion 522 of the holding member 516.

The first through holes 526 and the second through holes 527 are provided to be configured to allow the first binding ring 512 and the second binding ring 513 to loosely pass therethrough at a predetermined distance (a predetermined length determined by Japanese Industrial Standards or the like). Through holes 528 and fourth through holes 529 are provided to be configured to allow the third binding ring 514 and the fourth binding ring 515 to loosely pass therethrough at a predetermined distance (a predetermined length determined by Japanese Industrial Standards or the like).

The first through holes 526, the second through holes 527, the third through holes 528, and the fourth through holes 529 are provided so as to correspond to each half ring constituting each binding ring. The first through holes 526, the second through holes 527, the third through holes 528, and the fourth through holes 529 are provided in a width direction of the holding member 516 at a predetermined distance, parting right and left.

The operating piece constituting the operating member 518 has the a pair of left and right operating pieces 530 and 532 which are elongately formed in contrast to the operating piece of the binding device of the above embodiment.

The base portions of the first half ring 512*a*, the third half ring 513*a*, the fifth half ring 514*a*, and the seventh half ring 515*a* are secured to the first operating piece 530.

The base portions of the second half ring 512*b*, the fourth half ring 513*b*, the sixth half ring 514*b*, and the eighth half ring 515*b* are secured to the second operating piece 532.

The first operating piece 530 and the second operating piece 532 are formed with the opening/closing member housing portions 536A and 536B. In addition, in the vicinity outside two pairs of the opening/closing member fixing portions 538*a*1 and 538*a*2 formed on the surface (under side) of the opening/closing member housing portion 536A and the opening/closing member fixing portions 538*b*1 and 538*b*2 formed on the surface (under side) of the opening/closing member housing portion 536B, two movement restricting portions are formed for restricting the movement of the first operating piece 530 and the second operating piece 532 to the longitudinal direction.

Then, the opening/closing member 540 is mounted in the opening/closing member housing portion 536A, is secured so as to obliquely intersect the abutting edges 530*a* and 532*a* spreading the opening/closing member fixing portion 538*a*1 of the first operating piece 530 and the opening/closing member fixing portion 538*b*1 of the second operating piece 532. The opening/closing member 542 is mounted in the opening/closing member housing portion 536B, is secured so as to obliquely intersect the abutting edges 530*a* and 532*a* spreading the opening/closing member fixing portion 538*a*2 of the first operating piece 530 and the opening/closing member fixing portion 538*b*2 of the second operating piece 532.

The securing end portion 540*a* of the opening/closing member 540 is secured to the opening/closing member fixing portion 538*a*1 of the first operating piece 530, and the securing end portion 540*b* is secured to the opening/closing member fixing portion 538*b*1 of the second operating piece 532, respectively. The securing end portion 542*a* of the opening/closing member 542 is secured to the opening/closing member fixing portion 538*a*2 of the first operating piece 530, and the securing end portion 542*b* is secured to the opening/closing member fixing portion 538*b*2 of the second operating piece 532, respectively.

Figure 34:
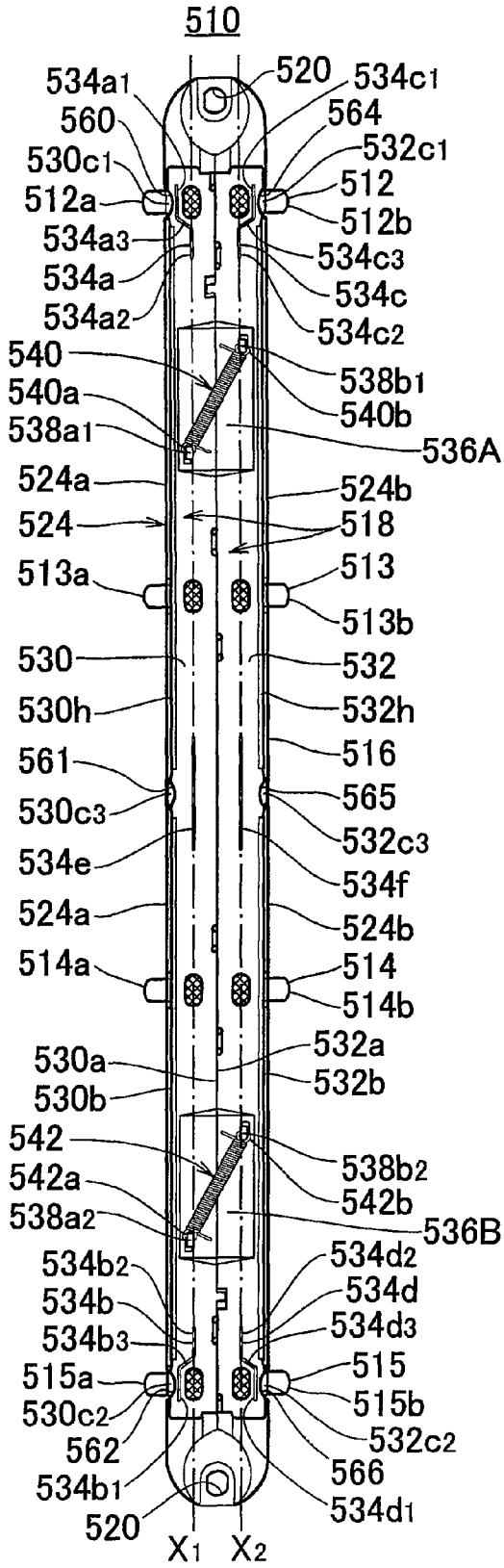
FIG. 34 is a bottom view of the whole binding device in FIG. 32.
Figure 35:
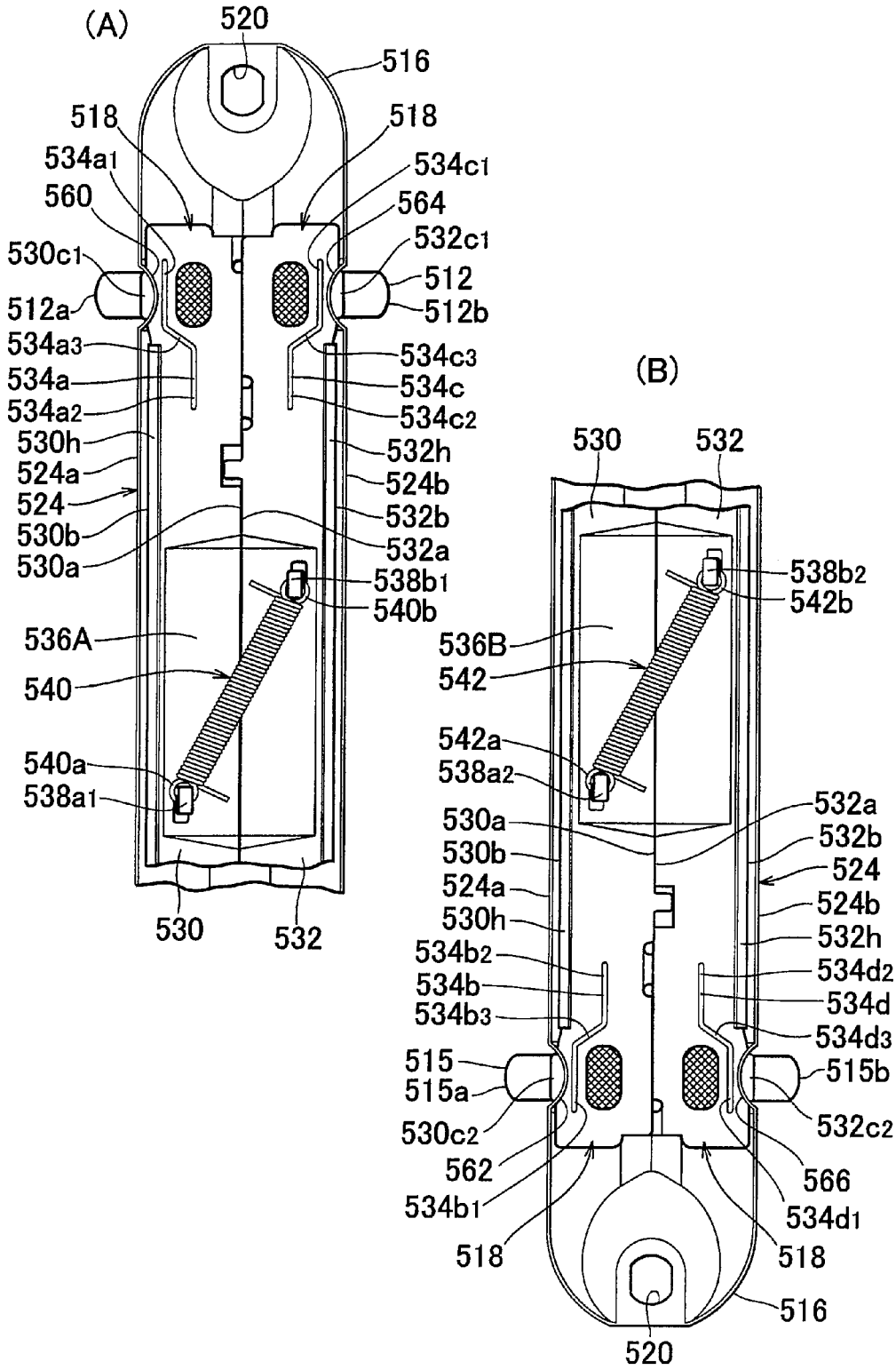
FIGS. 35(A) and 35(B) are bottom views which enlarged a part of FIG. 34.
Figure 36:
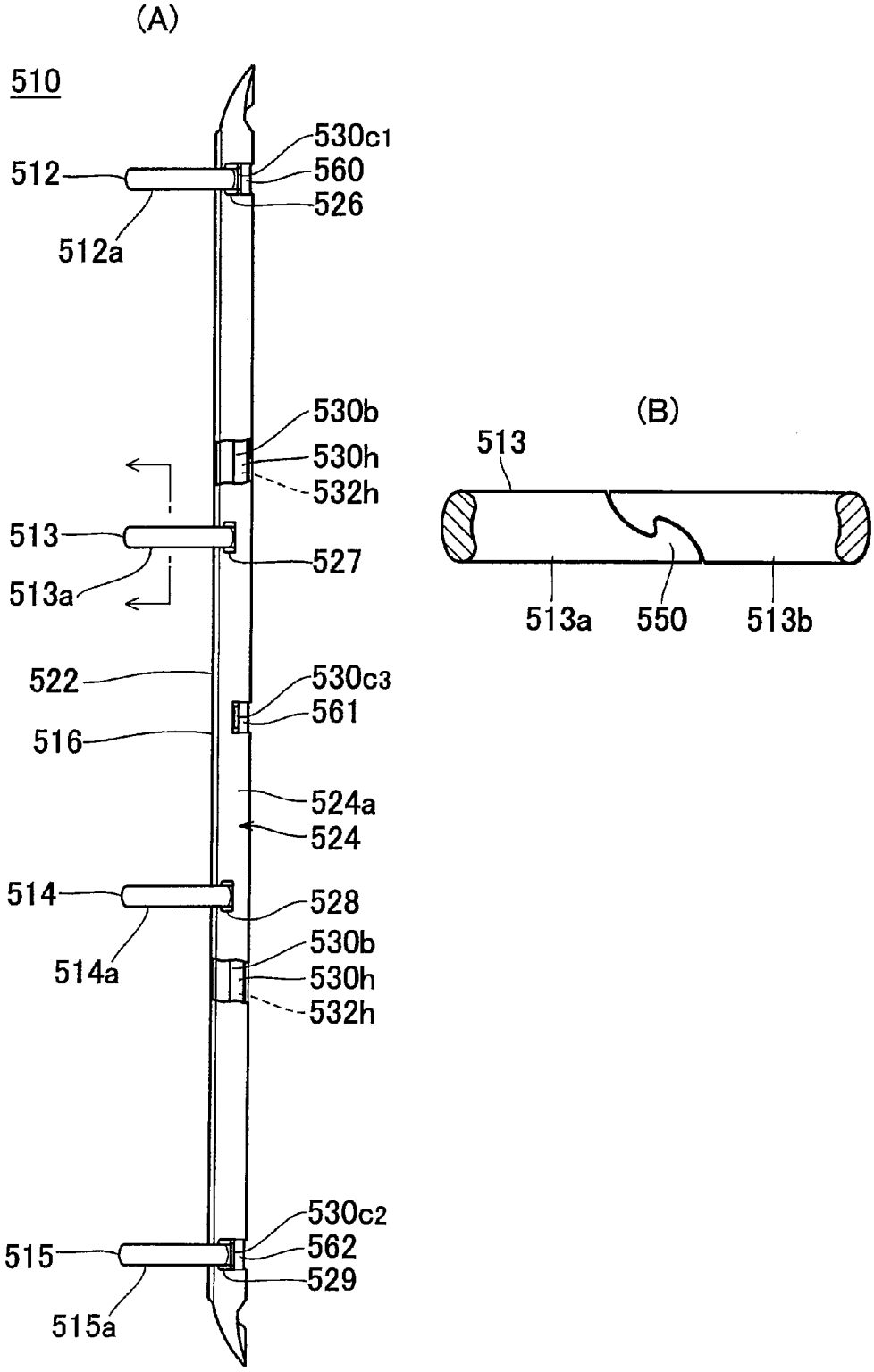
FIG. 36(A) is a side view of the binding device in FIG. 32.
FIG. 36(B) is a cross-sectional view of the binding ring of the binding device in FIG. 32.
Figure 37:
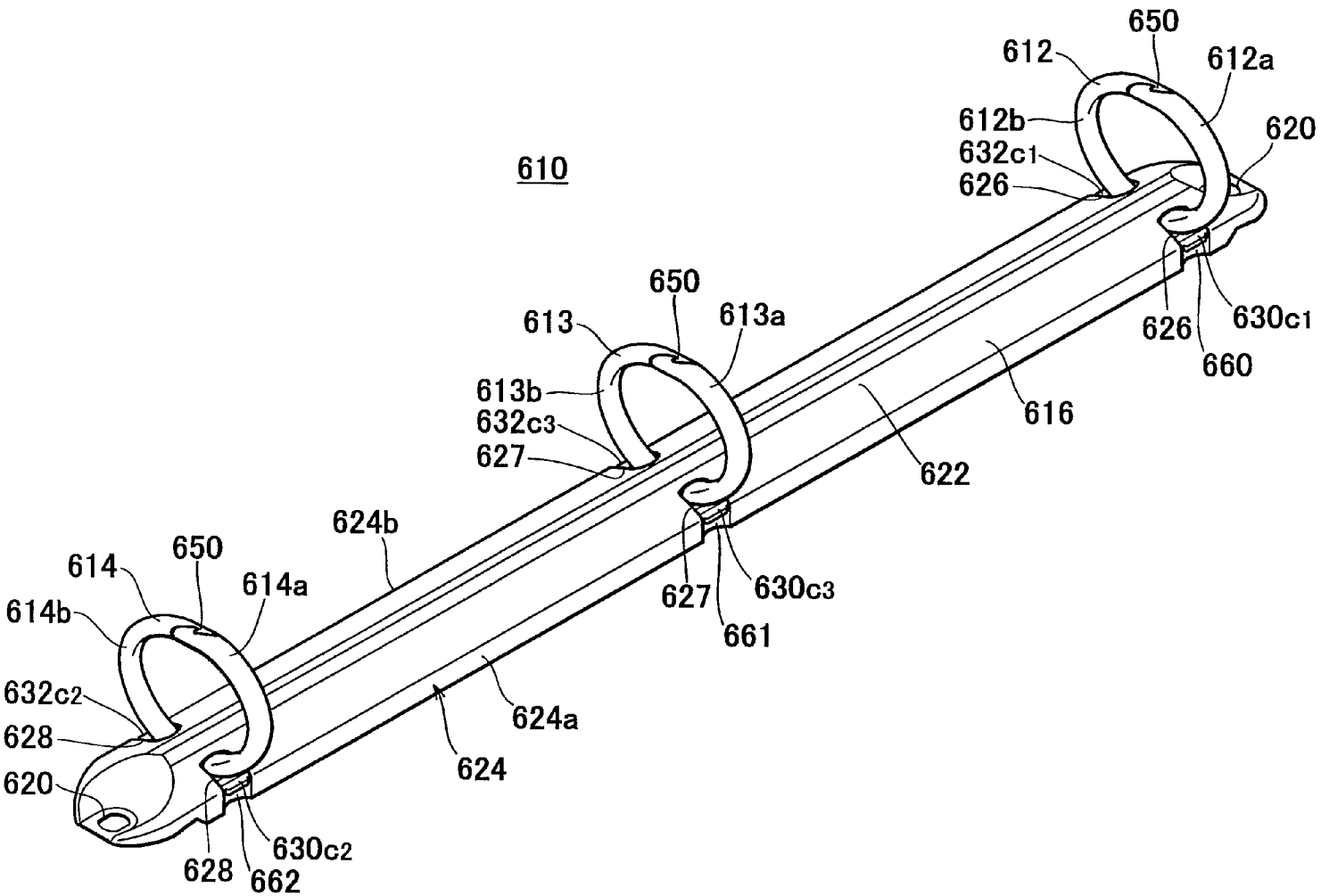
FIG. 37 is a perspective view showing an example of the binding device according to another embodiment.
Figure 38:
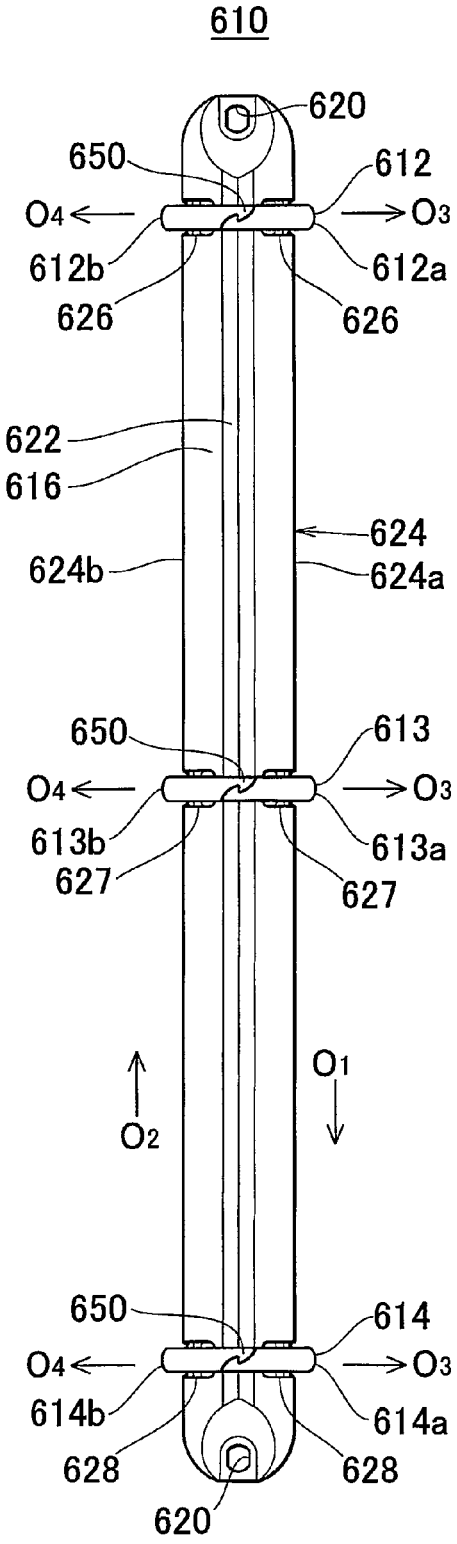
FIG. 38 is a plan view showing an example of the binding device according to another embodiment.
Figure 39:
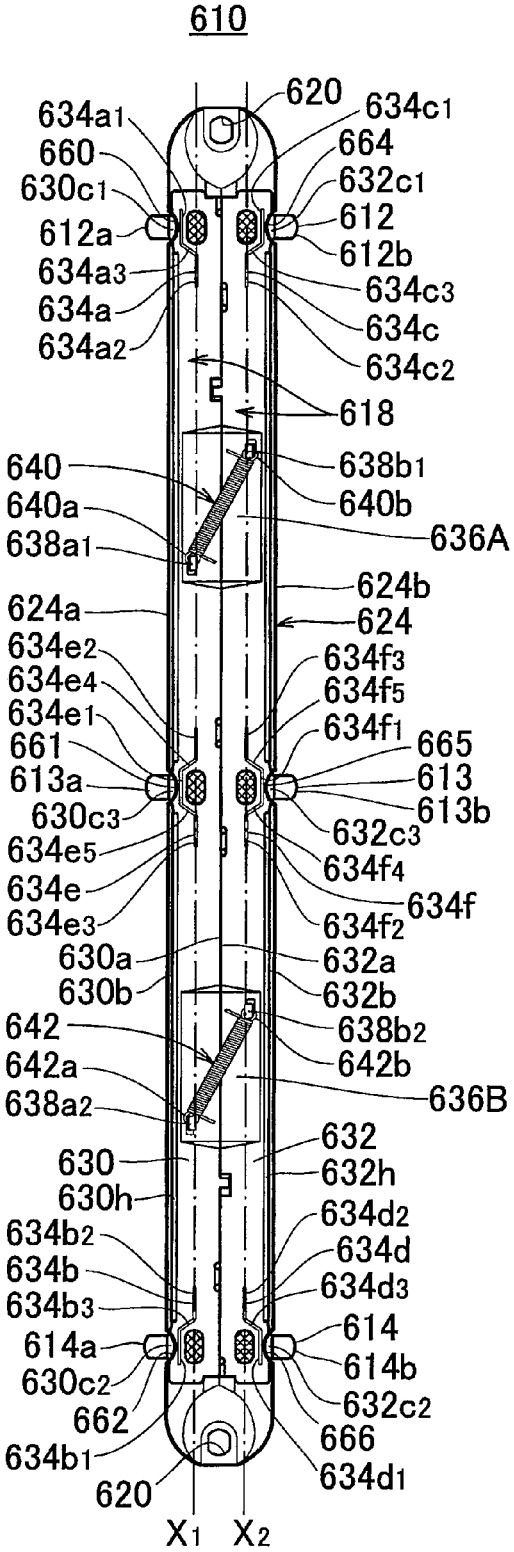
FIG. 39 is a bottom view of the whole binding device in FIG. 37.
Figure 40:
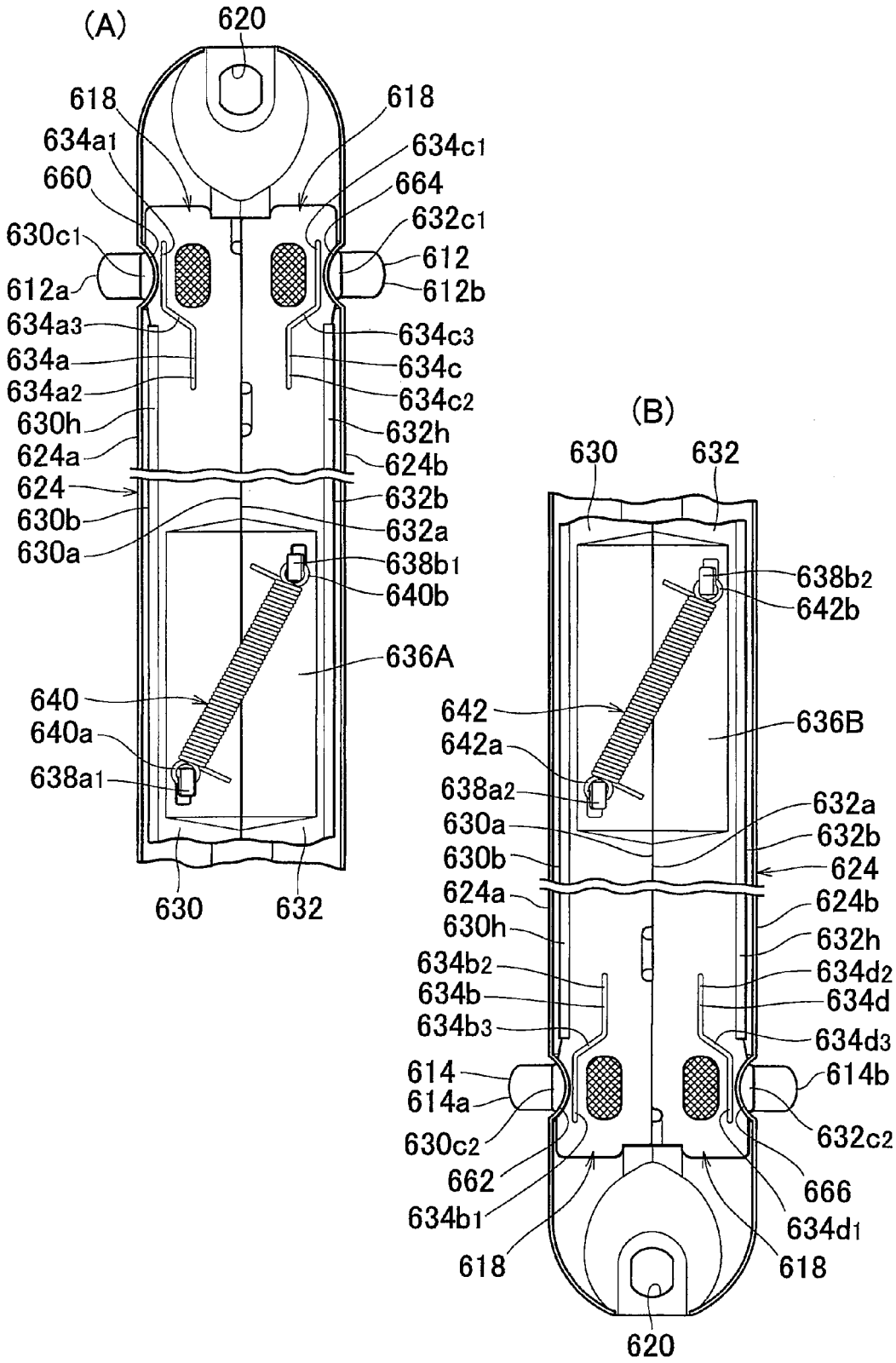
FIGS. 40(A) and 40(B) are bottom views which enlarged a part of FIG. 39.
Figure 41:
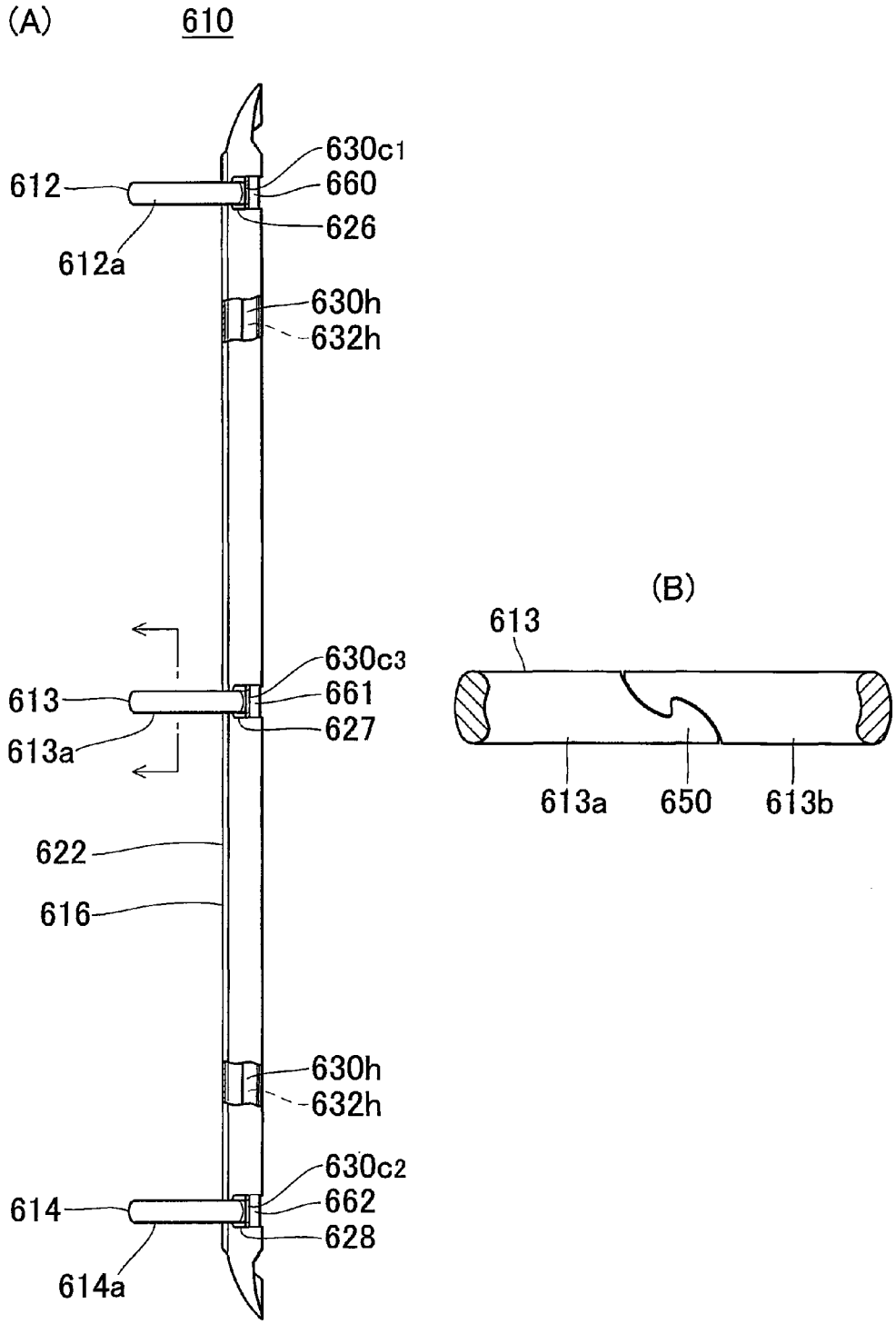
FIG. 41(A) is a side view of the binding device in FIG. 37.
FIG. 41(B) is a cross-sectional view of the binding ring of the binding device in FIG. 37.

The first operating piece 530 is formed with the protrusion 530*h* which extends to the direction close to the direction connecting the base portion of the first binding ring 512 and the base portion of the fifth binding ring 515 (shown in the X1 and X2 directions of FIG. 34) to be disposed with a spacing, at a position away from the abutting edge 530*a*.

In this embodiment, the protrusion 530*h* extends to the length direction of the first operating piece 530, parallel to the direction connecting the base portion of the first binding ring 512 and the base portion of the fifth binding ring 515.

The protrusion 530*h* continuously protrudes to the side opposite to the direction in which the first binding ring 512 and the fifth binding ring 515 protrude between the base portion of the first binding ring 512 and the base portion of the fifth binding ring 515 to be disposed with a spacing, at the outer edge 530*b*, except for the vicinity of the protruding portion 530*c*3.

The protrusion 530*h* is formed by bending the tabular metal plate having an L shape in a cross section, constituting the first operating piece 530.

Furthermore, the second operating piece 532 is formed with the protrusion 532*h* which extends to the direction close to the direction connecting the base portion of the first binding ring 512 and the base portion of the fifth binding ring 515 (shown in the X1 and X2 directions of FIG. 34) to be disposed with a spacing, at a position away from the abutting edge 532*a*.

In this embodiment, the protrusion 532*h* extends to the length direction of the second operating piece 532, parallel to the direction connecting the base portion of the first binding ring 512 and the base portion of the fifth binding ring 515.

The protrusion 532*h* continuously protrudes to the side opposite to the direction in which the first binding ring 512 and the fifth binding ring 515 protrude between the base portion of the first binding ring 512 and the base portion of the fifth binding ring 515 to be disposed with a spacing, at the outer edge 532*b*, except for the vicinity of the protruding portion 530*c*3.

The protrusion 532*h* is formed by bending the tabular metal plate having an L shape in a cross section, constituting the second operating piece 532.

Therefore, in the first operating piece 530 and the second operating piece 532, the bend between the base portion of the first binding ring 512 and the base portion of the fifth binding ring 515 are prevented by the protrusions 530*h* and 532*h*.

In the first operating pieces 530, beads 534*a*, 534*b*, and 534*e* protrude toward the upper face in the vicinity of the bases of the first half ring 512*a* and the seventh half ring 515*a* secured in the base portions and in the vicinity of the center of the protruding portion 530*c*3 so that the first operating piece 530 is reinforced so as to reduce the bend.

In the second operating pieces 532, beads 534*c*, 534*d*, and 534*f* protrude toward the upper face in the vicinity of the bases of the second half ring 512*b* and the eighth half ring 515*b* secured in the base portions and in the vicinity of the center of the protruding portion 532*c*3 so that the second operating piece 532 is reinforced so as to reduce the bend.

The bead 534*a* includes a first linear portion 534*a*1 extending in the longitudinal direction of the first operating piece 530 between the base portion of the first half ring 512*a* and the protruding portion 530*c*1, a second linear portion 534*a*2 extending in the longitudinal direction of the first operating piece 530 from the vicinity of the base portion of the first half ring 512*a* inside the protrusion 530*h* (substantially at the center in the width direction of the first operating piece 530), a hatched portion 534*a*3 connecting between the inner edge of the first linear portion 534*a*1 and the outer edge of the second linear portion 534*a*2. The bead 534*a* extrudes the linear projection having the predetermined width from the under side toward the upper face of the first operating piece 530.

The bead 534*b* includes a first linear portion 534*b*1 extending in the longitudinal direction of the first operating piece 530 between the base portion of the seventh half ring 515*a* and the protruding portion 530*c*2, a second linear portion 534*b*2 extending in the longitudinal direction of the first operating piece 530 from the vicinity of the base portion of the seventh half ring 515*a* inside the protrusion 530*h* (substantially at the center in the width direction of the first operating piece 530), a hatched portion 534*b*3 connecting between the inner edge of the first linear portion 534*b*1 and the outer edge of the second linear portion 534*b*2. The bead 534*b* extrudes the linear projection having the predetermined width from the under side toward the upper face of the first operating piece 530.

The bead 534*c* includes a first linear portion 534*c*1 extending in the longitudinal direction of the second operating piece 532 between the base portion of the second half ring 512*b* and the protruding portion 532*c*1, a second linear portion 534*c*2 extending in the longitudinal direction of the second operating piece 532 from the vicinity of the base portion of the second half ring 512*b* inside the protrusion 532*h* (substantially at the center in the width direction of the second operating piece 532), a hatched portion 534*c*3 connecting between the inner edge of the first linear portion 534*c*1 and the outer edge of the second linear portion 534*c*2. The bead 534*c* extrudes the linear projection having the predetermined width from the under side toward the upper face of the second operating piece 532.

The bead 534*d* includes a first linear portion 534*d*1 extending in the longitudinal direction of the second operating piece 532 between the base portion of the eighth half ring 515*b* and the protruding portion 532*c*2, a second linear portion 534*d*2 extending in the longitudinal direction of the second operating piece 532 from the vicinity of the base portion of the eighth half ring 515*b* inside the protrusion 532*h* (substantially at the center in the width direction of the second operating piece 532), a hatched portion 534*d*3 connecting between the inner edge of the first linear portion 534*d*1 and the outer edge of the second linear portion 534*d*2. The bead 534*d* extrudes the linear projection having the predetermined width from the under side toward the upper face of the second operating piece 532.

The bead 534*e* has a linear shape, and is so formed as to spread between the protrusion 530*h* and the protrusion 530*h* which are divided into an upper part and a lower part, in the vicinity of the protruding portion 530*c*3.

The bead 534*f* has the linear shape, and is so formed as to spread between the protrusion 532*h* and the protrusion 532*h* which are divided into an upper part and a lower part, in the vicinity of the protruding portion 532*c*3.

In the binding device of the above embodiments, one opening/closing member is mounted on one pair of the operating pieces. However, in the binding device of this embodiment, a total of two opening/closing members 540 and 542, one each on the upper and lower positions, are mounted in correspondence with lengths of a pair of the operating piece 530 and the operating piece 532.

The protruding portion 530*c*1 is held by the first holding portion 560, the protruding portion 530*c*2 by the first holding portion 562, the protruding portion 532*c*1 by the second holding portion 564, and the protruding portion 532*c*2 by the second holding portion 566, respectively.

Furthermore, the protruding portion 530*c*3 is held by the third holding portion 561, the protruding portion 532*c*3 by the third holding portion 565, respectively.

Next, a three-ring perfect-circle type binding device of another embodiment according to the present invention is described with reference to FIGS. 37 to 41.

A binding device 610 of this embodiment has a configuration substantially the same as the configuration of the binding device 210 of the embodiment described above. However, the configuration of the holding member, the configuration of the operating member, and the configuration of the opening/closing member are different since the number of binding rings is increased. Therefore, a description is mainly given of these differences.

The binding device 610 includes a pair of binding rings, i.e., a first binding ring 612, a second binding ring 613, a third binding device 614, a holding member 616, and an operating member 618. Each of the first binding ring 612, the second binding ring 613, the third binding ring 614 is made of a metal in an approximately annular shape. The holding member 616 has a length that enables the first binding ring 612 and the third binding ring 614 to be disposed with a spacing therebetween. A base of each of the first binding ring 612 and the third binding ring 614 is secured to a surface of the operating member 618 such that the first binding ring 612 and the third binding ring 614 are disposed with a spacing therebetween. The operating member 618 is movably secured inside the holding member 616 such that the first binding ring 612, the second binding ring 613, and the third binding ring 614 are secured to the holding member 616.

The binding rings are of a three-hole type and include three binding rings, i.e., the first binding ring 612, the second binding ring 613, and the third binding ring 614.

The first binding ring 612 includes a first half ring 612*a* and a second half ring 612*b*, the second binding ring 613 includes a third half ring 613*a* and a fourth half ring 613*b*, and the third binding ring 614 includes a fifth half ring 614*a* and a sixth half ring 614*b*.

Then, a binding ring latching portion 650 is formed at the end of the first half ring 612*a* and the second half ring 612*b*, at the end of the third half ring 613*a* and the fourth half ring 613*b*, and at the end of the fifth half ring 614*a* and the sixth half ring 614*b*, i.e., at the top portion of each of the first binding ring 612, the second binding ring 613, and the third binding ring 614, in order to allow an object S such as a paper to be bound by inserting the half rings into binding holes provided in the object S such as the paper in advance.

The first binding ring 612, the second binding ring 613 and the third binding ring 614 constituting the binding rings may be formed by widening a metal-made wire rod having a circular cross-section in a direction for disengaging the binding ring latching portions 650 (the O1 and O2 directions of FIG. 38) and by pressing the central portion of the wire rod to bend in a direction for closing the binding rings.

Then, the first binding ring 612, the second binding ring 613, and the third binding ring 614 are formed into a shape having a substantially bean-shaped cross-section. In the substantially bean-shaped cross-section, the central portion thereof protrudes in a direction for opening the binding ring (the O3 direction in FIG. 38 for the first half ring 612*a*, the third half ring 613*a*, and fifth half ring 614*a* and the O4 direction in FIG. 38 for the second half ring 612*b*, the fourth half ring 613*b*, and sixth half ring 614*b*), and the both edges thereof are bent in a direction for closing the binding ring.

In other words, when the annular first binding ring 612, the second binding ring 613, and the third binding ring 614 are viewed from the opening/closing direction, a wavy surface is formed on the inner side of the first binding ring 612, the second binding ring 613, and the third binding ring 614, and the outer side of the first binding ring 612, the second binding ring 613, and the third binding ring 614 is formed into a semicircular arc shape.

Furthermore, as viewed from a direction for disengaging the binding rings, each of the first binding ring 612, the second binding ring 613, and the third binding ring 614 has opposite outer edges formed into a semicircular arc shape.

Conventional binding rings having a circular cross-section do not resist deformation when the diameter is small. When the diameter is increased, the cross-sectional area increases to increase cost for the material therefor. Since binding holes formed in the object S such as the paper are usually circular holes, conventional binding rings having a substantially rectangular cross-section are not well suitable for the binding holes of the object S such as the paper and are likely to damage the binding holes of the paper.

Meanwhile, when the first binding ring 612, the second binding ring 613, and the third binding ring 614 constituting the binding rings are thin, the binding ring latching portions 650 may not be securely fitted with each other.

Hence, it is desirable to increase the width of the first binding ring 612, the second binding ring 613, and the third binding ring 614. However, even in a case in which a wire rod having a small cross-sectional area is employed as a raw wire rod, it is desirable to ensure a required width for a binding ring by machining the raw metal-made wire rod.

Therefore, in the binding rings according to the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring latching portion 650, whereby the binding ring latching portions 650 can be completely engaged with each other.

The holding member 616 has a substantially rectangular shape in a plan view having a length which allows the first binding ring 612, the second binding ring 613, and the third binding ring 614 to be disposed with a predetermined spacing therebetween. Furthermore, both the end portions of the holding member 616, or portions in the vicinity of an attachment hole 620 for attaching the holding member 616 to a cover A, are formed into a substantially semicircular arc shape in a plan view.

The holding member 616 is configured to have a holding space inside a bound object-mounting portion 622, and the operating member 618 and the like are contained in the holding space.

Along both edges of the bound object-mounting portion 622 of the holding member 616 are provided holding walls 624 each of which extends in the longitudinal direction of the bound object-mounting portion 622 substantially from one end of the bound object-mounting portion 622 to the other end and slidably holds the operating member 618.

In this embodiment, holding walls 624*a* and 624*b* are provided consecutively so as to hang down from substantially entire portions extending, in the longitudinal direction of the holding member 616, inwardly between the vicinities outside the first binding ring 612, the second binding ring 613, and the third binding ring 614.

Furthermore, the first holding wall 624*a* and the second holding wall 624*b* are in parallel with each other and have substantially the same plate-like shape.

The operating member 618 to be described in detail later and the like are contained in the holding space surrounded by the first holding wall 624*a* and the second holding wall 624*b* and the bound object-mounting portion 622

First through holes 626, second through holes 627, and third through holes 628 for respectively allowing the first binding ring 612, the second binding ring 613, and the third binding ring 614 to loosely pass through with a predetermined distance (a predetermined length determined by Japanese Industrial Standards or the like) therebetween are provided through the bound object-mounting portion 622 of the holding member 616.

The first through holes 626, the second through holes 627, and the third through holes 628 are provided so as to correspond to each half ring constituting each binding ring. The first through holes 626, the second through holes 627, and the third through holes 628 are provided in a width direction of the holding member 616 at a predetermined distance, parting right and left.

Similarly to the operating pieces of the binding device 10 of the above embodiments, the operating pieces constituting the operating member 618 have a pair of left and right operating pieces.

A first operating piece 630 and a second operating piece 632 are formed similarly to the first operating piece 530 and the second operating piece 532, respectively, of the embodiment described above, the base portion of the first half ring 612*a*, the third half ring 613*a*, and the fifth half ring 614*a* being secured to the first operating piece 630, the base portion of the second half ring 612*b*, the fourth half ring 613*b*, and the sixth half ring 614*b* being secured to the second operating piece 632.

The first operating piece 630 and the second operating piece 632 are formed with the two pairs of the opening/closing member housing portions 636A and 636B. In addition, in the vicinity outside two pairs of the opening/closing member fixing portions 638*a*1 and 638*a*2 formed on the surface (under side) of the opening/closing member housing portion 636A and the opening/closing member fixing portions 638*b*1 and 638*b*2 formed on the surface (under side) of the opening/closing member housing portion 636B, two movement restricting portions are formed for restricting the movement of the first operating piece 630 and the second operating piece 632 to the longitudinal direction.

Then, the opening/closing member 640 is mounted in the opening/closing member housing portion 636A, and is provided, i.e., fixed, in such a manner as to obliquely intersect the abutting edges 630*a* and 632*a* spreading between the opening/closing member fixing portion 638*a*1 of the first operating piece 630 and the opening/closing member fixing portion 638*b*1 of the second operating piece 632. The opening/closing member 642 is mounted in the opening/closing member housing portion 636B, and is provided, i.e., is fixed, in such a manner as to obliquely intersect the abutting edges 630*a* and 632*a* spreading between the opening/closing member fixing portion 638*a*2 of the first operating piece 630 and the opening/closing member fixing portion 638*b*2 of the second operating piece 632.

The securing end portion 640*a* of the opening/closing member 640 is fixed to the opening/closing member fixing portion 638*a*1 of the first operating piece 630, and the securing end portion 640*b* is fixed to the opening/closing member fixing portion 638*b*1 of the second operating piece 632, respectively. The securing end portion 642*a* of the opening/ closing member 642 is fixed to the opening/closing member fixing portion 638*a*2 of the first operating piece 630, and the securing end portion 642*b* is fixed to the opening/closing member fixing portion 638*b*2 of the second operating piece 632, respectively.

The first operating piece 630 is formed with the protrusion 630*h* which extends to the direction close to the direction connecting the base portion of the first binding ring 612 and the base portion of the third binding ring 614 (shown in the X1 and X2 directions of FIG. 39) to be disposed with a spacing, at a position away from the abutting edge 630*a*.

In this embodiment, the protrusion 630*h* extends to the length direction of the first operating piece 630, parallel to the direction connecting the base portion of the first binding ring 612 and the base portion of the third binding ring 614.

The protrusion 630*h* continuously protrudes to the side opposite to the direction in which the first binding ring 612 and the third binding ring 614 protrude between the base portion of the first binding ring 612 and the base portion of the third binding ring 614 to be disposed with a spacing, at the outer edge 630*b*, except for the vicinity of the protruding portion 630*c*3.

The protrusion 630*h* is formed by bending the tabular metal plate having an L shape in a cross section, constituting the first operating piece 630.

Furthermore, the second operating piece 632 is formed with the protrusion 632*h* which extends to the direction close to the direction connecting the base portion of the first binding ring 612 and the base portion of the third binding ring 614 (shown in the X1 and X2 directions of FIG. 39) to be disposed with a spacing, at a position away from the abutting edge 632*a*

In this embodiment, the protrusion 632*h* extends to the length direction of the second operating piece 632, parallel to the direction connecting the base portion of the first binding ring 612 and the base portion of the third binding ring 614.

The protrusion 632*h* continuously protrudes to the side opposite to the direction in which the first binding ring 612 and the third binding ring 614 protrude between the base portion of the first binding ring 612 and the base portion of the third binding ring 614 to be disposed with a spacing, at the outer edge 632*b*, except for the vicinity of the protruding portion 632*c*3.

The protrusion 632*h* is formed by bending the tabular metal plate having an L shape in a cross section, constituting the second operating piece 632.

Therefore, in the first operating piece 630 and the second operating piece 632, the bend between the base portion of the first binding ring 612 and the base portion of the third binding ring 614 is prevented by the protrusions 630*h* and 632*h*.

In the first operating piece 630, beads 634*a*, 634*b*, and 634*e* protrude toward the upper face in the vicinity of the bases of the first half ring 612*a*, the third half ring 613*a*, the fifth half ring 614*a* secured in the base portions so that the first operating piece 630 is reinforced so as to reduce the bend.

In the second operating piece 632, beads 634*c*, 634*d*, and 634*f* protrude toward the upper face in the vicinity of the bases of the second half ring 612*b*, the fourth half ring 613*b*, and the sixth half ring 614*b* secured in the base portions so that the second operating piece 632 is reinforced so as to reduce the bend.

The bead 634*a* includes a first linear portion 634*a*1 extending in the longitudinal direction of the first operating piece 630 between the base portion of the first half ring 612*a* and the protruding portion 630*c*1, a second linear portion 634*a*2 extending in the longitudinal direction of the first operating piece 630 from the vicinity of the base portion of the first half ring 612*a* inside the protrusion 630*h* (substantially at the center in the width direction of the first operating piece 630), a hatched portion 634*a*3 connecting between the inner edge of the first linear portion 634*a*1 and the outer edge of the second linear portion 634*a*2. The bead 634*a* extrudes the linear projection having the predetermined width from the under side toward the upper face of the first operating piece 630.

The bead 634*b* includes a first linear portion 634*b*1 extending in the longitudinal direction of the first operating piece 630 between the base portion of the fifth half ring 614*a* and the protruding portion 630*c*2, a second linear portion 634*b*2 extending in the longitudinal direction of the first operating piece 630 from the vicinity of the base portion of the fifth half ring 614*a* inside the protrusion 630*h* (substantially at the center in the width direction of the first operating piece 630), a hatched portion 634*b*3 connecting between the inner edge of the first linear portion 634*b*1 and the outer edge of the second linear portion 634*b*2. The bead 634*b* extrudes the linear projection having the predetermined width from the under side toward the upper face of the first operating piece 630.

The bead 634*c* includes a first linear portion 634*c*1 extending in the longitudinal direction of the second operating piece 632 between the base portion of the second half ring 612*b* and the protruding portion 632*c*1, a second linear portion 634*c*2 extending in the longitudinal direction of the second operating piece 632 from the vicinity of the base portion of the second half ring 612*b* inside the protrusion 632*h* (substantially at the center in the width direction of the second operating piece 632), a hatched portion 634*c*3 connecting between the inner edge of the first linear portion 634*c*1 and the outer edge of the second linear portion 634*c*2. The bead 634*c* extrudes the linear projection having the predetermined width from the under side toward the upper face of the second operating piece 632.

The bead 634*d* includes a first linear portion 634*d*1 extending in the longitudinal direction of the second operating piece 632 between the base portion of the sixth half ring 614*b* and the protruding portion 632*c*2, a second linear portion 634*d*2 extending in the longitudinal direction of the second operating piece 632 from the vicinity of the base portion of the sixth half ring 614*b* inside the protrusion 632*h* (substantially at the center in the width direction of the second operating piece 632), a hatched portion 634*d*3 connecting between the inner edge of the first linear portion 634*d*1 and the outer edge of the second linear portion 634*d*2. The bead 634*d* extrudes the linear projection having the predetermined width from the under side toward the upper face of the second operating piece 632.

The bead 634*e* is so formed as to spread between the protrusion 630*h* and the protrusion 630*h* which are divided into an upper part and a lower part, between the base portion of the third half ring 613*a* and the protruding portion 630*c*3.

The bead 634*e* includes a first linear portion 634*e*1 extending in the longitudinal direction of the first operating piece 630 between the base portion of the third half ring 613*a* and the protruding portion 630*c*3, a second linear portion 634*e*2 extending in the longitudinal direction of the first operating piece 630 from the vicinity of the base portion of the fifth half ring 613*a* inside the protrusion 630*h*, a hatched portion 634*e*3 connecting between the first linear portion 634*e*1 and the second linear portion 634*e*2. The bead 634*e* extrudes the linear projection having the predetermined width from the under side toward the upper face of the first operating piece 630.

The bead 634*f* is so formed as to spread between the protrusion 632*h* and the protrusion 632*h* which are divided into an upper part and a lower part, between the base portion of the fourth half ring 613*b* and the protruding portion 632*c*3.

The bead 634*f* includes a first linear portion 634*f*1 extending in the longitudinal direction of the second operating piece 632 between the base portion of the fourth half ring 613*b* and the protruding portion 632*c*3, a second linear portion 634*f*2 extending in the longitudinal direction of the second operating piece 632 from the vicinity of the base portion of the third half ring 613*b* inside the protrusion 632*h*, a hatched portion 634*f*3 connecting between the first linear portion 634*f*1 and the second linear portion 634*f*2. The bead 634*f* extrudes the linear projection having the predetermined width from the under side toward the upper face of the second operating piece 632.

In the binding device of the above embodiments, one opening/closing member is mounted on one pair of the operating pieces. However, in the binding device of this embodiment, two opening/closing members 640 and 642 may be mounted on a pair of operating pieces.

Furthermore, only one opening/closing member between total two of the opening/closing member 640 and the opening/closing member 642 may be mounted.

The protruding portion 630*c*1 is held by the first holding portion 660, the protruding portion 630*c*2 by the first holding portion 662, the protruding portion 632*c*1 by the second holding portion 664, and the protruding portion 632*c*2 by the second holding portion 666, respectively.

Furthermore, the protruding portion 630*c*3 is held by the third holding portion 661, the protruding portion 632*c*3 by the third holding portion 665, respectively.

In the embodiments described above, a pair of operating pieces is formed with a protruding portion to be inserted into a through hole formed in a holding member. Therefore, even when the base portions of binding rings are secured to the operating piece by, for example, swaging, the area can be increased in order to reduce stress applied to the operating piece.

Therefore, the strength of the operating piece as a whole can be increased.

In addition, a common through hole can be used as a through hole for inserting the protruding portion of the operating piece and a through hole for inserting the binding rings. Therefore, the structure of the holding member can be simplified, thereby achieving cost reduction.

The opening/closing member 40, the opening/closing member fixing portions 38*a* and 38*b* may be changed as described below.

Figure 42:
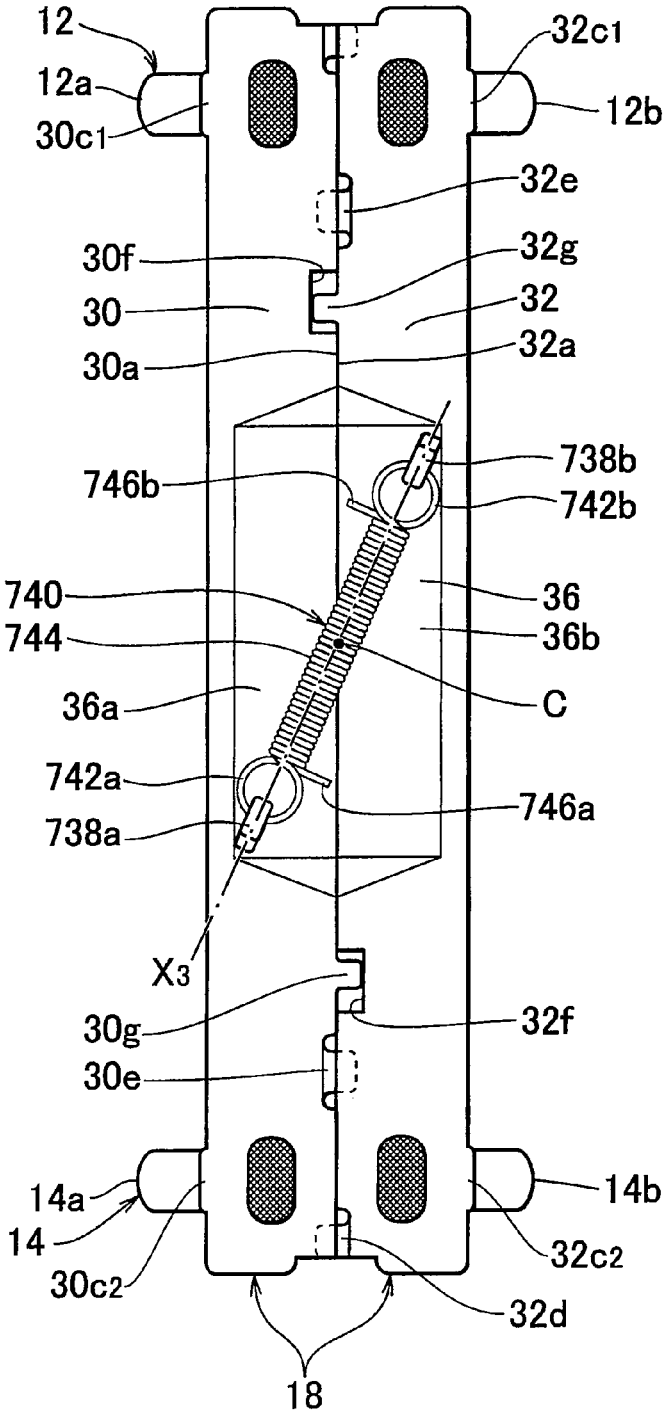
FIG. 42 is a schematic bottom view showing an alternative example of the opening/closing member and the operating members.
Figure 43:
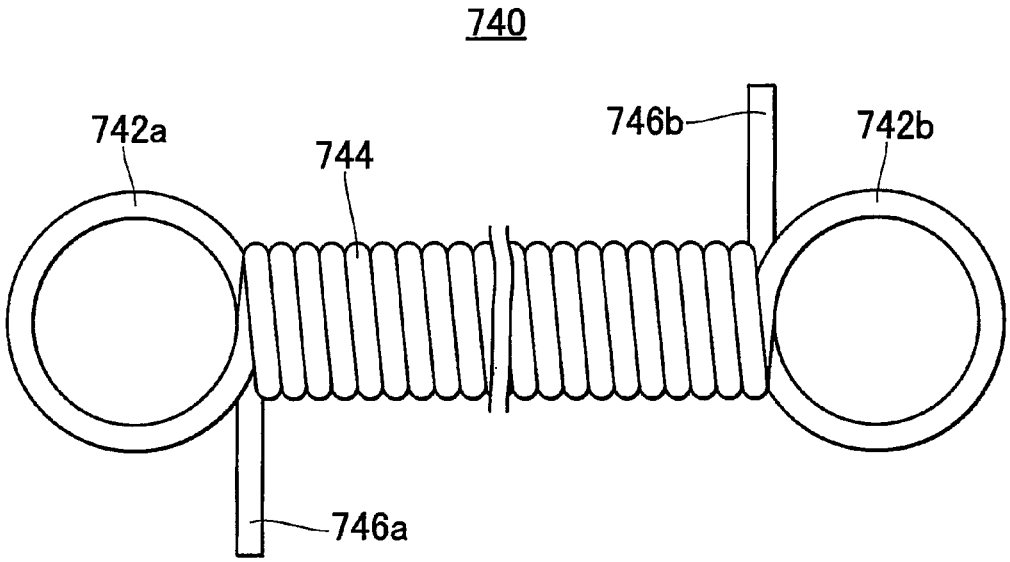
FIG. 43 is a plan view showing an alternative example of the opening/closing member.
Figure 44:
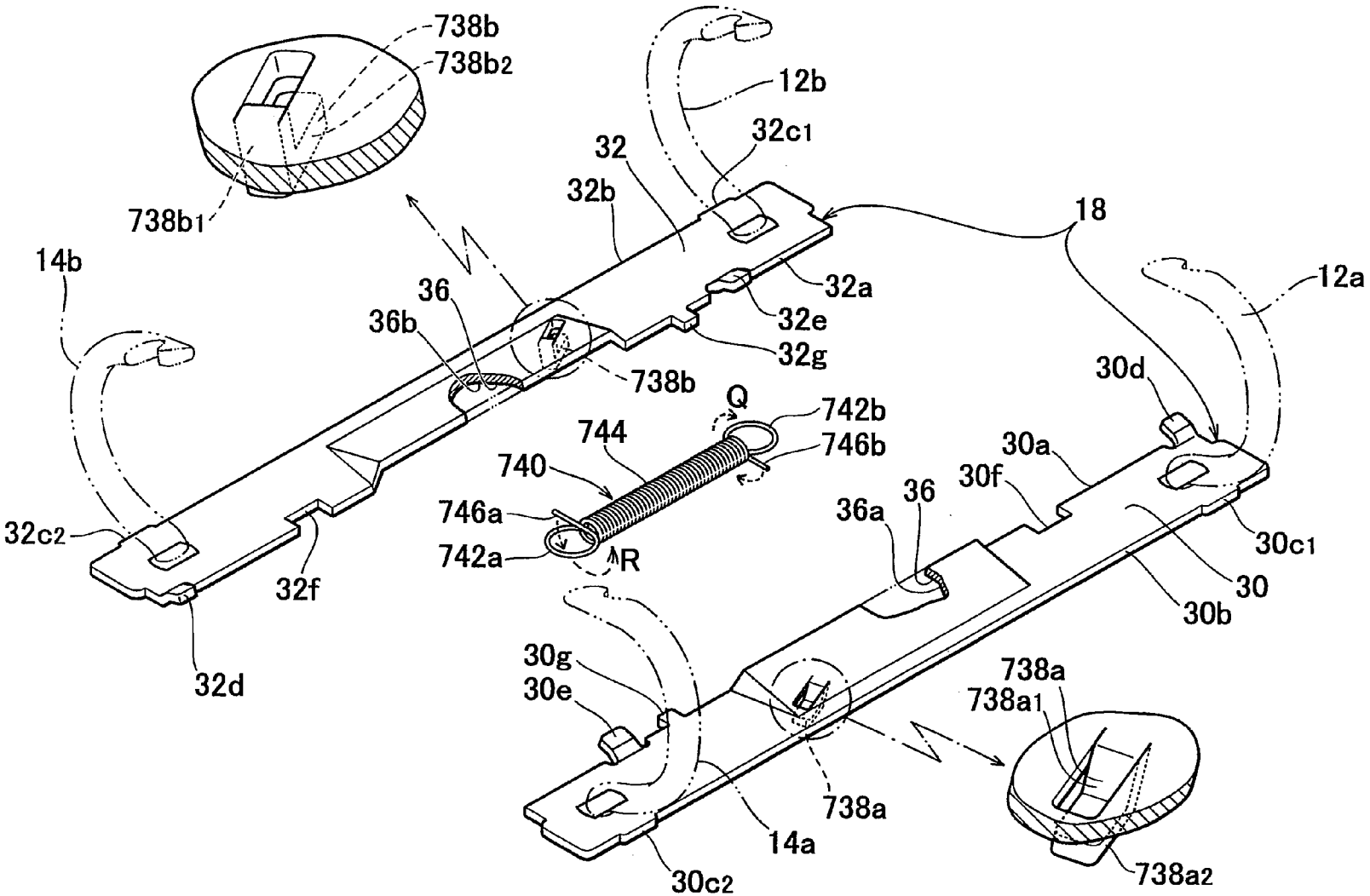
FIG. 44 is a schematic perspective view showing an alternative example of the operating members and the opening/closing member.

FIGS. 42 to 44 are alternative embodiments of the binding device 10 shown in FIG. 1.

As shown in FIGS. 42 to 44, the opening/closing member fixing portions 738*a* and 738*b* may be formed so that the coil portion 744 of the opening/closing member 740 is so provided as to extend obliquely intersecting the abutting edge 30*a* and the abutting edge 32*a*, along the line X3 (shown in FIG. 42) connecting the center C (shown in FIG. 42) in the longitudinal direction of the abutting edges 30*a* and 32*a* and the opening/closing member fixing portions 738*a* and 738*b*.

In other words, the opening/closing member fixing portion 738*a* of the opening/closing member 740 may be formed so that opening/closing member 740 is extent along the line X3 (shown in FIG. 42) connecting the center C in the longitudinal direction of the abutting edge 30*a* and the opening/closing member fixing portion 738*a*.

The opening/closing member fixing portion 738*b* of the opening/closing member 740 may be formed so that opening/closing member 740 is extent along the line X3 (shown in FIG. 42) connecting the center C in the longitudinal direction of the abutting edge 32*a* and the opening/closing member fixing portion 738*b*.

The latching base portion 738*a*1 of the opening/closing member fixing portion 738*a* and the latching base portion 738*b*1 of the opening/closing member fixing portion 738*b* are orthogonal to the line X3. At the tip end (lower end) of the latching base portion 738*a*1 of the opening/closing member fixing portion 738*a* and the latching base portion 738*b*1 of the opening/closing member fixing portion 738*b*, the latching and locking portion 738*a*2 (of the opening/closing member fixing portion 738*a*) and the latching and locking portion 738*b*2 (of the opening/closing member fixing portion 738*b*) extending along the line X3 (shown in FIG. 42) to the side opposite to the opening/closing member 740 are formed. The opening/closing member fixing portions 738*a* and 738*b* are formed in a substantially L shape in a side view.

The opening/closing member fixing portions 738*a* and 738*b* are formed so as to be point-symmetric, defining the center C (shown in FIG. 42) in the longitudinal direction of the abutting edges 30*a* and 32*a* as a center.

Furthermore, the size or shape of the one securing end portion 42*a* of the opening/closing member 40 and the other securing end portion 42*b* of the opening/closing member 40 may be changed to the size or shape of one securing end portion 742*a* of the opening/closing member 740 and the other securing end portion 742*b* of the opening/closing member 740 as shown in FIG. 43. In addition, the length of the restricting arm portions 46*a* and 46*b* may be changed to the length of the restricting arm portion 746*a* of the opening/closing member 740 and the restricting arm portion 746*b* of the opening/closing member 740 as shown in FIG. 43. One of the restricting arm portions 46*a* and 46*b* may be removed.

A two-ring perfect-circle type binding device of another embodiment according to the present invention is described.

Figure 45:
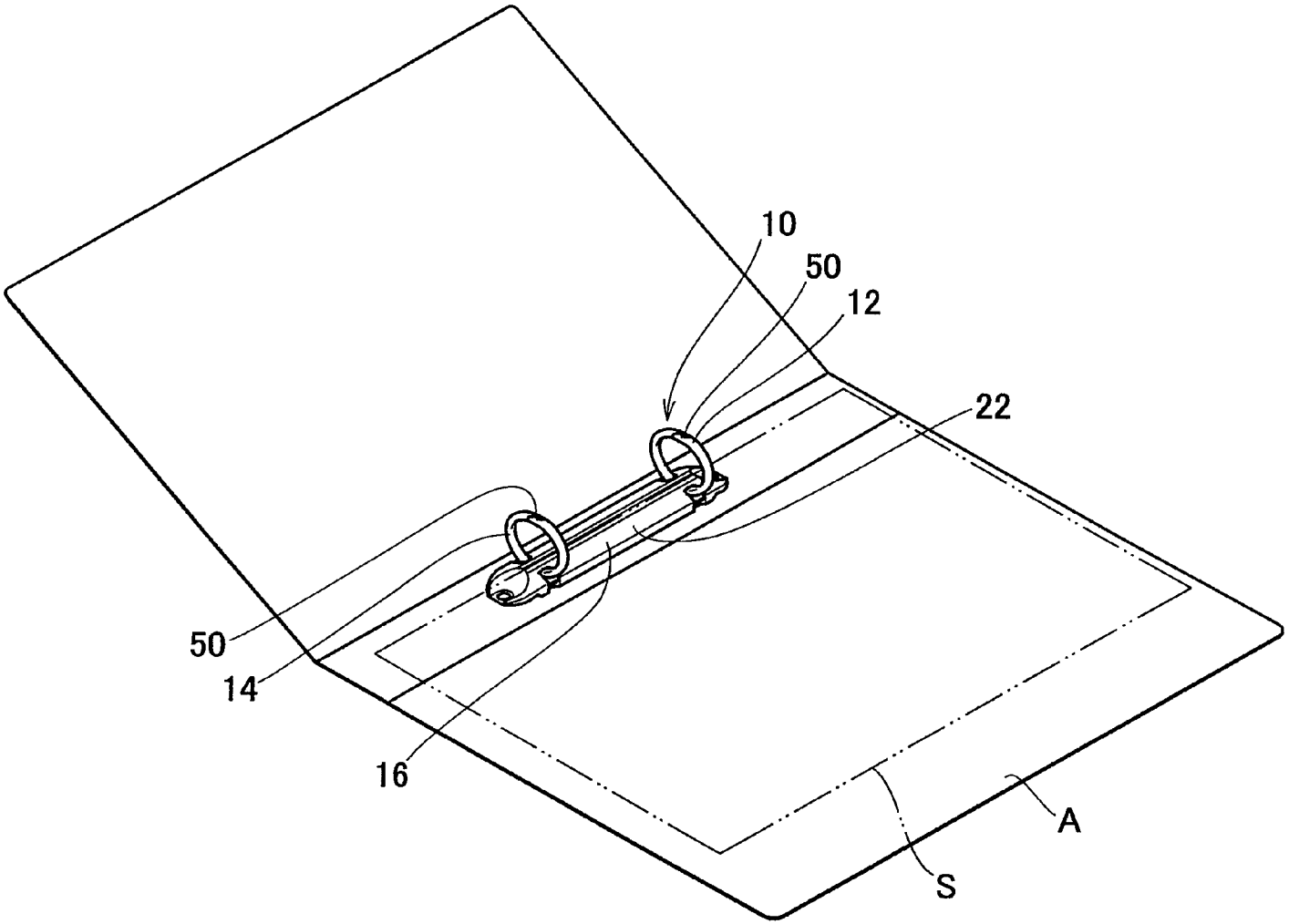
FIG. 45 is a perspective view showing a file with the binding device according to an embodiment of the present invention.

FIG. 45 is a perspective view showing a file with the binding device according to an embodiment of the present invention.

Figure 46:
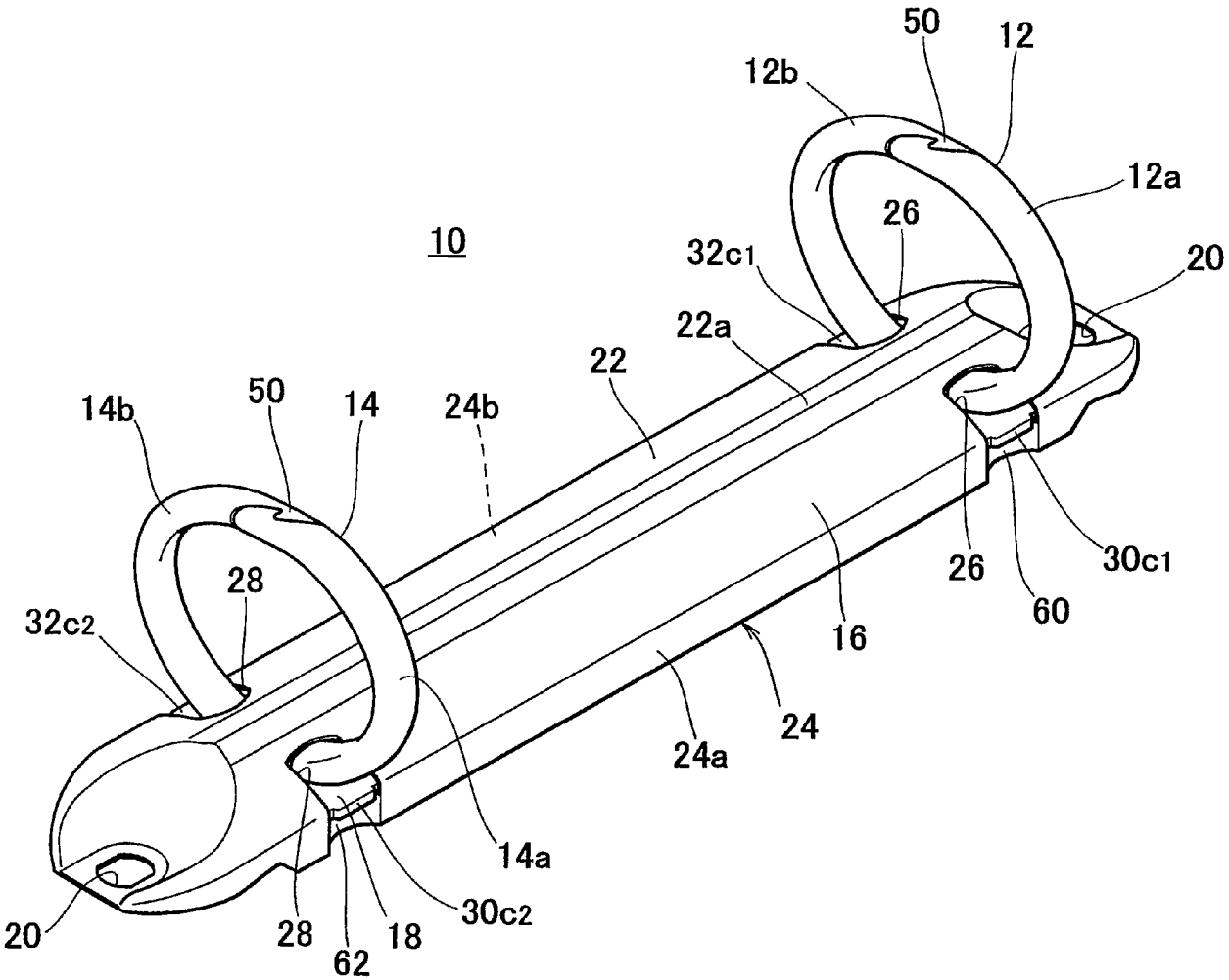
FIG. 46 is a perspective view showing an example of the binding device according to an embodiment of the present invention.
Figure 47:
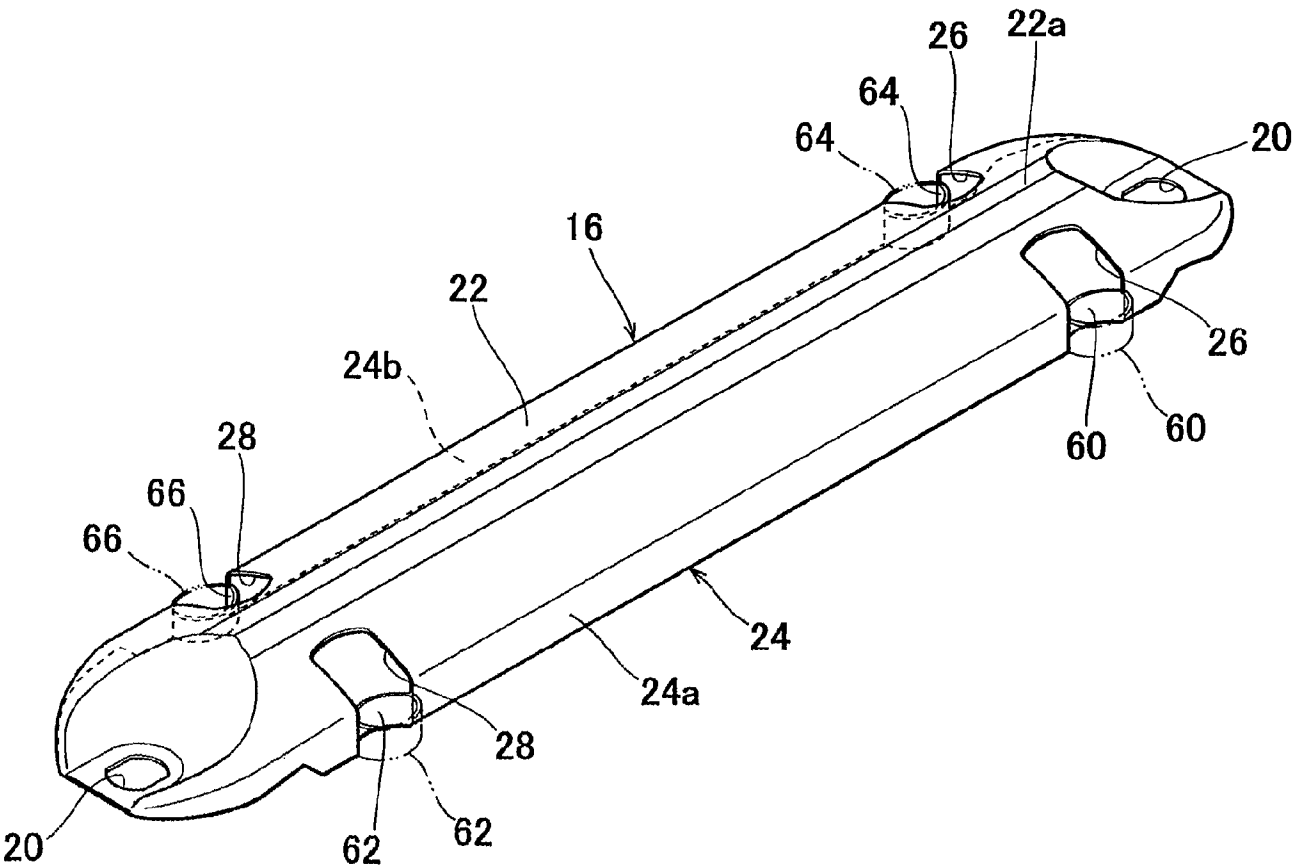
FIG. 47 is a perspective view of the holding member.

FIG. 46 is a perspective view showing an example of the binding device according to an embodiment of the present invention. FIG. 47 is a perspective view of the holding member.

Figure 48:
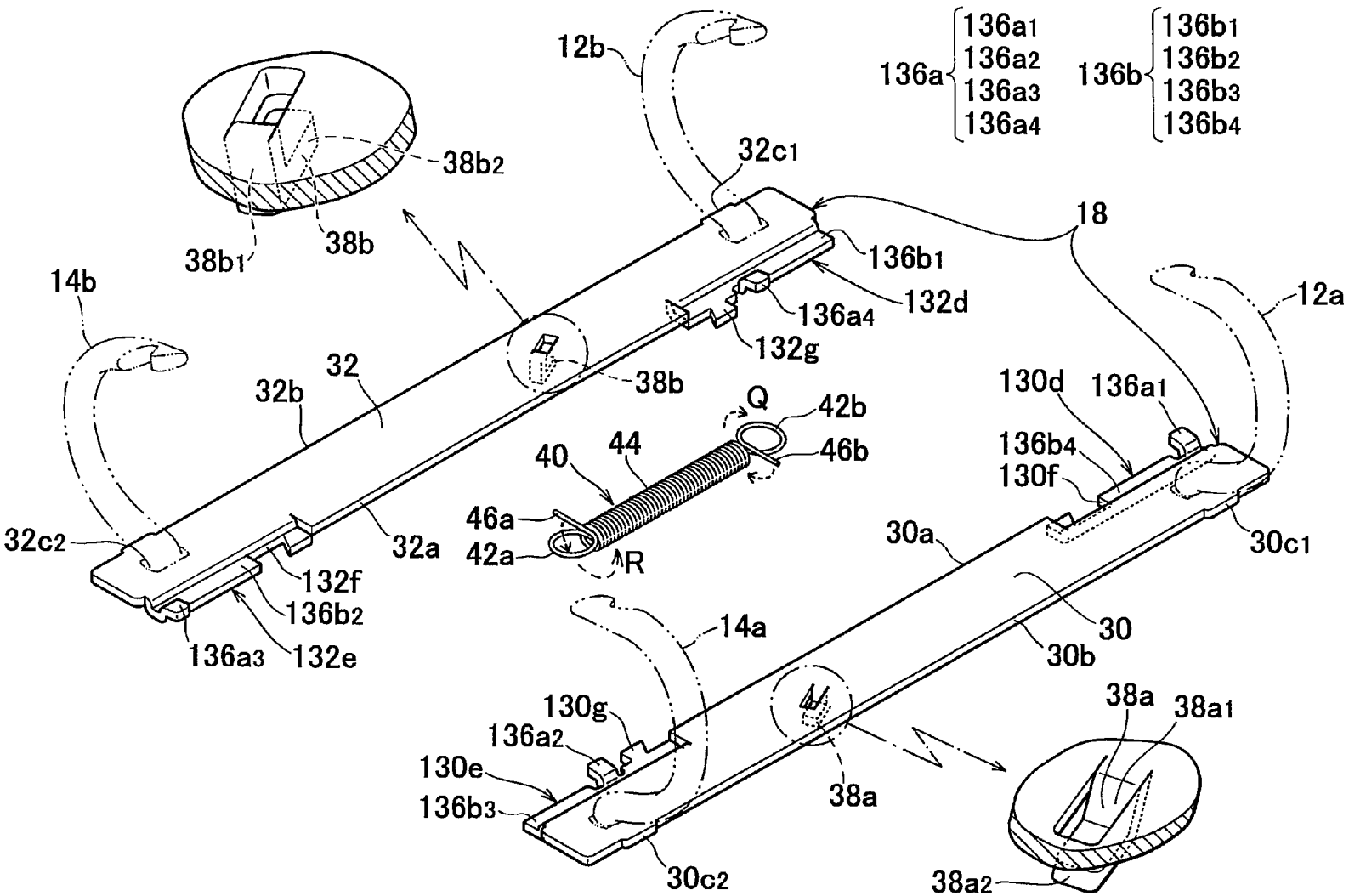
FIG. 48 is a schematic perspective view of the operating members and the opening/closing member.

FIG. 48 is a schematic perspective view of the operating members and the opening/closing member.

Figure 49:
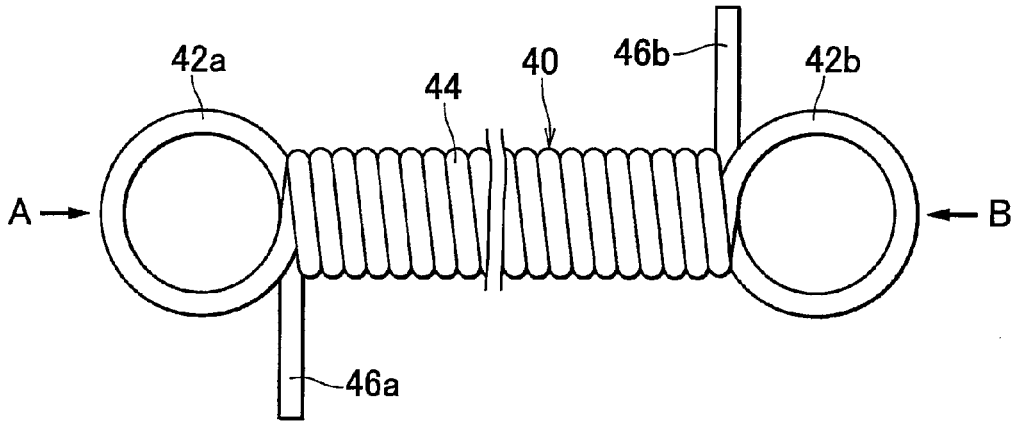
FIG. 49 is a plan view of the opening/closing member.

FIG. 49 is a plan view of the opening/closing member.

FIGS. 50(A), 50(B), and 50(C) are schematic side views of opening/closing members, where FIG. 50(A) is a schematic side view in an original state, and FIGS. 50(B) and 50(C) are schematic side views in which the coil portions are secured to the operating pieces by applying forces to the circumferential direction of the coil portions.

FIG. 51 (A) is a schematic plan view showing the binding rings and the operating members in a closed state. FIG. 51(B) is a schematic left side view showing the binding rings and the operating members in a closed state. FIG. 51(C) is a schematic elevation view showing the binding ring and the operating members in a closed state. FIG. 51(D) is a schematic bottom view showing the binding rings and the operating members in a closed state.

Figure 52:
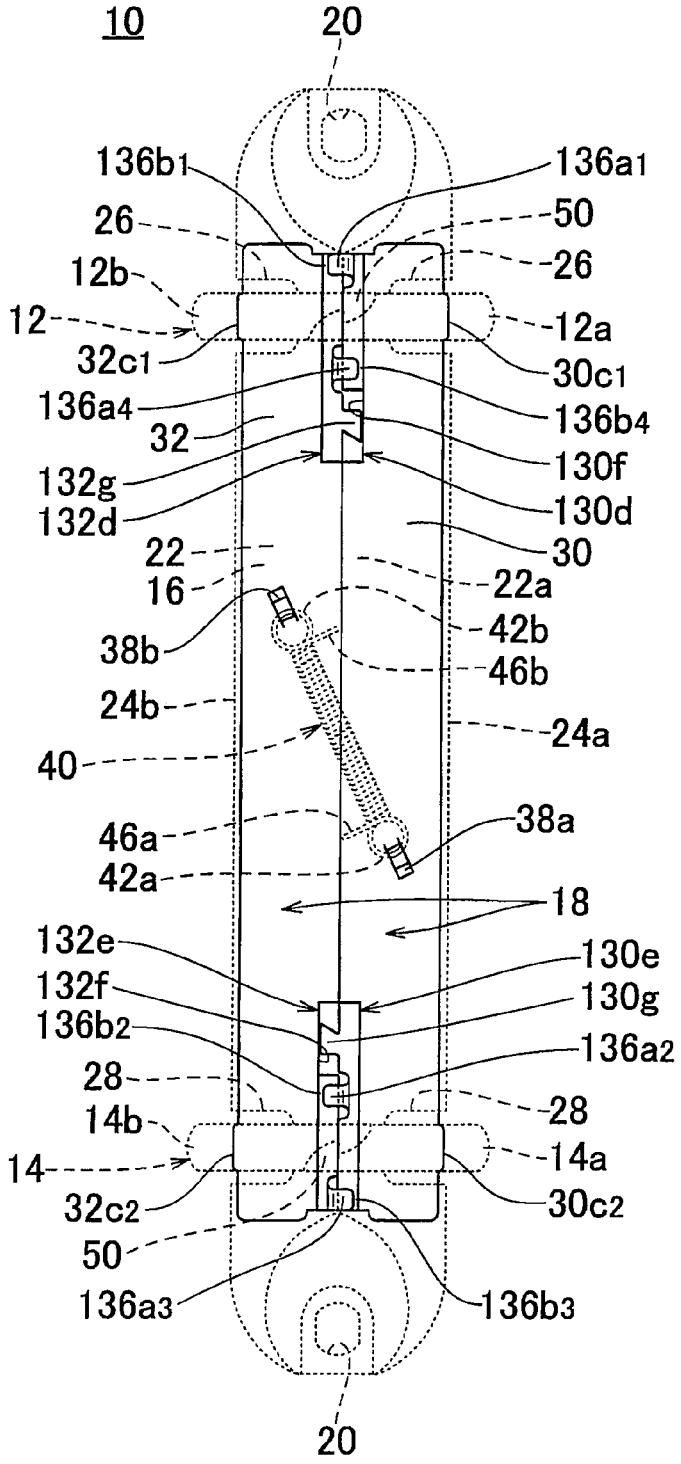
FIG. 52 is a schematic plan view of the binding device in a closed state.

FIG. 52 is a schematic plan view of the binding device in a closed state.

Figure 53:
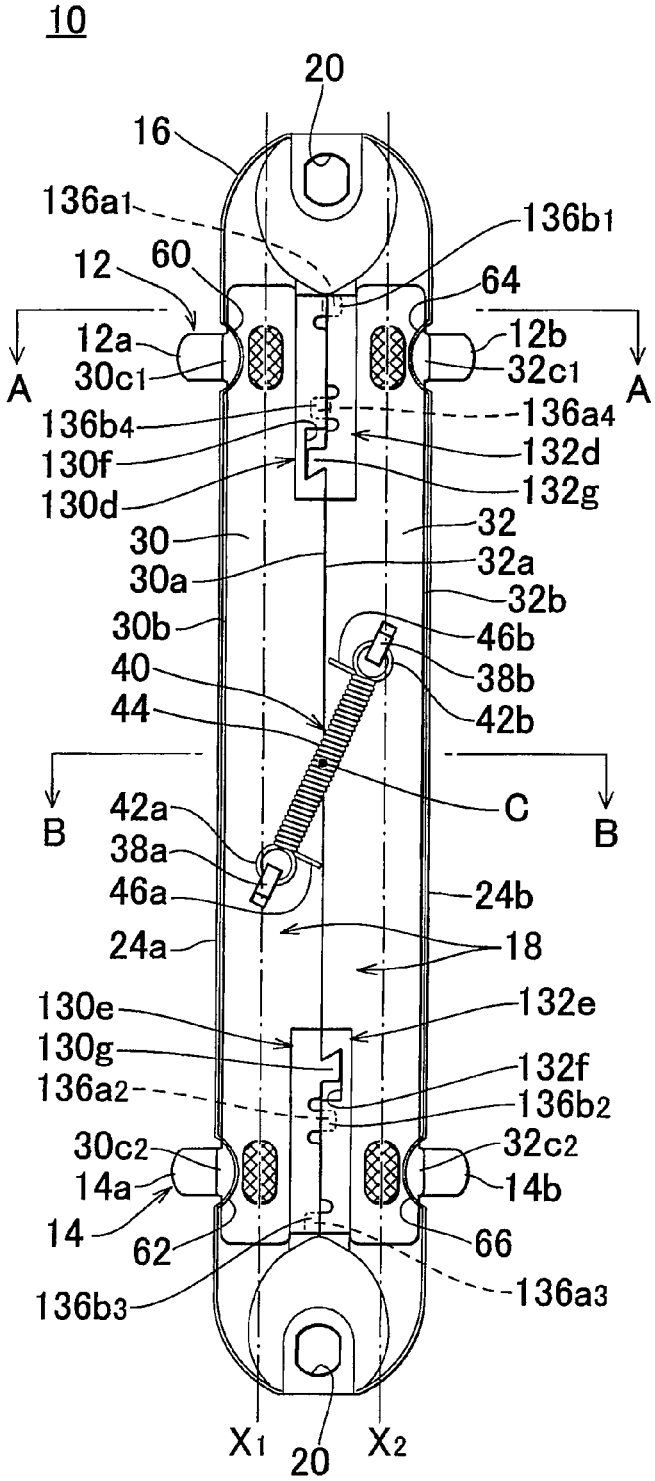
FIG. 53 is a bottom view of the binding device in a closed state.

FIG. 53 is a bottom view of the binding device in a closed state.

FIGS. 54(A) and 54(B) are cross-sectional views of the binding devices in a closed state, where FIG. 54(A) is a cross-sectional view taken along the line A-A in FIG. 53, and FIG. 54(B) is a cross-sectional view taken along the line B-B in the schematic view, FIG. 53.

Figure 55:
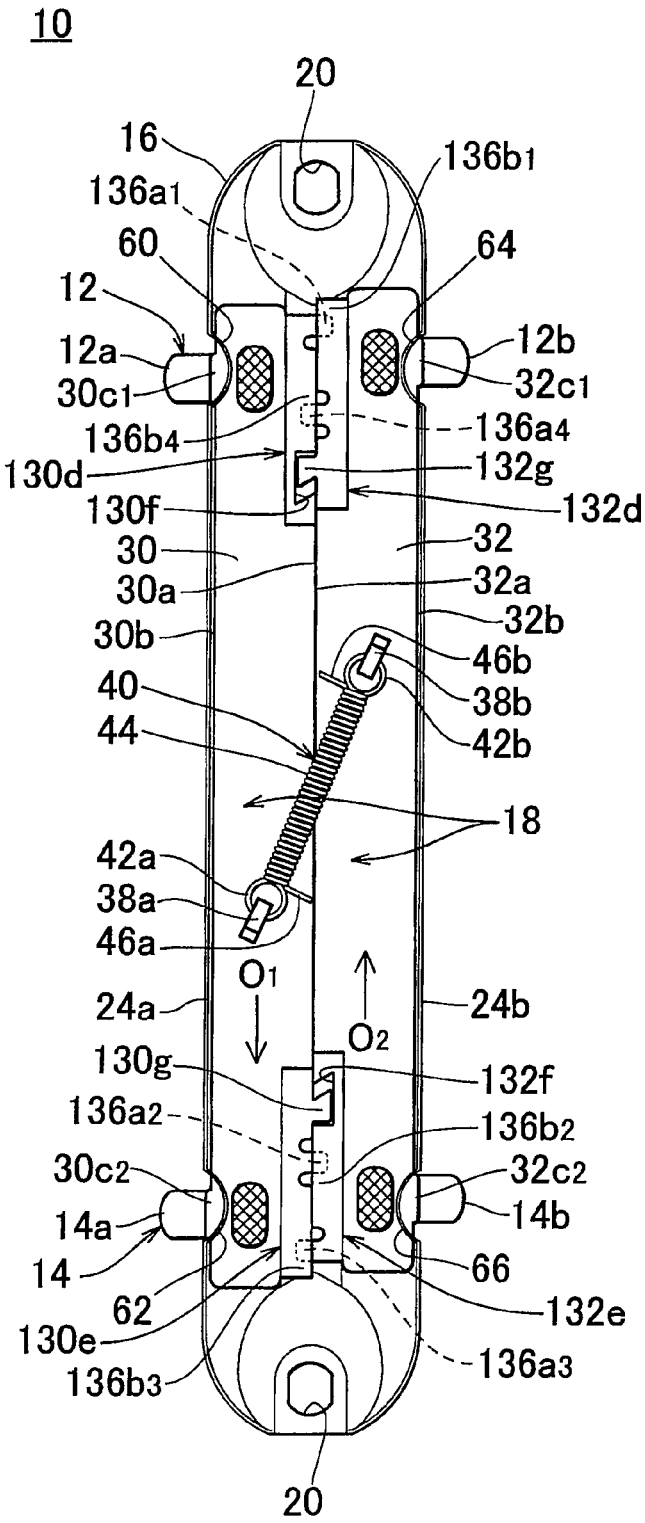
FIG. 55 is a bottom view of the binding device showing a state in which the binding rings are opened.

FIG. 55 is a bottom view of the binding device showing a state in which the binding rings are opened.

Figure 56:
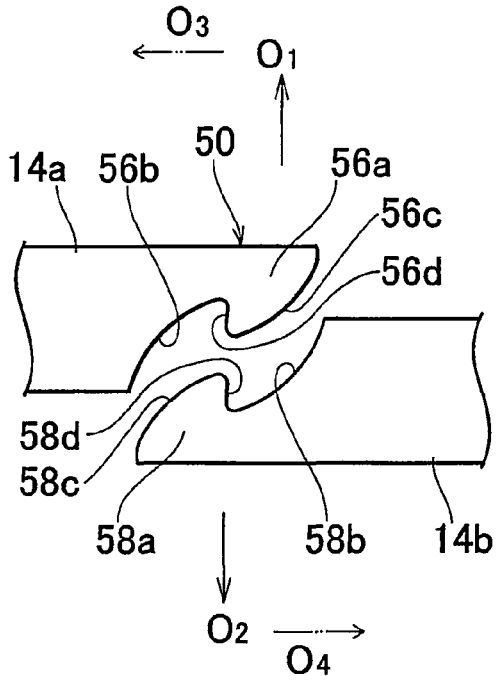
FIG. 56 is a schematic view of the binding rings of the binding device showing a state in which the binding rings are opened.
Figure 56:
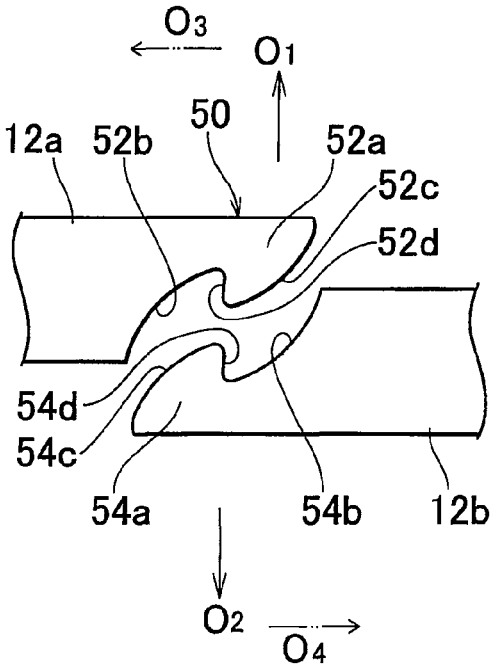
Figure 57:
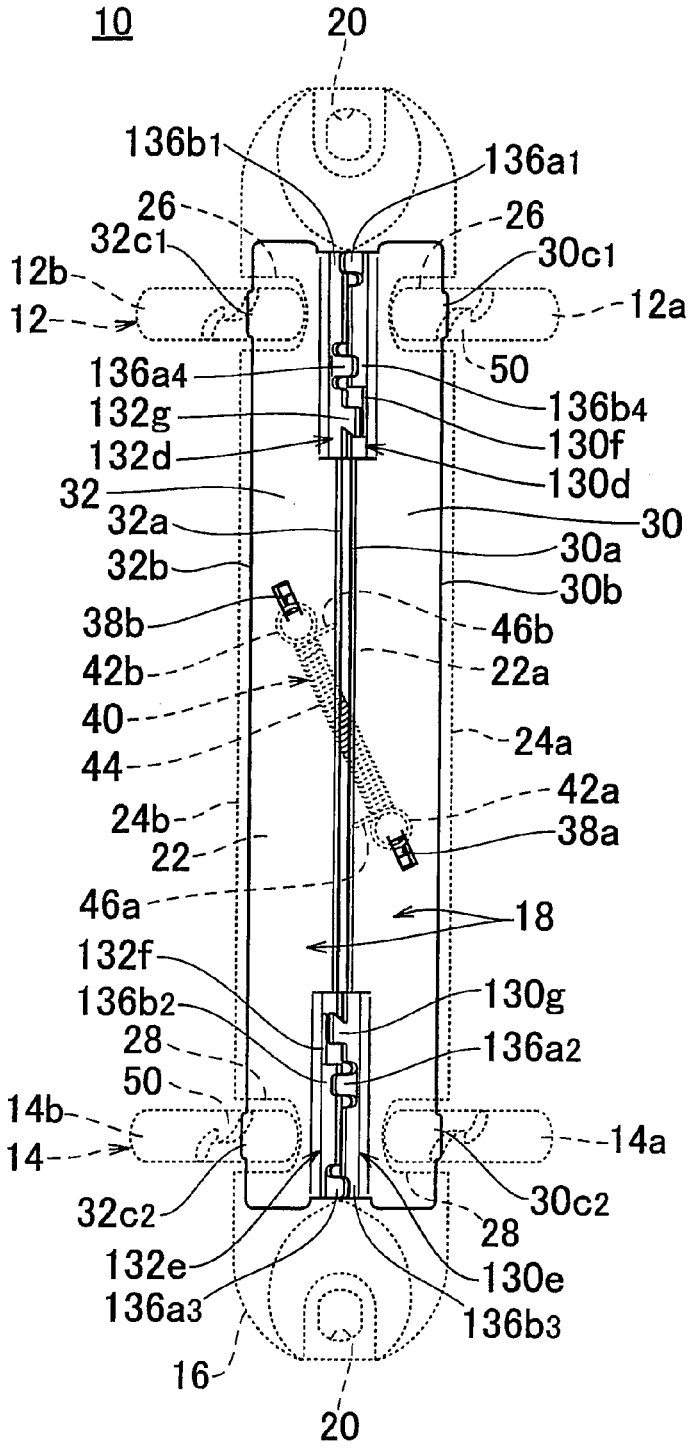
FIG. 57 is a schematic plan view showing the binding device in an opened state.

FIG. 56 is a schematic view of the binding rings of the binding device showing a state in which the binding rings are opened.

A binding device 10 shown in FIGS. 45 and 46 is secured onto an inner surface of a spine between a pair of folding lines, i.e., a right folding line and a left folding line, provided in the approximate center of a cover A. The cover A is made of a relatively hard sheet material, such as cardboard.

As a securing method, fastening tools such as a bolt and a nut or an eyelet are inserted into attachment holes 20 (described below in detail) provided at both ends of the binding device 10 in a longitudinal direction so as to secure the binding device 10 to the spine, thereby fixing the binding device 10 to the spine.

In this embodiment, the description is made using a bolt and a nut as fastening tools. However, the fastening tools are not limited thereto. For example, a screw, an eyelet, a rivet, and other suitable fastening tools can also be used.

The binding device 10 includes a pair of binding rings, i.e., a first binding ring 12 and a second binding ring 14, a holding member 16, and an operating member 18. Each of the first binding ring 12 and the second binding ring 14 is made of a metal in an approximately annular shape. The holding member 16 has a length that enables the first binding ring 12 and the second binding ring 14 to be disposed with a spacing therebetween. A base of each of the first binding ring 12 and the second binding ring 14 is secured to a surface of the operating member 18 such that the first binding ring 12 and the second binding ring 14 are disposed with a spacing therebetween. The operating member 18 is movably secured inside the holding member 16 such that the first binding ring 12 and the second binding ring 14 are secured to the holding member 16.

This binding device 10 is of an openable-closable two-hole type, i.e., the binding rings thereof include the first binding ring 12 serving as a main binding ring and the second binding ring 14 serving as a subsidiary binding ring.

The first binding ring 12 and the second binding ring 14 are configured such that their binding ring latching portions 50 can be disengaged with fingers in the same direction.

Then, when the binding rings are closed, the first binding ring 12 serving as the main binding ring is configured to be closed by directly sandwiching the first binding ring 12 between, for example, the thumb and first finger.

Then, when the first binding ring 12 is operated in a closing direction by sandwiching it between two fingers, the second binding ring 14 serving as the subsidiary binding ring is operated following this operation.

The holding member 16 is an approximately rectangular shape in a plan view, having a length that enables the first binding ring 12 and the second binding ring 14 to be provided at a predetermined distance from one another. Both ends of the holding member 16, i.e., in the vicinity of the attachment holes 20 for attachment to the cover A, are configured to have an approximately semicircular arc shape in a plan view.

The holding member 16 has a bound object-mounting portion 22 having an approximately semicircular arc cross-sectional shape. The bound object-mounting portion 22 protrudes inwardly from the outer vicinities of the positions where the first binding ring 12 and the second binding ring 14 are secured in a longitudinal direction toward the center.

In addition, inside of the bound object-mounting portion 22 of the holding member 16 is configured to have holding space so that the operating member 18 or other member is housed in the holding space.

On both ends of the bound object-mounting portion 22 of the holding member 16, holding walls 24 for slidably holding the operating member 18 are provided substantially from one end to the other end of the bound object-mounting portion 22 in its longitudinal direction.

For the holding wall 24, in this preferred embodiment, a first holding wall 24*a* and a second holding wall 24*b* are continuously provided so as to downwardly extend from the outer vicinities of the first binding ring 12 and the second binding ring 14 over approximately the entire length.

The first holding wall 24*a* and the second holding wall 24*b* are in parallel with each other and have substantially the same plate-like shape.

Then, the operating member 18 and the opening/closing member 40 to be described in detail later and the like are housed in the holding space surrounded by the first holding wall 24*a*, the second holding wall 24*b*, and the bound object-mounting portion 22.

First through holes 26 and second through holes 28 are provided through the bound object-mounting portion 22 of the holding member 16 to be configured to allow the first binding ring 12 and the second binding ring 14 to loosely pass therethrough at a predetermined distance (a predetermined length determined by Japanese Industrial Standards or the like).

The first through holes 26 and the second through holes 28 are provided so as to correspond to a first half ring 12*a* and a second half ring 12*b* constituting the first binding ring 12 and a third half ring 14*a* and a fourth half ring 14*b* constituting the second binding ring 14, respectively. The first through holes 26 and the second through holes 28 are provided in a width direction of the holding member 16 at a predetermined distance, parting right and left.

The operating member 18 includes a pair of the first operating piece 30 and the second operating piece 32, each being made of a metal plate having an approximately rectangular shape in a plan view.

The first operating piece 30 and the second operating piece 32 are, in the longitudinal direction, parallel to the first holding wall 24*a* and the second holding wall 24*b*, having the outer edge 30*b* and outer edge 32*b* so formed as to oscillate on the inner surfaces thereof.

Parallel to the outer edge 30*b* and the outer edge 32*b*, an abutting edge 30*a* and an abutting edge 32*a* abutting the pair of the first operating piece 30 and the second operating piece 32 are formed at the inner edges.

The first operating piece 30 and the second operating piece 32 are point-symmetric, defining center C (shown in FIGS. 51 and 53) in the longitudinal direction of the abutting edge 30*a* and 32*a* as a center of symmetry. When each member is apposed in the longitudinal direction in the holding space of the holding member 16, each member is flexibly engaged at the inner edge thereof.

When no external force is applied, the first operating piece 30 and the second operating piece 32 are provided within the inner space of the holding member 16 so as to be folded downward, i.e., to be oriented in a direction separating from the inner surface of the bound object-mounting portion 22 of the holding member 16 (the abutting edges 30*a* and 32*a* are situated below a plane Pxy shown in FIG. 51) or to be folded upward state, i.e., to be oriented in a direction approaching the inner surface of the bound object-mounting portion 22 of the holding member 16 (the abutting edges 30*a* and 32*a* are situated above the plane Pxy shown in FIG. 51).

Then, the first operating piece 30 and the second operating piece 32 are installed in the holding space portion in the inside of the holding member 16 so as to maintain the downward or upward folded state.

The plane Pxy includes horizontal axes Y1 and Y2 and longitudinal axes X1 and X2 (shown in FIG. 51) passing through the locations (four locations) where the respective bases of the first binding ring 12 and the second binding ring 14 are secured to the first operating piece 30 and the second operating piece 32.

For the operating member 18, the base of the first half ring 12*a* constituting the first binding ring 12 is secured onto a surface (i.e., an upper surface) of one of the operating pieces, i.e., the first operating piece 30, which faces the inner surface of the bound object-mounting portion 22 of the holding member 16. On the same surface, the base of the third half ring 14*a* constituting the second binding ring 14 is secured at a predetermined distance from the first half ring 12*a*.

The base of the second half ring 12*b* constituting the first binding ring 12 is secured onto a surface (i.e., an upper surface) of the other operating piece, i.e., the second operating piece 32, which faces the inner surface of the bound object-mounting portion 22 of the holding member 16. On the same surface, the base of the fourth half ring 14*b* constituting the second binding ring 14 is secured at a predetermined distance from the second half ring 12*b*.

One operating piece, i.e., the first operating piece 30 are formed with a protruding portion 30*c*1 (formed in the vicinity of the first half ring 12*a*) which is inserted in first through holes 26 formed in the holding member 16, and with a protruding portion 30*c*2 (formed in the vicinity of the third half ring 14*a*) which is inserted in second through holes 28 formed in the holding member 16.

The second operating piece 32 are formed with a protruding portion 32*c*1 (formed in the vicinity of the second half ring 12*b*) which is inserted in the first through holes 26 formed in the holding member 16, and with a protruding portion 32*c*2 (formed in the vicinity of the fourth half ring 14*b*) which is inserted in the second through holes 28 formed in the holding member 16.

Then, a pair of the first operating piece 30 and the second operating piece 32 abut against each other in a situation where the protruding portion 30*c*1 and a protruding portion 30*c*2 are passed through a first through hole 26 and a second through hole 28 and a protruding portion 32*c*1 and a protruding portion 32*c*2 are passed through the first through hole 26 and the second through hole 28.

The first operating piece 30 and the second operating piece 32 are oscillatably maintained in the holding member 16 in the direction where the first binding ring 12 and the second binding ring 14 are opened or closed.

The abutting edges 30*a* and 32*a* are housed in the holding member 16 so that the abutting edges 30*a* and 32*a* come close to the inner surface of the holding member 16 when the binding rings, i.e., the first binding ring 12 and the second binding ring 14, are opened and that the abutting edges 30*a* and 32*a* are separated away from the inner surface of the holding member 16 when the first binding ring 12 and the second binding ring 14 are closed.

The first operating piece 30 is formed with the abutting edge 30*a* on the inner side thereof. The abutting edge 30*a* is substantially linear, and the pair of the operating pieces abut against each other along the abutting edge 30*a*. Furthermore, the first operating piece 30 is formed with the outer edges 30*b* on the outer side thereof, the outer edges 30*b* being substantially parallel to the abutting edge 30*a* and being substantially linear.

The second operating piece 32 is formed with the abutting edge 32*a* on the inner side thereof. The abutting edge 32*a* is substantially linear, and the pair of the operating pieces abut against each other along the abutting edge 32*a*. Furthermore, the second operating piece 32 is formed with the outer edges 32*b* on the outer side thereof, the outer edges 32*b* being substantially parallel to the abutting edge 32*a* and being substantially linear.

The outer edge 30*b* of the first operating piece 30 is formed with a protruding portion 30*c*1 and a protruding portion 30*c*2.

The outer edge 32*b* of the second operating piece 32 is formed with a protruding portion 32*c*1 and a protruding portion 32*c*2.

In other words, the abutting edge 30*a* and the abutting edge 32*a* abut against each other, and the outer edge 30*b* and the outer edge 32*b* approach the inner side surfaces within the both walls of the first holding wall 24*a* and the second holding wall 24*b* of the holding member 16.

A pair of the protruding portion 30*c*1 and the protruding portion 30*c*2 are formed on the outer side (in the width direction of the first operating piece 30) close to the attachment positions of the base portions of the first half ring 12*a* and the third half ring 14*a* to be disposed with a spacing at front and rear positions.

In addition, a pair of the protruding portion 32*c*1 and the protruding portion 32*c*2 are formed on the outer side (in the width direction of the second operating piece 32) close to the attachment positions of the base portions of the second half ring 12*b* and the fourth half ring 14*b* to be disposed with a spacing at front and rear positions.

Then, the protruding portion 30*c*1 and the protruding portion 30*c*2, and the protruding portion 32*c*1 and the protruding portion 32*c*2 protrude outwardly from the first holding wall 24*a* and the second holding wall 24*b* of the holding wall 16, respectively, so as to allow the first binding ring 12 and the second binding ring 14 to be opened and closed.

The protruding portion 30*c*1 and the protruding portion 30*c*2 have the first through holes 26 of the first holding wall 24*a* of the holding member 16 and a length to protrude outwardly from the first through holes 26. Furthermore, the protruding portion 32*c*1 and the protruding portion 32*c*2 have the second through holes 28 of the second holding wall 24*b* of the holding member 16 and a length to protrude outwardly from the second through holes 28. In addition, the protruding portion 32*c*1 and the protruding portion 32*c*2 have a tongue-like shape which has a width for allowing the operating member 18 to move in the longitudinal direction of the holding member 16 when the binding rings 12 and 14 are opened or closed.

The operating piece 30 and the operating piece 32 are made of a thin plate of metal or plastic, and the operating piece 30 and the operating piece 32 are formed integrally with the protruding portion 30*c*1, the protruding portion 30*c*2, the protruding portion 32*c*1, and the protruding portion 32*c*2.

The opening/closing member 40 is secured to the operating member 18 on the reverse side opposite to the surface on which the first binding ring 12 and the second binding ring 14 are secured. When the first binding ring 12 and the second binding ring 14 are opened, the opening/closing member 40 is formed to cause the first binding ring 12 and the second binding ring 14 to be changed in the opening direction such that the operating pieces 30 and 32 are moved in a longitudinal direction of the holding member 16 and are held in a direction approaching the inner surface of the holding member 16, within the holding member 16.

The opening/closing member 40 is secured to the operating member 18, on the reverse side opposite to the surface in which the first binding ring 12 and the second binding ring 14 are secured after the opening/closing member 40 which biases to the direction the first binding ring 12 and the second binding ring 14 are opened is secured.

Then, when the first binding ring 12 and the second biding ring 14 are closed, the operating pieces 30 and 32 are held in a planar state, in a state in which the abutting edges 30*a* and 32*a* abut against each other at a position away from an inner surface of the holding member 16. Then, when the first binding ring 12 and the second biding ring 14 are opened, the operating pieces 30 and 32 are secured to the holding member 16 so as to be held in an upward folded state in a direction approaching the inner surface of the holding member 16 in a state in which the abutting edges 30*a* and 32*a* abut against each other.

The first operating piece 30 is located in the vicinity of both ends of the abutting edges 30*a*. The first operating piece 30 is bent and recessed to the side of the face to which the opening/closing member 40 is secured from a surrounding reference surface LP1 along the abutting edges 30*a* in the vicinity of both ends of the abutting edges 30*a*, in the area near the abutting edge 30*a* from the area to which the base portions of the first half ring 12*a* and the third half ring 14*a* are secured. The first operating piece 30 is formed with a recess portion on opposite side of first operating piece 130*d* and a recess portion on front side of first operating piece 130*e*.

Then, a second engaging portion on opposite side of first operating piece 136*b*4 having an engaging portion located lower than the reference surface LP1 is formed by the recess portion on front side of first operating piece 130*e* and the recess portion on opposite side of first operating piece 130*d*.

Furthermore, the second operating piece 32 is located in the vicinity of both ends of the abutting edges 32*a*. The second operating piece 32 is bent and recessed to the side of the face to which the opening/closing member 40 is secured from a surrounding reference surface LP2 along the abutting edges 32*a* in the vicinity of both ends of the abutting edges 32*a*, in the area near the abutting edge 32*a* from the area to which the base portions of the second half ring 12*b* and the fourth half ring 14*b* are secured. The second operating piece 32 is formed with a recess portion on front side of second operating piece 132*e* and a recess portion on opposite side of second operating piece 132*d*.

Then, a second engaging portion on opposite side of second operating piece 136*b*1 having an engaging face located lower than the reference surface LP2 is formed by the recess portion on front side of second operating piece 132*e* and the recess portion on opposite side of second operating piece 132*d*.

The first operating piece 30 is formed with the recess portion on opposite side of first operating piece 130*d* by bending and recessing the abutting edge 30*a* to the side of the face to which the opening/closing member 40 is secured from the surrounding reference surface LP1. In addition, the first operating piece 30 is formed with a first engaging portion on opposite side of first operating piece 136*a*1 having the engaging face located lower than the reference surface LP1 by bending to the side opposite to the face to which the opening/closing member 40 is secured. Furthermore, the second operating piece 32 is formed with the recess portion on opposite side of second operating piece 132*d* by bending and recessing the abutting edge 32*a* to the side of the face to which the opening/closing member 40 is secured from the surrounding reference surface LP2. In addition, the second operating piece 32 is formed with the second engaging portion on opposite side of second operating piece 136*b*1 having the engaging face located lower than the reference surface LP2.

The engaging face of the first engaging portion on opposite side of first operating piece 136*a*1 and the engaging face of the second engaging portion on opposite side of second operating piece 136*b*1 are engaged with each other in substantially the same height as or the lower height than the reference surface LP1 and the reference surface LP2.

The second operating piece 32 is formed with the recess portion on front side of second operating piece 132*e* by bending and recessing the abutting edge 32*a* to the side of the face to which the opening/closing member 40 is secured from the surrounding reference surface LP2. In addition, the second operating piece 32 is formed with a first engaging portion on front side of second operating piece 136*a*3 having the engaging face located lower than the reference surface LP2 by bending to the side front to the face to which the opening/closing member 40 is secured. Furthermore, the first operating piece 30 is formed with the recess portion on front side of first operating piece 130*e* by bending and recessing the abutting edge 30*a* to the side of the face to which the opening/closing member 40 is secured from the surrounding reference surface LP1. In addition, the first operating piece 30 is formed with the second engaging portion on front side of first operating piece 136*b*3 having the engaging face located lower than the reference surface LP1.

The engaging face of the first engaging portion on front side of second operating piece 136*a*3 and the engaging face of the second engaging portion on front side of first operating piece 136*b*3 are engaged with each other in substantially the same height as or the lower height than the reference surface LP1 and the reference surface LP2.

The first operating piece 30 is formed with the recess portion on front side of first operating piece 130*e* by bending and recessing the abutting edge 30*a* to the side of the face to which the opening/closing member 40 is secured from the surrounding reference surface LP1. In addition, the first operating piece 30 is formed with a first engaging portion on front side of first operating piece 136*a*2 having the engaging face located lower than the reference surface LP1 by bending to the side opposite to the face to which the opening/closing member 40 is secured. Furthermore, the second operating piece 32 is formed with the recess portion on front side of second operating piece 132*e* by bending and recessing the abutting edge 32*a* to the side of the face to which the opening/closing member 40 is secured from the surrounding reference surface LP2. In addition, the second operating piece 32 is formed with the second engaging portion on front side of second operating piece 136*b*2 having the engaging face located lower than the reference surface LP2.

The engaging face of the first engaging portion on front side of first operating piece 136*a*2 and the engaging face of the second engaging portion on front side of second operating piece 136*b*2 are engaged with each other in substantially the same height as or the lower height than the reference surface LP1 and the reference surface LP2.

The second operating piece 32 is formed with the recess portion on opposite side of second operating piece 132*d* by bending and recessing the abutting edge 32*a* to the side of the face to which the opening/closing member 40 is secured from the surrounding reference surface LP2. In addition, the second operating piece 32 is formed with a first engaging portion on opposite side of second operating piece 136*a*4 having the engaging face located lower than the reference surface LP2 by bending to the side opposite to the face to which the opening/closing member 40 is secured. Furthermore, the first operating piece 30 is formed with the recess portion on opposite side of first operating piece 130*d* by bending and recessing the abutting edge 30*a* to the side of the face to which the opening/closing member 40 is secured from the surrounding reference surface LP1. In addition, the first operating piece 30 is formed with the second engaging portion on opposite side of first operating piece 136*b*4 having the engaging face located lower than the reference surface LP1.

The engaging face of the first engaging portion on opposite side of second operating piece 136*a*4 and the engaging face of the second engaging portion on opposite side of first operating piece 136*b*4 are engaged with each other in substantially the same height as or the lower height than the reference surface LP1 and the reference surface LP2.

The engaging face of the first engaging portion 136*a* of the first operating piece 30 and the engaging face of the second engaging portion 136*b* of the second operating piece 32 are engaged with each other in substantially the same height as or the lower height than the reference surface LP1 and the reference surface LP2.

The engaging face of the first engaging portion 136*a* of the second operating piece 32 and the engaging face of the second engaging portion 136*b* of the first operating piece 30 are engaged with each other in substantially the same height as or the lower height than the reference surface LP1 and the reference surface LP2.

The first engaging portion 136*a* includes the first engaging portion on opposite side of first operating piece 136*a*1, the first engaging portion on front side of first operating piece 136*a*2, the first engaging portion on front side of second operating piece 136*a*3, and the first engaging portion on opposite side of second operating piece 136*a*4.

The second engaging portion 136*b* includes the second engaging portion on opposite side of second operating piece 136*b*1, the second engaging portion on front side of second operating piece 136*b*2, the second engaging portion on front side of first operating piece 136*b*3, and the second engaging portion on opposite side of first operating piece 136*b*4.

The first operating piece 30 is formed with the first engaging portion 136*a* and the second engaging portion 136*b* as well as the second operating piece 32. At this time, the second operating piece 32 is formed with the second engaging portion 136*b* and the first engaging portion 136*a* as well as the first operating piece 30.

The first operating piece 30 and the second operating piece 32, respectively, opposed to each other are formed to allow the first operating piece 30 and the second operating piece 32 to oscillate about the abutting edges 30*a* and 32*a*, by engaging the first engaging portion 136*a* with the second engaging portion 136*b*.

As described as above, so as to be held and move the operating member 18 and the opening/closing member 40 in the holding space of the holding member 16, the engaging portion, i.e., the first engaging portion 136*a* and the second engaging portion 136*b* for maintaining the abutting state also while moving are formed so as to protrude to the abutting edges, i.e., the abutting edges 30*a* and 32*a* of a pair of the operating pieces, i.e., the first operating piece 30 and the second operating piece 32, towards the side of the face to which the opening/closing member 40 is secured. Therefore, a reduction in profile can be achieved by lowering the height of the holding member 16.

The first engaging portion 136*a* is formed into a U shape in a plan view having the base portion protruding an amount corresponding to the thickness of the operating member 18 from the recess portions (the recess portion on opposite side of first operating piece 130*d*, the recess portion on front side of first operating piece 130*e*, the recess portion on opposite side of second operating piece 132*d*, and the recess portion on front side of second operating piece 132*e*) and the retaining portion protruding from the end of the base portion, toward the inner surface side of the bound object-mounting portion 22 of the holding member 16.

Then, the retaining portion has a function of preventing disengagement of the first operating piece 30 or the second operating piece 32, which is one of the pair of the operating pieces, i.e., the first operating piece 30 and the second operating piece 32.

The outermost first engaging portion on opposite side of first operating piece 136*a*1 and the outermost first engaging portion on front side of second operating piece 136*a*3 have a width which allows the outermost first engaging portion on opposite side of first operating piece 136*a*1 and the outermost first engaging portion on front side of second operating piece 136*a*3 to be positioned within the length of the operating member 18 even when the first operating piece 30 and the second operating piece 32 are moved in opposite directions.

The outermost first engaging portion on opposite side of first operating piece 136*a*1 and the outermost first engaging portion on front side of second operating piece 136*a*3 are formed to be separated from the inward first engaging portion on opposite side of second operating piece 136*a*4 and the inward first engaging portion on front side of first operating piece 136*a*2, respectively, by an appropriate distance so that the portion attached to the base portion of the first binding ring 12 or the second binding ring 14 is located therebetween.

Figure 54:
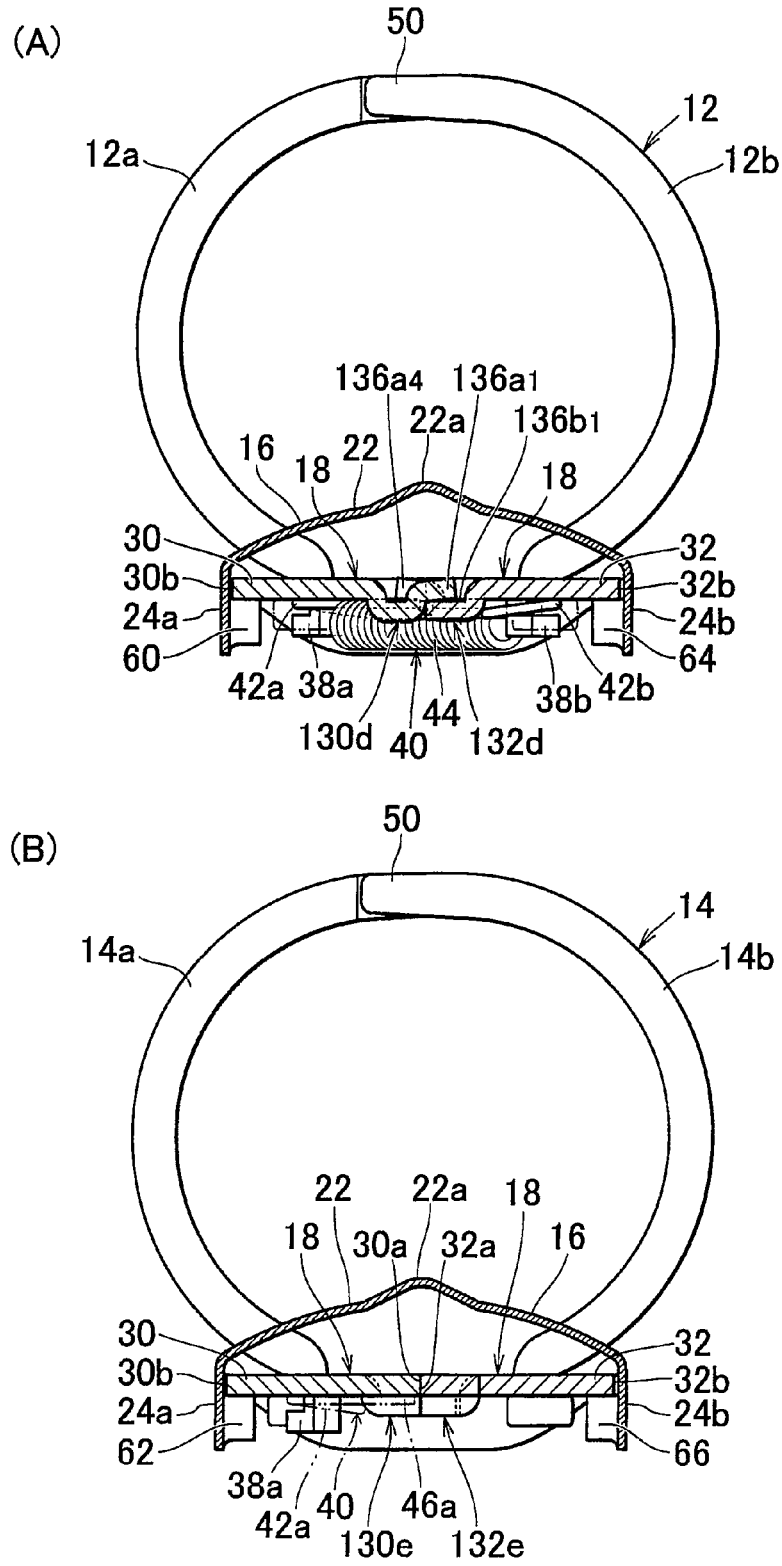
FIGS. 54(A) and 54(B) are cross-sectional views of the binding devices in a closed state, where

As shown in FIG. 54, when the first binding ring 12 and the second binding ring 14 are closed, the first operating piece 30 and the second operating piece 32 constituting the operating member 18 are secured in the space inside the holding member 16 so as to be held in a state (i.e., in a horizontal and planar state) in which the abutting edges 30*a* and 32*a* of the first operating piece 30 and the second operating piece 32 abut against each other with the abutting edges 30*a* and 32*a* directed in a direction away from the inner surface of the holding member 16 (the inner surface of the bound object-mounting portion 22).

Figure 59:
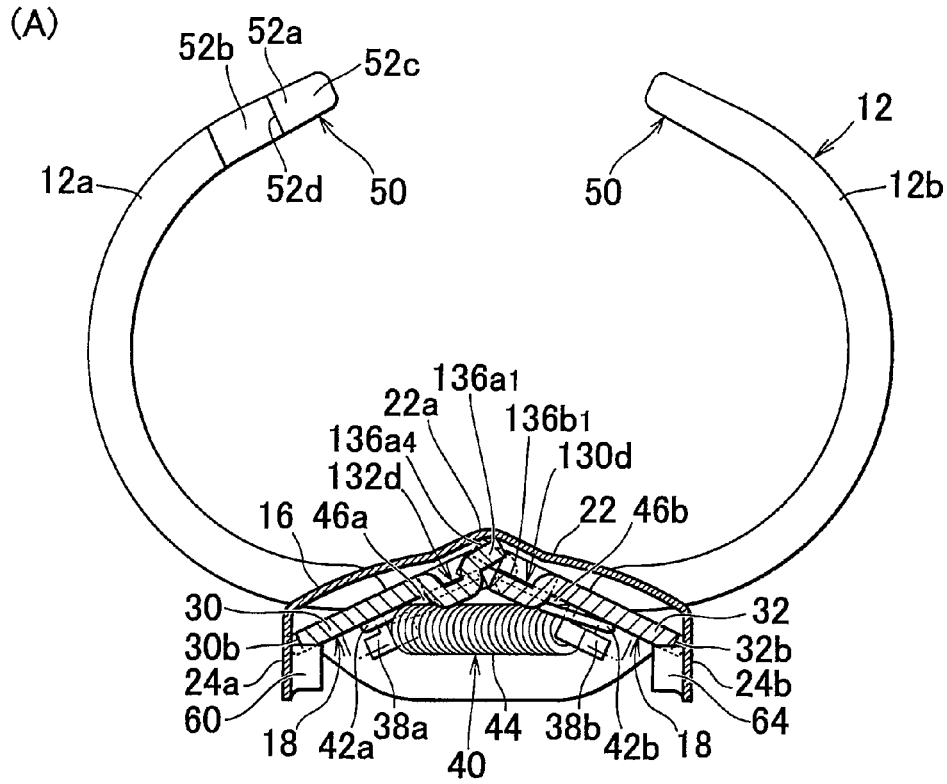
FIGS. 59(A) and 59(B) are cross-sectional views showing the binding devices in an opened state, where
Figure 59:
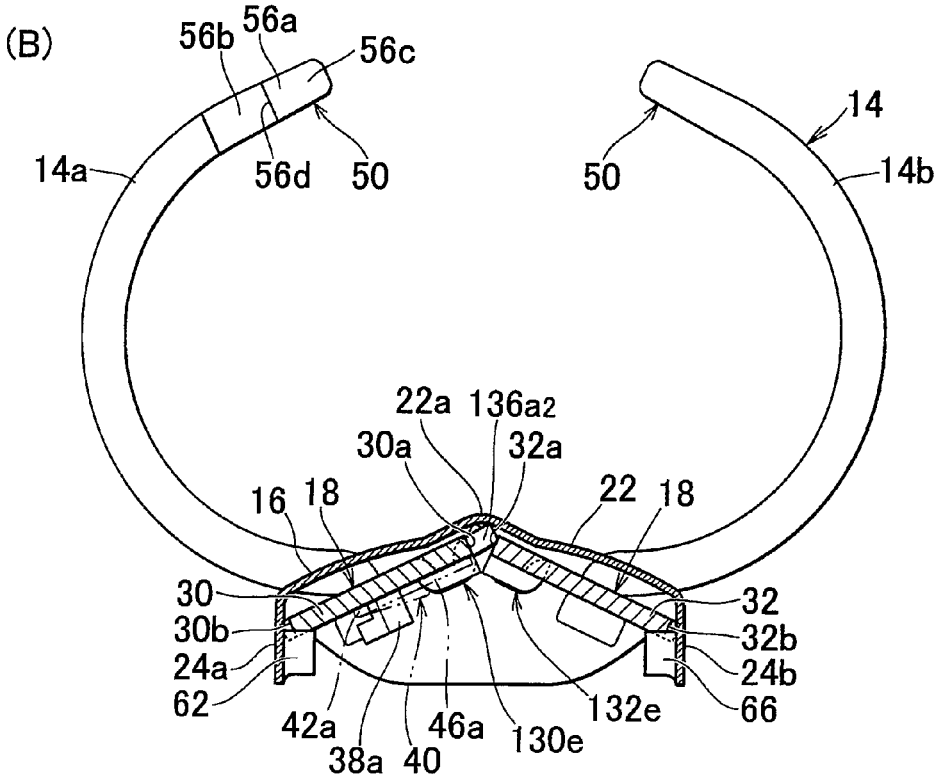
Figure 60:
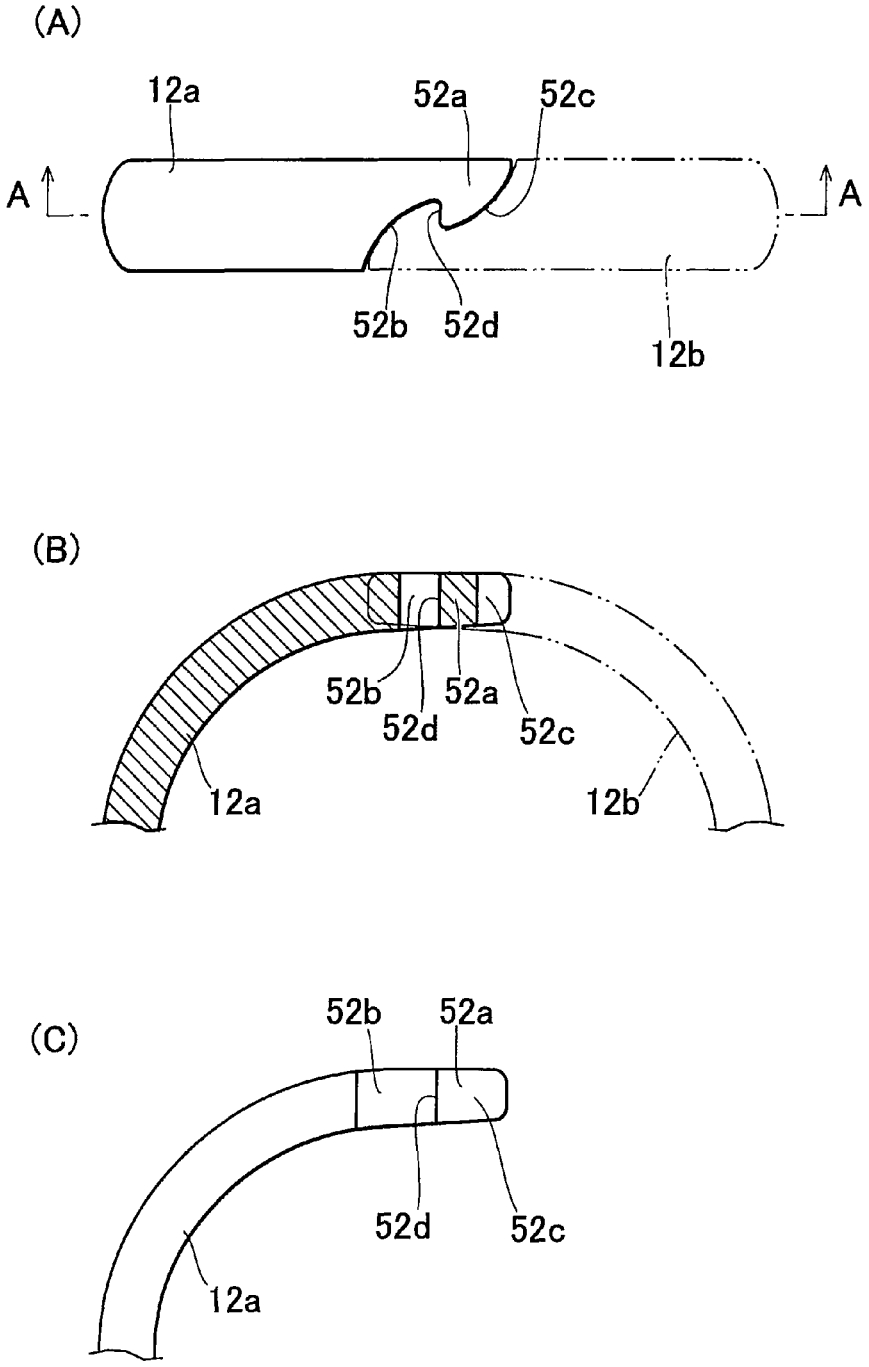
FIGS. 60(A), 60(B), and 60(C) are schematic views showing latching portions of the binding rings, where
Figure 61:
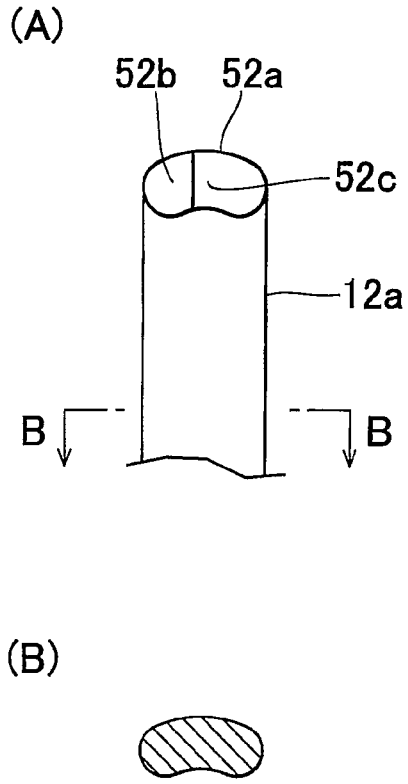
FIGS. 61(A) and 61(B) are schematic views of the latching portion of the binding ring, where
Figure 62:
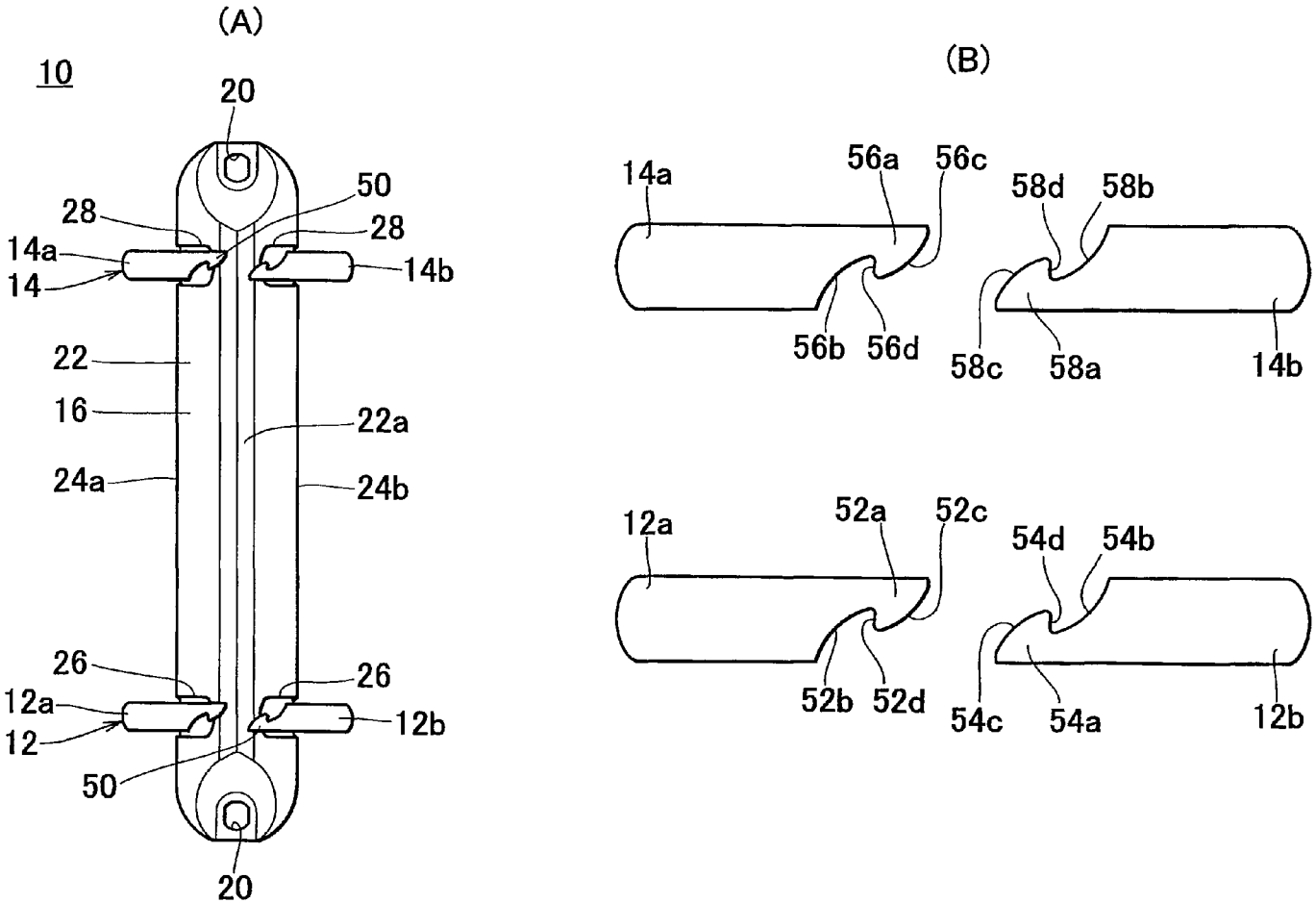
FIGS. 62(A) and 62(B) are schematic views showing a state in which the binding rings are closed, where

In addition, as shown in FIG. 59, when the first binding ring 12 and the second binding ring 14 are opened, the first operating piece 30 and the second operating piece 32 constituting the operating member 18 are secured in the space inside the holding member 16 so as to be held in a state (i.e., in an upward folded state) in which the abutting edge 32*a* of the second operating piece 32 abuts on the inner surface of the holding member 16 (the inner surface of the bound object-mounting portion 22) with the abutting edges 30*a* and 32*a* directed in a direction approaching the inner surface.

Furthermore, the first operating piece 30 and the second operating piece 32 constituting the operating member 18 are slidably disposed such that, when the operating pieces 30 and 32 are directed in a direction approaching the inner surface of the bound object-mounting portion 22 of the holding member 16, i.e., are in an upward folded state, the first operating piece 30 and the second operating piece 32 can be movable in the longitudinal direction of the first operating piece 30 and the second operating piece 32, i.e., a direction parallel to the line (X1 in FIG. 51) connecting the first half ring 12*a* and the third half ring 14*a* secured to the first operating piece 30 and parallel to the line (X2 in FIG. 51) connecting the second half ring 12*b* and the fourth half ring 14*b* secured to the second operating piece 32.

Each of the first operating piece 30 and the second operating piece 32 is formed with a movement restricting portion, which is provided in the vicinities inside gap portion of a first engaging portion on front side of first operating piece 136*a*2 and a first engaging portion on opposite side of second operating piece 136*a*4, in a recess portion on opposite side of first operating piece 130*d*, a recess portion on front side of first operating piece 130*e*, a recess portion on opposite side of second operating piece 132*d*, and a recess portion on front side of second operating piece 132*e*. The movement restricting portion is provided for restricting the movement of the first operating piece 30 and the second operating piece 32 in the longitudinal direction.

The movement restricting portion is formed of a restricting recess 30*f*, a restricting projection 30*g*, a restricting recess 32*f*, and a restricting projection 32*g*, the restricting recess 30*f* and the restricting projection 30*g* being formed in the abutting edge 30*a* of the first operating piece 30, the restricting recess 32*f* and the restricting projection 32*g* being formed in the abutting edge 32*a* of the second operating piece 32.

The restricting recess 30*f* is a notch which is provided in the vicinity outside the recess 36*a* and has a square U shape in a plan view recessed from the abutting edge 30*a* in the width direction. The restricting projection 32*g* is a projection which has a square U shape in a plan view and is formed so as to loosely fit into the restricting recess 30*f*.

The restricting projection 32*g* and the restricting recess 30*f* are formed such that the restricting projection 32*g* fits loosely into the restricting recess 30*f* to allow the first operating piece 30 and the second operating piece 32 to move in opposite longitudinal directions inside the restricting recess 30*f*.

The restricting recess 32*f* is a notch which is provided in the vicinity outside the recess 36*b* and has a square U shape in a plan view recessed from the abutting edge 32*a* in the width direction. The restricting projection 30*g* is a projection which has a square U shape in a plan view and is formed so as to loosely fit into the restricting recess 32*f*.

The restricting projection 30*g* and the restricting recess 32*f* are formed such that the restricting projection 30*g* fits loosely into the restricting recess 32*f* to allow the first operating piece 30 and the second operating piece 32 to move in opposite longitudinal directions inside the restricting recess 32*f*.

An opening/closing member 40 for shifting the first binding ring 12 and the second binding ring 14 in the opening/closing direction is provided on the side of the abutting edge 30*a* of the first operating piece 30 and the abutting edge 32*a* of the second operating piece 32.

The opening/closing member 40 is extended in a direction obliquely intersecting the direction connecting the base portions of the binding rings secured to the first operating piece 30 to be disposed with a spacing, i.e., the first half ring 12*a* and the third half ring 14*a*, and in a direction obliquely intersecting the direction connecting the base portions of the binding rings secured to the operating piece 32 to be disposed with a spacing, i.e., the second half ring 12*b* and the fourth half ring 14*b* such that a pair of the operating piece 30 and the operating piece 32 are moved in opposite directions and the opening/closing conditions of the binding rings, i.e., the first binding ring 12 and the second binding ring 14 are maintained, between the pair of the operating piece 30 and the operating piece 32 constituting the operating member 18.

The opening/closing member 40 is made of an extension coil spring and includes a coil portion 44 and the securing end portion 42*a* and the securing end portion 42*b* which was made as a hook by winding the coil portion 44 from the both ends of the coil portion 44.

A restricting arm portion 46*a* and a restricting arm portion 46*b* protrude in the circumferential direction of the coil portion 44 so as to be parallel to each other, as shown in FIG. 50(A).

In the opening/closing member 40, the securing end portion 42*a* which receives load is secured to the first operating piece 30 and the securing end portion 42*b* is secured to the second operating piece 32, in a state in which the first binding ring 12 and the second binding ring 14 are closed, and in a state in which the coil portion 44 which was adhering at no load is so strained as to extend, i.e., in a state in which the coil portion 44 receives tensile load.

In addition, in a state in which the first binding ring 12 and the second binding ring 14 are closed, to a direction in which the first operating piece 30 and the second operating piece 32 are rotationally moved with the abutting edges 30*a* and 32*a* as a center toward the direction from an opened state to a closed state, the twisting moment is received around a central axis of the coil portion 44 (coil), a spring is loaded, and bending stress is generated on a strand. Then, the securing end portion 42*a* is secured to the first operating piece 30, and the securing end portion 42*b* is secured to the second operating piece 32.

Figure 50:
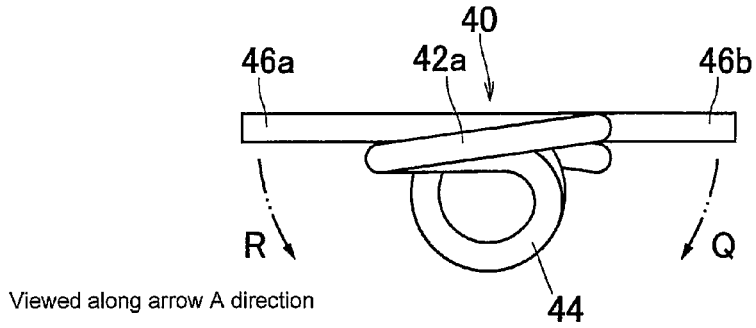
FIGS. 50(A), 50(B), and 50(C) are schematic side views of opening/closing members, where
Figure 50:
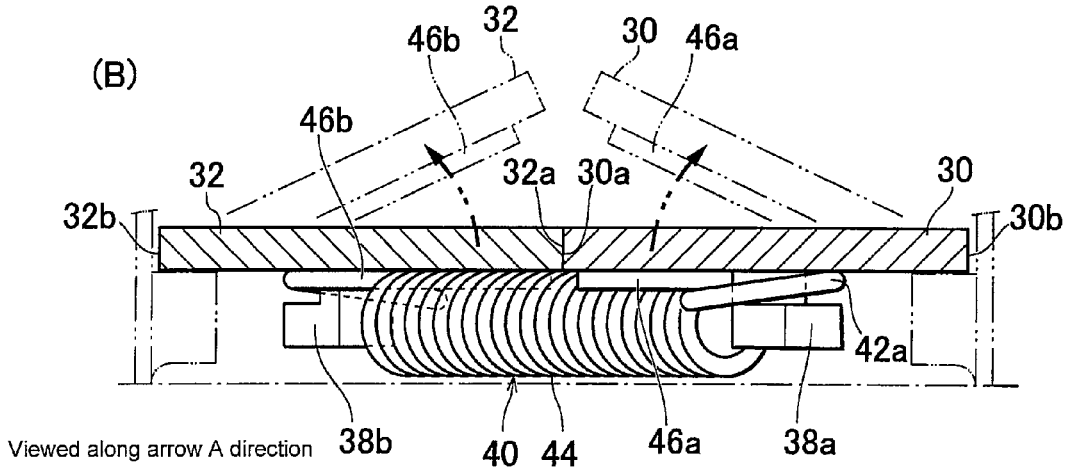
Figure 50:
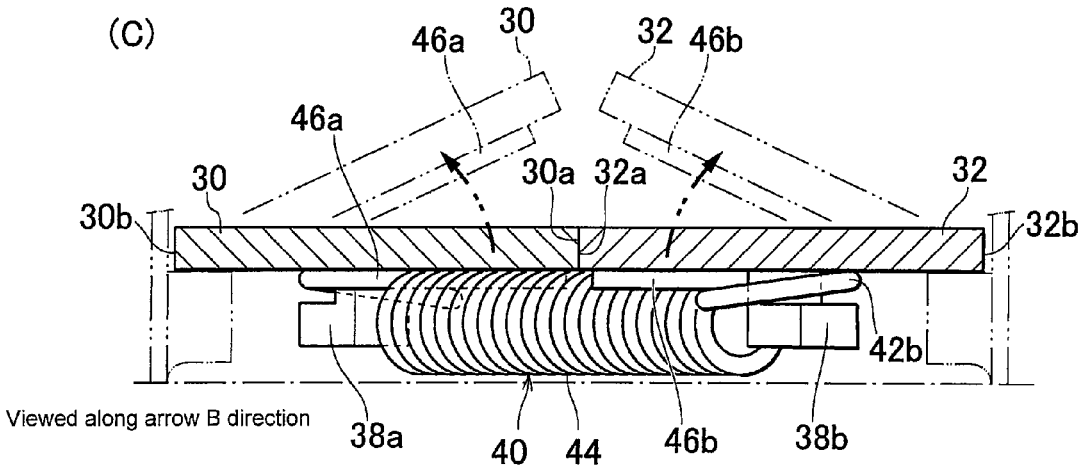

In this case, for the opening/closing member 40, in view of a state in which no load such as the twisting moment is placed on the coil portion 44 (shown in FIG. 50(A)), the securing end portions 42*a* and 42*b* are secured to the opening/closing member fixing portions 38*a* and 38*b*, respectively, in a state in which the coil portion 44 is twisted for one revolution or more so as to increase the number of coil of the coil portion 44 for one revolution or more (the R direction for the securing end portions 42*a* and the restricting arm portion 46*a*, and the Q direction for the securing end portion 42*b* and the restricting arm portion 46*b* (shown in FIG. 49 and FIG. 50 (A))

It is configured that the load direction for loading a spring is the direction for winding the coil portion 44 (coil).

The restricting arm portions 46*a* and 46*b* extend from a side on which the securing end portions 42*a* and 42*b* are fixed to the first operating piece 30 and the second operating piece 32 to a direction orthogonal to the central axis of the coil portion 44. One restricting arm portion 46*a* and the other restricting arm portion 46*b* protrude in the circumferential direction of the coil portion 44 so as to be parallel to each other, and extend in the opposite direction to each other, in an original state in which no twisting moment is generated, as shown in FIGS. 49 and 50(A).

One restricting arm portion 46*a* abuts at its tip end the reverse side of the first operating piece 30 when the securing end portion 42*a* is secured to the opening/closing member fixing portion 38*a* of the first operating piece 30. The other restricting arm portion 46*b* abuts at its tip end the reverse side (the underside) of the second operating piece 32 when the securing end portion 42*b* is secured to the opening/closing member fixing portion 38*b* of the second operating piece 32. The securing end portions 42*a* and 42*b* of round hook are configured to be secured to the opening/closing member fixing portions 38*a* and 38*b* in a normal state on all occasions, without heavily tilting.

In an original state in which no twisting moment is generated, one restricting arm portion 46*a* and the other restricting arm portion 46*b* are formed so as to be parallel to each other.

One end of the securing end portion 42*a* of the opening/closing member 40 is latched and secured to the opening/closing member fixing portion 38*a* formed on the reverse side (underside) of the one operating piece, i.e., the first operating piece 30. One end of the securing end portion 42*b* of the opening/closing member 40 is latched and secured to the opening/closing member fixing portion 38*b* formed on the reverse side (underside) of the other operating piece, i.e., the second operating piece 32.

The opening/closing member fixing portion 38*a* is located on the reverse side (under side) of the recess 36*a* of the opening/closing member housing portion 36, and is formed at the location deviated from the center C in a longitudinal direction of the first operating piece 30 (shown in FIGS. 51 and 53) toward a direction in which the first operating piece 30 moves when the first binding ring 12 and the second binding ring 14 are opened. The opening/closing member fixing portion 38*b* is located on the reverse side (under side) of the recess 36*b* of the opening/closing member housing portion 36, and is formed at the location deviated from the center C in a longitudinal direction of the second operating piece 32 (shown in FIGS. 51 and 53) toward a direction in which the second operating piece 32 moves when the first binding ring 12 and the second binding ring 14 are opened.

The opening/closing member fixing portion 38*a* is of an L shape in a side view, having the latching base portion 38*a*1 continuing to the reverse side of the first operating piece 30 and the latching and locking portion 38*a*2 provided at the tip end (lower end) of the latching base portion 38*a*1 in such a manner as to extend to the opposite side of the opening/closing member 40.

The opening/closing member fixing portion 38*b* is of an L shape in a side view, having the latching base portion 38*b*1 continuing to the reverse side of the second operating piece 32 and the latching and locking portion 38*b*2 provided at the tip end (lower end) of the latching base portion 38*b*1 in such a manner as to extend to the opposite side of the opening/closing member 40.

The opening/closing member fixing portions 38*a* and 38*b* are formed so as to be point-symmetric, defining the center C in the longitudinal direction of the first operating piece 30 and the second operating piece 32 as a center.

The opening/closing member 40 is diagonally provided to bridge between the first operating piece 30 and the second operating piece 32 so as to be extended when the abutting edge 30*a* of the first operating piece 30 and the abutting edge 32*a* of the second operating piece 32 are in a downward folded state (shown in FIG. 54), i.e., so as to separate away from the inner surface of the bound object-mounting portion 22 of the holding member 16. The opening/closing member 40 is configured such that a force to restore the opening/closing member 40 to the original state acts in such an extended state.

The opening/closing member 40 is provided to bridge between the first operating piece 30 and the second operating piece 32 so as to diagonally cross the respective longitudinal directions of the first operating piece 30 and the second operating piece 32, i.e., the line connecting the location of the first operating piece 30 where the half ring 12*a* is fixed and the location where the half ring 14*a* is fixed (the longitudinal axis X1 (shown in FIG. 51)) and the line connecting the location of the second operating piece 32 where the half ring 12*b* is fixed and the location where the half ring 14*b* is fixed (the longitudinal axis X2 (shown in FIG. 51)).

The opening/closing member fixing portion 38*a* of the first operating piece 30 and the opening/closing member fixing portion 38*b* of the second operating piece 32 are formed so as to be point-symmetric, defining the center C (shown in FIGS. 51 and 53) in the longitudinal direction of the abutting edges 30*a* and 32*a* as a rotation axis. In the opening/closing member 40, the securing end portion 42*a* is latched at the opening/closing member fixing portion 38*a*, and the securing end portion 42*b* is latched at the opening/closing member fixing portion 38*b* by the uniform length from the center C (shown in FIGS. 51 and 53) in the longitudinal direction of the abutting edges 30*a* and 32*a*. It is configured that the uniform force is applied to the first operating piece 30 and the second operating piece 32.

The opening/closing member 40 keeps the distance between the first operating piece 30 and the second operating piece 32 constant, the first operating piece 30 and the second operating piece 32 abutting against each other along the abutting edge 30*a* of the first operating piece 30 and the abutting edge 32*a* of the second operating piece 32. In addition, the opening/closing member 40 brings the first operating piece 30 and the second operating piece 32 close to each other to maintain an optimal state of the positional relationship between the first operating piece 30 and the second operating piece 32.

Therefore, when the first binding ring 12 and the second binding ring 14 constituting the binding rings are opened or closed, the first operating piece 30 and the second operating piece 32 oscillate about the abutting edges 30*a* and 32*a* each serving as a pivot.

In this case, even when the sum of the width of the first operating piece 30 and the width of the second operating piece 32 reaches maximum, i.e., even when the first operating piece 30 and the second operating piece 32 are in a plane state, an appropriate gap is generated between the outermost edge (outer edge 30*b*) of the first operating piece 30 and the first holding wall 24*a* of the holding member 16 and between the outermost edge (outer edge 32*b*) of the second operating piece 32 and the second holding wall 24*b* of the holding member 16. In addition, the first operating piece 30 and the second operating piece 32 of the operating member 18 can be smoothly moved in the holding space of the holding member 16.

Figure 51A:
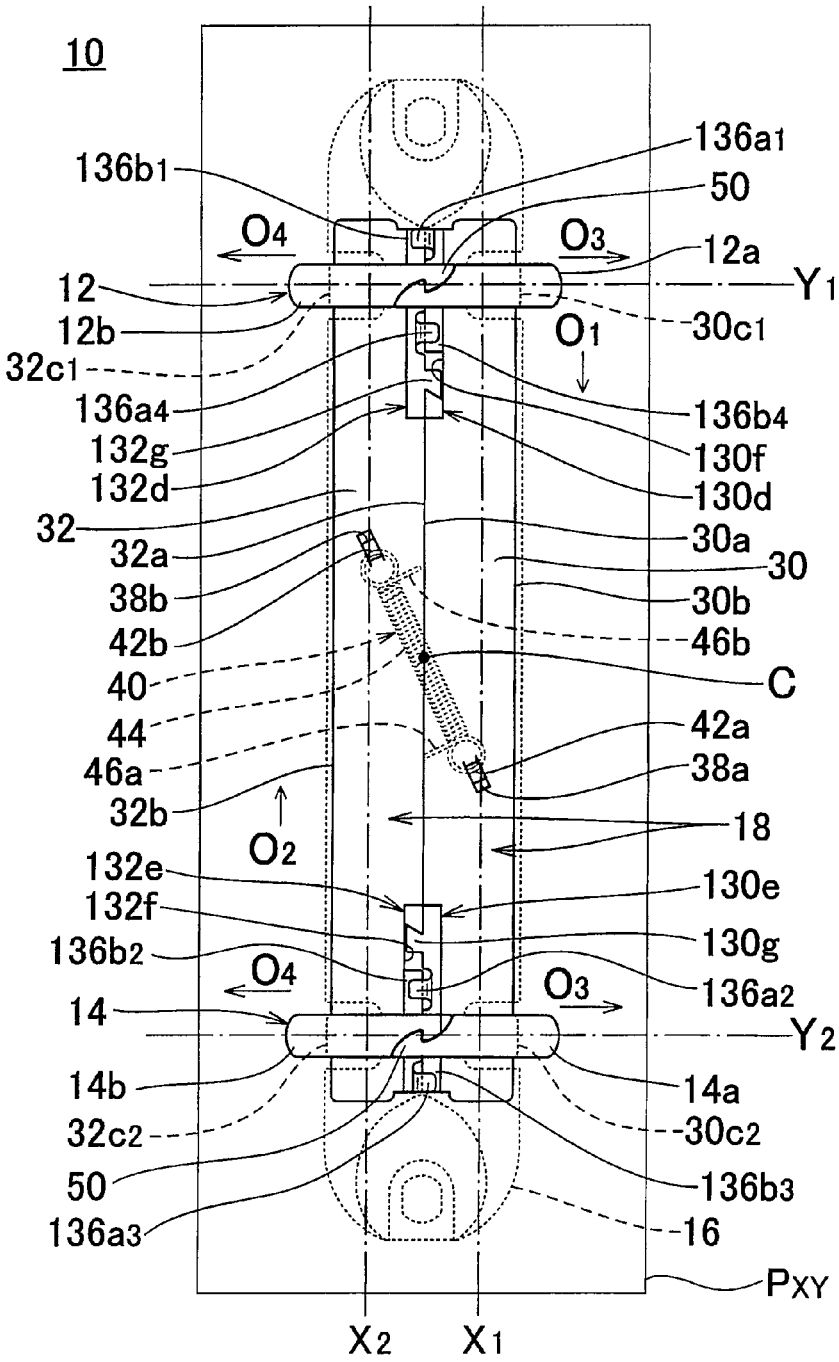
FIG. 51(A) is a schematic plan view showing the binding rings and the operating members in a closed state.
Figure 51B:
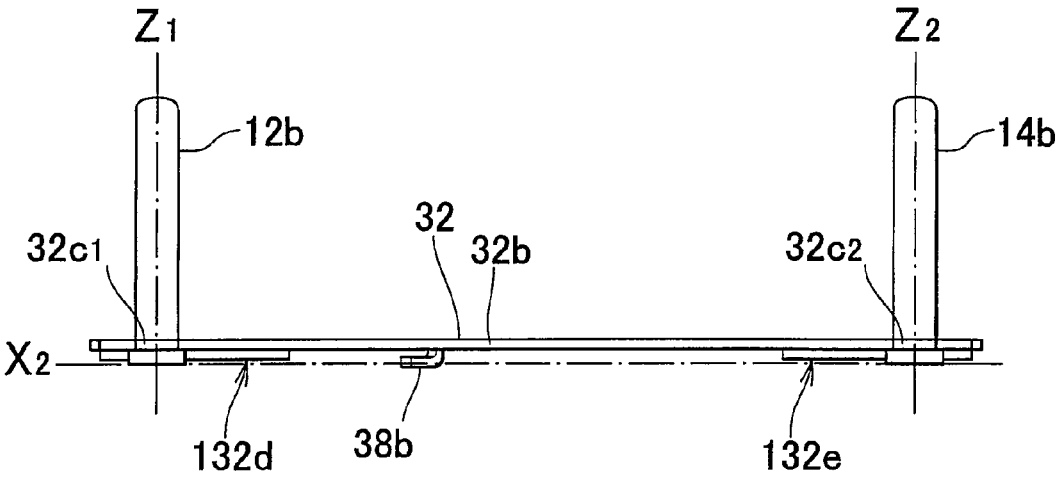
FIG. 51(B) is a schematic left side view showing the binding rings and the operating members in a closed state.
Figure 51C:
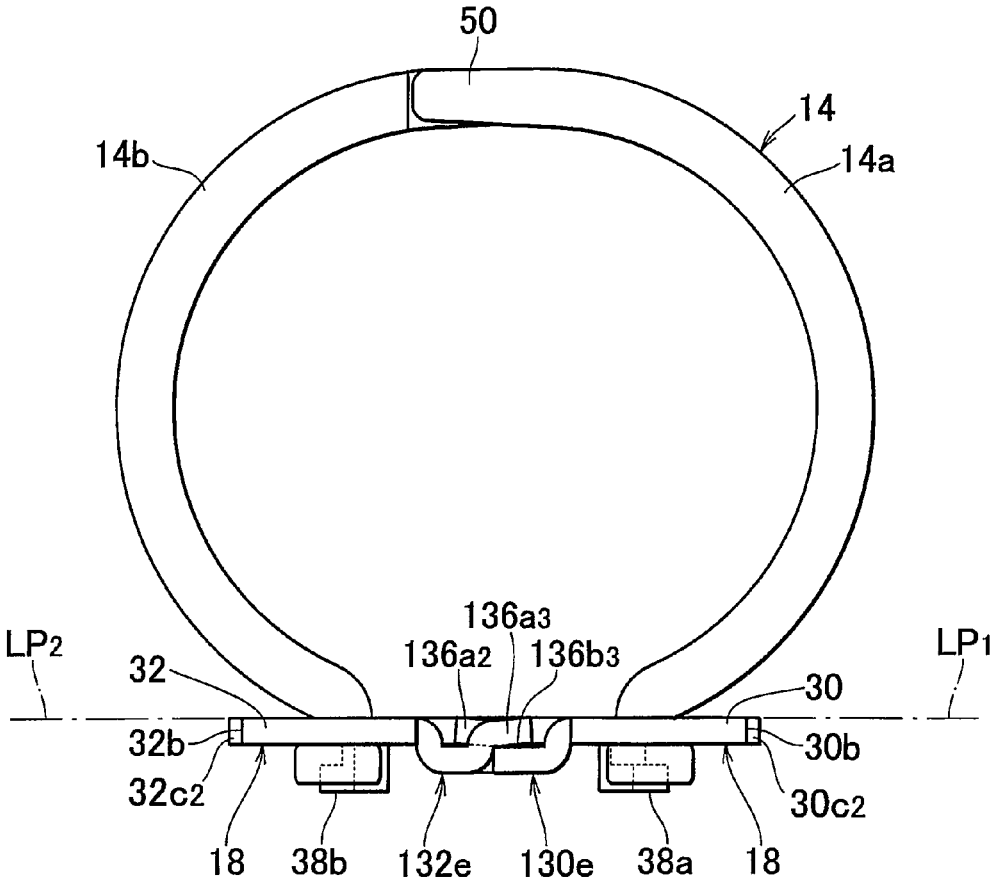
FIG. 51(C) is a schematic elevation view showing the binding ring and the operating members in a closed state.
Figure 51D:
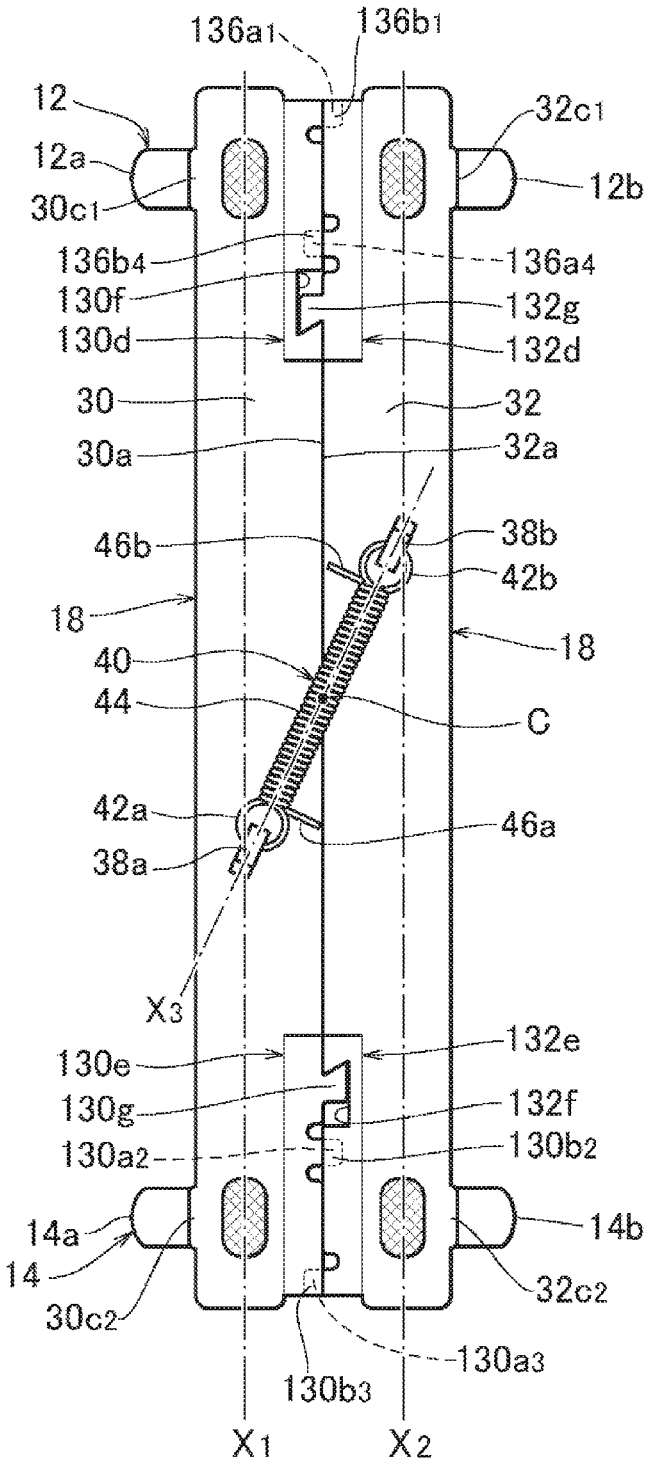
FIG. 51(D) is a schematic bottom view showing the binding rings and the operating members in a closed state.

The opening/closing member fixing portion 38*a* and the opening/closing member fixing portion 38*b* are formed, as shown in FIG. 51, such that the opening/closing member 40 is diagonally crossed to the abutting edge 30*a* and abutting edge 32*a*, along the line X3 (as shown in FIG. 51D) which connects center C in the longitudinal direction of abutting edge 30*a* and abutting edge 32*a* (as shown in FIG. 51D) with the opening/closing member fixing portion 38*a* and opening/closing member fixing portion 38*b*.

In other words, the opening/closing member fixing portion 38*a* of the opening/closing member 40 is formed such that the opening/closing member 40 is placed along the line X3 (as shown in FIG. 51D) which connects the center C in the longitudinal direction of abutting edge 30*a* (as shown in FIG. 51D) with the opening/closing member fixing portion 38*a*.

The opening/closing member fixing portion 38*b* of the opening/closing member 40 is formed such that the opening/closing member 40 is placed along the line X3 (as shown in FIG. 51D) which connects the center C in the longitudinal direction of abutting edge 32*a* (as shown in FIG. 51D) with the opening/closing member fixing portion 38*b*.

The latching base portion 38*a*1 in the opening/closing member fixing portion 38*a* and the latching base portion 38*b*1 in the opening/closing member fixing portion 38*b* are perpendicular to the said line X3 to form an approximately L-shape in side view, wherein latching and locking portion 38*a*2 (for the opening/closing member fixing portion 38*a*) and latching and locking portion 38*b*2 (for the opening/closing member fixing portion 38*b*) which extend respectively along the said line X3 (as shown in FIG. 51D) into the direction opposite to the opening/closing member 40 are formed at the tip end (lower end) of the latching base portion 38*a*1 in the opening/closing member fixing portion 38*a* and the latching base portion 38*b*1 in the opening/closing member fixing portion 38*b*. The opening/closing member fixing portion 38*a* and the opening/closing member fixing portion 38*b* are formed symmetrically with respect to center C in the longitudinal direction of abutting edge 30*a* and abutting edge 32*a*.

Furthermore, by moving the pair of the first operating piece 30 and the second operating piece 32 oppositely in the longitudinal direction of the holding member 16, each of the first binding ring 12 and the second binding ring 14 composed by combining the corresponding half rings is separated.

When each of the first binding ring 12 and the second binding ring 14 is separated, the opening/closing member 40 biases the first operating piece 30 and the second operating piece 32 to thereby release the first half ring 12*a* and the second half ring 12*b* from each other and the third half ring 14*a* and the fourth half ring 14*b* from each other.

When the first binding ring 12 and the second binding ring 14 start being opened with a hand, i.e., when the binding ring latching portions 50 of each of the first binding ring 12 and the second binding ring 14 are disengaged, the elasticity of the opening/closing member 40 acts for the direction in which the extended coil portion 44 of the opening/closing member 40 is still extending, the elasticity of the opening/closing member 40 causes the first operating piece 30 and the second operating piece 32 constituting the operating member 18 to move in directions which cause the first half ring 12*a* and the second half ring 12*b* of the first binding ring 12 to be separated from each other (the first half ring 12*a* to move in the O1 direction and the second half ring 12*b* to move in the O2 direction (shown in FIG. 51)) and which cause the third half ring 14*a* and the fourth half ring 14*b* of the second binding ring 14 to be separated from each other (the third half ring 14*a* to move in the O1 direction and the fourth half ring 14*b* to move in the O2 direction (shown in FIG. 51)). The elasticity of the opening/closing member 40 causes the first operating piece 30 and the second operating piece 32 constituting the operating member 18 to move the first operating piece 30 and the second operating piece 32 in the opposite direction each other (the O1 direction for the first operating piece 30 and the O2 direction for the second operating piece 32) (see FIG. 55).

Furthermore, the opening/closing member 40 acts so as to separate the first half ring 12*a* and the second half ring 12*b* away from each other and the third half ring 14*a* and the fourth half ring 14*b* away from each other in a circumferential direction (in the directions of the horizontal axes Y1 and Y2 in FIG. 51).

Figure 58:
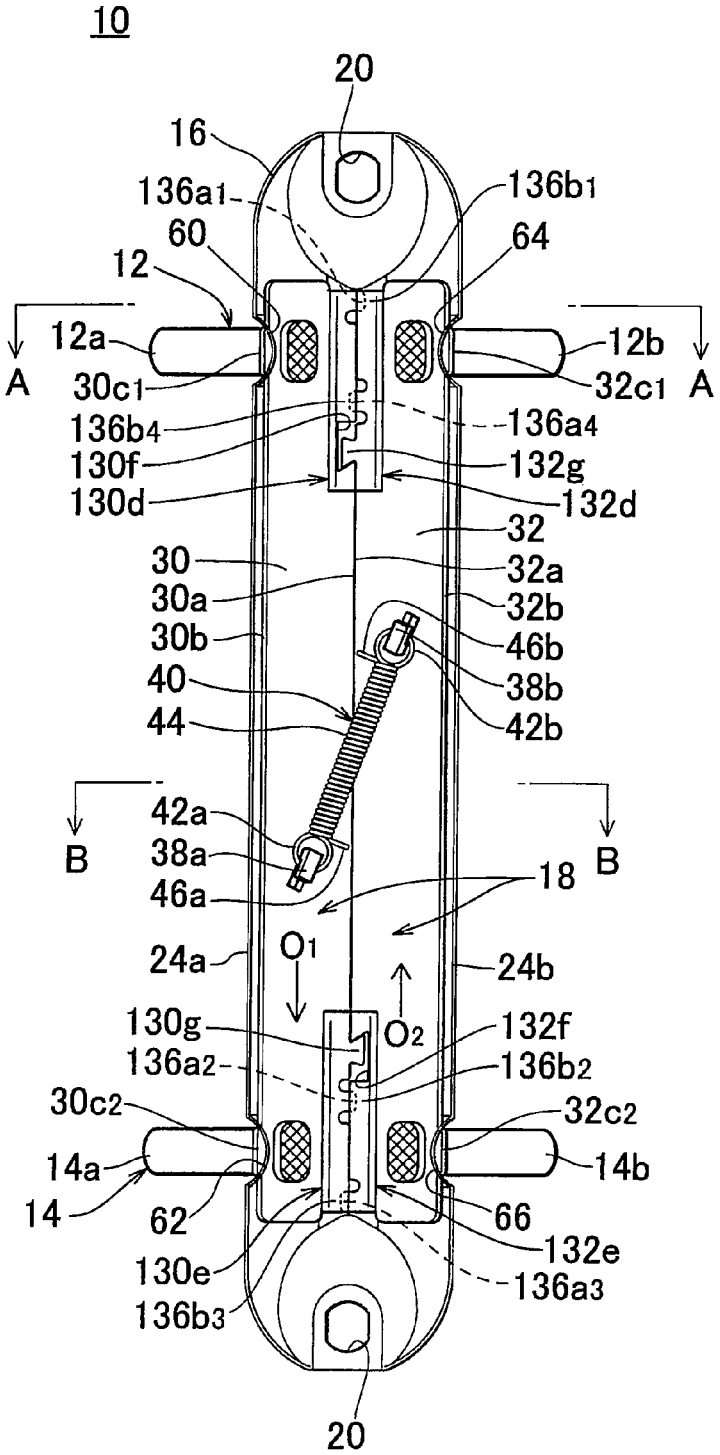
FIGS. 58(A) and 58(B) are schematic bottom views showing the binding device in a opening state, where

The twisted opening/closing member 40 attempts to return to the original state as shown in arrow directions of FIGS. 50(B) and (C) and thus acts to separate the first half ring 12*a* and the second half ring 12*b* and the third half ring 14*a* and the fourth half ring 14*b* in the circumferential direction of the first binding ring 12 and the second binding ring 14 (an O3 direction for first half ring 12*a* and the third half ring 14*a* and an O4 direction (shown in FIG. 51) for the second half ring 12*b* and the fourth half ring 14*b* (see FIG. 58 (A)).

Then, the opening/closing member 40 operates to the direction in which the coil portion 44 extending due to the elasticity of the opening/closing member 40 is shrinking, the first operating piece 30 constituting the operating member 18 moves in a direction toward a position for closing the binding ring latching portions 50 (the direction opposite to O1, shown in FIG. 51) and the second operating piece 32 moves in a direction toward a position for closing the binding ring latching portions 50 (the direction opposite to O2, shown in FIG. 51) (see FIGS. 58(B) and 59).

In other words, the first operating piece 30 and the second operating piece 32 change from the planar state to an upward folded state.

The first binding ring 12 and the second binding ring 14 are opened by rotating to the opening direction (the O3 direction for the first half ring 12*a* and the third half ring 14*a*, and the O4 direction for the second half ring 12*b* and the fourth half ring 14*b*).

When the first binding ring 12 and the second binding ring 14 are opened, the opening/closing member 40 acts so as to maintain the abutting edge 30*a* of the first operating piece 30 and the abutting edge 32*a* of the second operating piece 32 in an upward folded state, i.e., in a state where they are close to the inner surface of the bound object-mounting portion 22 of the holding member 16.

The bound object-mounting portion 22 of the holding member 16 is formed with a bulging portion 22*a* which extends in the longitudinal direction of the bound object-mounting portion 22.

The bulging portion 22*a* is formed with a recessed portion on the inner side thereof. The bulging portion 22*a* is formed to extend in the longitudinal direction of the bound object-mounting portion 22 so as to prevent the engaging portions 30*d*, 30*e*, 32*d*, and 32*e* and the opening/closing member 40 from abutting against the inner surface of the bound object-mounting portion 22 when the engaging portions 30*d* and 32*e* and the engaging portions 30*e* and 32*d* of the operating member 18 rotate upwardly and the opening/closing member 40 moves upwardly.

Then, the holding member 16 includes the holding wall 24 and the bound object-mounting portion 22 which extends to the direction close to the direction connecting the base portions of the first binding ring 12 and the second binding ring 14 to be disposed with a spacing in the operating member 18.

The holding portion for holding the operating member 18 within the holding member 16 is formed with the holding wall 24 and the bound object-mounting portion 22 of the holding member 16. The operating member 16 and the opening/closing member 40, when the first binding ring 12 and the second binding ring 14 are opened or closed, are configured to move within the holding portion (space).

As described above, the holding member 16 includes the holding wall 24 composed of the first holding wall 24*a* and the second holding wall 24*b* which extend to the direction close to the direction connecting the base portions (shown in the X1 direction and the X2 direction of FIG. 51) of the first binding ring 12 and the second binding ring 14 to be disposed with a spacing in the operating member 18.

The holding wall 24 extends to the direction intersecting the direction connecting the base portions (shown in the X1 direction and the X2 direction of FIG. 51) of the first binding ring 12 and the second binding ring 14 to be disposed with a spacing in the operating member 18. The holding wall 24 includes the holding wall which holds the protruding portions 30*c*1 and 30*c*2 of the first operating piece 30 and the protruding portions 32*c*1 and 32*c*2 of the second operating piece 32 protruding facing the outside of the holding wall 24, i.e., the first holding portions 60 and 62 formed in the first holding wall 24*a* and the second holding portions 64 and 66 formed in the second holding wall 24*b*.

The first holding portions 60 and 62 are recessed toward the inside of the holding wall 24 (the first holding wall 24*a*) so that the first holding portions 60 and 62 in which the part of the holding wall 24 is projected outwardly form the protruding portions 30*c*1 and 30*c*2 of the operating member 18 maintain the protruding portions 30$c$1 and 30$c$2 of the operating member 18 which is fitted into the inside of the holding member 16.

Furthermore, the second holding portions 64 and 66 are recessed toward the inside of the holding wall 24 (the second holding wall 24$b$) so that the second holding portions 64 and 66 in which the part of the holding wall 24 is projected outwardly form the protruding portions 32$c$1 and 32$c$2 of the operating member 18 maintain the protruding portions 32$c$1 and 32$c$2 of the operating member 18 which is fitted into the inside of the holding member 16.

The first holding portions 60 and 62 and the second holding portions 64 and 66 are formed with a thin cut 68$a$, cut 70$a$, cut 72$a$, and cut 74$a$ to be disposed with a spacing between the lower edges of the holding wall 24 along the undersides of the first operating piece 30 and the second operating piece 32 of the operating member 18. In addition, the first holding portions 60 and 62 and the second holding portions 64 and 66 are formed by the area projected outwardly from the holding wall 24 between the cuts 68$a$, 70$a$, 72$a$, and 74$a$ and the lower edges of the holding wall 24 (see FIGS. 66 (A) and (B)).

Then, the areas constituting the first holding portions 60 and 62 and the second holding portions 64 and 66 are projected toward the inside to maintain the lower edges of the protruding portions 30$c$1, 30$c$2, 32$c$1, and 32$c$2 of the operating member 18 which is fitted into the inside of the holding member 16, and are recessed toward the inside of areas other than areas between the cuts 68$a$, 70$a$, 72$a$, and 74$a$ of the holding wall 24 and the lower edges of the holding wall 24. Accordingly, the first holding portions 60 and 62 and the second holding portions 64 and 66 are formed (see FIGS. 67(A)(B)).

The first binding ring 12 is composed of the semicircular arc-shaped first half ring 12$a$ and the second half ring 12$b$ so as to form an approximately annular shaped binding ring, whereas the second binding ring 14 is composed of the semicircular arc-shaped third half ring 14$a$ and the fourth half ring 14$b$ so as to form an approximately annular shaped binding ring.

The binding ring latching portions 50 are provided at the tips of the first and second half rings 12$a$ and 12$b$ and the tips of the third and fourth half rings 14$a$ and 14$b$, i.e., at the top of the first binding ring 12 and the top of the second binding ring 14 such that the first, second, third, and fourth half rings 12$a$, 12$b$, 14$a$ and 14$b$ pass through binder holes perforated through an object S such as a paper in advance to bind the object S such as the paper.

The first binding ring 12 and the second binding ring 14 constituting the binding rings are formed by widening a metal-made wire rod having a circular cross-section in a direction for disengaging the binding ring latching portions 50 (the O1 and O2 directions of FIG. 51) and pressing the central portion of the wire rod to bend in a direction for closing the binding rings.

Then, the first binding ring 12 and the second binding ring 14 are formed into a shape having a substantially bean-shaped cross-section. In the substantially bean-shaped cross-section, the central portion thereof protrudes in a direction for opening the binding ring (the O3 direction in FIG. 51 for the first half ring 12$a$ and the third half ring 14$a$ and the O4 direction in FIG. 51 for the second half ring 12$b$ and the fourth half ring 14$b$), and the both edges thereof are bent in a direction for closing the binding ring.

In other words, when the annular first binding ring 12 and second binding ring 14 are viewed from the opening/closing direction, a wavy surface is formed on the inner side of the first binding ring 12 and the second binding ring 14, and the outer side of the first binding ring 12 and the second binding ring 14 is formed into a semicircular arc shape.

Furthermore, as viewed from a direction for disengaging the binding rings, each of the first binding ring 12 and the second binding ring 14 has opposite outer edges formed into a semicircular arc shape. Conventional binding rings having a circular cross-section do not resist deformation when the diameter is small. When the diameter is increased, the cross-sectional area increases to increase cost for the material therefor. Furthermore, since binding holes formed in the object such as the paper are usually circular holes, conventional binding rings having a substantially rectangular cross-section are not well suitable for the binding holes of the object such as the paper and are likely to damage the binding holes of the papers.

Meanwhile, when the first binding ring 12 and the second binding ring 14 constituting the binding rings are thin, the binding ring latching portions 50 may not be securely fitted with each other.

Hence, it is desirable to increase the width of the first binding ring 12 and the second binding ring 14. However, even in a case in which a wire rod having a small cross-sectional area is employed as a raw wire rod, it is desirable to ensure a required width for a binding ring by machining the raw metal-made wire rod.

Therefore, in the binding rings according to the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring latching portions 50, whereby the binding ring latching portions 50 can be completely engaged with each other.

In this embodiment, the first half ring 12$a$ and the second half ring 12$b$ constituting the first binding ring 12 and the third half ring 14$a$ and the fourth half ring 14$b$ constituting the second binding ring 14 have the same shape, i.e., the same curvature (radius of curvature).

The first half ring 12$a$ and the second half ring 12$b$ constituting the first binding ring 12 are annularly connected by engaging the binding ring latching portion 50 on a free end of the first half ring 12$a$ with the binding ring latching portion 50 on a free end of the second half ring 12$b$.

Furthermore, the third half ring 14$a$ and fourth half ring 14$b$ constituting the second binding ring 14 are annularly connected by engaging the binding ring latching portion 50 on a free end of the third half ring 14$a$ with the binding ring latching portion 50 on a free end of the fourth half ring 14$b$.

The first binding ring 12 and the second binding ring 14 are provided so as to extend upward from the first operating piece 30 and the second operating piece 32 so as to define a plane perpendicular to the plane Pxy containing the horizontal axes Y1 and Y2 and the longitudinal axes X1 and X2 (shown in FIG. 51) passing through the locations (four locations) where the bases of the first binding ring 12 and the second binding ring 14 are secured to the first operating piece 30 and the second operating piece 32.

A circular plane defined by an axis Z1 (shown in FIG. 51) of the first binding ring 12 and a circular plane formed by an axis Z2 (shown in FIG. 51) of the second binding ring 14 are parallel to each other such that the first binding ring 12 and the second binding ring 14 are perpendicular to the plane Pxy passing through the locations where the first binding ring 12 and the second binding ring 14 are secured to the first operating piece 30 and the second operating piece 32.

As shown in FIGS. 60 to 65, the binding rings are composed of the first binding ring 12 serving as the main binding ring which is closed directly with fingers and the second binding ring 14 serving as the subsidiary binding ring which follows the motion of the first binding ring 12 in a closing direction.

Furthermore, the first binding ring 12 and the second binding ring 14 are configured such that the binding ring latching portions 50 thereof can be disengaged with fingers in the same direction (the O1 and O2 directions in FIG. 55).

The binding ring latching portion 50 is formed at the end of the first half ring 12*a* and at the end of the second half ring 12*b* constituting the first binding ring 12. The binding ring latching portion 50 is composed of a projection 52*a* at the end portion of the binding ring latching portion 50 and a recess 52*b* following the projection 52*a*. Furthermore, the binding ring latching portion 50 of the second half ring 12*b* is composed of a projection 54*a* at the end of the binding ring latching portion 50 and a recess 54*b* following the projection 54*a*. The projections 52*a* and 54*a* and the recesses 52*b* and 54*b* are formed so as to be protruded or recessed in mutually opposite directions, so that they are engaged with each other when the first binding ring 12 is closed.

The projections 52*a* and 54*a* are formed with inclined opposing faces 52*c* and 54*c*, respectively, each having a convex curved surface extending from the end portion toward the inside and with the inclined opposing faces 52*d* and 54*d*, respectively, which are formed continuously with the inclined opposing faces 52*c* and 54*c*, respectively, and gradually extend from the rear end portion (the base side) of the projections 52*a* and 54*a*, respectively, to the tip end side (a closing direction). The vicinity of the rear end of each of the projections 52*a* and 54*a* has a hook-like shape, and each of the projections 52*a* and 54*a* as a whole is formed into a hooked nose-like shape.

The recess 52*b* includes an inclined opposing face having a concave curved surface extending from the base portion side toward the tip end portion. Similarly, the recess 54*b* includes an inclined opposing face having a concave curved surface extending from the base portion side toward the tip end portion.

Moreover, the binding ring latching portion 50 is formed at the end of the third half ring 14*a* and at the end of the fourth half ring 14*b* constituting the second binding ring 14. The binding ring latching portion 50 is composed of a projection 56*a* constituting the binding ring latching portion 50 and a recess 56*b* following the projection 56*a*. Furthermore, the binding ring latching portion 50 of the fourth half ring 14*b* is composed of a projection 58*a* at the end of the binding ring latching portion 50 and a recess 58*b* following the projection 58*a* at the end of the binding ring latching portion 50. The projections 56*a* and 58*a* and the recesses 56*b* and 58*b* are formed so as to be protruded or recessed in mutually opposite directions, so that they are engaged with each other when the second binding ring 14 is closed.

The projections 56*a* and 58*a* are formed with inclined opposing faces 56*c* and 58*c*, respectively, each having a convex curved surface extending from the end portion toward the inside and with inclined opposing faces 56*d* and 58*d*, respectively, which are formed continuously with the inclined opposing faces 56*c* and 58*c*, respectively, and gradually extend from the rear end portion (the base side) of the projections 56*a* and 58*a*, respectively, to the tip end portion (a closing direction). The vicinity of the rear end of each of the projections 56*a* and 58*a* has a hook-like shape, and each of the projections 56*a* and 58*a* as a whole is formed into a hooked nose-like shape.

The recess 56*b* includes an inclined opposing face having a concave curved surface extending from the base portion side toward the tip end portion. Similarly, the recess 58*b* includes an inclined opposing face having a concave curved surface extending from the base portion side toward the tip end portion.

The projection 52*a* constituting the binding ring latching portion 50 of the first half ring 12*a* and the projection 56*a* constituting the binding ring latching portion 50 of the third half ring 14*a* are formed so as to protrude in the same direction. Furthermore, these projections 52*a* and 56*a* include a convex curved surface formed to extend from the tip end to the base side and are formed into the same shape.

The recess 52*b* constituting the binding ring latching portion 50 of the first half ring 12*a* and the recess 56*b* constituting the binding ring latching portion 50 of the third half ring 14*a* are formed so as to be recessed in the same direction. Furthermore, these recesses 52*b* and 56*b* include a concave curved surface formed to extend from the rear end of the projections 54*a* and 56*a* to the base side and formed into the same shape.

The projection 54*a* constituting the binding ring latching portion 50 of the second half ring 12*b* and the projection 58*a* constituting the binding ring latching portion 50 of the fourth half ring 14*b* are formed so as to protrude in the same direction. Furthermore, these projections 54*a* and 58*a* include a convex curved surface formed to extend from the tip end to the base side and are formed into the same shape.

Furthermore, the recess 54*b* constituting the binding ring latching portion 50 of the second half ring 12*b* and the recess 58*b* constituting the binding ring latching portion 50 of the fourth half ring 14*b* are formed so as to be recessed in the same direction. Furthermore, these recesses 54*b* and 58*b* include a concave curved surface formed to extend from the rear end of the projections 54*a* and 58*a* to the base side and formed into the same shape.

The projection 52*a* and the recess 52*b* of the first half ring 12*a* and the projection 54*a* and the recess 54*b* of the second half ring 12*b* are formed so as to be point-symmetric, and the projection 56*a* and the recess 56*b* of the third half ring 14*a* and the projection 58*a* and the recess 58*b* of the fourth half ring 14*b* are formed so as to be point-symmetric.

The inclined opposing face 52*c* of the projection 52*a* of the first binding ring 12 and the inclined opposing face of the recess 54*b* are formed so as to obliquely intersect the direction of the axis of the first binding ring 12. When the first binding ring 12 is opened or closed, the inclined opposing face 52*c* and the inclined opposing face of the recess 54*b* come into contact with each other in an inscribed relation with one point shared thereby.

The inclined opposing face 52*c* of the projection 52*a* of the first binding ring 12 and the inclined opposing face 54*c* of the projection 54*a* are formed so as to obliquely intersect the direction of the axis of the first binding ring 12. When the first binding ring 12 is opened or closed, the inclined opposing faces 52*c* and 54*c* come into contact with each other in a circumscribed relation with one point shared thereby.

The inclined opposing face 56*c* of the projection 56*a* of the second binding ring 14 and the inclined opposing face of the recess 58*b* are formed so as to obliquely intersect the direction of the axis of the second binding ring 14. When the second binding ring 14 is opened or closed, the inclined opposing face 56*c* and the inclined opposing face of the recess 58*b* come into contact with each other in an inscribed relation with one point shared thereby.

The inclined opposing face 56*c* of the projection 56*a* of the second binding ring 14 and the inclined opposing face 58*c* of the projection 58*a* are formed so as to obliquely intersect the direction of the axis of the second binding ring 14. When the second binding ring 14 is opened or closed, the inclined opposing faces 56*c* and 58*c* come into contact with each other in a circumscribed relation with one point shared thereby.

Figure 63:
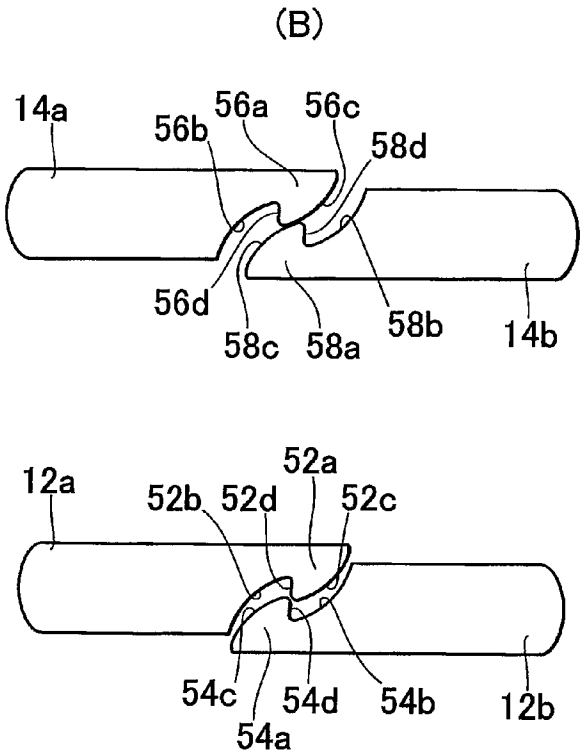
FIGS. 63(A) and 63(B) are schematic views showing a state in which the binding rings are closed, where
Figure 63:
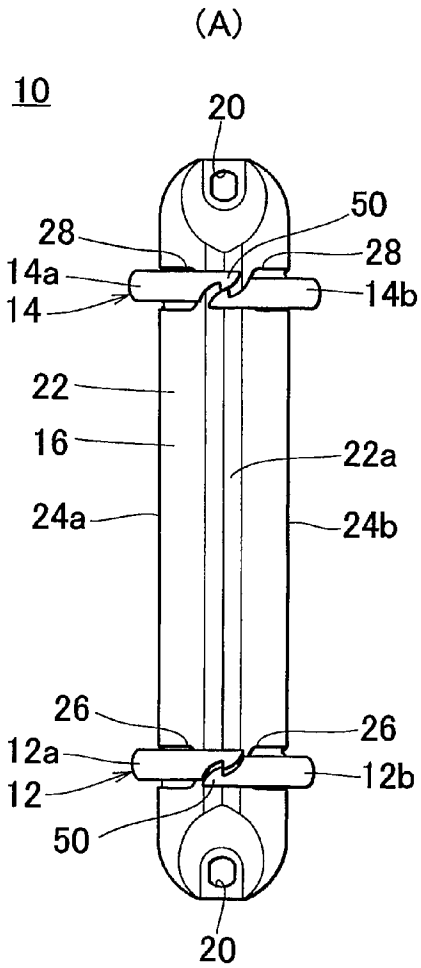
Figure 64:
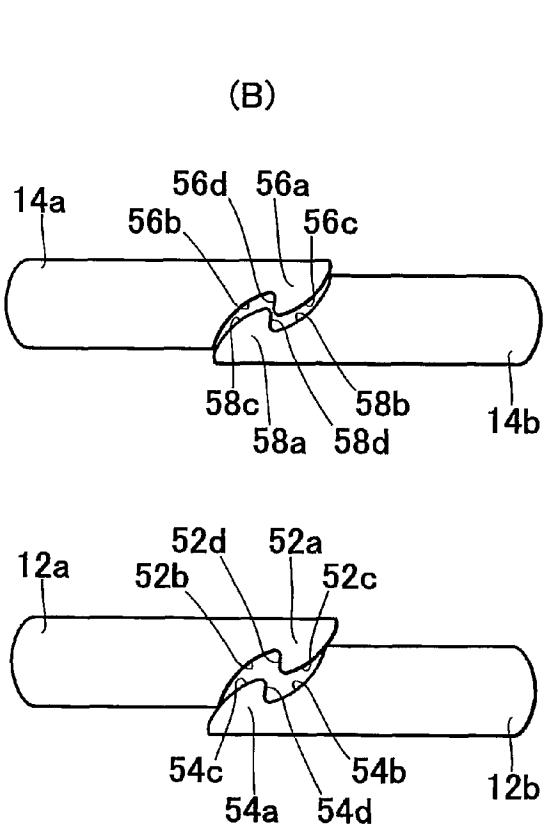
FIGS. 64(A) and 64(B) are schematic views showing a state in which the binding rings are closed, where
Figure 64:
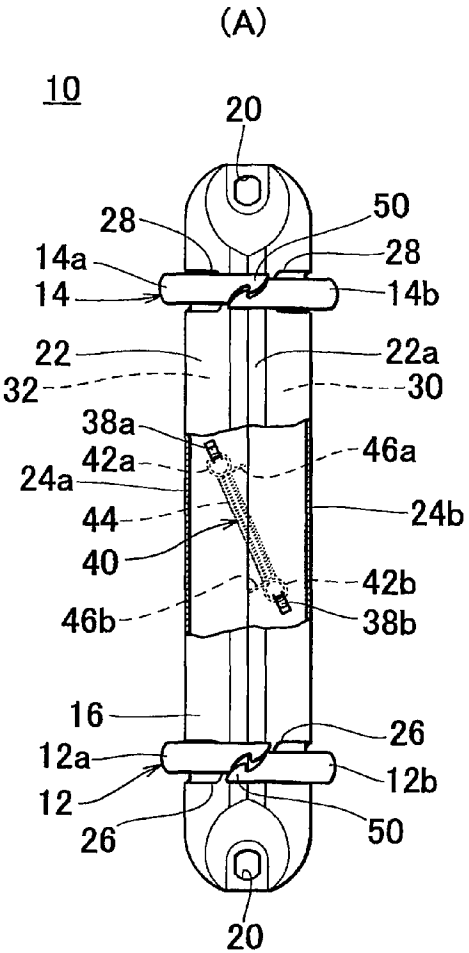
Figure 65:
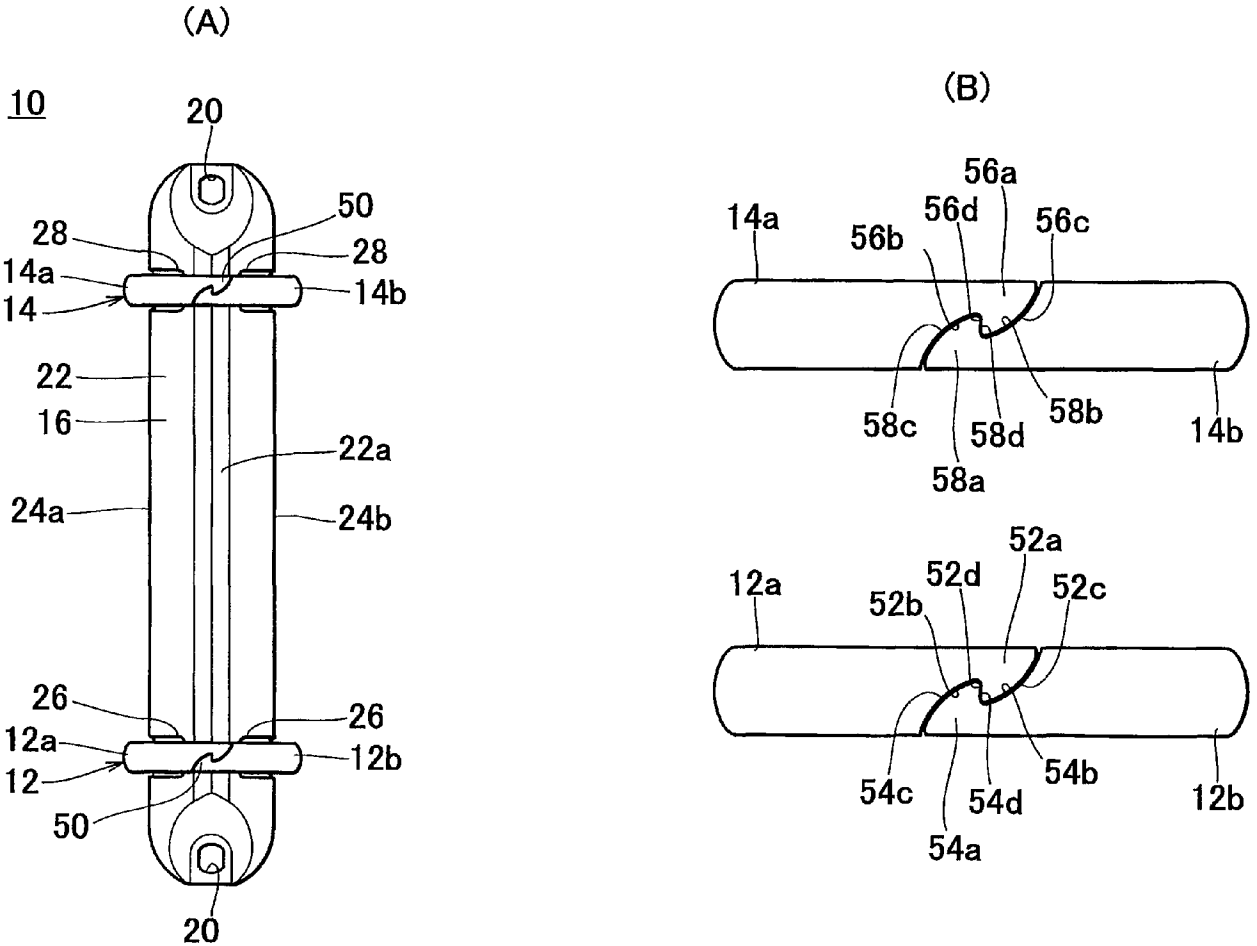
FIGS. 65(A) and 65(B) are schematic views showing a state in which the binding rings are closed, where

When the first binding ring 12 serving as the main binding ring is held with two fingers to start closing the binding rings 12 and 14, the projection 52*a* of the first half ring 12*a* of the first binding ring 12 and the projection 54*a* of the second half ring 12*b* of the first binding ring 12 abut against each other before the projection 56*a* of the third half ring 14*a* of the second binding ring 14 and the recess 58*b* of the fourth half ring 14*b* of the second binding ring 14 abut against each other (see FIG. 63). Furthermore, by operating the first binding ring 12 so as to be closed, the recess 52*b* of the first half ring 12*a* of the first binding ring 12 oscillates on the projection 54*a* of the second half ring 12*b*. Then, the projection 52*a* of the first half ring 12*a* of the first binding ring 12 moves past a normal engagement position where the projection 52*a* fits into the recess 54*b* of the second half ring 12*b*, and the projection 52*a* of the first half ring 12*a* slides upward on the inclined opposing face of the recess 54*b* of the second half ring 12*b* (see FIG. 64).

Hence, by operating the first binding ring 12 in the closing direction, the projection 56*a* of the third half ring 14*a* of the second binding ring 14 abuts against the projection 58*a* of the fourth half ring 14*b* of the second binding ring 14. Furthermore, by operating the first binding ring 12 so as to be closed, the projection 56*a* of the third half ring 14*a* of the second binding ring 14 oscillates on the inclined opposing face 58*c* of the projection 58*a* of the fourth half ring 14*b* (see FIG. 63). Furthermore, the projection 52*a* of the first half ring 12*a* of the first binding ring 12 slides upward on the inclined opposing face of the recess 54*b* of the second half ring 12*b*. Then, the projection 56*a* of the third half ring 14*a* of the second binding ring 14 (the projection 58*a* of the fourth half ring 14*b*) fits into the recess 58*b* of the fourth half ring 14*b* (the recess 56*b* of the third half ring 14*a*) (see FIG. 64).

Thereafter, the fingers are removed from the first binding ring 12 to release the closing force. Then, the action of the opening/closing member 40 causes the first binding ring 12 to return slightly in the opening direction. Thus, in the first binding ring 12 as in the second binding ring 14, the projection 52*a* of the first half ring 12*a* (the projection 54*a* of the second half ring 12*b*) fits into the recess 54*b* of the second half ring 12*b* (the recess 52*b* of the first half ring 12*a*) (see FIG. 65).

When the binding rings are closed, the upward folded state (see FIG. 59) of the first operating piece 30 and the second operating piece 32 is gradually changed to the planar state (see FIG. 54). At this time, the first operating piece 30 and the second operating piece 32 in a regularly arranged state are temporarily moved in the respective directions for disengaging the binding ring latching portions 50 (the O1 direction for the first operating piece 30 and the O2 direction for the second operating piece 32) and thus are arranged in a staggered state (see FIG. 64). Subsequently, the first operating piece 30 and the second operating piece 32 are moved back and arranged regularly.

Hence, the restricting projection 30*g* of the first operating piece 30 constituting the movement restricting portion is moved inside the restricting recess 32*f* of the second operating piece 32 and abuts on an edge of the restricting recess 32*f*, the edge being on the side opposite to the direction for disengaging the binding ring latching portions 50. In addition, the restricting projection 32*g* of the second operating piece 32 constituting the movement restricting portion is moved inside the restricting recess 30*f* of the first operating piece 30 and abuts on an edge of the restricting recess 30*f*, the edge being on the side opposite to the direction for disengaging the binding ring latching portions 50 (see FIG. 55).

Therefore, when the binding rings are closed, the projection 52*a* of the first half ring 12*a* of the first binding ring 12 moves past the normal stop position where the projection 52*a* fits into the recess 54*b* of the second half ring 12*b*, and the projection 52*a* of the first half ring 12*a* slides upward on the inclined opposing face of the recess 54*b* of the second half ring 12*b*, thereby causing overrun. At this time, the overrun is stopped at an appropriate position by restricting the distance of movement of the first binding ring 12.

Thus, when the fingers are removed from the binding ring latching portions 50 of the first binding ring 12, the restoring force of the opening/closing member 40 causes the first operating piece 30 and the second operating piece 32 to move temporarily in the respective directions for disengaging the binding ring latching portions 50 (the O1 direction for the first operating piece 30 and the O2 direction for the second operating piece 32) and thus are arranged in a staggered state. Subsequently, the first operating piece 30 and the second operating piece 32 arranged in the staggered state are moved back and arranged regularly, and the binding ring latching portions 50 fit into each other (see FIGS. 53, 54, 63, 64, and 65).

Hence, when the first binding ring 12 serving as the main binding ring starts closing, the second binding ring 14, which serves as the subsidiary binding ring and is not closed directly with fingers, starts moving in the closing direction. Furthermore, when the first binding ring 12 is closed and moves past the normal engagement position, the engagement of the second binding ring 14 progresses, and the engagement of the second binding ring 14 is completed before the engagement of the first binding ring 12 is completed. Therefore, after the second binding ring 14, which serves as the subsidiary binding ring and is not closed directly with fingers, is securely engaged, the first binding ring 12 serving as the main binding ring is securely engaged.

Therefore, when the first binding ring 12 is held with fingers to move ahead in the closing direction, and when the first binding ring 12 is held so as to cause overrun, the second binding ring 14 can be securely engaged at the normal position and can be closed by operating only the first binding ring 12.

As described above, by operating the first binding ring 12 with fingers, the second binding ring 14 can also be closed, thereby improving the usability as one-touch binding devices.

When the binding ring latching portions 50 of the first binding ring 12 are disengaged by twisting the top portion of the first binding ring 12 with fingers, the restoring force of the twisted opening/closing member 40 is exerted on the first operating piece 30 and the second operating piece 32, and thus the first binding ring 12 is opened. Here, the restoring force of the opening/closing member 40 is a force for restoring the one securing end portion 42*a* and the other securing end portion 42*b* to the original state by rotating to the circumferential direction of the coil portion 44 as shown in the arrow directions of FIGS. 50 (B) and (C).

Then, the binding ring latching portions 50 of the first binding ring 12 and the second binding ring 14 are disengaged (see FIG. 55), and the planar state of the first operating piece 30 and the second operating piece 32 is gradually changed to the upward folded state. At this time, the first operating piece 30 and the second operating piece 32 are moved in the respective directions for disengaging the binding ring latching portions 50 (the O1 direction for the first operating piece 30 and the O2 direction for the second operating piece 32) (see FIG. 58(A)).

Hence, the restricting projection 30*g* of the first operating piece 30 constituting the movement restricting portion is moved inside the restricting recess 32*f* of the second operating piece 32 and abuts on an edge of the restricting recess 32*f*, the edge being on the side opposite to the direction for disengaging the binding ring latching portions 50. In addition, the restricting projection 32*g* of the second operating piece 32 constituting the movement restricting portion is moved inside the restricting recess 30*f* of the first operating piece 30 and abuts on an edge of the restricting recess 30*f*, the edge being on the side opposite to the direction of the binding ring latching portion 2 (see FIG. 58 (B)).

When the hand is removed from the first binding ring 12, a force is exerted on the first operating piece 30 and the second operating piece 32, for restoring the one securing end portion 42*a* and the other securing end portion 42*b* of the opening/closing member 40 to the original state by rotating to the circumferential direction of the coil portion 44 as shown in the arrow directions of FIGS. 50 (B) and (C). Therefore, the first binding ring 12 and the second binding ring 14 are opened further (the first half ring 12*a* and the third half ring 14*a* are opened in the O3 direction, and the second half ring 12*b* and the fourth half ring 14*b* are opened in the O4 direction).

In addition, by shrinking the coil portion 44 of the opening/closing member 40, a force for arranging movement of the one securing end portion 42*a* and the other securing end portion 42*b* of the opening/closing member 40 opposite to each other in a plan view is exerted to cause the first operating piece 30 and the second operating piece 32 to move in directions opposite to each other (see FIG. 58 (A) (B)).

In other words, the operating member 18 and the opening/closing member 40 exert an action in the direction for opening the projection 56*a* of the third half ring 14*a* and the projection 58*a* of the fourth half ring 14*b* constituting the second binding ring 14, and an action in the direction for separating the projection 52*a* of the first half ring 12*a* of the first binding ring 12 from the projection 54*a* of the second half ring 12*b*. In addition, the operating member 18 and the opening/closing member 40 works such that the projection 56*a* of the third half ring 14*a* and the projection 58*a* of the fourth half ring 14*b* constituting the second binding ring 14 are separated from each other.

As described above, in this embodiment, by twisting the top portion of the first binding ring 12 or the second binding ring 14 with fingers, the binding ring latching portions 50 of the first half ring 12*a* and the second half ring 12*b* of the first binding ring 12 can be disengaged, and the binding ring latching portions 50 of the third half ring 14*a* and the fourth half ring 14*b* of the second binding ring 14 can also be disengaged.

When the engagement between the binding ring latching portions 50 of the first and second half rings 12*a* and 12*b* of the first binding ring 12 and the engagement between the binding ring latching portions 50 of the third and fourth half rings 14*a* and 14*b* of the second binding ring 14 are released, a force is exerted on the operating member 18 to urge the one securing end portion 42*a* and the other securing end portion 42*b* of the opening/closing member 40 to come close to each other in the circumferential direction of the coil portion 44. Therefore, the abutting edge 30*a* of the first operating piece 30 and the abutting edge 32*a* of the second operating piece 32 are brought into an upward folded state.

Figure 66:
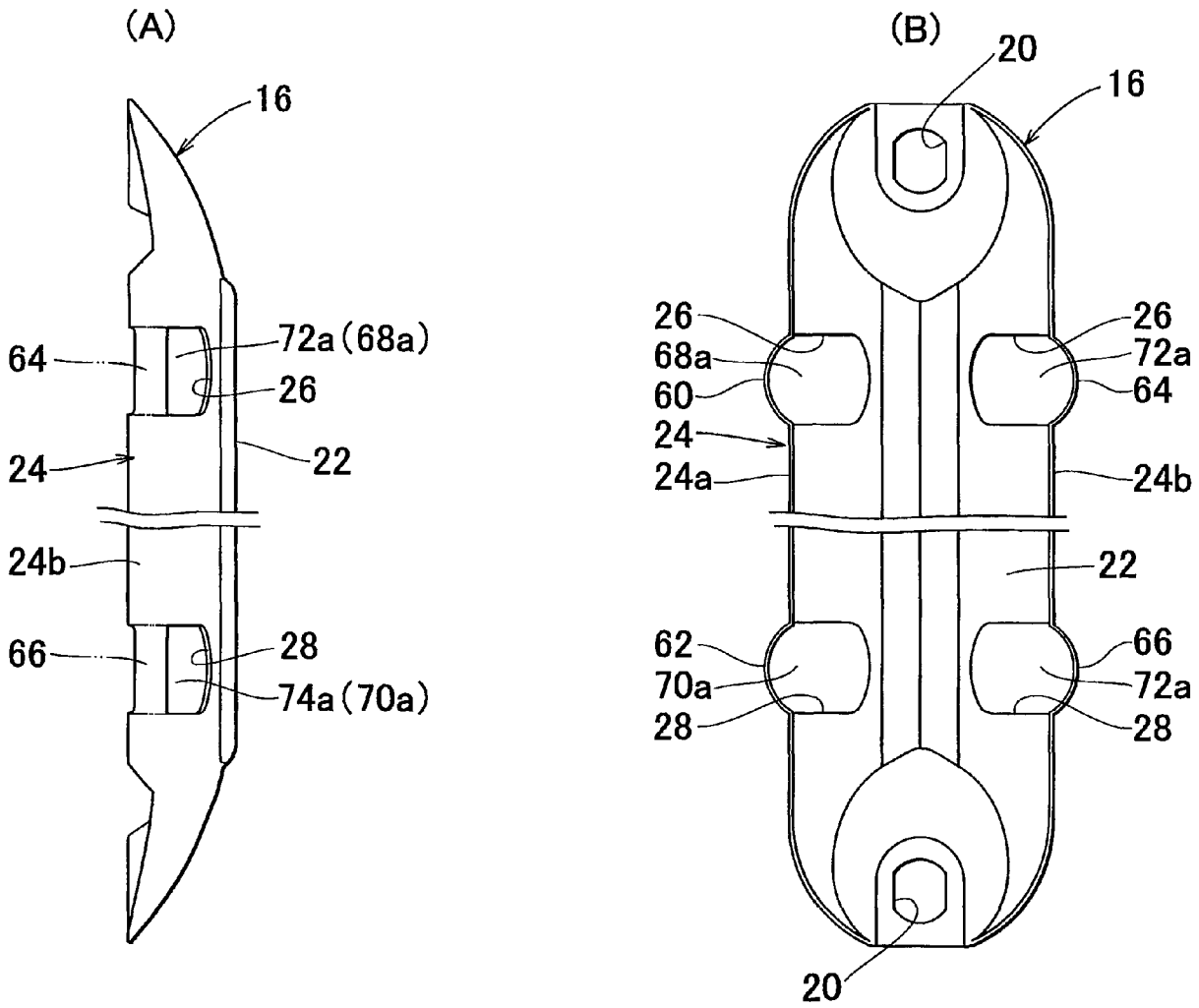
FIGS. 66(A) and 66(B) are schematic views showing method for forming the holding members, where 66(A) is a schematic side view of the holding member.
Figure 67:
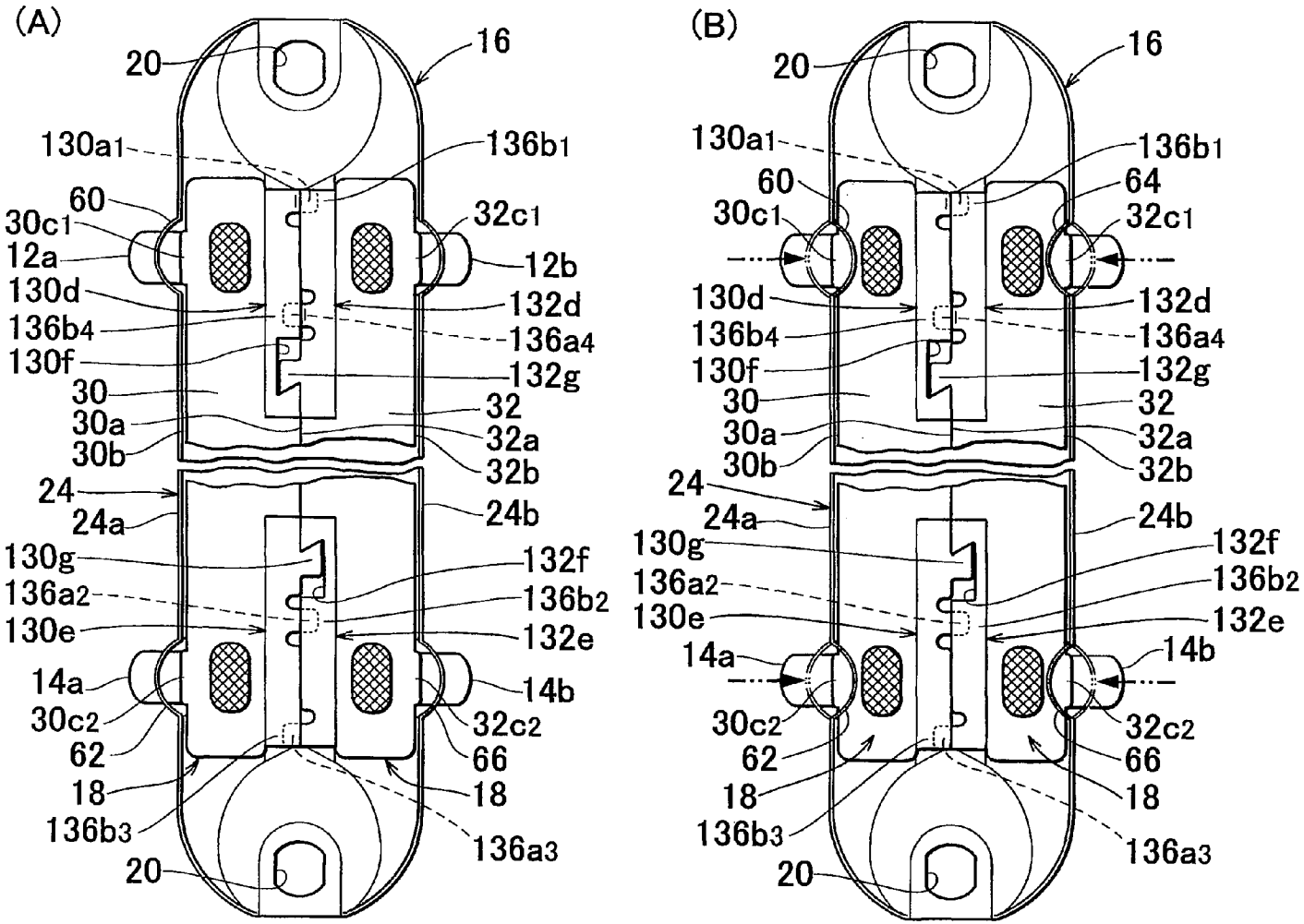
FIG. 67 is a schematic bottom view showing a method for forming the holding members.

Next, a method for mounting the operating member 18 in the holding space of the holding member 16 is described mainly with reference to FIGS. 66 and 67.

Before the holding member 16 mounts the first operating piece 30 and the second operating piece 32, the first holding portions 60 and 62 of the first holding wall 24*a* and the second holding portions 64 and 66 of the second holding wall 24*b* bulge toward the outside of the other area of the first holding wall 24*a* and the second holding wall 24*b* (see FIG. 66 (B)).

In other words, the first holding wall 24*a* is formed with the thin cuts 68*a* and 70*a* to be disposed with a spacing between the lower edges of the first holding wall 24*a* for forming the first holding portions 60 and 62 in the vicinity of the first through hole 26. The area between the cuts 68*a* and 70*a* and the lower edges of the first holding wall 24*a* is projected toward the outside of the first holding wall 24*a*. Therefore, the first holding portions 60 and 62 are formed (see FIG. 66 (B)).

Furthermore, the second holding wall 24*b* is formed with the thin cuts 72*a* and 74*a* to be disposed with a spacing between the lower edges of the second holding wall 24*b* for forming the second holding portions 64 and 66 in the vicinity of the second through hole 28. The area between the cuts 72*a* and 74*a* and the lower edges of the second holding wall 24*b* is projected toward the outside of the second holding wall 24*b*. Therefore, the second holding portions 64 and 66 are formed (see FIG. 66 (A)).

When the operating member 18 is mounted in the holding space of the holding member 16, first, the first operating piece 30 is mounted in the holding member 16, then the second operating piece 32 is mounted in the holding member 16 (see FIG. 67 (A)).

At this time, the protruding portion 30*c*1 of the first operating piece 30 is located within the first holding portion 60, and the protruding portion 30*c*2 of the first operating piece 30 is located within the first holding portion 62. The protruding portion 32*c*1 of the second operating piece 32 is located within the second holding portion 64, the protruding portion 32*c*2 of the second operating piece 32 is located within the second holding portion 66.

Next, the first holding portions 60 and 62 and the second holding portions 64 and 66 are driven into the inside of the first holding wall 24*a* and the second holding wall 24*b*, thereby forming the first holding portions 60 and 62 and the second holding portions 64 and 66 of circular arc shape in a plan view (see FIG. 67 (B)).

Then, the first holding portion 60 is formed so as to hold the underside of the protruding portion 30*c*1, and the first holding portion 62 is formed so as to hold the underside of the protruding portion 30*c*2. The second holding portion 64 is formed so as to hold the underside of the protruding portion 32*c*1, and the second holding portion 66 is formed so as to hold the underside of the protruding portion 32*c*2.

Then, the protruding portion 30*c*1 protrudes outwardly from the first through hole 26, and the protruding portion 30*c*2 protrudes outwardly from the second through hole 28. The protruding portion 32*c*1 protrudes outwardly from the first through hole 26, and the protruding portion 32*c*2 protrudes outwardly from the second through hole 28.

Next, a method for mounting the opening/closing member 40 on the operating member 18 is described with reference to FIGS. 48 to 50.

In a state in which the first binding ring 12 and the second binding ring 14 are closed, the securing end portion 42*a* secures the opening/closing member 40 to the first operating piece 30, and the securing end portion 42*b* secures the opening/closing member 40 to the second operating piece 32 so that a spring is loaded in a direction for rotationally moving the first operating piece 30 and the second operating piece 32, defining the abutting edges 30*a* and 32*a* as a center, to the direction from an opened state to a closed state, the twisting moment is received around a central axis of the coil portion 44 (coil), and bending stress is generated on a strand.

In this case, for the opening/closing member 40, in view of a state in which no load such as the twisting moment is placed on the coil portion 44 (shown in FIG. 50 (A)), the securing end portions 42*a* and 42*b* are secured to the opening/closing member fixing portions 38*a* and 38*b*, respectively, in a state in which the coil portion 44 is twisted for one revolution or more so as to increase the number of coil of the coil portion 44 for one revolution or more (the R direction for the securing end portions 42*a* and the restricting arm portion 46*a*, and the Q direction for the securing end portion 42*b* and the restricting arm portion 46*b* (shown in FIG. 49 and FIG. 50 (A))

It is configured that the load direction for loading a spring is the direction for winding the coil portion 44 (coil).

In the embodiments described above, a pair of operating pieces (the first operating piece 30 and the second operating piece 32) is formed with the protruding portions (the protruding portions 30*c*1, 30*c*2, 32*c*1, and 32*c*2) to be inserted into the through holes (the first through hole 26 and the second through hole 28) formed in the holding member 16. Therefore, even when the base portions of the binding rings (the first binding ring 12 and the second binding ring 14) are secured to the operating pieces (the first operating piece 30 and the second operating piece 32) by, for example, swaging, the area can be increased in order to reduce stress applied to the operating pieces (the first operating piece 30 and the second operating piece 32).

Therefore, the strength of the operating pieces (the first operating piece 30 and the second operating piece 32) as a whole can be increased.

Figure 68:
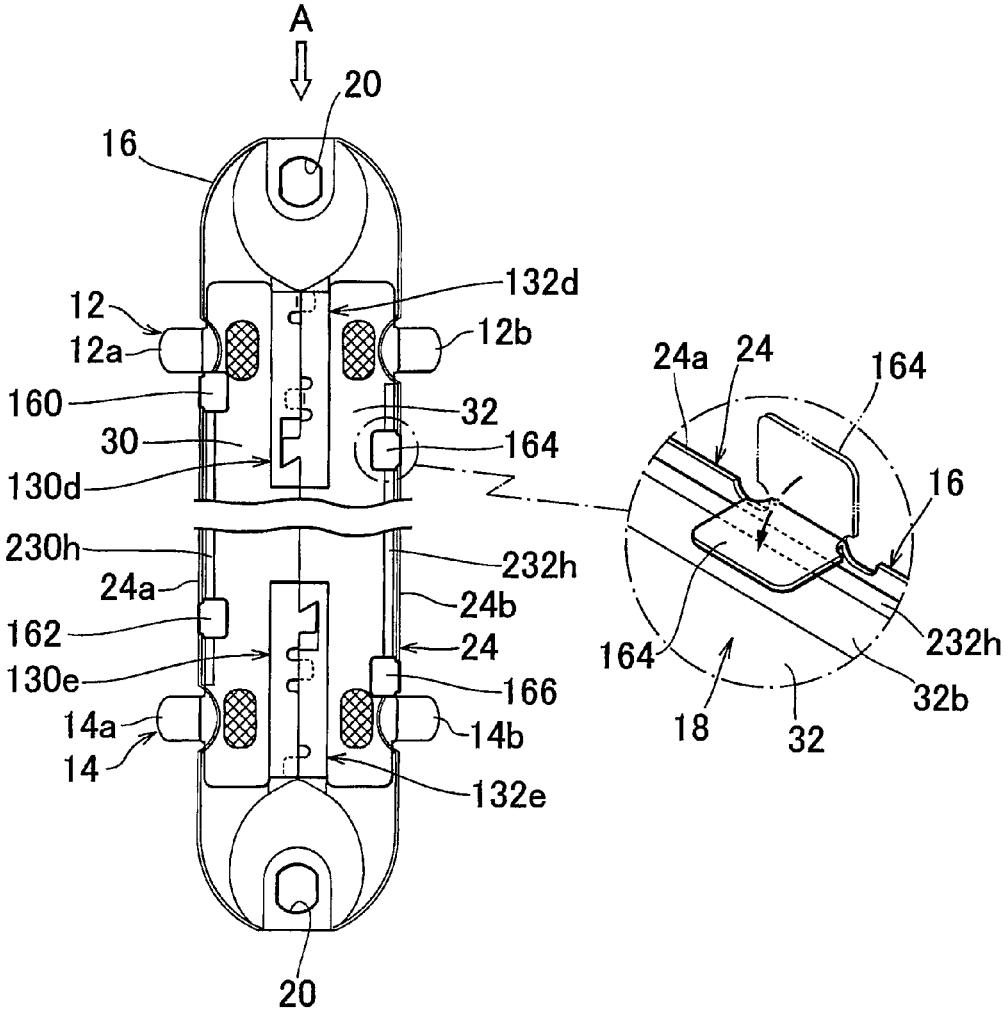
FIG. 68 is a schematic bottom view showing a method for forming an alternative example of the holding member.
Figure 69:
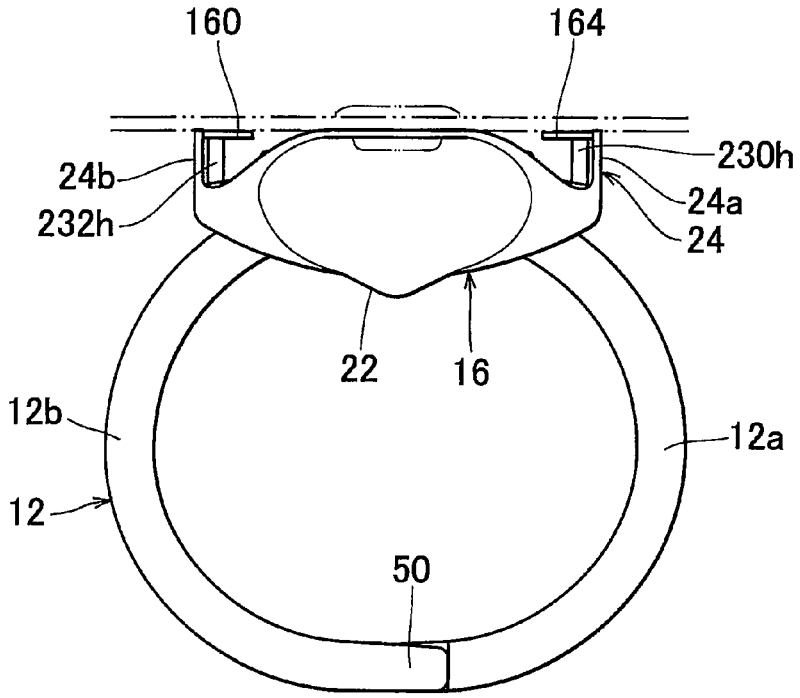
FIG. 69 is a view taken along arrow A direction in FIG. 68.

In contrast to the holding portion in the above embodiment, as shown in FIGS. 68 and 69, the square projections provided to protrude from the lower edges of the holding walls are bent toward the inside, the first holding portions 160 and 162 are formed in the first holding wall 24*a*, and the second holding portions 164 and 166 are formed in the second holding wall 24*b*. Thereby this invention may be configured so that the lower edges of the protrusions 230*h* and 232*h* (protruded on the side opposite to the protruding directions of the first binding ring 12 and the second binding ring 14) formed in the first operating piece 30 and the second operating piece 32 of the operating member 18 are maintained by the first holding portions 160 and 162 of the first holding wall 24*a* and the second holding portions 164 and 166 of the second holding wall 24*b*.

The first operating piece 30 and the second operating piece 32, along the length direction, can be moved by sliding the upper faces of the first holding portions 160 and 162 of the first holding wall 24*a* and the second holding portions 164 and 166 of the second holding wall 24*b*.

Figure 70:
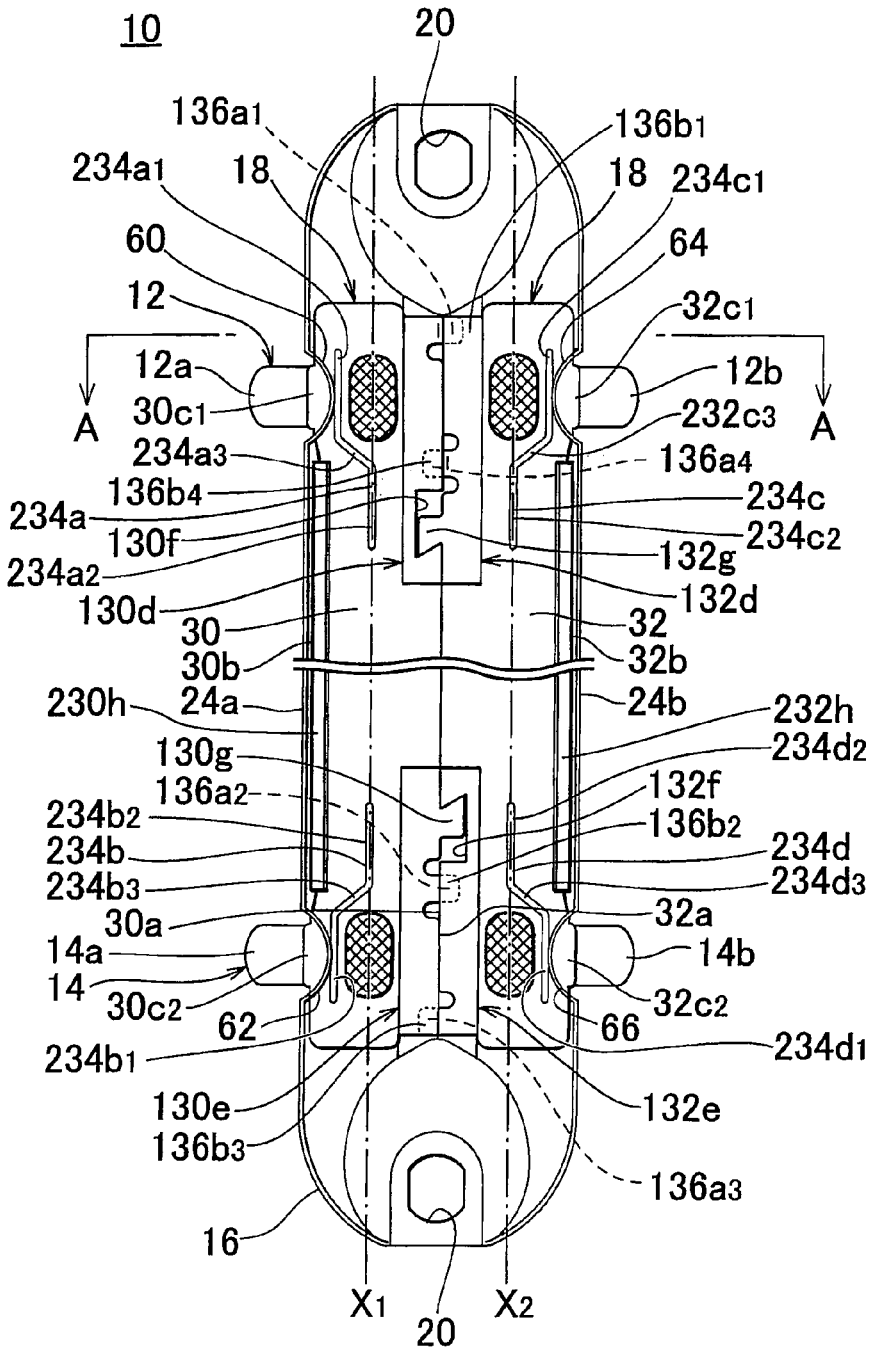
FIG. 70 is a schematic bottom view showing an alternative example of the operating members.
Figure 71:
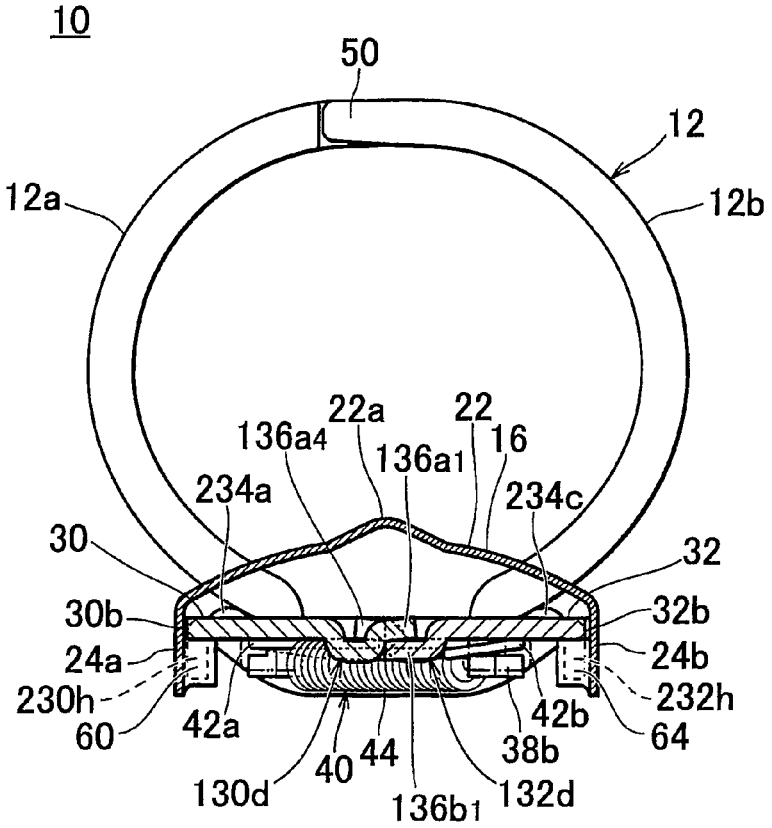
FIG. 71 is a schematic cross-sectional view showing an alternative example of the operating member.

In contrast to the above embodiment, the operating members may be changed as described in FIGS. 70 and 71.

The first operating pieces 30 shown in FIGS. 70 and 71 are formed with the protrusion 230*h* which extends to the direction close to the direction connecting the base portion of the first binding ring 12 and the base portion of the second binding ring 14 (shown in the X1 and X2 directions of FIG. 70) to be disposed with a spacing, at a position away from the abutting edge 30*a*.

In this embodiment, the protrusion 230*h* extends to the length direction of the first operating piece 30, parallel to the direction connecting the base portion of the first binding ring 12 and the base portion of the second binding ring 14.

The protrusion 230*h* continuously protrudes to the side opposite to the direction in which the first binding ring 12 and the second binding ring 14 protrude between the base portion of the first binding ring 12 and the base portion of the second binding ring 14 to be disposed with a spacing, between the protruding portions 30*c*1 and 30*c*2 of the outer edge 30*b*.

The protrusion 230*h* is formed by bending the tabular metal plate having an L shape in a cross section, constituting the first operating piece 30.

Furthermore, the second operating pieces 32 shown in FIGS. 70 and 71 are formed with the protrusion 232*h* which extends to the direction close to the direction connecting the base portion of the first binding ring 12 and the base portion of the second binding ring 14 (shown in the X1 and X2 directions of FIG. 70) to be disposed with a spacing, at a position away from the abutting edge 32*a*.

In this embodiment, the protrusion 232*h* extends to the length direction of the second operating piece 32, parallel to the direction connecting the base portion of the first binding ring 12 and the base portion of the second binding ring 14.

The protrusion 232*h* continuously protrudes to the side opposite to the direction in which the first binding ring 12 and the second binding ring 14 protrude between the base portion of the first binding ring 12 and the base portion of the second binding ring 14 to be disposed with a spacing, between the protruding portions 32*c*1 and 32*c*2 of the outer edge 32*b*.

The protrusion 232*h* is formed by bending the tabular metal plate having an L shape in a cross section, constituting the second operating piece 32.

Therefore, in the first operating piece 30 and the second operating piece 32, the bend between the base portion of the first binding ring 12 and the base portion of the second binding ring 14 is prevented by the protrusions 230*h* and 232*h*.

In the first operating pieces 30 shown in FIGS. 70 and 71, beads 234*a* and 234*b* protrude toward the upper face in the vicinity of the bases of the first half ring 12*a* and the third half ring 14*a* secured in the base portions so that the first operating piece 30 is reinforced so as to reduce the bend.

In the second operating pieces 32 shown in FIGS. 70 and 71, beads 234*c* and 234*d* protrude toward the upper face in the vicinity of the bases of the second half ring 12*b* and the fourth half ring 14*b* secured in the base portions so that the second operating piece 32 is reinforced so as to reduce the bend.

The bead 234*a* includes a first linear portion 234*a*1 extending in the longitudinal direction of the first operating piece 30 between the base portion of the first half ring 12*a* and the protruding portion 30*c*1, a second linear portion 234*a*2 extending in the longitudinal direction of the first operating piece 30 from the vicinity of the base portion of the first half ring 12*a* inside the protrusion 230*h* (substantially at the center in the width direction of the first operating piece 30), a hatched portion 234*a*3 connecting between the inner edge of the first linear portion 234*a*1 and the outer edge of the second linear portion 234*a*2. The bead 234*a* extrudes the linear projection having the predetermined width from the under side toward the upper face of the first operating piece 30.

The bead 234*b* includes a first linear portion 234*b*1 extending in the longitudinal direction of the first operating piece 30 between the base portion of the third half ring 14*a* and the protruding portion 30*c*2, a second linear portion 234*b*2 extending in the longitudinal direction of the first operating piece 30 from the vicinity of the base portion of the third half ring 14*a* inside the protrusion 230*h* (substantially at the center in the width direction of the first operating piece 30), a hatched portion 234*b*3 connecting between the inner edge of the first linear portion 234*b*1 and the outer edge of the second linear portion 234*b*2. The bead 234*b* extrudes the linear projection having the predetermined width from the under side toward the upper face of the first operating piece 30.

The bead 234*c* includes a first linear portion 234*c*1 extending in the longitudinal direction of the second operating piece 32 between the base portion of the second half ring 12*b* and the protruding portion 32*c*1, a second linear portion 234*c*2 extending in the longitudinal direction of the second operating piece 32 from the vicinity of the base portion of the second half ring 12*b* inside the protrusion 232*h* (substantially at the center in the width direction of the second operating piece 32), a hatched portion 234*c*3 connecting between the inner edge of the first linear portion 234*c*1 and the outer edge of the second linear portion 234*c*2. The bead 234*c* extrudes the linear projection having the predetermined width from the under side toward the upper face of the second operating piece 32.

The bead 234*d* includes a first linear portion 234*d*1 extending in the longitudinal direction of the second operating piece 32 between the base portion of the fourth half ring 14*b* and the protruding portion 32*c*2, a second linear portion 234*d*2 extending in the longitudinal direction of the second operating piece 32 from the vicinity of the base portion of the third half ring 14*b* inside the protrusion 232*h* (substantially at the center in the width direction of the second operating piece 32), a hatched portion 234*d*3 connecting between the inner edge of the first linear portion 234*d*1 and the outer edge of the second linear portion 234*d*2. The bead 234*d* extrudes the linear projection having the predetermined width from the under side toward the upper face of the second operating piece 32.

A cover may be the following cover 310 so as to prevent the first binding ring 12 and the second binding ring 14 from bending when there are a large amount of objects S such as papers bound in the first binding ring 12 and the second binding ring 14.

Figure 72:
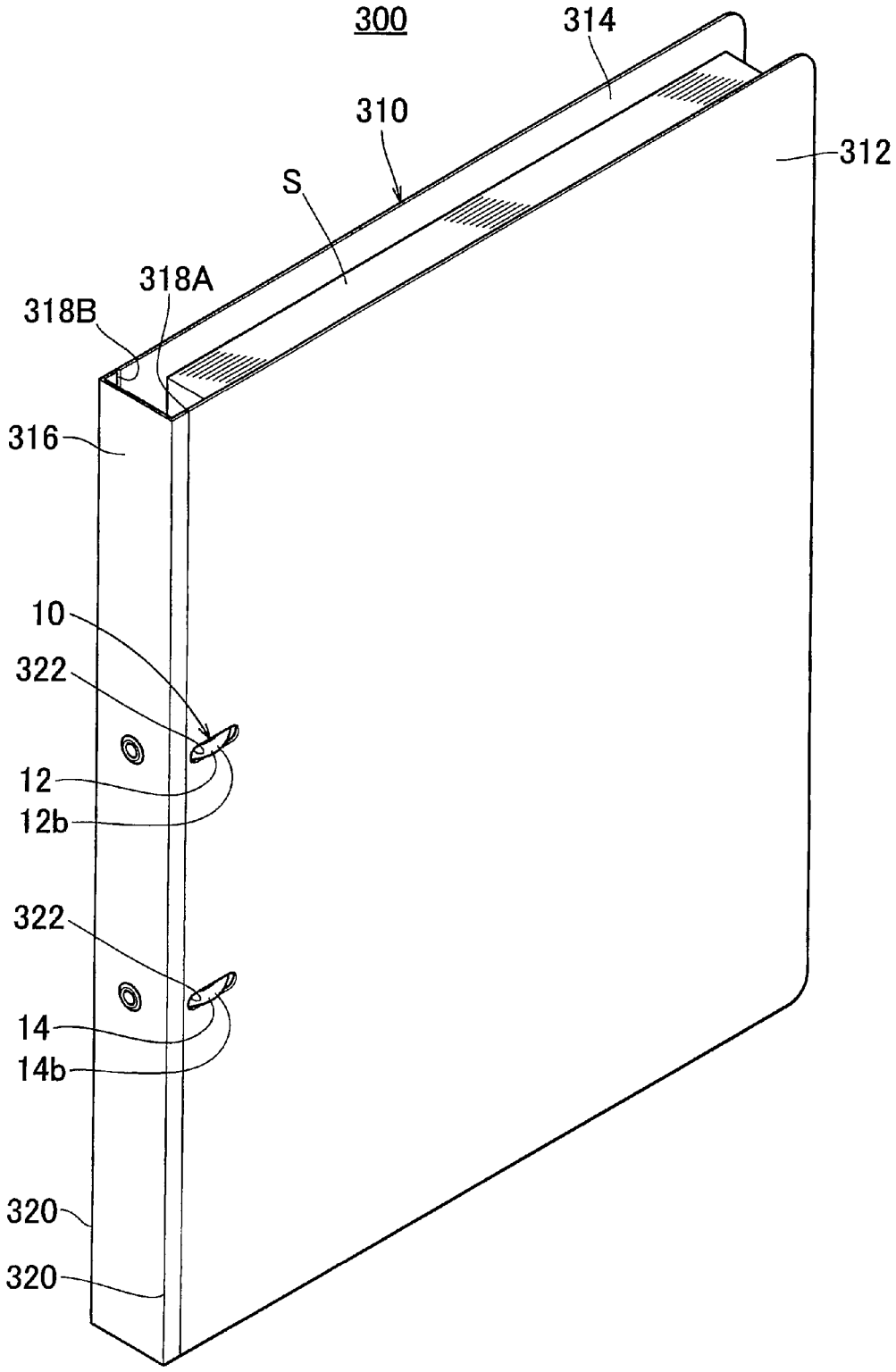
FIG. 72 is a schematic perspective view in which a cover is closed.
Figure 73:
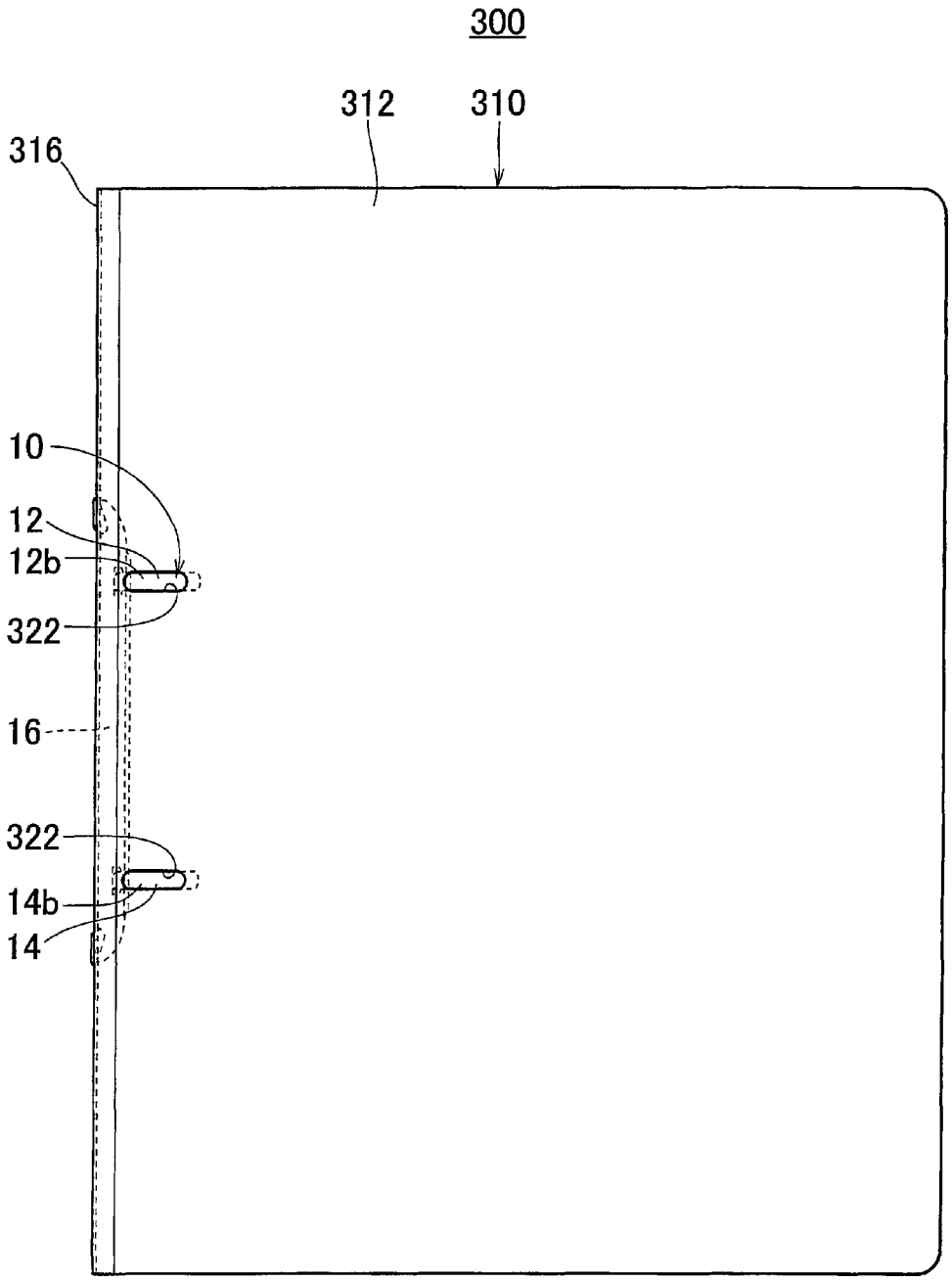
FIG. 73 is a schematic side view in which a cover is closed.
Figure 74:
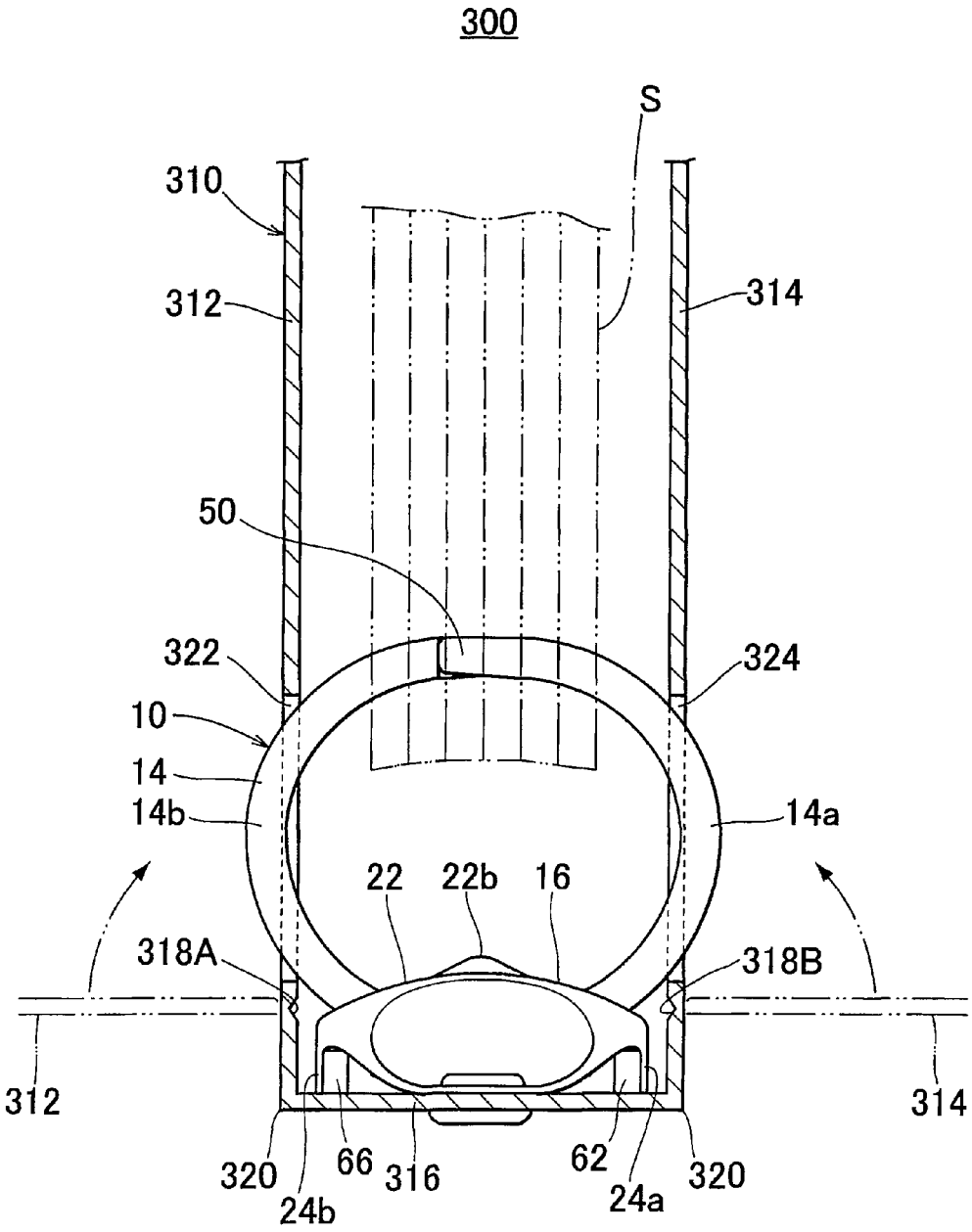
FIG. 74 is a schematic cross-sectional view in which a cover is closed.

The cover 310 includes a spine 316 fixing the holding member of the binding ring, an extended front cover 312 and back cover 314 installed openable/closable. As shown in FIGS. 72 to 74, the front cover 312 and the back cover 314 are consecutively installed to the spine 316 so as to be in an upright-installing state.

Then, the front cover 312 and the back cover 314 are provided with thin hinge portions 318A and 318B for opening/closing, near the spine 316.

As a configuration of a consecutive installing portion of the front cover 312/the back cover 314 and the spine 316, adopted is the configuration to form the consecutive installing portion 320 made of a substantially V-shaped groove for the plastic-type cover, and to bend the covers at the bottom of the groove.

In other words, as shown in FIG. 74, the front cover 312 and the back cover 314 are provided with the substantially V-shaped groove of the consecutive installing portion 320 between the front cover 312/the back cover 314 and the spine 316. The front cover 312 and the back cover 314 are consecutively installed to the spine 316 so as to be upright-installing state by bending the covers at the bottom of the groove of this consecutive installing portion 320.

When using the consecutive installing portion 320, the spine 316 may change the configuration by changing the angle of this consecutive installing portion 320.

Thin hinge portions 318A and 318B which permits the opening/closing of the front cover 312 and the back cover 314 are the substantially V-shaped groove in a cross section, and are provided at the front cover 312 and the back cover 314 in a position slightly near an edge from the consecutive installing portion 320.

In manufacturing as an example to form the cover 310 by using the cover made of a thermoplastic-resin sheet material, for example, the consecutive installing portion 320 made of two substantially V-shaped grooves are formed, each parallel to the cover made of the thermoplastic-resin sheet material. The consecutive installing portion 320 made of the substantially V-shaped grooves are heat-pressed, parallel to each other at the position a little near to the inside of this consecutive installing portion 320. And at the same time, by applying pressure to the covers to the direction to block the consecutive installing portion 320 made of substantially V-shaped grooves, each bottom of the grooves are bent.

Other than the single body of the thermoplastic-resin sheet material, a two-layer structure made of the thermoplastic-resin sheet material and a coated material may be used.

Furthermore, in this two-layer structure, if a two-layer structure made of a hard sheet material and a cloth is provided, a configuration may be adopted to glue both of the groove faces of the consecutive installing portion 320 made of substantially V-shaped grooves.

The front cover 312 and the back cover 314 are provided with binding ring fixing means 322 and 324 for restricting the movement of the first binding ring 12 and the second binding ring 14 by inserting a part of the binding device 10, in a region opposite to the closed first binding ring 12 and second binding ring 14.

The binding ring fixing means 322 and 324 are composed of through holes or steps in which the first binding ring 12 and the second binding ring 14 are fitted into or inserted loosely so as to oppose to the side face of the moving side of the first binding ring 12 and the second binding ring 14.

These binding ring fixing means 322 and 324 are long holes extending to the direction of the first binding ring 12 and the second binding ring 14. The long holes are formed by a pair of the above and lower linear hole edges having the length and width corresponding to the length and width of the portions in which the first binding ring 12 and the second binding ring 14 are fitted into or inserted loosely and circular-arc shaped hole edges consecutively installed between both left edges and between both right edges of the linear hole edges.

The width of the closed first binding ring 12 and second binding ring 14 are formed wider than the width of the spine 316 of the cover 310 or the width between the front cover 312 and the back cover 314 opposing parallel.

The first binding ring 12 and the second binding ring 14 are fitted into the long holes constituting the binding ring fixing means 322 and 324 formed in the front cover 312 and the back cover 314 closed substantially parallel to each other, from the position slightly higher than the base portion in which the first operating piece 30 and the second operating piece 32 are attached to the position slightly exterior of the binding ring latching portion 50.

A pair of the above and lower linear hole edges of the long holes abut against the upper and lower side faces of the first binding ring 12 and the second binding ring 14, and circular-arc shaped hole edges of the long holes abut against the right and left circumferential surfaces of the first binding ring 12 and the second binding ring 14.

Then, when file/binder 300 is made upright, defining the first binding ring 12 as an upper side and the second binding ring 14 as a lower side in a state in which the front cover 312 and the back cover 314 of the file/binder 300 are closed parallel, the movement of the first binding ring 12 and the second binding ring 14 are restricted by the binding ring fixing means 324, even if the first half ring 12*a* of the first binding ring 12 and the third half ring 14*a* of the second binding ring 14 are moved to the lower direction disengaging from the second half ring 12*b* of the first binding ring 12 and the fourth half ring 14*b* of the second binding ring 14, in such a way that impact is given when the object P such as the paper bound at the side of the first half ring 12*a* of the first binding ring 12 and the side of the third half ring 14*a* of the second binding ring 14.

Since the first binding ring 12 and the second binding ring 14 are latched at the hole edge on the lower side of the binding ring fixing means 324, the first half ring 12*a* of the first binding ring 12 and the second half ring 12*b* of the first binding ring 12, and the third half ring 14*a* of the second binding ring 14 and the fourth half ring 14*b* of the second binding ring 14 can not be disengaged at the binding ring latching portions 50, respectively.

For attachment of the binding device 10 to the cover A, after the lower edges of the first holding wall 24*a* and the second holding wall 24*b* are brought into contact with the cover A, bolts and nuts or rivets may be inserted into the attachment holes 20 so as to attach the binding device 10 to the cover A.

In the above-described embodiment, a two-ring type binder with the first binding ring 12 and the second binding ring 14 has been described. However, multi-ring type binders with an increased number of rings, for example, a three-ring type, a four-ring type, a twenty-ring type, a twenty-six ring type or a thirty-ring type binder can be provided.

Corresponding to the number of the binding ring, the length of the holding member and the operating member are extended. In addition, a through hole like one or more first through holes and second through holes are formed between the first through hole and the second through hole of the holding member. It is only necessary that the binding ring secured to the operating member can be penetrated and inserted.

Figure 75:
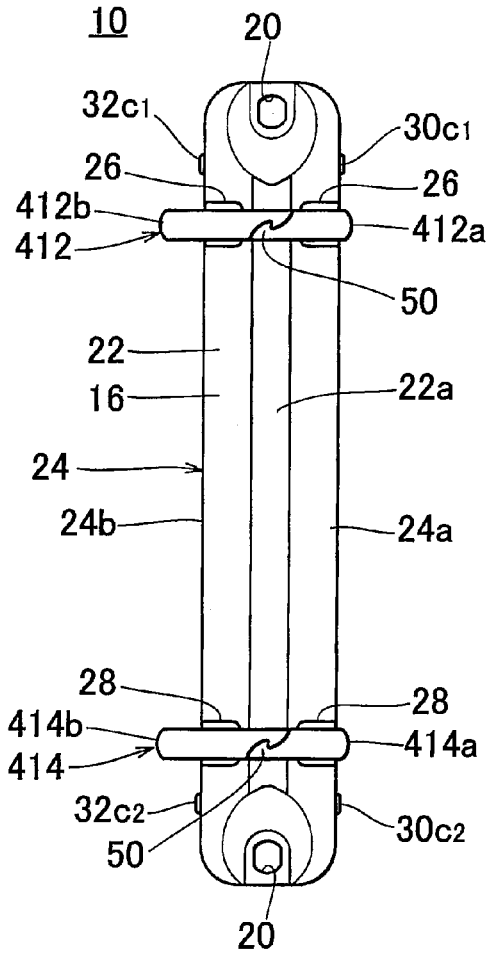
FIGS. 75(A) and 75(B) are schematic views showing alternative examples of the binding rings, where
Figure 75:
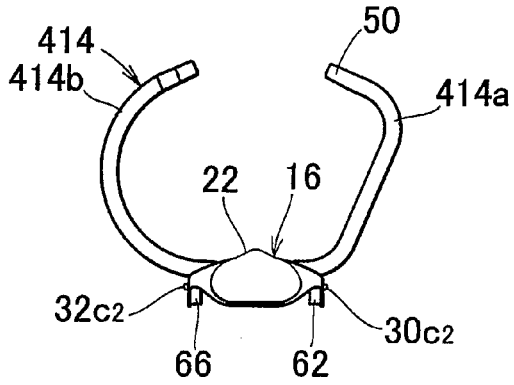

Furthermore, as shown in FIG. 75, the shape of the binding ring may be substantially a D shape, not substantially an O shape.

In order to form the first binding ring 412 and the second binding ring 414 of substantially the D shape, the second half ring 412*b* and the fourth half ring 414*b* are formed in substantially a C shape which is relatively the same as in the above embodiment, and the first half ring 412*a* and the third half ring 414*a* are formed in substantially a reverse L shape. When the first half ring 412*a* and the second half ring 412*b*, and the third half ring 414*a* and the fourth half ring 414*b* are closed, the first binding ring 412 and the second binding ring 414 are formed in substantially a D shape.

In the binding device of the above embodiment, one opening/closing member was mounted in response to a pair of operating pieces. A total number of two opening/closing members may be mounted.

Furthermore, the first operating piece and the second operating piece constituting the operating piece were formed integrally. As the number of the binding ring (such as four-hole, twenty-hole, twenty-six-hole, or thirty-hole) increases, the first operating piece and the second operating piece may be divided respectively.

Figure 76:
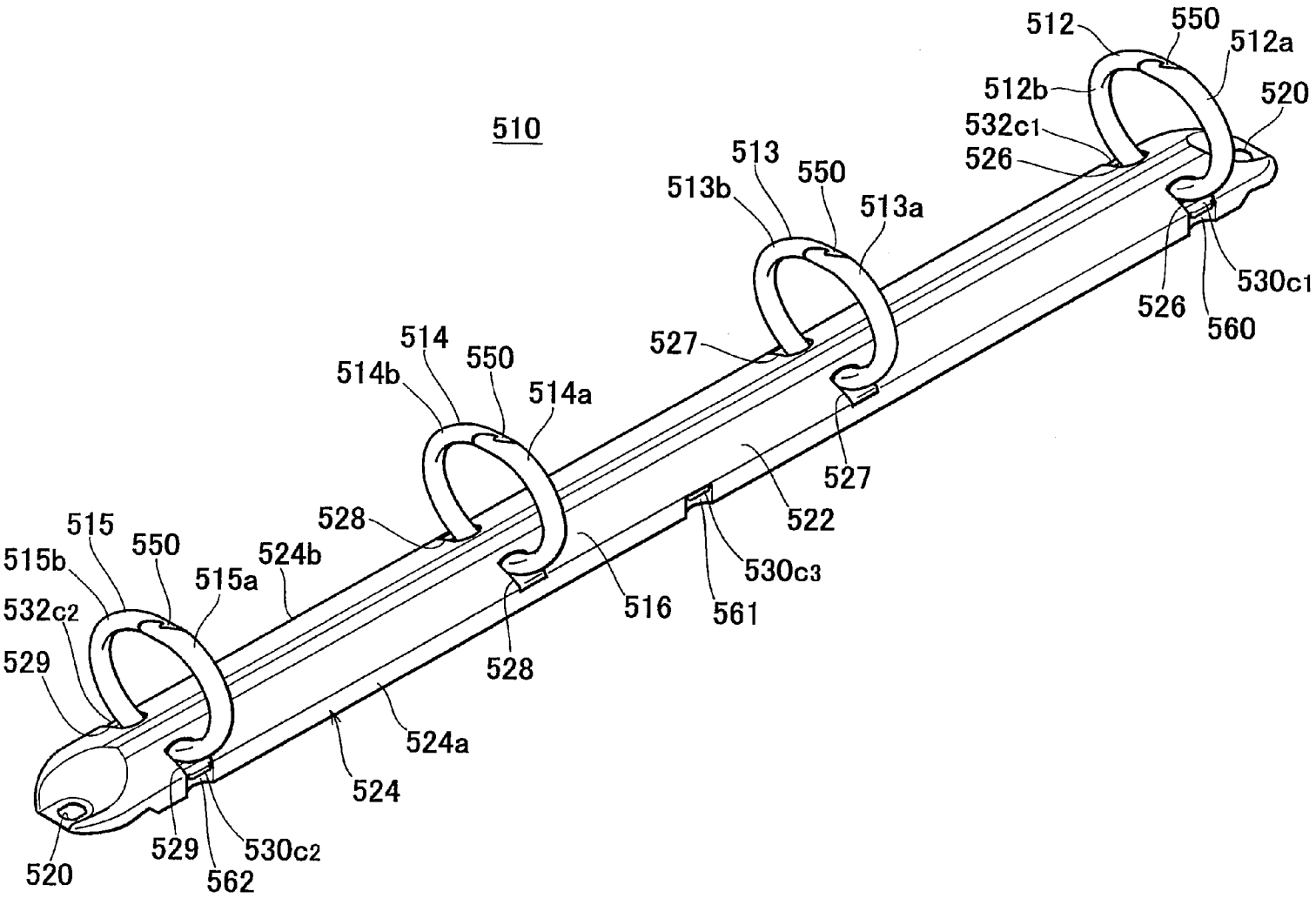
FIG. 76 is a perspective view showing an example of the binding device according to another embodiment.
Figure 77:
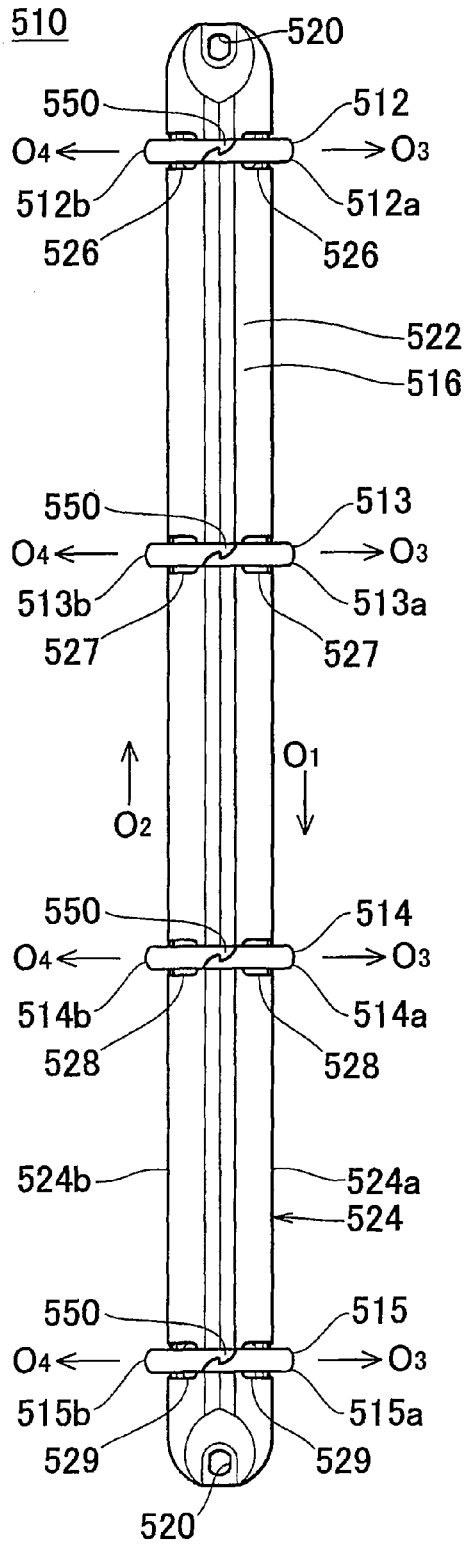
FIG. 77 is a plan view showing an example of the binding device according to another embodiment.

Next, a four-ring perfect-circle type binding device of another embodiment according to the present invention is described with reference to FIGS. 76 and 77.

A binding device 510 of this embodiment has a configuration substantially the same as the configuration of the binding device 10 of the embodiment described above. However, the configuration of the holding member, the configuration of the operating member, and the configuration of the opening/closing member are different since the number of binding rings is increased. Therefore, a description is mainly given of these differences.

The binding device 510 includes: a pair of substantially annular first binding ring 512 and second binding ring 513 and a pair of substantially annular third binding ring 514 and fourth binding ring 515, each of which is made of metal; a holding member 516 having a length which allows the first binding ring 512 and the fourth binding ring 515 to be disposed with a spacing therebetween; and an operating member 518 having a surface to which the base portions of each of the first binding ring 512 and the fourth binding ring 515 are secured with a spacing therebetween, the operating member 518 being movably secured inside the holding member 516 such that the first binding ring 512, the second binding ring 513, the third binding ring 514, and the fourth binding ring 515 are secured to the holding member 516.

The binding rings are of a four-hole type and include four binding rings, i.e., the first binding ring 512, the second binding ring 513, the third binding ring 514, and the fourth binding ring 515.

The first binding ring 512 includes a first half ring 512*a* and a second half ring 512*b*, and the second binding ring 513 includes a third half ring 513*a* and a fourth half ring 513*b*. The third binding ring 514 includes a fifth half ring 514*a* and a sixth half ring 514*b*, and the fourth binding ring 515 includes a seventh half ring 515*a* and an eighth half ring 515*b*.

Then, a binding ring latching portion 550 is formed at the end of the first half ring 512*a* and the second half ring 512*b*, at the end of the third half ring 513*a* and the fourth half ring 513*b*, at the end of the fifth half ring 514*a* and the sixth half ring 514*b*, and at the end of seventh half ring 515*a* and the eighth half ring 515*b*, i.e., at the top portion of each of the first binding ring 512, the second binding ring 513, the third binding ring 514, and the fourth binding ring 515 in order to allow an object S such as a paper to be bound by inserting the half rings into binding holes provided in the object S such as the paper in advance.

The first half ring 512*a* and the second half ring 512*b* constituting the first binding ring 512 are annularly engaged with each other by engaging the binding ring latching portion 550 of the first half ring 512*a* with the binding ring latching portion 550 of the second half ring 512*b*.

The fifth half ring 514*a* and the sixth half ring 514*b* constituting the third binding ring 514 are annularly engaged with each other by engaging the binding ring latching portion 550 of the fifth half ring 514*a* with the binding ring latching portion 550 of the sixth half ring 514*b*.

The holding member 516 is of a substantially rectangular shape in a plan view, having such a length that allows the first binding ring 512, the second binding ring 513, the third binding ring 514, and the fourth binding ring 515 to be provided at predetermined intervals. Both ends of the holding member 516, i.e., in the vicinity of attachment holes 520 for attachment to the cover A, are each formed to have an approximately semicircular arc shape in a plan view.

The holding member 516 has a holding space inside the bound object-mounting portion 522, and the holding member 516 is configured to house the operating member 518 or the like.

On both ends of the bound object-mounting portion 522 of the holding member 516, holding walls 524 for slidably holding the operating member 518 are provided in a longitudinal direction substantially from one end to the other end of the bound object-mounting portion 522.

In this embodiment, first holding walls 524*a* and second holding walls 524*b* are continuously provided in a longitudinal direction of the holding member 516 in such a manner as to extend downward and inward from the outer vicinities of the first binding ring 512, the second binding ring 513, the third binding ring 514, and the fourth binding ring 515 over the approximately entire length.

The first holding walls 524*a* and the second holding walls 524*b* are in parallel with each other and have substantially the same plate-like shape.

The operating member 518 or the like to be described below in detail is housed within the holding space surrounded by the first holding walls 524*a*, the second holding walls 524*b*, and the bound object-mounting portion 522.

First through holes 526, second through holes 527, third through holes 528, and fourth through holes 529 are provided through the bound object-mounting portion 522 of the holding member 516.

The first through holes 526 and the second through holes 527 are provided to be configured to allow the first binding ring 512 and the second binding ring 513 to loosely pass therethrough at a predetermined distance (a predetermined length determined by Japanese Industrial Standards or the like). The third through holes 528 and the fourth through holes 529 are provided to be configured to allow the third binding ring 514 and the fourth binding ring 515 to loosely pass therethrough at a predetermined distance (a predetermined length determined by Japanese Industrial Standards or the like).

The first through holes 526, the second through holes 527, the third through holes 528, and the fourth through holes 529 are provided so as to correspond to each half ring constituting each binding ring. The first through holes 526, the second through holes 527, the third through holes 528, and the fourth through holes 529 are provided in a width direction of the holding member 516 at a predetermined distance, parting right and left.

The operating piece constituting the operating member 518 has a pair of left and right operating pieces 530 and 532 which are elongately formed in contrast to the operating piece of the binding device of the above embodiment.

The base portions of the first half ring 512*a*, the third half ring 513*a*, the fifth half ring 514*a*, and the seventh half ring 515*a* are secured to the first operating piece 530.

The base portions of the second half ring 512*b*, the fourth half ring 513*b*, the sixth half ring 514*b*, and the eighth half ring 515*b* are secured to the second operating piece 532.

The engaging surface of the first engaging portion 536*a* in the said first operating piece 530 and the engaging surface of the second engaging portion 536*b* in the said second operating piece 532 are engaged at a level approximately equal or lower than the said reference level LP1 and the reference level LP2.

The engaging surface of the first engaging portion 536*a* in the said second operating piece 532 and the engaging surface of the second engaging portion 536*b* in the said first operating piece 530 are engaged at a level approximately equal or lower than the said reference level LP1 and the reference level LP2.

The first engaging portion 536*a* include the first engaging portion on opposite side of the first operating piece 536*a*1, the first engaging portion on front side of first operating piece 536*a*2, the first engaging portion on front side of second operating piece 536*a*3, and the first engaging portion on opposite side of the second operating piece 536*a*4.

The second engaging portion 536*b* include the second engaging portion on opposite side of second operating piece 536*b*1, the second engaging portion on front side of second operating piece 536*b*2, the second engaging portion on front side of first operating piece 536*b*3 and the second engaging portion on opposite side of first operating piece 536*b*4.

On the first operating piece 530 and the second operating piece 532, are formed recess portion on opposite side of first operating piece 760*d*, center of recess portion on front side of first operating piece 730*e*, recess portion on opposite side of second operating piece 732*d* and recess portion on front side of second operating piece 732*e*. Moreover, are formed the first engaging portion on opposite side of first operating piece 536*a*1 on the recess portion on opposite side of first operating piece 730*d*, the second engaging portion on opposite side of second operating piece 536*b*1 on the recess portion on opposite side of second operating piece 732*d*, the first engaging portion on front side of second operating piece 536*a*3 on the recess portion on front of second operating piece 732*e*, the second engaging portion on front side of first operating piece 536*b*3 on the recess portion on front of the first operating piece 730*e*, the first engaging portion on front of first operating piece 536*a*2 on the recess portion on front of first operating piece 730*e*, the second engaging portion on front side of second operating piece 536*b*2 on the recess portion on front of the second operating piece 732*e*, the first engaging portion on opposite side of second operating piece 536*a*4 on the recess portion on opposite side of second operating piece 732*d*, and the second engaging portion on opposite side of first operating piece 536*b*4 on the recess portion on opposite side of first operating piece 730*d*.

The recess portion on opposite side of first operating piece 730*d* and the recess portion of on opposite side of second operating piece 732*d*, as well as the recess portion on the front side of first operating piece 730*e* and the recess portion on front side of second operating piece 732*e* are formed in two pairs in the superior and inferior part in the longitudinal direction of the first operating piece 530 and the second operating piece 532.

Furthermore, the first engaging portion on opposite side of first operating piece 536*a*1 and the first engaging portion on opposite side of second operating piece 536*a*4, as well as the first engaging portion of front side of first operating piece 536*a*2 and the first engaging portion on front side of second operating piece 536*a*3 are also formed in two pairs in the superior and inferior part in the longitudinal direction of the first operating piece 530 and the second operating piece 532.

In addition, in the same manner as in the embodiment described above, restricting recess 530*f* and 532*f*, as well as restricting projection 530*g* and 532*g* are formed in a similar way.

Besides, the opening/closing member 540 is fixed straddled over the opening/closing member fixing portion 538*a*1 of the first operating piece 530 and the opening/closing member fixing portion 538*b*1 of the second operating piece 532, such that it is oblique to the abutting edge 530*a* and the abutting edge 532*a*. The opening/closing member 542 is fixed straddled over the opening/closing member fixing portion 538*a*2 of the first operating piece 530 and the opening/closing member fixing portion 538*b*2 of the second operating piece 532, such that it is oblique to the abutting edge 530*a* and the abutting edge 532*a*.

The secured end portion 540*a* and the secured end portion 540*b* of the opening/closing member 540 are secured to the opening/closing member fixing portion 538*a*1 of the first operating piece 530 and the opening/closing member fixing portion 538*b*1 of the second operating piece 532 respectively. The secured end portion 542*a* and the secured end portion 542*b* of the opening/closing member 542 are secured to the opening/closing member fixing portion 538*a*2 of the first operating piece 530 and the opening/closing member fixing portion 538*b*2 of the second operating piece 532 respectively.

Figure 78:
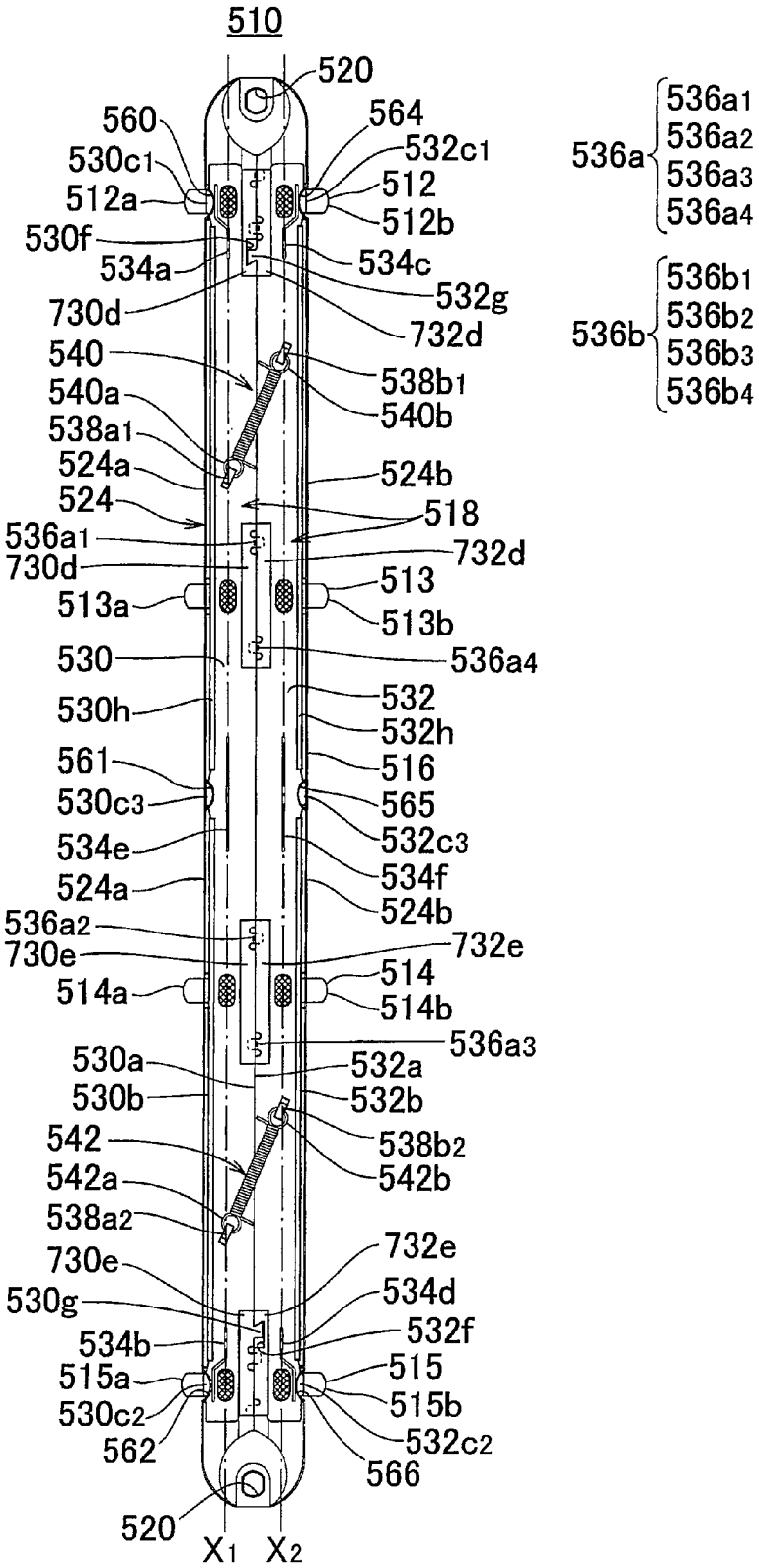
FIG. 78 is a bottom view of the whole binding device in FIG. 76.
Figure 79:
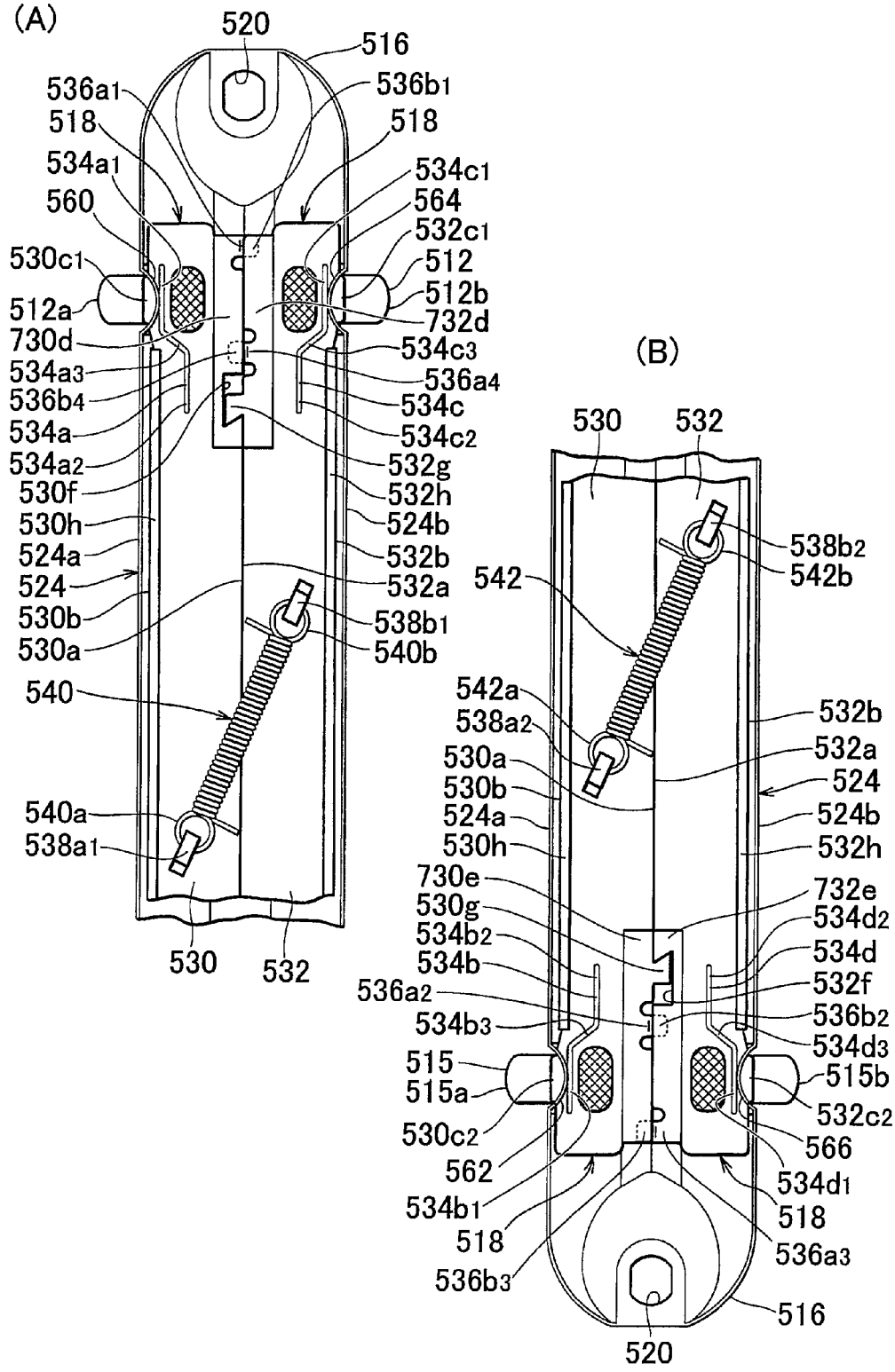
FIGS. 79(A) and 79(B) are bottom views which enlarged a part of FIG. 78.
Figure 80:
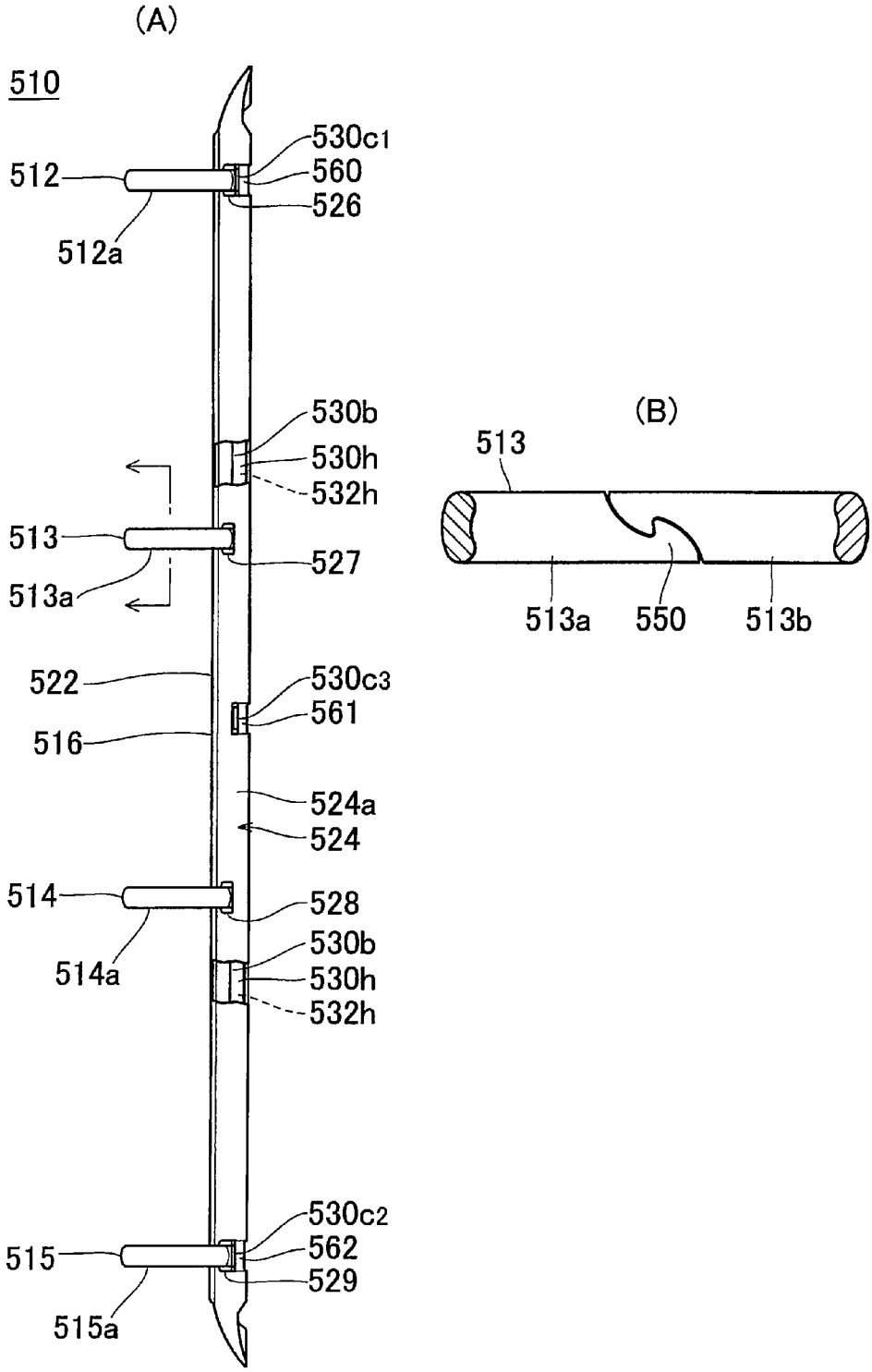
FIG. 80(A) is a side view of the binding device in FIG. 76.
FIG. 80(B) is a cross-sectional view of the binding ring of the binding device in FIG. 76.
Figure 81:
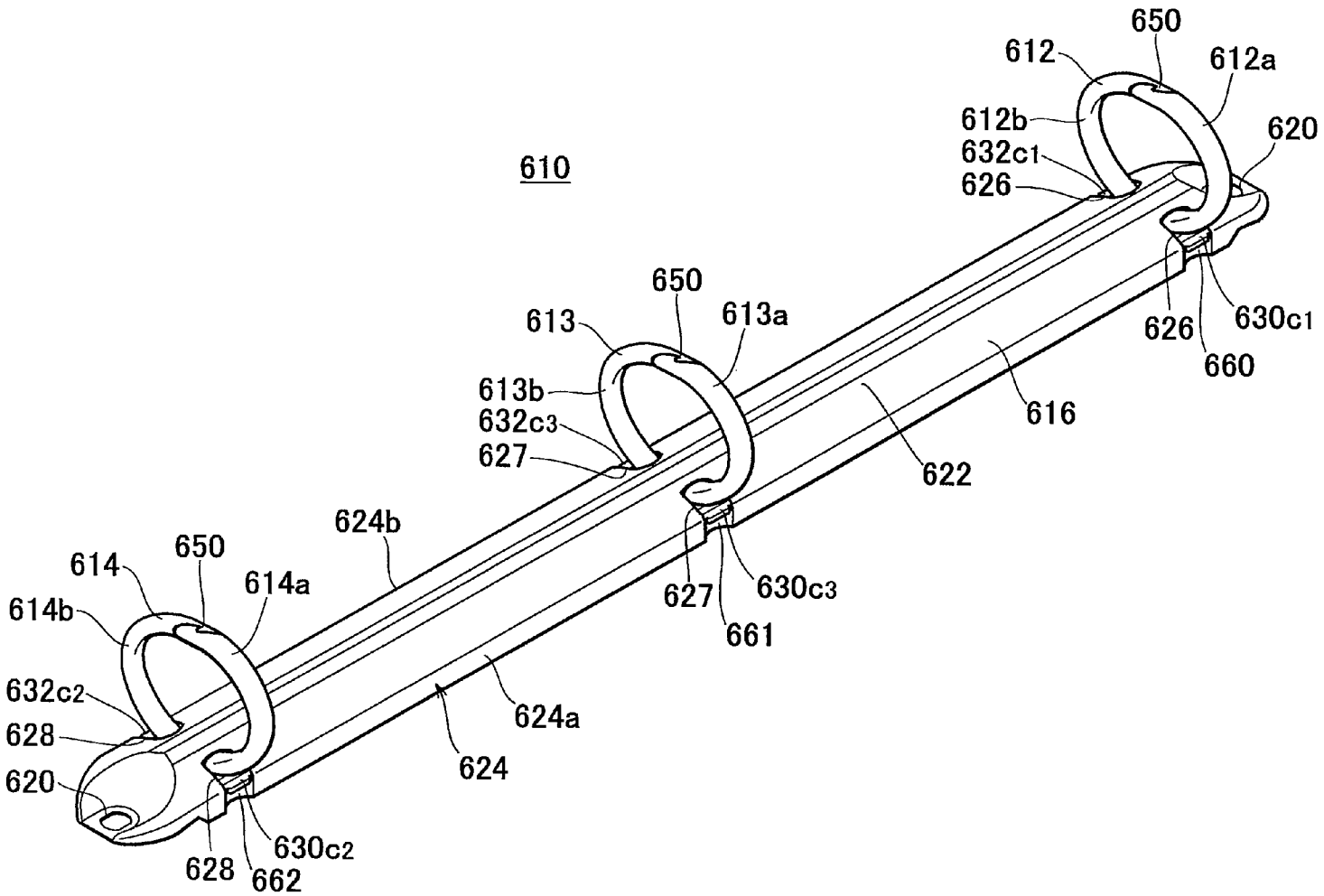
FIG. 81 is a perspective view showing an example of the binding device according to another embodiment.
Figure 82:
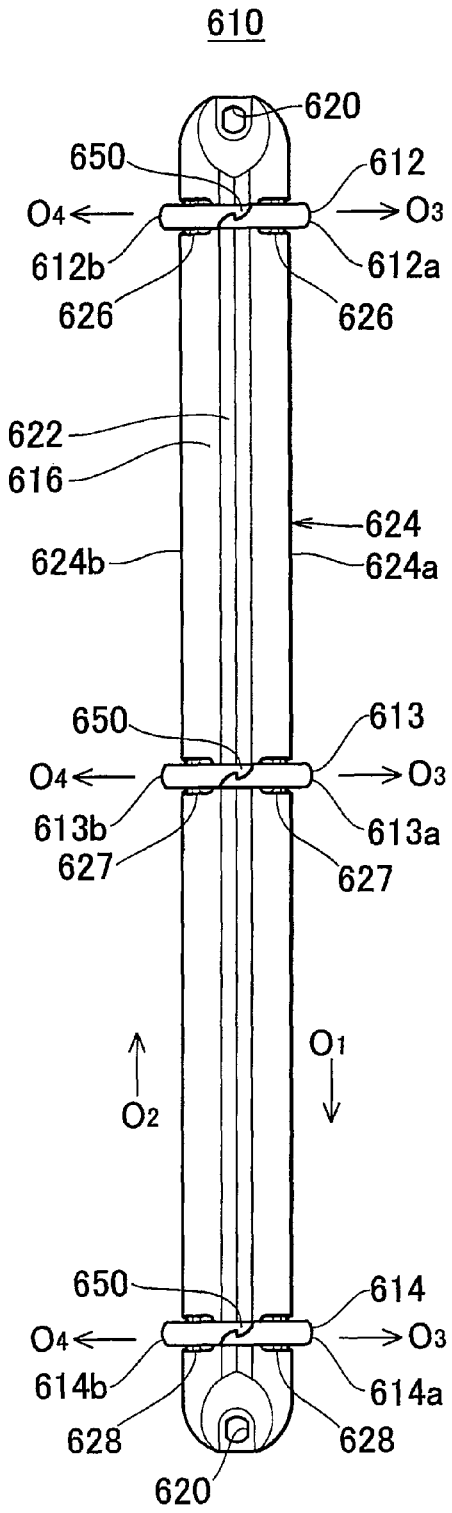
FIG. 82 is a plan view showing an example of the binding device according to another embodiment.
Figure 83:
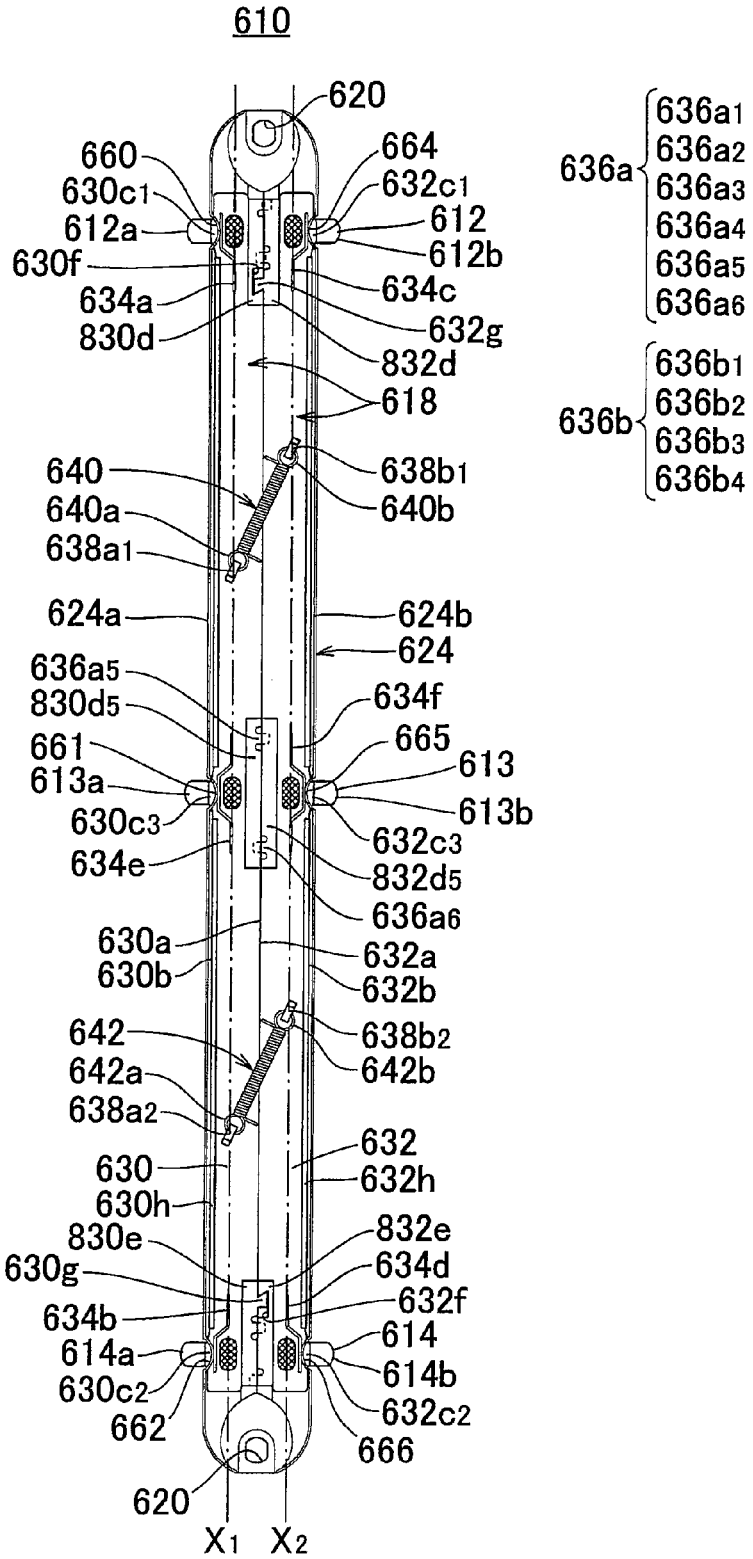
FIG. 83 is a bottom view of the whole binding device in FIG. 81.
Figure 84:
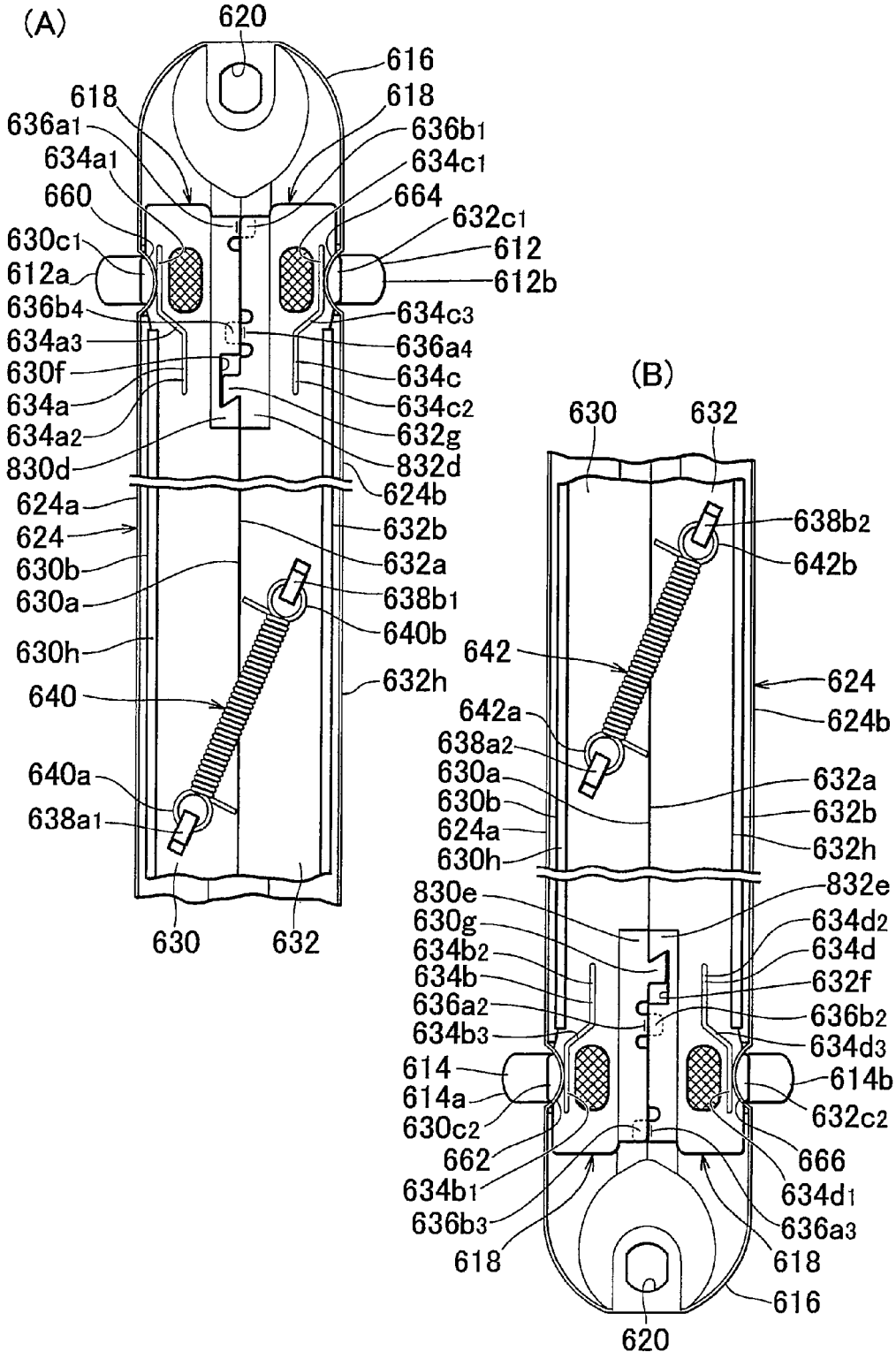
FIGS. 84(A) and 84(B) are bottom views which enlarged a part of FIG. 83.
Figure 85:
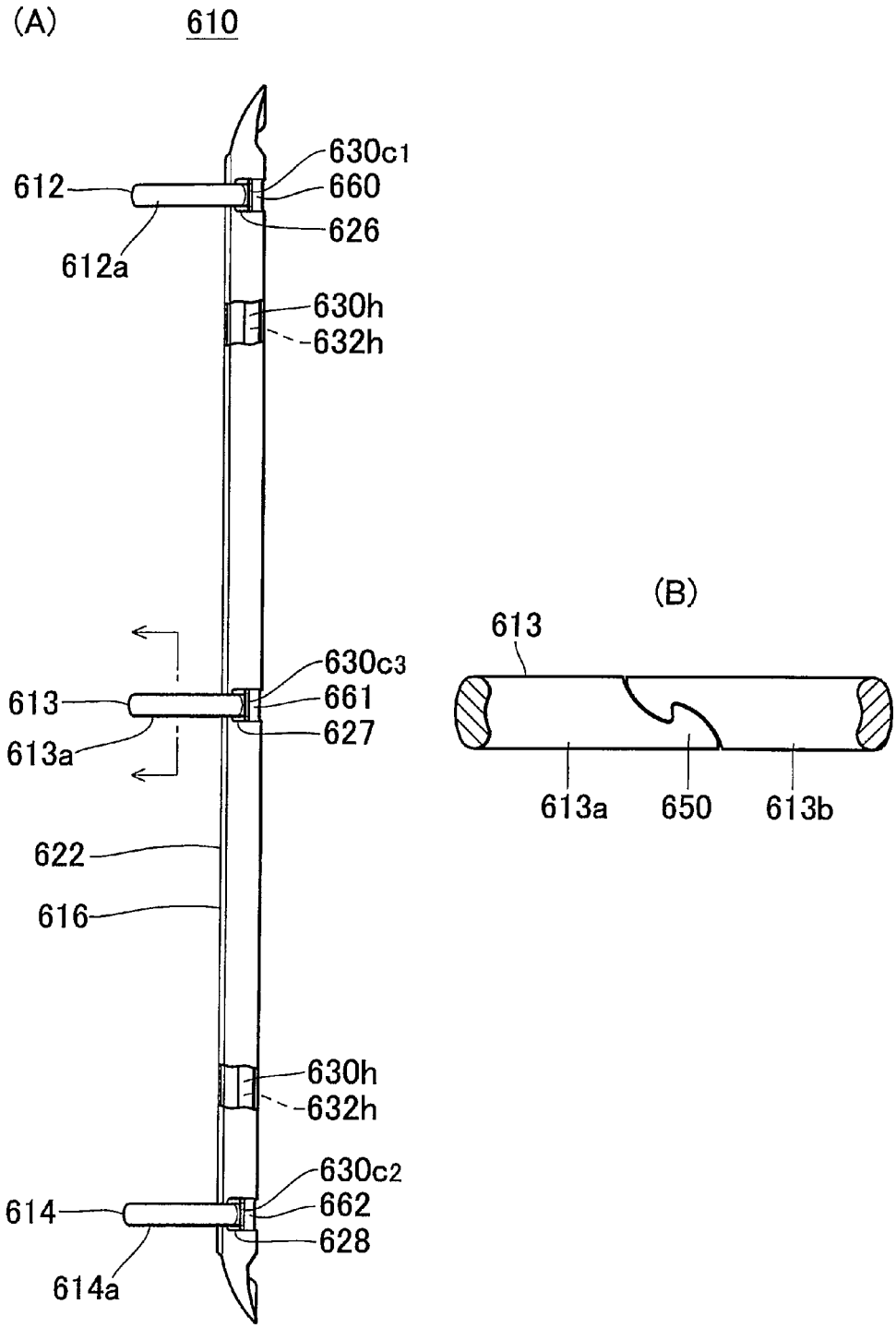
FIG. 85(A) is a side view of the binding device in FIG. 81.
FIG. 85(B) is a cross-sectional view of the binding ring of the binding device in FIG. 81.

The first operating piece 530 is formed with the protrusion 530*h* which extends to the direction close to the direction connecting the base portion of the first binding ring 512 and the base portion of the fifth binding ring 515 (shown in the X1 and X2 directions of FIG. 78) to be disposed with a spacing, at a position away from the abutting edge 530*a*.

In this embodiment, the protrusion 530*h* extends to the length direction of the first operating piece 530, parallel to the direction connecting the base portion of the first binding ring 512 and the base portion of the fifth binding ring 515.

The protrusion 530*h* continuously protrudes to the side opposite to the direction in which the first binding ring 512 and the fifth binding ring 515 protrude between the base portion of the first binding ring 512 and the base portion of the fifth binding ring 515 to be disposed with a spacing, at the outer edge 530*b*, except for the vicinity of the protruding portion 530*c*3.

The protrusion 530*h* is formed by bending the tabular metal plate having an L shape in a cross section, constituting the first operating piece 530.

Furthermore, the second operating piece 532 is formed with the protrusion 532*h* which extends to the direction close to the direction connecting the base portion of the first binding ring 512 and the base portion of the fifth binding ring 515 (shown in the X1 and X2 directions of FIG. 78) to be disposed with a spacing, at a position away from the abutting edge 532*a*.

In this embodiment, the protrusion 532*h* extends to the length direction of the second operating piece 532, parallel to the direction connecting the base portion of the first binding ring 512 and the base portion of the fifth binding ring 515.

The protrusion 532*h* continuously protrudes to the side opposite to the direction in which the first binding ring 512 and the fifth binding ring 515 protrude between the base portion of the first binding ring 512 and the base portion of the fifth binding ring 515 to be disposed with a spacing, at the outer edge 532*b*, except for the vicinity of the protruding portion 532*c*3.

The protrusion 532*h* is formed by bending the tabular metal plate having an L shape in a cross section, constituting the second operating piece 532.

Therefore, in the first operating piece 530 and the second operating piece 532, the bend between the base portion of the first binding ring 512 and the base portion of the fifth binding ring 515 are prevented by the protrusions 530*h* and 532*h*.

In the first operating pieces 530, beads 534*a*, 534*b*, and 534*e* protrude toward the upper face in the vicinity of the bases of the first half ring 512*a* and the seventh half ring 515*a* secured in the base portions and in the vicinity of the center of the protruding portion 530*c*3 so that the first operating piece 530 is reinforced so as to reduce the bend.

In the second operating pieces 532, beads 534*c*, 534*d*, and 534*f* protrude toward the upper face in the vicinity of the bases of the second half ring 512*b* and the eighth half ring 515*b* secured in the base portions and in the vicinity of the center of the protruding portion 532*c*3 so that the second operating piece 532 is reinforced so as to reduce the bend.

The bead 534*a* includes a first linear portion 534*a*1 extending in the longitudinal direction of the first operating piece 530 between the base portion of the first half ring 512*a* and the protruding portion 530*c*1, a second linear portion 534*a*2 extending in the longitudinal direction of the first operating piece 530 from the vicinity of the base portion of the first half ring 512*a* inside the protrusion 530*h* (substantially at the center in the width direction of the first operating piece 530), a hatched portion 534*a*3 connecting between the inner edge of the first linear portion 534*a*1 and the outer edge of the second linear portion 534*a*2. The bead 534*a* extrudes the linear projection having the predetermined width from the under side toward the upper face of the first operating piece 530.

The bead 534*b* includes a first linear portion 534*b*1 extending in the longitudinal direction of the first operating piece 530 between the base portion of the seventh half ring 515*a* and the protruding portion 530*c*2, a second linear portion 534*b*2 extending in the longitudinal direction of the first operating piece 530 from the vicinity of the base portion of the seventh half ring 515*a* inside the protrusion 530*h* (substantially at the center in the width direction of the first operating piece 530), a hatched portion 534*b*3 connecting between the inner edge of the first linear portion 534*b*1 and the outer edge of the second linear portion 534*b*2. The bead 534*b* extrudes the linear projection having the predetermined width from the under side toward the upper face of the first operating piece 530.

The bead 534*c* includes a first linear portion 534*c*1 extending in the longitudinal direction of the second operating piece 532 between the base portion of the second half ring 512*b* and the protruding portion 532*c*1, a second linear portion 534*c*2 extending in the longitudinal direction of the second operating piece 532 from the vicinity of the base portion of the second half ring 512*b* inside the protrusion 532*h* (substantially at the center in the width direction of the second operating piece 532), a hatched portion 534*c*3 connecting between the inner edge of the first linear portion 534*c*1 and the outer edge of the second linear portion 534*c*2. The bead 534*c* extrudes the linear projection having the predetermined width from the under side toward the upper face of the second operating piece 532.

The bead 534*d* includes a first linear portion 534*d*1 extending in the longitudinal direction of the second operating piece 532 between the base portion of the eighth half ring 515*b* and the protruding portion 532*c*2, a second linear portion 534*d*2 extending in the longitudinal direction of the second operating piece 532 from the vicinity of the base portion of the eighth half ring 515*b* inside the protrusion 532*h* (substantially at the center in the width direction of the second operating piece 532), a hatched portion 534*d*3 connecting between the inner edge of the first linear portion 534*d*1 and the outer edge of the second linear portion 534*d*2. The bead 534*d* extrudes the linear projection having the predetermined width from the under side toward the upper face of the second operating piece 532.

The bead 534*e* has the linear shape, and is formed spreading between the protrusion 530*h* and the protrusion 530*h* which are divided into the upper part and the lower part, in the vicinity of the protruding portion 530*c*3.

The bead 534*f* has the linear shape, and is formed spreading between the protrusion 532*h* and the protrusion 532*h* which are divided into the upper part and the lower part, in the vicinity of the protruding portion 532*c*3.

In the binding device of the above embodiments, one opening/closing member is mounted on one pair of the operating pieces. However, in the binding device of this embodiment, a total of two opening/closing members 540 and 542, one each on the upper and lower positions, are mounted in correspondence with lengths of a pair of the operating piece 530 and the operating piece 532.

The protruding portion 530*c*1 is held by the first holding portion 560, the protruding portion 530*c*2 by the first holding portion 562, the protruding portion 532*c*1 by the second holding portion 564, and the protruding portion 532*c*2 by the second holding portion 566, respectively.

Furthermore, the protruding portion 530*c*3 is held by the third holding portion 561, the protruding portion 532*c*3 by the third holding portion 565, respectively.

Next, a three-ring perfect-circle type binding device of another embodiment according to the present invention is described with reference to FIGS. 81 to 85.

A binding device 610 of this embodiment has a configuration substantially the same as the configuration of the binding device 210 of the embodiment described above. However, the configuration of the holding member, the configuration of the operating member, and the configuration of the opening/closing member are different since the number of binding rings is increased. Therefore, a description is mainly given of these differences.

The binding device 610 includes a pair of binding rings, i.e., a first binding ring 612, a second binding ring 613, a third binding device 614, a holding member 616, and an operating member 618. Each of the first binding ring 612, the second binding ring 613, the third binding ring 614 is made of a metal in an approximately annular shape. The holding member 616 has a length that enables the first binding ring 612 and the third binding ring 614 to be disposed with a spacing therebetween. A base of each of the first binding ring 612 and the third binding ring 614 is secured to a surface of the operating member 618 such that the first binding ring 612 and the third binding ring 614 are disposed with a spacing. The operating member 618 is movably secured inside the holding member 616 such that the first binding ring 612, the second binding ring 613, and the third binding ring 614 are secured to the holding member 616.

The binding rings are of a three-hole type and include three binding rings, i.e., the first binding ring 612, the second binding ring 613, and the third binding ring 614.

The first binding ring 612 includes a first half ring 612*a* and a second half ring 612*b*, the second binding ring 613 includes a third half ring 613*a* and a fourth half ring 613*b*, and the third binding ring 614 includes a fifth half ring 614*a* and a sixth half ring 614*b*.

Then, a binding ring latching portion 650 is formed at the end of the first half ring 612*a* and the second half ring 612*b*, at the end of the third half ring 613*a* and the fourth half ring 613*b*, and at the end of the fifth half ring 614*a* and the sixth half ring 614*b*, i.e., at the top portion of each of the first binding ring 612, the second binding ring 613, and the third binding ring 614, in order to allow an object S such as a paper to be bound by inserting the half rings into binding holes provided in the object S such as the paper in advance.

The first binding ring 612, the second binding ring 613, and the third binding ring 614 constituting the binding rings are formed by widening a metal-made wire rod having a circular cross-section in a direction for disengaging the binding ring latching portions 650 (the O1 and O2 directions of FIG. 82) and pressing the central portion of the wire rod to bend in a direction for closing the binding rings.

Then, the first binding ring 612, the second binding ring 613, and the third binding ring 614 are formed into a shape having a substantially bean-shaped cross-section. In the substantially bean-shaped cross-section, the central portion thereof protrudes in a direction for opening the binding ring (the O3 direction in FIG. 38 for the first half ring 612*a*, the third half ring 613*a*, and fifth half ring 614*a* and the O4 direction in FIG. 82 for the second half ring 612*b*, the fourth half ring 613*b*, and sixth half ring 614*b*), and the both edges thereof are bent in a direction for closing the binding ring.

In other words, when the annular first binding ring 612, second binding ring 613, and third binding ring 614 are viewed from the opening/closing direction, a wavy surface is formed on the inner side of the first binding ring 612, the second binding ring 613, and the third binding ring 614, and the outer side of the first binding ring 612, the second binding ring 613, and the third binding ring 614 is formed into a semicircular arc shape.

Furthermore, as viewed from a direction for disengaging the binding rings, each of the first binding ring 612, the second binding ring 613, and the third binding ring 614 has opposite outer edges formed into a semicircular arc shape.

Conventional binding rings having a circular cross-section do not resist deformation when the diameter is small. When the diameter is increased, the cross-sectional area increases to increase cost for the material therefor. Since binding holes formed in the object S such as the paper are usually circular holes, conventional binding rings having a substantially rectangular cross-section are not well suitable for the binding holes of the object S such as the paper and are likely to damage the binding holes of the paper.

Meanwhile, when the first binding ring 612, the second binding ring 613, and the third binding ring 614 constituting the binding rings are thin, the binding ring latching portions 650 may not be securely fitted with each other.

Hence, it is desirable to increase the width of the first binding ring 612, the second binding ring 613, and the third binding ring 614. However, even in a case in which a wire rod having a small cross-sectional area is employed as a raw wire rod, it is desirable to ensure a required width for a binding ring by machining the raw metal-made wire rod.

Therefore, in the binding rings according to the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring latching portion 650, whereby the binding ring latching portions 650 can be completely engaged with each other.

The holding member 616 has a substantially rectangular shape in a plan view having a length which allows the first binding ring 612, the second binding ring 613, and the third binding ring 614 to be disposed with a predetermined spacing therebetween. Furthermore, both the end portions of the holding member 616, or portions in the vicinity of an attachment hole 620 for attaching the holding member 616 to a cover A, are formed into a substantially semicircular arc shape in a plan view.

The holding member 616 is configured to have a holding space inside a bound object-mounting portion 622, and the operating member 618 and the like are contained in the holding space.

Along both edges of the bound object-mounting portion 622 of the holding member 616 are provided holding walls 624 each of which extends in the longitudinal direction of the bound object-mounting portion 622 substantially from one end of the bound object-mounting portion 622 to the other end and slidably holds the operating member 618.

In this embodiment, holding walls 624*a* and 624*b* are provided consecutively so as to hang down from substantially entire portions extending, in the longitudinal direction of the holding member 616, inwardly between the vicinities outside the first binding ring 612, the second binding ring 613, and the third binding ring 614.

Furthermore, the first holding wall 624*a* and the second holding wall 624*b* are in parallel with each other and have substantially the same plate-like shape.

The operating member 618 to be described in detail later and the like are contained in the holding space surrounded by the first holding wall 624*a* and the second holding wall 624*b* and the bound object-mounting portion 622.

First through holes 626, second through holes 627, and third through holes 628 for respectively allowing the first binding ring 612, the second binding ring 613, and the third binding ring 614 to loosely pass through with a predetermined distance (a predetermined length determined by Japanese Industrial Standards or the like) therebetween are provided through the bound object-mounting portion 622 of the holding member 616.

The first through holes 626, the second through holes 627, and the third through holes 628 are provided so as to correspond to each half ring constituting each binding ring. The first through holes 626, the second through holes 627, and the third through holes 628 are provided in a width direction of the holding member 616 at a predetermined distance, parting right and left.

Similarly to the operating pieces of the binding device 10 of the above embodiments, the operating pieces constituting the operating member 618 have a pair of left and right operating pieces.

A first operating piece 630 and a second operating piece 632 are formed similarly to the first operating piece 530 and the second operating piece 532, respectively, of the embodiment described above, the base portion of the first half ring 612*a*, the third half ring 613*a*, and the fifth half ring 614*a* being secured to the first operating piece 630, the base portion of the second half ring 612*b*, the fourth half ring 613*b*, and the sixth half ring 614*b* being secured to the second operating piece 632.

The engaging surface of the first engaging portion 636*a* in the said first operating piece 630 and the engaging surface of the second engaging portion 636*b* in the said second operating piece 632 are engaged at a level approximately equal or lower than the said reference level LP1 and the reference level LP2.

The engaging surface of the first engaging portion 636*a* in the said second operating piece 632 and the engaging surface of the second engaging portion 636*b* in the said first operating piece 630 are engaged at a level approximately equal or lower than the said reference level LP1 and the reference level LP2.

The first engaging portion 636*a* include the first engaging portion on opposite side of the first operating piece 636*a*1, the first engaging portion on front side of first operating piece 636*a*2, the first engaging portion on front side of second operating piece 636*a*3, and the first engaging portion on opposite side of the second operating piece 636*a*4.

The second engaging portion 636*b* include the second engaging portion on opposite side of second operating piece 636*b*1, the second engaging portion on front side of second operating piece 636*b*2, the second engaging portion on front side of first operating piece 636*b*3 and the second engaging portion on opposite side of first operating piece 636*b*4.

In this embodiment, the first engaging portion 636*a* and the second engaging portion 636*b* are formed at the center in the longitudinal direction of the first operating piece 630 and the second operating piece 632.

The center of the first engaging portion 636*a* and the second engaging 636*b* are formed with the recess portion of the center of the first operating piece 830*d*5 and the first engaging portion 636*a*5 as well as the recess portion of the second operating piece 832*d*5 and the first engaging portion 636*a*6.

On the first operating piece 630 and the second operating piece 632, are formed recess portion on opposite side of first operating piece 830*d*, center of recess portion on front side of first operating piece 830*e*, recess portion on opposite side of second operating piece 832*d* and recess portion on front side of second operating piece 832*e*.

Moreover, are formed the first engaging portion on opposite side of first operating piece 636*a*1 on the recess portion on opposite side of first operating piece 830*d*, the second engaging portion on opposite side of second operating piece 636*b*1 on the recess portion on opposite side of second operating piece 832*d*, the first engaging portion on front side of second operating piece 636*a*3 on the recess portion on front of second operating piece 832*e*, the second engaging portion on front side of first operating piece 636*b*3 on the recess portion on front of the first operating piece 830*e*, the first engaging portion on front of first operating piece 636*a*2 on the recess portion on front of second operating piece 832*e*, the second engaging portion on front side of second operating piece 636*b*2 on the recess portion on front of the second operating piece 832*e*, the first engaging portion on opposite side of second operating piece 636*a*4 on the recess portion on opposite side of second operating piece 832*d*, and the second engaging portion on opposite side of first operating piece 636*b*4 on the recess portion on opposite side of first operating piece 830*d*.

In addition, in the same manner as in the embodiment described above, restricting recess 630*f* and 632*f*, as well as restricting projection 630*g* and 632*g* are formed in a similar way.

Besides, the opening/closing member 640 is diagonally provided to bridge between the abutting edges 630*a* and 632*a*, i.e., is fixed straddled over the opening/closing member fixing portion 638*a*1 of the first operating piece 630 and the opening/closing member fixing portion 638*b*1 of the second operating piece 632, such that it is oblique to the abutting edge 630*a* and the abutting edge 632*a*. The opening/closing member 642 is diagonally provided to bridge between the abutting edges 630*a* and 632*a*, i.e., is fixed straddled over the opening/closing member fixing portion 638*a*2 of the first operating piece 630 and the opening/closing member fixing portion 638*b*2 of the second operating piece 632, such that it is oblique to the abutting edge 630*a* and the abutting edge 632*a*.

The secured end portion 640*a* and the secured end portion 640*b* of the opening/closing member 640 are secured to the opening/closing member fixing portion 638*a*1 of the first operating piece 630 and the opening/closing member fixing portion 638*b*1 of the second operating piece 632 respectively. The secured end portion 642*a* and the secured end portion 642*b* of the opening/closing member 642 are secured to the opening/closing member fixing portion 638*a*2 of the first operating piece 630 and the opening/closing member fixing portion 638*b*2 of the second operating piece 632 respectively.

The first operating piece 630 is formed with the protrusion 630*h* which extends to the direction close to the direction connecting the base portion of the first binding ring 612 and the base portion of the third binding ring 614 (shown in the X1 and X2 directions of FIG. 83) to be disposed with a spacing, at a position away from the abutting edge 630*a*.

In this embodiment, the protrusion 630*h* extends to the length direction of the first operating piece 630, parallel to the direction connecting the base portion of the first binding ring 612 and the base portion of the third binding ring 614.

The protrusion 630*h* continuously protrudes to the side opposite to the direction in which the first binding ring 612 and the third binding ring 614 protrude between the base portion of the first binding ring 612 and the base portion of the third binding ring 614 to be disposed with a spacing, at the outer edge 630*b*, except for the vicinity of the protruding portion 630*c*3.

The protrusion 630*h* is formed by bending the tabular metal plate having an L shape in a cross section, constituting the first operating piece 630.

Furthermore, the second operating piece 632 is formed with the protrusion 632*h* which extends to the direction close to the direction connecting the base portion of the first binding ring 612 and the base portion of the third binding ring 614 (shown in the X1 and X2 directions of FIG. 83) to be disposed with a spacing, at a position away from the abutting edge 632*a*.

In this embodiment, the protrusion 632*h* extends to the length direction of the second operating piece 632, parallel to the direction connecting the base portion of the first binding ring 612 and the base portion of the third binding ring 614.

The protrusion 632*h* continuously protrudes to the side opposite to the direction in which the first binding ring 612 and the third binding ring 614 protrude between the base portion of the first binding ring 612 and the base portion of the third binding ring 614 to be disposed with a spacing, at the outer edge 632*b*, except for the vicinity of the protruding portion 632*c*3.

The protrusion 632*h* is formed by bending the tabular metal plate having an L shape in a cross section, constituting the second operating piece 632.

Therefore, in the first operating piece 630 and the second operating piece 632, the bend between the base portion of the first binding ring 612 and the base portion of the third binding ring 614 are prevented by the protrusions 630*h* and 632*h*.

In the first operating pieces 630, beads 634*a*, 634*b*, and 634*e* protrude toward the upper face in the vicinity of the bases of the first half ring 612*a*, the third half ring 613*a*, and the fifth half ring 614*a* secured in the base portions so that the first operating piece 630 is reinforced so as to reduce the bend.

In the second operating pieces 632, beads 634*c*, 634*d*, and 634*f* protrude toward the upper face in the vicinity of the bases of the second half ring 612*b*, the fourth half ring 613*b*, and the sixth half ring 614*b* secured in the base portions so that the second operating piece 632 is reinforced so as to reduce the bend.

The bead 634*a* includes a first linear portion 634*a*1 extending in the longitudinal direction of the first operating piece 630 between the base portion of the first half ring 612*a* and the protruding portion 630*c*1, a second linear portion 634*a*2 extending in the longitudinal direction of the first operating piece 630 from the vicinity of the base portion of the first half ring 612*a* inside the protrusion 630*h* (substantially at the center in the width direction of the first operating piece 630), a hatched portion 634*a*3 connecting between the inner edge of the first linear portion 634*a*1 and the outer edge of the second linear portion 634*a*2. The bead 634*a* extrudes the linear projection having the predetermined width from the under side toward the upper face of the first operating piece 630.

The bead 634*b* includes a first linear portion 634*b*1 extending in the longitudinal direction of the first operating piece 630 between the base portion of the fifth half ring 614*a* and the protruding portion 630*c*2, a second linear portion 634*b*2 extending in the longitudinal direction of the first operating piece 630 from the vicinity of the base portion of the fifth half ring 614*a* inside the protrusion 630*h* (substantially at the center in the width direction of the first operating piece 630), a hatched portion 634*b*3 connecting between the inner edge of the first linear portion 634*b*1 and the outer edge of the second linear portion 634*b*2. The bead 634*b* extrudes the linear projection having the predetermined width from the under side toward the upper face of the first operating piece 630.

The bead 634*c* includes a first linear portion 634*c*1 extending in the longitudinal direction of the second operating piece 632 between the base portion of the second half ring 612*b* and the protruding portion 632*c*1, a second linear portion 634*c*2 extending in the longitudinal direction of the second operating piece 632 from the vicinity of the base portion of the second half ring 612*b* inside the protrusion 632*h* (substantially at the center in the width direction of the second operating piece 632), a hatched portion 634*c*3 connecting between the inner edge of the first linear portion 634*c*1 and the outer edge of the second linear portion 634*c*2. The bead 634*c* extrudes the linear projection having the predetermined width from the under side toward the upper face of the second operating piece 632.

The bead 634*d* includes a first linear portion 634*d*1 extending in the longitudinal direction of the second operating piece 632 between the base portion of the sixth half ring 614*b* and the protruding portion 632*c*2, a second linear portion 634*d*2 extending in the longitudinal direction of the second operating piece 632 from the vicinity of the base portion of the sixth half ring 614*b* inside the protrusion 632*h* (substantially at the center in the width direction of the second operating piece 632), a hatched portion 634*d*3 connecting between the inner edge of the first linear portion 634*d*1 and the outer edge of the second linear portion 634*d*2. The bead 634*d* extrudes the linear projection having the predetermined width from the under side toward the upper face of the second operating piece 632.

The bead 634*e* is formed spreading between the protrusion 630*h* and the protrusion 630*h* which are divided into the upper part and the lower part, between the base portion of the third half ring 613*a* and the protruding portion 630*c*3.

The bead 634*e* includes a first linear portion 634*e*1 extending in the longitudinal direction of the first operating piece 630 between the base portion of the third half ring 613*a* and the protruding portion 630*c*3, a second linear portion 634*e*2 extending in the longitudinal direction of the first operating piece 630 from the vicinity of the base portion of the third half ring 613*a* inside the protrusion 630*h*, a hatched portion 634*e*3 connecting between the first linear portion 634*e*1 and the second linear portion 634*e*2. The bead 634*e* extrudes the linear projection having the predetermined width from the under side toward the upper face of the first operating piece 630.

The bead 634*f* is formed spreading between the protrusion 632*h* and the protrusion 632*h* which are divided into the upper part and the lower part, between the base portion of the fourth half ring 613*b* and the protruding portion 632*c*3.

The bead 634*f* includes a first linear portion 634*f*1 extending in the longitudinal direction of the second operating piece 632 between the base portion of the fourth half ring 613*b* and the protruding portion 632*c*3, a second linear portion 634*f*2 extending in the longitudinal direction of the second operating piece 632 from the vicinity of the base portion of the fourth half ring 613*b* inside the protrusion 632*h*, a hatched portion 634*f*3 connecting between the first linear portion 634*f*1 and the second linear portion 634*f*2. The bead 634*f* extrudes the linear projection having the predetermined width from the under side toward the upper face of the second operating piece 632.

In the binding device of the above embodiments, one opening/closing member is mounted on one pair of the operating pieces. However, in the binding device of this embodiment, two opening/closing members 640 and 641 are mounted on a pair of operating pieces.

Among the total two opening/closing members 640 or 641, only one may be mounted on a pair of operating pieces.

The protruding portion 630*c*1 is held by the first holding portion 660, the protruding portion 630*c*2 by the first holding portion 662, the protruding portion 632*c*1 by the second holding portion 664, and the protruding portion 632*c*2 by the second holding portion 666, respectively.

Furthermore, the protruding portion 630*c*3 is held by the third holding portion 661, the protruding portion 632*c*3 by the third holding portion 665, respectively.

In the embodiment described above, as a protruding portion being formed on a pair of operating pieces in order to be fit into a through hole formed on the holding member, the dimension can be enlarged because even though the base portion of the binding ring is swaged onto the operation pieces, the stress given on the operation pieces are smaller. Therefore, the strength of the entire operation piece can be intensified.

Furthermore, the through hole into which the protruding portion of operation piece is fit and the through hole into which the binding ring is fit being able to be made common, the structure of the holding member can be simplified and the production cost be lowered.

The opening/closing member 40 along with the opening/closing member fixing portion 38*a* and the opening/closing member fixing portion 38*b* may be modified as follows:

One of the securing end portion 42*a* of the opening/closing member 40 and the other securing end portion 42*b* of the opening/closing member 40 can be modified in its size or form in the same manner as one of the securing end portion 42*a* of the opening/closing member 40 and the other securing end portion 42*b* of the opening/closing member 40, and restricting arm portion 46*a* of the opening/closing member 40 and the restricting arm portion 46*b* of the opening/closing member 40 can be modified in its length, or one of the restricting arm portions 46*a* and 46*b* can be omitted.

INDUSTRIAL APPLICABILITY

The binding device according to this invention can be used as a binding device for binding papers such as files or binders.

The invention claimed is:

1. A binding device comprising:

a plurality of openable-closeable binding rings;

a holding member having a length which allows the binding rings to be disposed with a spacing therebetween;

an operating member having a surface on which the binding rings are secured with a spacing therebetween, the operating member being secured inside the holding member such that the binding rings are secured to the holding member; and an opening/closing member biasing the binding rings in an opening direction, wherein the operating member comprises a first operating piece and a second operating piece, to one of which one base portion of each of the binding rings is secured and to the other of which the other base portion of each of the binding rings is secured, wherein the holding member includes a bulging portion that extends in the longitudinal direction of a bound object-mounting portion such that engaging portions of the operating pieces oscillate to an inner side of the bound object-mounting portion, wherein when the binding rings open or close, abutting edges of the first and the second operating pieces engage with each other in a state of abutting the first and the second operating pieces, wherein in a direction approaching the inner surface of the bound object-mounting portion of the holding member, the abutting edges of the first and the second operating pieces abut with each other in the longitudinal direction of the first and the second operating pieces to allow the first and the second operation pieces to slide toward the opposite directions thereof, wherein, when the binding rings are closed, at a position away from an inner surface of the holding member, the operating pieces are held in a state in which abutting edges thereof abut against each other, wherein, when the binding rings are opened, the operating pieces are secured to the holding member so as to be held in a manner such as to be directed in a direction approaching the inner surface of the holding member, wherein the opening/closing member is slidably disposed in a holding portion of the holding member such that the first and the second operating pieces move to opposite sides in the longitudinal direction of the operating pieces, wherein the first and the second operating pieces have protruding portions configured to be inserted in a first and a second through hole formed in the holding member, respectively, and are formed with outer edges on the outer side thereof, the outer edges being substantially parallel to the abutting edges, wherein the pair of operating pieces abut with each other, and being substantially linear, wherein the engaging portions, which engage the first and second operating pieces, are provided at the abutting edges where the pair of operating pieces abut so as to protrude from the abutting edges toward the upper sides of the operating pieces, wherein the operating member has an opening/closing member housing portion for housing the opening/closing member, wherein the operating member is recessed at the vicinity of the abutting edge of the operating member toward a protruding direction of a first binding ring of the plurality of binding rings, and is recessed at the vicinity of an abutting edge of another operating member toward the protruding direction of a second binding ring of the plurality of binding rings, forming a first recess in the operating member and a second recess in the other operating member, and the opening/closing member housing portion is formed with the first recess and the second recess, and wherein the opening/closing member is secured to the opening/closing member housing portion of the operating member on the reverse side opposite to the surface on which the binding rings are secured, and when the binding rings are opened, the opening/closing member causes the binding rings to be changed in the opening direction so that the operating pieces are moved in a longitudinal direction of the holding member and are held in the direction approaching the inner surface of the holding member, within the holding member.

2. The binding device according to claim 1, wherein the opening/closing member is made of an elastic member, wherein one end of the opening/closing member is secured in the opening/closing member housing portion on a surface opposite to the surface on which the base portions of the binding rings in one of the operating pieces constituting the operating member are secured, wherein the other end of the opening/closing member is secured in the opening/closing member housing portion on a surface opposite to the surface on which the base portions of the binding rings in the other of the operating pieces constituting the operating member are secured, and wherein the opening/closing member is extended between one and the other of the operating pieces.

3. The binding device according to claim 1, wherein the operating member has the opening/closing member housing portion formed by recessing the vicinity of the abutting edges of the pair of operating pieces in a direction in which the binding rings protrude.

4. The binding device according to claim 1, wherein the opening/closing member housing portion has a recess formed in one of the operating pieces and a recess formed in the other of the operating pieces so as to be line-symmetric to each other, defining the abutting edges as an axis.

5. A binding device comprising:

a plurality of openable/closable binding rings;

a holding member having a length which allows the binding rings to be disposed with a spacing therebetween;

an operating member having a pair of operating pieces of a plate-like shape on which the binding rings are secured in a manner such as to extend from a surface side, the pair of operating pieces being held inside the holding member such that the binding rings are secured to the holding member; and an opening/closing member secured to the operating member on a reverse side opposite to the surface side on which the binding rings are secured, the opening/closing member biasing the binding rings in an opening direction, wherein the operating member has the operating pieces to one of which one base portion of each of the binding rings is secured and to the other of which the other base portion of each of the binding rings is secured, wherein, when the binding rings are closed, at a position away from an inner surface of the holding member, the operating pieces are held in a planar state in a state in which abutting edges thereof abut against each other, wherein, when the binding rings are opened, the operating pieces are secured to the holding member so as to be held in an upward folded state with the abutting edges of the operating pieces directed in a direction approaching the inner surface of the holding member, wherein an engaging portion configured to hold and move the operating member and the opening/closing member in a holding space of the holding member, and configured to maintain the abutting state even during the movement, is formed at the abutting edges of the pair of operating pieces in a manner such as to be bent and recessed towards a surface side on which the opening/closing member is secured, wherein the engaging portion is formed at a height that is the same as or lower than a height of a reference surface of the operating pieces on the surface side, wherein the engaging portion is formed into a substantially U-shape when viewed in a plan view and has a base portion and a retaining portion, the base portion protruding toward an inner surface side of a bound object-mounting portion of the holding member by an amount corresponding to a thickness of the operating member, the retaining portion protruding from the end of the base portion, and wherein the opening/closing member and the operating member are formed such that, when the binding rings are opened, within the holding member, the operating pieces are moved in a longitudinal direction of the holding member and are held in the direction approaching the inner surface of the holding member.

6. The binding device according to claim 1, wherein the opening/closing member is made of an elastic member, and wherein the opening/closing member is extended, between the pair of operating pieces constituting the operating member, in a direction obliquely intersecting a direction connecting the base portions of the binding rings secured to the operating pieces with a spacing therebetween, such that the pair of operating pieces are moved in opposite directions and an opening/closing condition of the binding rings are maintained.

7. The binding device according to claim 1, wherein one end of the opening/closing member is secured to one of the operating pieces constituting the operating member, wherein the other end of the opening/closing member is secured to the other of the operating pieces constituting the operating member, and wherein the opening/closing member is extended between one and the other of the operating pieces.

8. The binding device according to claim 1, wherein the opening/closing member is made of a coil spring, the spring receiving twisting moment around a central axis of a coil, and wherein, in a state in which the spring is loaded and bending stress is generated on a strand while a pair of the binding rings are closed, one end of the opening/closing member is secured to one of the operating pieces constituting the operating member and the other end of the opening/closing member is secured to the other of the operating pieces constituting the operating member.

9. The binding device according to claim 1, wherein in the opening/closing member, a load direction in which the spring is loaded is a direction in which the coil is wound.

10. The binding device according to claim 1, wherein the operating member has the pair of operating pieces movably secured to the holding member so as to oscillate about the abutting edges of the pair of operating pieces and move in the direction connecting the base portions of the binding rings disposed with a spacing therebetween, within the holding member.

11. The binding device according to claim 1, wherein the holding member is formed with a holding portion for holding the operating member inside the holding member, the holding portion being recessed or bent towards the inside so as to hold the operating member fitted inside the holding member.

12. The binding device according to claim 1, wherein the holding member includes a holding wall and the bound object-mounting portion extending in a direction close to the direction connecting the base portions of the binding rings disposed on the operating member with a spacing therebetween, wherein the holding wall and the bound object-mounting portion of the holding member forms the holding space for holding the operating member inside the holding member, and wherein the operating member and the opening/closing member are configured to move within the holding space when the binding rings are opened or closed.

13. The binding device according to claim 1, wherein the holding member has the holding space for holding the operating member inside the holding member, the holding space being formed by a holding wall and the bound object-mounting portion and including an inner surface of a bulging portion for forming a recessed portion which houses the abutting edges of the pair of operating pieces in an upward folded state when the binding rings are opened, and wherein, in the operating member, one and the other of the operating pieces abut against each other at the abutting edges and are movably secured at outer edges to an inner side of the holding wall and the binding rings are secured in a manner such as to protrude towards the bound object-mounting portion.

14. The binding device according to claim 5, wherein said one of the operating pieces has a first engaging portion formed by bending and recessing the abutting edge from the surrounding reference surface towards the surface side on which the opening/closing member is secured and also bending the abutting edge towards a side opposite to the surface on which the opening/closing member is secured, the first engaging portion having an engaging surface located lower than the reference surface, wherein the other of the operating pieces has a second engaging portion formed by bending and recessing the abutting edge from the surrounding reference surface towards the surface side on which the opening/closing member is secured, the second engaging portion having an engaging surface located lower than the reference surface, and wherein the engaging surface of the first engaging portion of said one of the operating pieces and the engaging surface of the second engaging portion of the other of the operating pieces are engaged with each other at a height substantially the same as or lower than the height of the reference surfaces.

15. The binding device according to claim 5, wherein said one operating piece has first engaging portions formed by bending and recessing vicinity of both ends of the abutting edge along the abutting edge from the surrounding reference surface towards the surface side on which the opening/closing member is secured to thereby form recessed portions and then bending the recessed portions towards the side opposite to the surface on which the opening/closing member is secured, each of the first engaging portions having an engaging surface located higher than surrounding thereof but lower than the reference surface, wherein the other of the operating pieces has second engaging portions formed by bending and recessing vicinity of both ends of the abutting edge along the abutting edge from the surrounding reference surface towards the surface side on which the opening/closing member is secured to thereby form recessed portions, each of the second engaging portions having an engaging surface formed by the recessed portion and located lower than the reference surface, and wherein the engaging surface of each of the first engaging portions of said one of the operating pieces and the engaging surface of each of the second engaging portions of the other of the operating pieces are engaged with each other at the height substantially the same as or lower than the height of the reference surfaces.

16. The binding device according to claim 1, wherein said one of the operating pieces has a plurality of first engaging portions formed by bending and recessing the vicinity of the both ends of the abutting edge, in which portions extending from regions where the base portions of the binding rings are secured towards the abutting edge, along the abutting edge from the surrounding reference surface towards the surface side on which the opening/closing member is secured to thereby form the recessed portions and then bending the recessed portions towards the side opposite to the surface on which the opening/closing member is secured, each of the first engaging portions having the engaging surface located higher than the surrounding thereof but lower than the reference surface, wherein the other of the operating pieces has a second engaging portion formed by bending and recessing the vicinity of the both ends of the abutting edge, portions extending from regions where the base portions of the binding rings are secured towards the abutting edge, along the abutting edge from the surrounding reference surface towards the surface side on which the opening/closing member is secured to thereby form the recessed portions, each of the second engaging portions having the engaging surface formed by the recessed portions and located lower than the reference surface, and wherein the engaging surface of each of the first engaging portions of said one of the operating pieces and the engaging surface of each of the second engaging portions of the other of the operating pieces are engaged with each other at the height substantially the same as or lower than the height of the reference surfaces.

17. The binding device according to claim 5, wherein said one of the operating pieces is formed with the first engaging portions and, in addition, has second engaging portions formed in the same manner as the other of the operating pieces has, and the other of the operating pieces is formed with the second engaging portions and, in addition, has first engaging portions formed in the same manner as said one of the operating pieces has.

18. The binding device according to claim 1, wherein said one and the other of the operating pieces are plates of a rectangular shape in a plan view, including a length direction extending in a moving direction at time of opening and closing the binding rings, and wherein said one and the other of the operating pieces are point-symmetric, defining a center of the abutting edges in a length direction as a center of symmetry.

19. A binding device comprising:

a plurality of openable/closable binding rings;

a holding member having a length which allows the binding rings to be disposed with a spacing therebetween;

an operating member having a pair of operating pieces of a plate-like shape on which the binding rings are secured in a manner such as to extend from a surface side, the pair of operating pieces being held inside the holding member such that the binding rings are secured to the holding member; and an opening/closing member secured to the operating member on a reverse side opposite to the surface side on which the binding rings are secured, the opening/closing member biasing the binding rings in an opening direction, wherein the operating member has the operating pieces to one of which one base portion of each of the binding rings is secured and to the other of which the other base portion of each of the binding rings is secured, wherein, when the binding rings are closed, at a position away from an inner surface of the holding member, the operating pieces are held in a planar state in a state in which abutting edges thereof abut against each other, wherein, when the binding rings are opened, the operating pieces are secured to the holding member so as to be held in an upward folded state with the abutting edges of the operating pieces directed in a direction approaching the inner surface of the holding member, wherein, an engaging portion configured to hold and move the operating member and the opening/closing member in a holding space of the holding member, and the operating piece is formed with the recess portion on front and opposite side of the pair of operating pieces by bending and recessing the abutting edge to the side of the face to which the opening/closing member is secured from the surrounding reference surface, furthermore, the engage portion is configured to allow the pair of operating pieces to maintain the abutting state even during the movement, and is formed at the abutting edges of the pair of operating pieces in a manner such as to be bent and recessed towards a side opposite to the surface side on which the opening/closing member is secured, wherein the engaging portion is formed at a height the same as or lower than a height of a reference surface of the operating pieces on the surface side, and wherein the opening/closing member and the operating member are formed such that, when the binding rings are opened, within the holding member, the operating pieces are moved in a longitudinal direction of the holding member and are held in the direction approaching the inner surface of the holding member.

* * * * *